US012421875B2

(12) United States Patent
Gaziano

(10) Patent No.: US 12,421,875 B2
(45) Date of Patent: Sep. 23, 2025

(54) INTERNAL COMBUSTION ENGINE

(71) Applicant: Philip Franklin Gaziano, Wilbraham, MA (US)

(72) Inventor: Philip Franklin Gaziano, Wilbraham, MA (US)

( * ) Notice: Subject to any disclaimer, the term of this patent is extended or adjusted under 35 U.S.C. 154(b) by 0 days.

(21) Appl. No.: 18/940,487

(22) Filed: Nov. 7, 2024

(65) Prior Publication Data

US 2025/0154885 A1 May 15, 2025

Related U.S. Application Data

(63) Continuation-in-part of application No. 18/440,717, filed on Feb. 13, 2024, now Pat. No. 12,228,091, and a continuation-in-part of application No. PCT/US2024/015639, filed on Feb. 13, 2024.

(60) Provisional application No. 63/597,654, filed on Nov. 9, 2023.

(51) Int. Cl.
*F01L 1/14* (2006.01)
*F01L 1/26* (2006.01)

(52) U.S. Cl.
CPC ..... *F01L 1/146* (2013.01); *F01L 1/267* (2013.01)

(58) Field of Classification Search
CPC ..... F01L 1/047; F01L 1/18; F01L 1/44; F01L 1/46; F01L 1/146; F01L 1/267
See application file for complete search history.

(56) References Cited

U.S. PATENT DOCUMENTS

| | | | |
|---|---|---|---|
| 4,011,842 | A | 3/1977 | Davies et al. |
| 4,921,734 | A | 5/1990 | Thorpe et al. |
| 4,957,081 | A | 9/1990 | Ito et al. |
| 5,421,293 | A | 6/1995 | Noltemeyer et al. |
| 5,954,038 | A | 9/1999 | Warwick et al. |
| 6,539,835 | B1 | 4/2003 | Rasmussen et al. |
| 7,533,648 | B2 | 5/2009 | Möller et al. |
| 7,895,936 | B2 | 3/2011 | Hofbauer |
| 8,360,028 | B2 | 1/2013 | Betzmeir et al. |
| 10,202,909 | B2 * | 2/2019 | Okazaki ..... F02D 15/04 |
| 10,801,403 | B2 | 10/2020 | Nishikawa et al. |
| 2007/0012180 | A1 | 1/2007 | Miyamoto et al. |
| 2009/0071434 | A1 | 3/2009 | MacMillan et al. |
| 2009/0151708 | A1 | 6/2009 | Schouweiler, Jr. |

(Continued)

FOREIGN PATENT DOCUMENTS

| | | | |
|---|---|---|---|
| CA | 2 159 232 | A1 | 3/1996 |
| CH | 466 944 | A | 12/1968 |

(Continued)

OTHER PUBLICATIONS

Inconel Trademark Search Results, obtained from https://www.uspto.gov/trademarks.

*Primary Examiner* — Grant Moubry

(74) *Attorney, Agent, or Firm* — Knobbe Martens Olson & Bear LLP

(57) ABSTRACT

An internal combustion engine has a cylinder block that defines a blind cylinder bore that terminates within the cylinder block. A piston is positioned within the blind cylinder bore. The piston is connected to two crankshafts. A combustion chamber is formed between the piston and the blind end of the cylinder bore. Various mechanisms can provide actuation, timing control, and during control of valves that control flow into and out of the combustion chamber.

20 Claims, 58 Drawing Sheets

(56) References Cited

U.S. PATENT DOCUMENTS

| | | | | |
|---|---|---|---|---|
| 2013/0213332 | A1* | 8/2013 | Yano | F01L 1/356 123/90.17 |
| 2015/0136089 | A1* | 5/2015 | Tanaka | F02B 75/04 123/48 R |
| 2015/0240742 | A1 | 8/2015 | Takahara | |
| 2016/0215692 | A1 | 7/2016 | Warey et al. | |
| 2016/0319738 | A1 | 11/2016 | Yamada et al. | |
| 2016/0356239 | A1 | 12/2016 | Graham et al. | |
| 2017/0159602 | A1 | 6/2017 | Park et al. | |
| 2017/0219006 | A1 | 8/2017 | Chandrashekar | |
| 2017/0248099 | A1 | 8/2017 | Wagner et al. | |
| 2017/0328299 | A1 | 11/2017 | Kim et al. | |
| 2020/0080587 | A1 | 3/2020 | Campbell et al. | |

FOREIGN PATENT DOCUMENTS

| | | | | |
|---|---|---|---|---|
| CN | 204 099 043 | U | 1/2015 | |
| CN | 116 335 817 | A | 6/2023 | |
| DE | 8334059 | U1 | 7/1985 | |
| DE | 4242634 | A1 * | 7/1993 | F01L 1/044 |
| DE | 10314683 | A1 * | 11/2004 | F01L 1/08 |
| DE | 102008018949 | A1 | 11/2008 | |
| DE | 102008060463 | A1 | 6/2010 | |
| DE | 10 2016 210822 | A1 | 12/2016 | |
| EP | 0649979 | A1 | 4/1995 | |
| EP | 1 775 455 | A2 | 4/2007 | |
| EP | 2396521 | B1 | 3/2017 | |
| FR | 2 869 951 | A1 | 11/2005 | |
| GB | 1344612 | A | 1/1974 | |
| JP | 2013 024142 | A | 2/2013 | |
| KR | 101 709 624 | B1 | 2/2017 | |
| WO | WO 95/18917 | A1 | 7/1995 | |
| WO | WO 98/23855 | A1 | 6/1998 | |
| WO | WO 2016/041298 | A1 | 3/2016 | |
| WO | WO 2016/056161 | A1 | 4/2016 | |
| WO | WO 2017/087733 | A1 | 5/2017 | |

* cited by examiner

INTERNAL COMBUSTION ENGINE

INCORPORATION BY REFERENCE TO ANY PRIORITY APPLICATIONS

The present application claims priority benefit to U.S. Provisional Application No. 63/597,654, filed Nov. 9, 2023, entitled "INTERNAL COMBUSTION ENGINE." The present application is a continuation-in-part of U.S. application Ser. No. 18/440,717, filed Feb. 13, 2024, entitled "INTERNAL COMBUSTION ENGINE." The present application is a continuation-in-part of PCT Application No. US2024/015639, filed Feb. 13, 2024, entitled "INTERNAL COMBUSTION ENGINE." All of the abovementioned applications are hereby incorporated by reference herein in their entireties. Any and all applications for which a foreign or domestic priority claim is identified in the Application Data Sheet as filed with the present application are hereby incorporated by reference under 37 CFR 1.57 and made a part of this specification.

BACKGROUND

Field

The present disclosure generally relates to internal combustion engines. More particularly, the present disclosure relates to layouts for, components of, construction techniques for, materials for, and methods of operating internal combustion engines.

Description of the Related Art

In reciprocating internal combustion engines, a cylinder block is a main structural component. The cylinder block contains one or more cylinder bores. A cylinder head connects to the upper end of the cylinder block. Together, the cylinder block and the cylinder head house the cylinder bores and combustion chambers. The piston moves up and down inside the cylinder bore. Connecting rods connect the pistons to a crankshaft. The connecting rods convert the translational movement of the pistons to rotational movement of the crankshaft.

SUMMARY

There remains a need for improved engine designs and configurations. For example, there are needs that include improving efficiency, increasing access new cleaner fuels, reducing engine size and weight for increased applications, and reducing carbon dioxide, carbon monoxide, nitrogen oxides, and soot production and emissions.

The major components of a conventional internal combustion engine can include a cylinder head, cylinder block, crankcase, etc. In some cases, it can be beneficial to combine one or more of the major components into a single component. For example, combining two or more major components can reduce parts counts, simplify assembly, improve mechanical stiffness, reduce failures due to unplanned separations or sealing failures, reduce or eliminate potential leaks of intake gases, combustion gases, exhaust gasses, lubrication fluids, and/or cooling fluids, an/do reduce or eliminate other sealing issues between major components, and so forth. For example, it may be possible to operate with higher compression ratios in an engine where two or more major components have been combined into a single component. While combining components can offer many advantages, it will be appreciated the combining components can have drawbacks, such as difficulty in accessing internal areas of an engine.

Certain features, aspects, and advantages of configurations of the present disclosure relate to improvements to internal combustion engines. Certain features, aspects, and advantages of configurations of the present disclosure apply to two-stroke and/or four stroke heat engine cycles, with or without increased ideal expansion from Atkinsons or Miller cycles, with or without variable compression ratios, and using different ignition types, including compression ignition, spark ignition, and/or homogeneous charge compression ignition engines and/or related engine add-on constructions.

Certain features, aspects, and advantages of certain configurations can improve the efficiency of two-stroke engines, four-stroke engines, or both. In some configurations, efficiency can be improved whether the Atkinson cycle and/or Miller cycle is used or not. Engines operating under the Atkinson cycle and/or Miller cycle have a greater expansion volume compared to the compression volume. While a reduction in compression volume may reduce maximum power output, the increased expansion relative to the compression volume can enable extraction of more work per unit of fuel. In some configurations, efficiency, flexibility, or both can be improved by allowing the degree of Atkinson or Miller cycles to range from a maximum of Atkinson or Miller cycles that is needed to achieve ideal expansion, to no Atkinson cycle or Miller cycle at all, leading to symmetric expansion, in the same engine. In some configurations, a reverse Atkinson cycle or reverse Miller cycle can be used, in which the compression volume is larger than the expansion volume, which can lead to increased power and/or useful work for a given engine size. In some configurations, a ratio of ideal to non-ideal expansion can be changed while an engine is running, for example to adjust for differing amounts of desired power and/or efficiency, to accommodate different amounts of boost pressure, to account for differing final compression ratios, and/or to accommodate different fuels. In some configurations, the ratio of ideal to non-ideal expansion can be continuously variable. This continuously variable amount of Atkinson cycle and/or Miller cycle can also facilitate engines capable of variable compression, which can give added flexibility and efficiency.

Certain features, aspects, and advantages of certain configurations can be used with any type of ignition system. For example, some engine configurations can employ spark ignition while other configurations can be better suited to compression ignition, while yet other configurations can be better suited to stratified charge and/or homogenous charge compression ignition.

The systems, methods and devices described herein have innovative aspects, no single one of which is indispensable or solely responsible for their desirable attributes. Without limiting the scope of the claims, some of the advantageous features will now be summarized.

In some aspects, the techniques described herein relate to an internal combustion engine including one or more of: a cylinder block, the cylinder block defining a cylinder bore, a piston capable of reciprocating within the cylinder bore between top dead center and bottom dead center, a combustion chamber defined above the piston within the cylinder bore, one or more intake passages, sometimes referred to as an intake ports or intake runners extending from outside the block or uniblock to the combustion chamber through one or more intake valve opening, one or more exhaust passages, sometimes referred to as an exhaust ports or exhaust runners, extending from exhaust valve opening(s) from the combustion chamber to outside the block or uniblock, one or more intake valve(s) that open and close, one or more exhaust valves that open and close, the piston driving a crosshead that drives connecting rods that drive two or more crankshafts, the crankshafts driving one or more valve lift cam assemblies, that are either part of one or more of the crankshafts or consisting of one or more separate valve cam shafts driven from one or more crankshafts by timing gears, timing belts or timing chains, the cam assemblies controlling, through a series of cam followers, movement of the intake valve(s) and the exhaust valve(s) and with some configurations having cam adjustments using one or more worm gear(s) such that the cam assembly is configured to control at least one or both of valve timing and valve duration for one or more of the valves. In some implementations, the timing gears may be configured to not obstruct the valve actuation systems. In some implementations, the timing gears can be used to balance the engine. In some implementations, the timing gears can mesh with additional balancing gears.

In some aspects, one or more of the worm gears may be coupled to a controller, which may be either a stepper motor, a servo motor, or a manually operated control lever or knob. In some aspects, one or more of these controllers may in turn be controlled by engine control computers. In some aspects, the cam assembly includes a differential-type assembly operated by the worm gear, the differential assembly configured to adjust an angular position of one or more shaft such that timing of the opening and closing of one or more of the intake valve(s) and the exhaust valve(s) can be adjusted. In some aspects, the cam assembly includes a first cam shaft, the first cam shaft including a first cam lobe, the cam assembly including a second cam shaft, the second cam shaft including a second cam lobe, the first cam shaft and the second cam shaft being coupled for rotation, a first differential assembly controlling an angular orientation of the first cam shaft and a second differential assembly controlling an angular orientation of the second cam shaft such that valve timing and valve duration can be controlled by the first differential assembly and the second differential assembly.

In some aspects, the techniques described herein relate to a two-stroke internal engine. In some examples, the two-stroke engine can utilize cylinder side port to poppet valve uniflow scavenging. In other examples, the two-stroke engine can utilize poppet valve to poppet valve loop scavenging.

In some aspects, the techniques described herein relate to a two-stroke reciprocating pump or compressor.

Some configurations of the engines can have a number of advantages over existing engine designs. In some configurations, the engines can be scalable over large power ranges. For example, the engines can be configured to produce about one horsepower (hp) or more. Some configurations can enable a modular approach. A modular approach can improve efficiency. Modules can be added or removed to achieve any desired horsepower. In some configurations, modules can be enabled or disabled as desired to achieve a particular output power. For example, the number of active modules can be selected so that most or all modules operate at or near peak efficiency to deliver a desired output power. Generally, comparisons to existing engines throughout this disclosure are in terms of conventional engines with similar maximum power outputs.

Some configurations herein can have a high power to weight ratio, a high power to size ratio, and so forth, as compared to conventional engines of similar maximum power outputs. In some configurations, the engines can operate using a wide variety of fuel sources, for example gasoline, fuel oil, diesel, natural gas (e.g., liquified natural gas), biofuels, synthetic fuels, ethanol, methane, hydrogen, and so forth. In some configurations, the engines can be simultaneously connected to more than one fuel source, and a fuel source can be selected without requiring physical modification of the engine.

Flexibility in horsepower, flexibility in fuel type, high power to weight ratios, high power to size ratios, high engine balance, high fuel use efficiency, reduced emissions, including particulates, nitrogen oxides, carbon monoxide and sulfur oxides, ease of manufacturing, reduced oil consumption, even during two-stroke and/or compression ignition operations, and/or other features and benefits of certain configurations can mean that engines designed according to the present disclosure can be used in a wide variety of applications. For example, applications can range from low power applications such as in lawn equipment, to automobiles, to military equipment, to large rail and sea-going shipping vessels, to the largest heat engines like those in stationary power plants. Advantageously, due to the comparatively light weight of some configurations according to the present disclosure, benefits can be realized even in cases when an engine designed according to the present disclosure has an efficiency similar to that of other engines. For example, an engine designed according to the present disclosure can be lighter than another engine of similar power and/or efficiency, such that the engine itself can contribute less to the total weight of a vehicle, such as an automobile, ship, aircraft, etc.

Some engines made according to the present disclosure can have high first law efficiency. For example, some configurations can have a first law efficiency (defined as $1-|Q_{out}|/Q_{in}$, where $Q_{out}$ is the waste heat and $Q_{in}$ is the input thermal energy) of from about 60% to about 85% or more. In some configurations, an engine can have a high compression ratio, for example about 10:1, about 20:1, about 30:1, about 40:1, about 50:1, about 75:1, about 100:1, or any value between these values, or more or less depending upon the particular engine design. In some configurations, an engine can have high compression and expansion efficiency. In some configurations, a compression ratio can be adjustable, enabling the prioritization of power or efficiency without the need to make permanent modifications to the engine.

Some configurations can have wide-ranging, continuously variable compression ratios. Some configurations can have wide-ranging, continuously variable scavenging timing ratios. Some configurations can have wide-ranging, continuously variable expansion ratios (e.g., ideal expansion, symmetric expansion, reverse ideal expansion, which is when a compression ratio is higher than an expansion ratio. In some configurations, an engine can have variable valve timing and/or variable valve open duration.

In some aspects, the techniques described herein relate to an internal combustion engine including a cylinder block. The cylinder block defines a cylinder bore. A piston is capable of reciprocating within the cylinder bore between top dead center and bottom dead center. A combustion chamber is defined above the piston within the cylinder bore. An intake passage extends into the combustion chamber. An intake port is defined at a junction of the intake passage and the combustion chamber. An exhaust passage extends from the combustion chamber. An exhaust port is defined at a junction of the exhaust passage and the combustion chamber. An intake valve opens and closes the intake port. An exhaust valve opens and closes the exhaust port. The piston drives a crankshaft. The crankshaft drives a cam assembly. The cam assembly controls movement of the intake valve and the exhaust valve and has a worm gear such that the cam assembly is configured to control at least one of valve timing and valve duration.

In some aspects, the techniques described herein relate to an internal combustion engine, wherein the worm gear is coupled to a stepper motor or a servo motor.

In some aspects, the techniques described herein relate to an internal combustion engine or claim 2, wherein the worm gear is connected to at least two additional worm gears.

In some aspects, the techniques described herein relate to an internal combustion engine, further including a planetary gear set. The planetary gear set includes a ring gear. At least one worm gear is connected to the ring gear of the planetary gear set. The planetary gear set being connected to the cam assembly such that rotation of the worm gear is transferred to at least a portion of the cam assembly through the planetary gear set to adjust timing of at least one of opening and closing of at least one of the intake valve and the exhaust valve.

In some aspects, the techniques described herein relate to an internal combustion engine, wherein the cam assembly includes an auxiliary shaft and a camshaft, the auxiliary shaft being driven by the camshaft and the auxiliary shaft driving at least one cam lobe that is freely rotatable relative to the camshaft.

In some aspects, the techniques described herein relate to an internal combustion engine, wherein the cam assembly includes a differential assembly controlled by the worm gear, the differential assembly configured to adjust an angular position of one or more shaft relative to a crankshaft such that timing of at least one of opening and closing of one or more of the intake valve and the exhaust valve can be adjusted.

In some aspects, the techniques described herein relate to an internal combustion engine, wherein the cam assembly includes a first camshaft, the first camshaft including a first cam lobe, the cam assembly including a second camshaft, the second camshaft including a second cam lobe, the first camshaft and the second camshaft being coupled for rotation, a first differential assembly controlling an angular orientation of the first camshaft relative to a crankshaft and a second differential assembly controlling an angular orientation of the second camshaft relative to the crankshaft such that at least one of valve timing and valve duration can be controlled by the first differential assembly and the second differential assembly.

In some aspects, the techniques described herein relate to an internal combustion engine, wherein an upper portion of the combustion chamber includes at least one opening that receives a fuel injector.

In some aspects, the techniques described herein relate to an internal combustion engine, wherein more than one fuel injector is positioned to inject fuel into the combustion chamber, a first fuel injector connected to a first fuel source and a second fuel injector connected to a second fuel source.

In some aspects, the techniques described herein relate to an internal combustion engine, wherein at least one of the intake valve and the exhaust valve is moved by a valve actuation system that includes a mechanical linkage.

In some aspects, the techniques described herein relate to an internal combustion engine, wherein the crankshaft includes at least one cam lobe, the at least one cam lobe moving a corresponding pushrod, and the corresponding pushrod acting against one or more rocker arm to cause movement of at least one of the intake valve and the exhaust valve.

In some aspects, the techniques described herein relate to an internal combustion engine, wherein the one or more rocker arm is connected to a valve actuating arm, the valve actuating arm including a paw, the paw positioned within a paw slot, the paw member and the paw slot cooperating to restrain movement of the valve actuating arm.

In some aspects, the techniques described herein relate to an internal combustion engine, wherein the cam assembly includes a cam shaft, the cam shaft including at least one cam lobe that rotates with the cam shaft, the at least one cam lobe configured to contact a cam follower, the cam follower being mounted to a first rocker arm, positioning of the first rocker arm being controlled by a lash adjuster.

In some aspects, the techniques described herein relate to an internal combustion engine, wherein the lash adjuster includes a body, the body receiving a first pivot point of the first rocker arm such that the first pivot point of the first rocker arm extends through the body.

In some aspects, the techniques described herein relate to an internal combustion engine, wherein the body of the lash adjuster includes a central member that is positioned between the first rocker arm and a second rocker arm and the first pivot point extends through the first rocker arm, the second rocker arm, and the central member such that the lash adjuster can adjust two rocker arms simultaneously.

In some aspects, the techniques described herein relate to an internal combustion engine, wherein the body of the lash adjuster receives a second pivot point that is parallel to the first pivot point.

In some aspects, the techniques described herein relate to an internal combustion engine, wherein the body of the lash adjuster receiving a force generator that can be used to adjust lash.

In some aspects, the techniques described herein relate to an internal combustion engine, wherein the force generator includes a threaded fastener or a hydraulic cylinder.

In some aspects, the techniques described herein relate to an internal combustion engine, wherein the hydraulic generator exerts a force on at least one wedge.

In some aspects, the techniques described herein relate to an internal combustion engine, wherein the cam shaft rotates about an axis and the axis is positioned above the lash adjuster.

Although several configurations, examples, and illustrations are disclosed below, it will be understood by those of ordinary skill in the art that the disclosure extends beyond the specifically disclosed configurations, examples, and illustrations and includes other uses of the disclosure. Configurations are described with reference to the accompanying figures, wherein like numerals refer to like elements throughout. The terminology used in the description presented herein is not intended to be interpreted in any limited or restrictive manner simply because it is being used in conjunction with a detailed description of some specific configurations of the disclosure. In addition, configurations can comprise several novel and inventive features. No single feature is solely responsible for its desirable attributes or is essential to practicing the disclosure herein described.

BRIEF DESCRIPTION OF THE DRAWINGS

Throughout the drawings, reference numbers may be reused to indicate general correspondence between referenced elements. The drawings are provided to illustrate example configurations described herein and are not intended to limit the scope of the disclosure.

DETAILED DESCRIPTION

Figure 1:
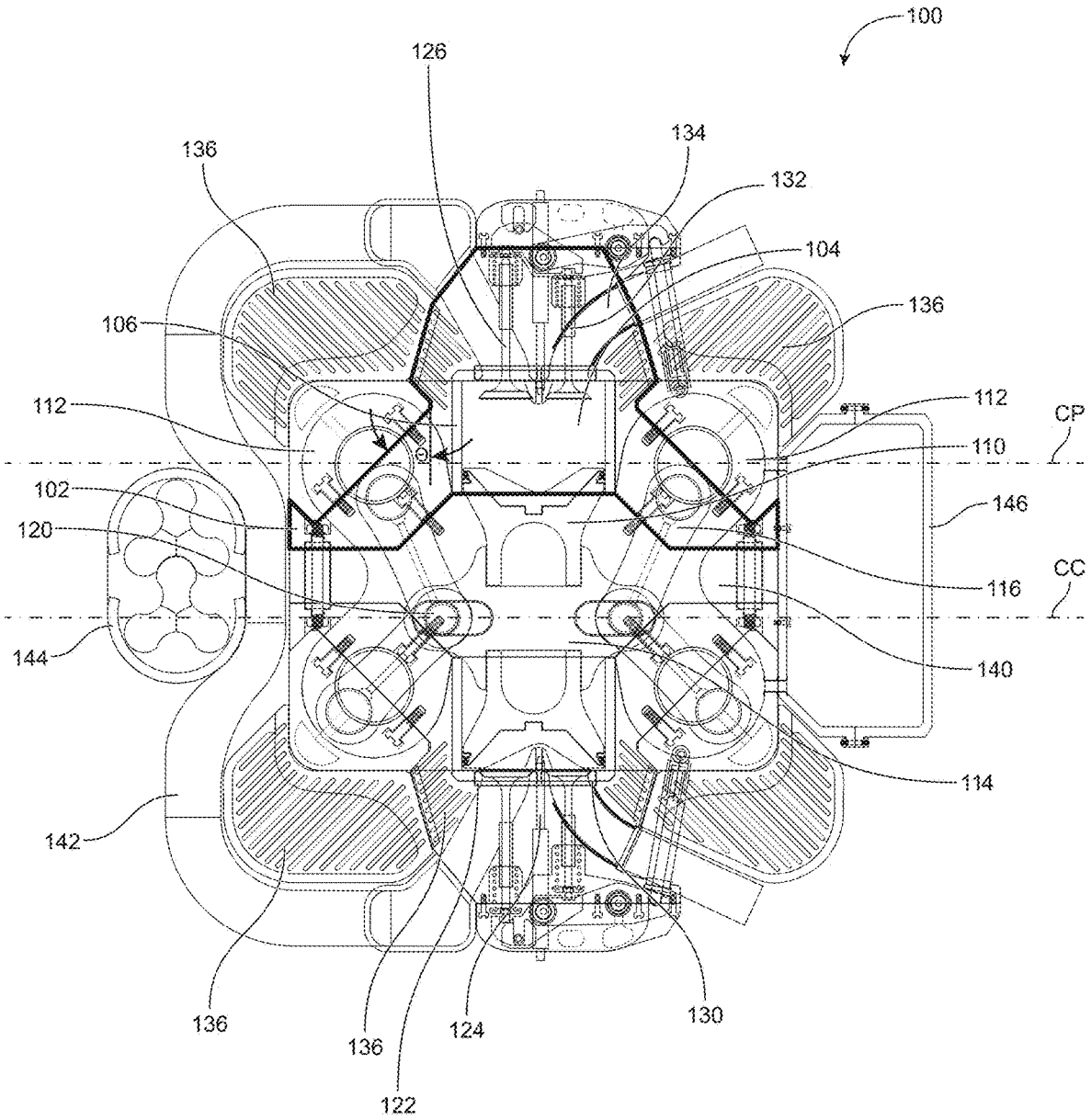
FIG. 1 illustrates a schematic view of a portion of an internal combustion engine employing at least two uniblocks.

With reference initially to FIG. 1, a portion of an internal combustion engine 100 is schematically illustrated. The internal combustion engine 100 is a type of heat engine that uses combustion (e.g., combustion of a fuel and air mixture) to produce mechanical energy. While internal combustion engines designed according to the present disclosure can use two-stroke cycles or four-stroke cycles, certain advantages may be more fully realized in two-stroke engines. As will be discussed, certain features, aspects, and advantages of certain embodiments disclosed herein will comprise valves and systems that can control the timing and duration of valve operation.

The internal combustion engine 100 that is illustrated in FIG. 1 comprises a uniblock 102. More particularly, the internal combustion engine 100 that is illustrated in FIG. 1 comprises at least two uniblocks 102. In some configurations, however, internal combustion engines 100 can be formed using a single uniblock 102.

The construction of the uniblock 102 is distinct from separable cylinder block and cylinder head assemblies commonly employed in conventional reciprocating internal combustion engines. In those conventional reciprocating internal combustion engines, the cylinder head assemblies are bolted to the cylinder block with a gasket positioned between the cylinder head assemblies and the cylinder block. In the conventional reciprocating internal combustion engines, the cylinder head assembly and the cylinder block together define the combustion chambers while the cylinder block defines the cylinder bores.

In the illustrated construction, however, what would be considered the cylinder head and the cylinder block in conventional reciprocating internal combustion engines are integrated into a single component to define at least a portion of the uniblock 102. The uniblock 102 illustrated in FIG. 1 can be formed as a single component that defines both a combustion chamber 104 and a cylinder bore 106. In some configurations, the uniblock 102 can be a monolithic component that defines the combustion chamber 104 and the cylinder bore 106. In some configurations, the uniblock 102 can define more than one combustion chamber 104 and/or more than one cylinder bore 106.

The uniblock 102 that is illustrated encloses, envelopes, and/or surrounds both of the combustion chamber 104 and at least a portion of the cylinder bore 106 that is associated with the combustion chamber 104. In some configurations, the uniblock 102 encloses, envelopes, and/or surrounds the combustion chamber 104 and at least a majority of the associated cylinder bore 106. In some configurations, the uniblock 102 encloses, envelopes, and/or surrounds the combustion chamber 104 and all of the associated cylinder bore 106. In other words, the combustion chamber 104 and the cylinder bore 106 can be defined within the uniblock 102 as a single recess.

A piston 110 is positioned within the cylinder bore 106. The piston 110 is configured to reciprocate within the cylinder bore 106. In some configurations, the piston 110 is inserted into the uniblock 102 from the bottom of the uniblock 102. In other words, because the combustion chamber 104 and the cylinder bore 106 are formed inwardly from the bottom of the uniblock 102 (i.e., similar to a blind hole), the piston 110 can be inserted into the cylinder bore 106 from the bottom of the uniblock 102. In the illustrated configuration of FIG. 1, the bottom of the uniblock 102 is the end of the uniblock 102 opposite the combustion chamber 104 along the path of the piston 110.

In the illustrated configuration, the piston 110 is connected to two crankshafts 112. The two crankshafts 112 in the internal combustion engine 100 are on opposing sides of the cylinder bore 106. A plane CP is defined through the two center axes of the two crankshafts 112. In at least some configurations, the plane CP is positioned above an upper surface of the piston 110 when the piston 110 is disposed within the cylinder bore 106 at a location that is furthest from the combustion chamber 104 (i.e., at bottom dead center).

Depending upon the configuration of the internal combustion engine 100 using the uniblock 102, the number of crankshafts 112 and/or the rotation of the crankshafts 112 relative to one another can vary. In some configurations, each uniblock 102 carries two or more counter-rotating crankshafts 112. In some configurations, there can be an even number of crankshafts 112. In the configuration of FIG. 1, the two crankshafts 112 can be disposed on either side of the piston 110 (i.e., the piston 110 can be positioned between the two crankshafts 112). The center axes (i.e., the axes of rotation) of the crankshafts 112 can be disposed below the top end of the cylinder bore 106 and/or the piston 110 when the piston 110 is closest to the combustion chamber 104 (i.e., at top dead center) but above the lower end of the cylinder bore 106 and/or the piston 110 when the piston 110 is furthest away from the combustion chamber 104 (i.e., at bottom dead center). In some configurations, the center axes of the crankshafts 112 can be above a connection point between a crosshead 114 and any connecting rods 116 that connect to the crosshead 114.

In the illustrated configuration, the two crankshafts 112 are at least partially housed within the uniblock 102. In the illustrated configuration, the two crankshafts 112 are accessible to an outside of the uniblock 102. More particularly, in the illustrated configuration, the two crankshafts 112 can be inserted from a top side (i.e., a side generally opposing the side with the opening in the uniblock 102 defined by the cylinder bore 106) or a lateral side of the uniblock 102. The two crankshafts 112 are inserted into the uniblock 102 through a side that is different from the side of the uniblock 102 through which the piston 110 is inserted.

The two crankshafts 112 are connected to the crosshead 114. The crosshead 114 can be separate of and connected to the piston 110 in the illustrated configuration. As discussed below, in some configurations, the crosshead 114 can be integrally formed as a monolith with at least one piston 110. The crosshead 114 can be triangular or Eiffel Tower shaped. The crosshead 114 can be subject to tensile and compressive forces. Accordingly, in some configurations, the crosshead 114 can be formed of a material with a high degree of mechanical strength, such as iron or steel.

Each of the two crankshafts 112 is connected to the crosshead 114 using one or more connecting rod 116. Because of the positioning of, and the use of, the two crankshafts 112, the connecting rods 116 operate primarily or almost entirely under tension during movement of the piston 110.

Crosshead/connecting rod axes are defined at connection locations between the connecting rod 116 and the crosshead 114. In the internal combustion engine 100 with the uniblock 102 that is illustrated, a sliding pin 120 connects the connecting rod 116 to the crosshead 114. In some configurations, the plane CP defined by the center axes of the two crankshafts 112 is between the combustion chamber 104 and a plane CC that is defined by the crosshead/connecting rod axes. While one of the plane CP and the plane CC is shown in conjunction with one uniblock 102 and the other of the plane CP and the plane CC is shown in conjunction with the other uniblock 102, it should be recognized that each of the plane CP and the plane CC are present with each uniblock 102.

The crosshead 114 in combination with the connecting rods 116 and the pair of crankshafts 112 define an assembly that constrains movement of the piston 110. The movement of the piston 110 is constrained to be only linear (allowing for slight variation as a result of tolerance deviations). The movement of the piston 110 is along the cylinder axis (e.g., the central axis of the cylinder bore 106). According to some configurations, the piston 110 can move only parallel (e.g., substantially only parallel) to the center line of the cylinder bore 106 with little or no side-to-side movement, rocking movement, and/or slapping forces. Constraining the motion of the piston 110 reduces side forces and stress loading on the piston 110 and on walls that define the cylinder bore 106. Such a configuration can provide significant advantages, including reduced wear of piston side walls, piston rings, and/or the cylinder/cylinder liner walls. In some cases, such a configuration can provide the advantages of reduced frictional heat and lower work energy losses.

Combustion materials (e.g., fuel and air) are delivered to the internal combustion engine 100 for combustion in the combustion chamber 104. The internal combustion engine 100 comprises at least one intake valve opening 122 and/or at least one fuel injector 124. Flow into the combustion chamber 104 through the intake valve opening 122 can be controlled by an intake valve 126.

The internal combustion engine 100 can expel exhaust products through at least one exhaust valve opening 130. Flow out of the combustion chamber 104 through the exhaust valve opening 130 can be controlled by an exhaust valve 132. The exhaust gases that pass through the exhaust valve opening 130 enter into an exhaust passage 134.

The internal combustion engine 100 can include one or more cooling component 136. The internal combustion engine 100 that is illustrated has fins, cooling tubes, and/or cooling plates (e.g., collectively referred to as one or more cooling component 136). The one or more cooling component 136 can be positioned near the combustion chamber 104. The one or more cooling component 136 can be used to prevent or at least reduce the likelihood of excess heat buildup in the combustion chamber 104. The excess heat could otherwise result in damage to engine components or cause premature lubricant degradation. Additionally, regulating the temperature of the combustion chamber 104 can enable the use of lower cost lubricants (e.g., avoid the use of more expensive lubricants suitable for use at temperatures higher than those typically encountered in an internal combustion engine).

Figure 3:
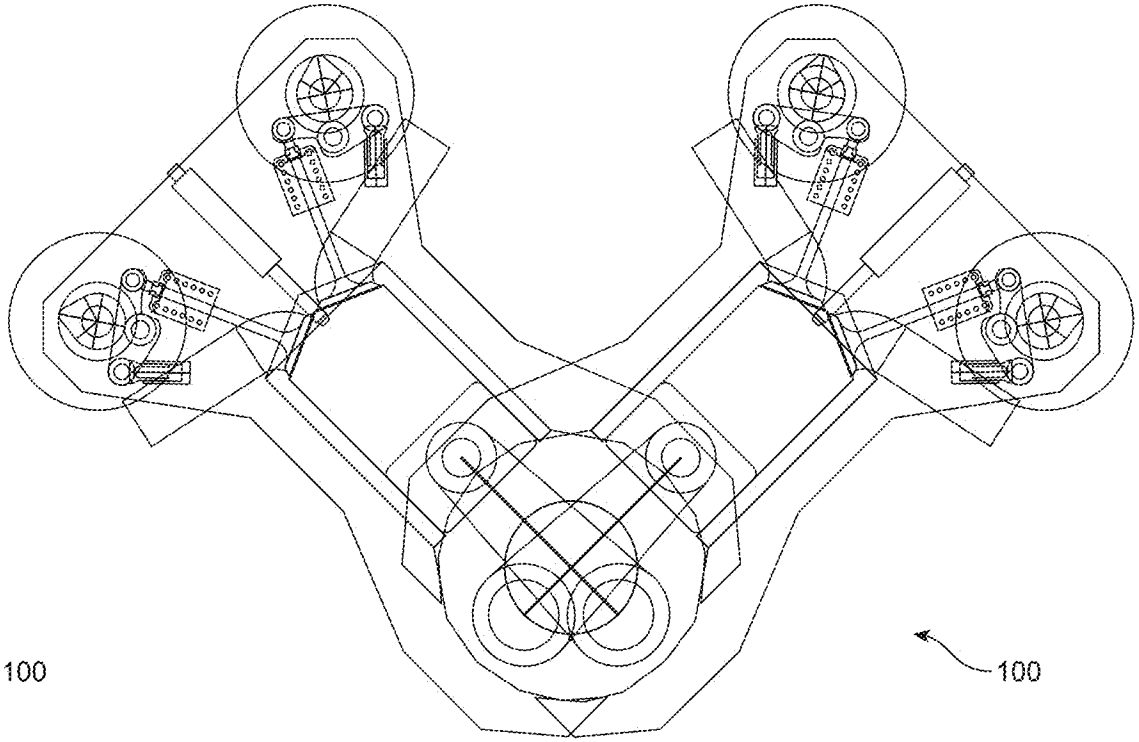
FIG. 3 illustrates a schematic cross-section view of a V engine configuration employing at least two uniblocks.
Figure 2:
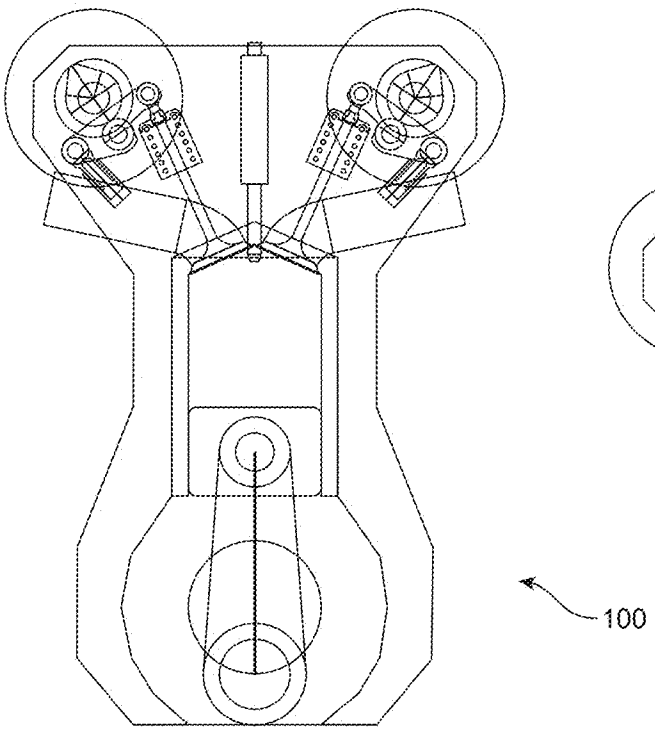
FIG. 2 illustrates a schematic cross-section view of an inline engine configuration employing a uniblock.
Figure 4:
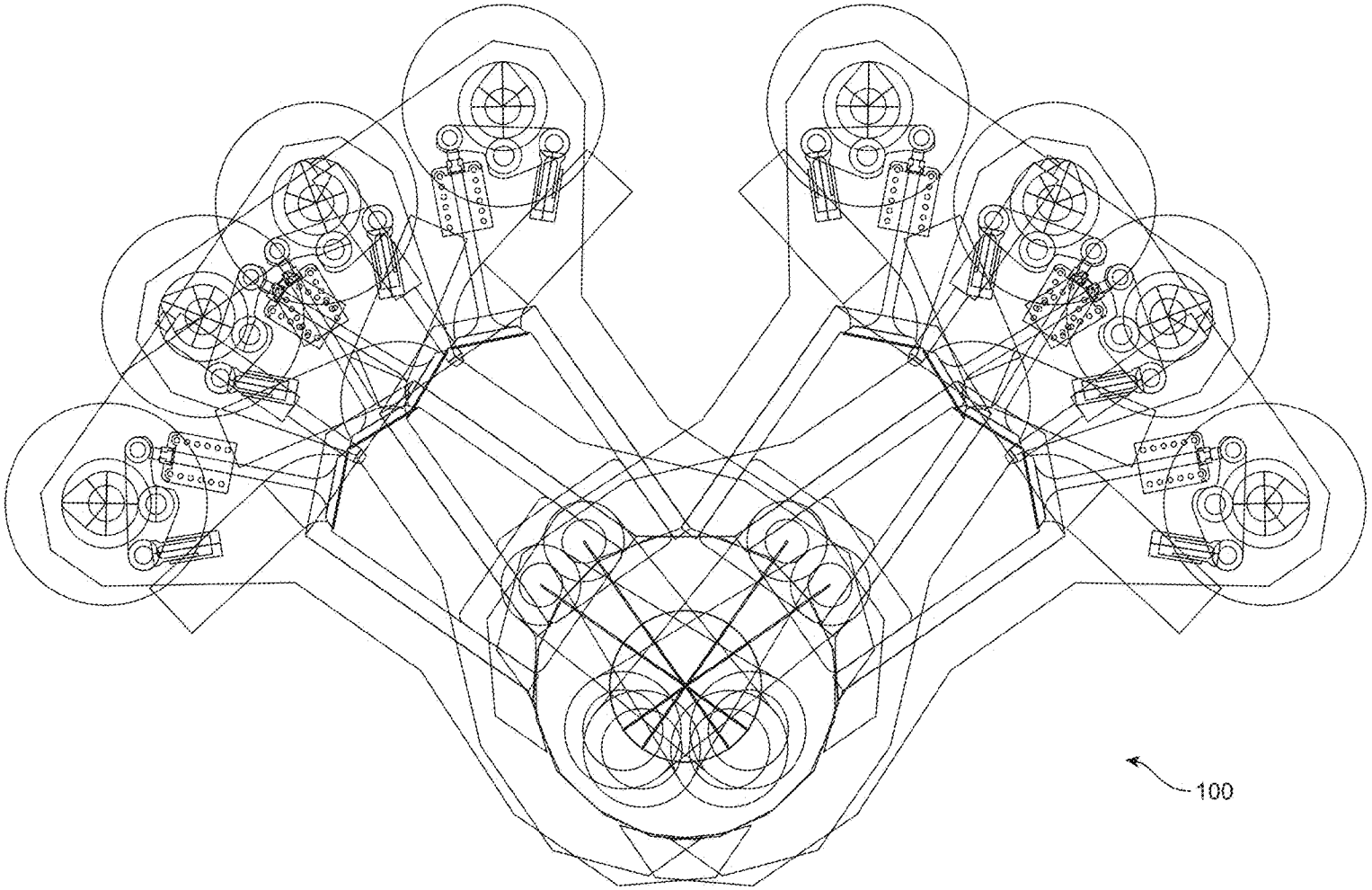
FIG. 4 illustrates a schematic cross-section view of a W engine configuration employing at least eight uniblocks.
Figure 5:
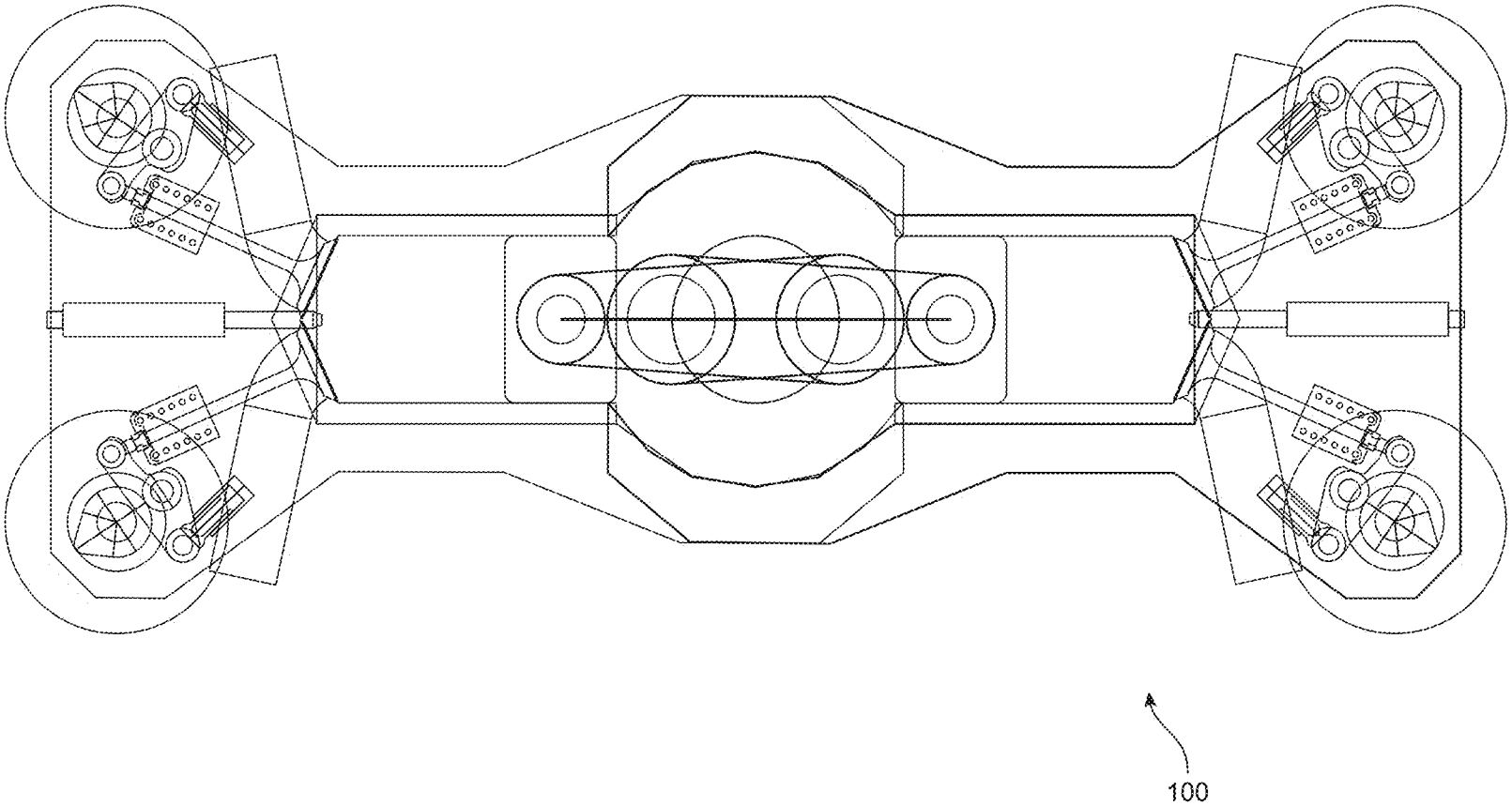
FIG. 5 illustrates a schematic cross-section view of an opposed engine employing at least two uniblocks.

With reference to FIGS. 1-5, two or more uniblocks 102 can be paired in various configurations for the internal combustion engine 100 using the uniblock 102. The multiple uniblocks 102 can be positioned side-by-side and/or end-to-end. FIGS. 2-5 illustrate various non-limiting configurations of internal combustion engines 100 featuring one or more uniblock 102. FIG. 2 illustrates a schematic view of an inline engine configuration. FIG. 3 illustrates a schematic view of a V engine configuration. FIG. 4 illustrates a schematic view of a W engine configuration. FIG. 5 illustrates a schematic view of an opposed engine. As illustrated in FIGS. 1-5, the modular nature afforded by the uniblock 102 facilitates engines of a multitude of constructions.

In configurations similar to those illustrated in FIGS. 1-5, the multiple uniblocks 102 can be joined together by a baseplate 140. The baseplate 140 is illustrated in FIG. 1. The baseplate 140 can be used to mount the uniblocks 102 side-by-side and/or end-to-end. For example, multiple uniblocks 102 can be paired in opposed balanced constructions, opposed compact constructions, and/or opposed captive free piston constructions. In some configurations, such as in an inline construction, for example, the uniblock 102 may not be paired with another. The opposed balanced constructions can have the advantage of balancing all piston related forces including primary, secondary, and rocking forces in both two and four-stroke constructions, and can have the advantage of balancing all forces including all piston and valve and valvetrain related forces in two-stroke constructions.

The internal combustion engine 100 also can include any of a number of auxiliary components. For example, the internal combustion engine 100 illustrated in FIG. 1 includes an intake plenum 142, a scavenging blower/supercharger 144, and/or an oil pan 146. Other components also can be used to improve performance of the internal combustion engine 100.

Advantages of the Internal Combustion Engine Employing Uniblocks

The uniblock 102 provides the internal combustion engine 100 using the uniblock 102 with some distinct advantages over traditional internal combustion engine configurations. For example, defining the combustion chamber 104 within the uniblock 102 enables the internal combustion engine 100 to withstand extremely high compression pressures. This results because there no longer is a gasketed junction between a cylinder head and a cylinder block. The gasketed junction in traditional engines is a location for high compression pressure failures. On the other hand, in the illustrated internal combustion engine 100 that employs the uniblock 102, the compression ratio can be about 10:1, about 20:1, about 30:1, about 40:1, about 50:1, about 75:1, about 100:1, any value between these values, or more or less depending upon the particular engine design. In other words, depending upon the desired compression ratio, the illustrated internal combustion engine 100 using the uniblock 102 can be modified to obtain that desired compression ratio. In addition, the benefits of the configurations of the internal combustion engine 100 employing the uniblock 102 can be scaled in size. For example, the ability to scale in size results in engines with maximum power outputs from one horsepower to one million horsepower, for example.

Traditional internal combustion engines have compression ratios between about 6:1 to about 10:1 for engines that burn gasoline and between about 12:1 and 20:1 for engines that burn diesel fuel. Thus, the internal combustion engines 100 using the uniblock 102 can have higher final compression ratios than typically is found in engines for many use cases. In some configurations, the final compression ratio can exceed 50:1. In some configurations, the internal combustion engine 100 that is arranged and configured according to the present disclosure can have a final compression ratio of 200:1 or higher. These higher than standard compression ratios can be more simply achieved in the internal combustion engine 100 that uses the uniblock 102. Such high compression ratios can result from the constructions that generally reduce the regions most likely to fail under the high pressures that result from the high compression ratios.

The internal combustion engine 100 using the uniblock 102 can be flexible regarding the type of fuel at least in part because of the high compression pressures that can be generated within the combustion chamber 104. For example, certain features, aspects, and advantages of the internal combustion engine 100 with the uniblock 102 can be used with compression ignition fuels, while others can be used with spark ignition fuels, and still others can be used with any fuel, including spark ignition and/or compression ignition fuels.

The uniblock 102 construction also enables the internal combustion engine 100 using the uniblock 102 to be lighter than a traditional reciprocating internal combustion engine of equivalent power. The internal combustion engine 100 using the uniblock 102 also can achieve other advantages. For example, some of the other advantages can include, but are not limited to, reduced fuel energy going to waste heat, increased cooling, more efficient cooling, increased charge air compression, reduced parts counts, reduced production costs, reduced stress risers in high temperature and high pressure areas of the uniblock, improved metal grain structure in high pressure and high temperature uniblock regions, increased engine longevity, increased engine working environments, increased service intervals and/or elimination of engine and engine parts failures due to cylinder block to cylinder head failures.

By combining the cylinder head and the cylinder block into a uniblock 102, issues like stress on head gaskets used to seal the connection between the cylinder block and the cylinder head can be reduced or eliminated. In some configurations, the uniblock 102 facilitates constructions of the internal combustion engine 100 that can have reduced waste heat production, improved heat dissipation, or both. In some configurations, the uniblock 102 facilitates constructions of the internal combustion engine 100 that can make more efficient use of space and volume. For example, according to some configurations, the internal combustion engine 100 using the uniblock 102 can have reduced size for a given horsepower when compared with traditional reciprocating engine designs.

In some configurations, the internal combustion engine 100 using the uniblock 102 can have reduced volume and/or weight per maximum horsepower output when compared to conventional inline, "V", "VR", "W", "X", opposed, boxer, flat, and/or radial piston constructions. The internal combustion engine 100 using the uniblock 102 can have reduced volume and/or weight per maximum horsepower output compared to radial engine constructions, including older engine constructions, such as Wankel engines, and newer engine constructions, including liquid piston and related constructions. The internal combustion engine 100 using the uniblock 102 can have reduced volume and/or weight per maximum horsepower output compared to the majority of gas turbine engines.

This consistently reduced volume and/or weight per maximum horsepower outputs means that some configurations of the internal combustion engine 100 using the uniblock 102 are well suited for applications where small size and/or weight for given power outputs are desirable, such as, in air transportation vehicles. In another example, the internal combustion engine 100 using the uniblock 102 can be paired with an electric motor in a hybrid drive vehicle (e.g., which can include use as a range extender in an electric vehicle), including in air transportation vehicles. In yet another example, the internal combustion engine 100 using the uniblock 102 can provide benefits in engine retrofit applications where reduced size and/or weight provides ease of and flexibility in retrofit applications, such as when owners of existing vehicles desire increased efficiency, reduced emissions, and/or increased power.

In some configurations, the internal combustion engine 100 using the uniblock 102 can have reduced piston speed for a given horsepower as compared with some other reciprocating engines, which can offer several benefits. For example, reduced piston speeds in the internal combustion engine 100 using the uniblock 102 can help reduce engine failures, increase durability, and/or increase maintenance intervals, which may make such engines more suitable for continuous use.

While increased compression ratios can be one advantage of the internal combustion engines 100 using the uniblock 102, there can also be other advantages in addition or alternatively to achieving higher compression ratios. For example, in some configurations, the uniblock 102 provides more flexibility in the placement of fuel injectors, spark plugs, and the like because there is no seam between the cylinder head and the cylinder block (i.e., these components are integrated into a monolithic form). For example, in an engine design with a separable cylinder head and cylinder block, it can be important to avoid the seam between the cylinder head and the cylinder block because interfering with the seam could compromise sealing, structural integrity, or both. The internal combustion engine 100 that uses the uniblock 102, as compared to conventional engines, allows for many additional advantages, including better lubrication, better balance, better heat management, and smaller and lighter engines for any given power input.

Uniblock

Figure 6:
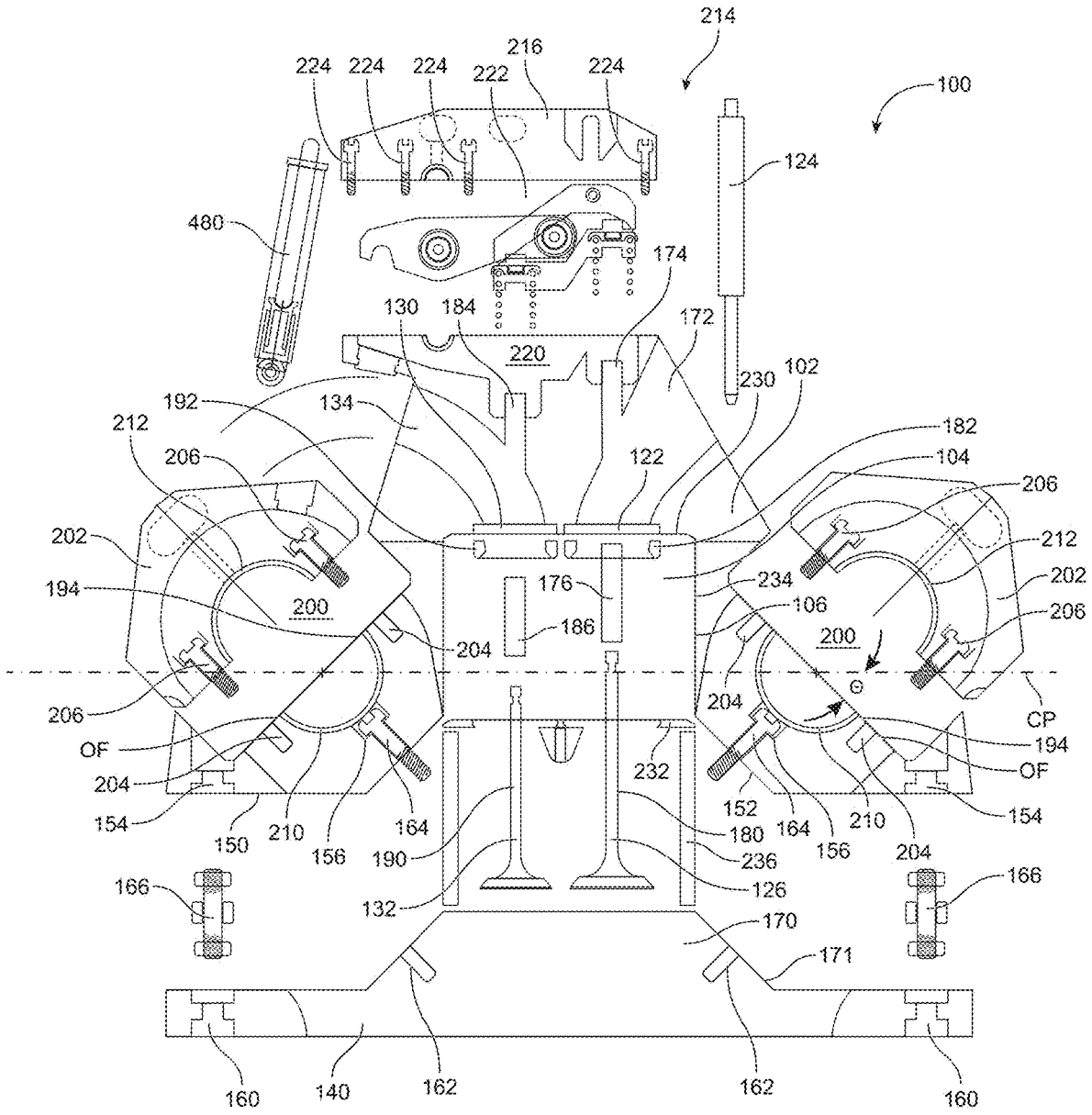
FIG. 6 illustrates an exploded view of at least a portion of an inline configuration of the internal combustion engine employing a uniblock.

With reference now to FIG. 6, the internal combustion engine 100 of FIG. 1 is illustrated in an exploded schematic view. The uniblock 102 can be formed using any suitable technique and using any suitable materials. For example, materials can be chosen for particular use cases. In some configurations, the uniblock 102 can be manufactured from various metals and/or alloys, including but not limited to aluminum or aluminum alloys, which can reduce the weight of the internal combustion engine 100 using the uniblock 102 relative to conventional engines having similar horsepower output. As another example, the uniblock 102 can be manufactured from iron, for example, but without limitation, which can offer increased strength and/or reduced cost.

When viewed in a cross-section taken normal to the axis of rotation of the two crankshafts 112 (see. e.g., FIG. 1 and the view of FIG. 6), the uniblock 102 can have a generally triangular shape. Such a generally triangular shape is shown, for example, in FIG. 1 and in FIG. 6. An outer face OF of the uniblock 102 where the crankshafts 112 are positioned can have an angle θ between 0 degrees and 90 degrees relative to the plane CP defined through the central axis of the cylinder bore and parallel to the axes of rotation of the two crankshafts 112. In some configurations, the angle θ is between 20 degrees and 70 degrees. In the illustrated configuration, the angle θ is 45 degrees. As a result of this generally triangular construction, forces can be directed toward the center of the uniblock 102. The generally triangular shape of the illustrated uniblock 102 also provides suitable strength and/or enables ease of production. The generally triangular shape of the uniblock 102 also can provide an advantage in the relationship between the stroke volume and the engine volume.

The geometry of the uniblock 102 can enable multiple ways of implementing constructions featuring two pistons 110 that are arranged in opposed relationships. In the illustrated configurations, the axis along which the pistons 110 reciprocate does not intersect with the either of the two crankshafts 112. In an "opposed balanced" construction, both of the two pistons 110 can be at top dead center at the same time. In such a construction, because the pistons 110 move along the same central axis, forces are better balanced. In an "opposed compact" construction, the pistons 110 can offset each other with one piston 110 being at top dead center when the other piston 110 is at bottom dead center. In both cases, and depending on the number of pistons 110, primary, secondary, and/or rocking forces may be substantially or completely canceled, which can improve the overall balance of the internal combustion engine 100 using the uniblock 102. According to some configurations, in the opposed balanced constructions, the primary, secondary, and/or rocking forces can be canceled with any even number of the pistons 110, including two pistons 110, while the opposed pistons 110 operate in a synchronized manner such that they are at the same point in the cycle at the same time. According to some configurations, an "opposed compact" construction can provide a significant space advantage.

In some configurations, the "opposed compact" construction can utilize captive free pistons. The captive free pistons may offer improved space and/or weight savings as compared to an opposed compact construction that is not using the captive free piston construction for a given engine stroke volume. In some configurations, the captive free pistons may provide benefits such as, for example, reducing forces that go into connecting rods and/or crankshafts. For example, during an expansion stage of a cycle of one piston, forces can be transmitted to the opposing piston, which is in a compression stage of a cycle. In some configurations, the captive free piston engine according to some configurations herein can have improved balance as compared to some other engines.

In some configurations (e.g., dual crankshafts or quad crankshafts in the case of a captured free piston design), the internal combustion engines 100 can result in a highly balanced configuration due to, not only the counterrotating nature of the two crankshafts, but also the balanced motions of pairs of connecting rods.

As introduced above, inline constructions also are contemplated. According to some configurations, the inline constructions can have downward strokes (e.g., from top dead center to bottom dead center) that are a greater percentage of a cycle than upward strokes (e.g., from bottom dead center to top dead center). Such an approach can result in a power stroke that is more than half of the cycle, which can occur in both two-stroke and four-stroke engine constructions. For example, there can be more degrees of power per cycle. In the two-stroke engine variant, this can enable continuous power and/or substantial power overlap even if only two cylinders are used.

Preferably, if there are multiple cylinder bores 106, which may be positioned side-by-side, then center to center spacing between the cylinder bores 106 can be between about 10% and about 20% of the internal diameter or cross dimension of the cylinder bores 106. In some configurations, the center to center spacing of the cylinder bores 106 can be greater than 20%. In some configurations, the spacing between the cylinder bores 106 can be less than 10%. In some configurations, the spacing can be between about 5% and about 10%. The spacing between the cylinder bores 106 can provide space between the cylinder bores 106 for cylinder liners, crank bearings, cam bearings, and so forth. When calculating the percentage of the diameter of the cylinder bore 106, the diameter is calculated as narrowed by any cylinder liner.

Figure 7:
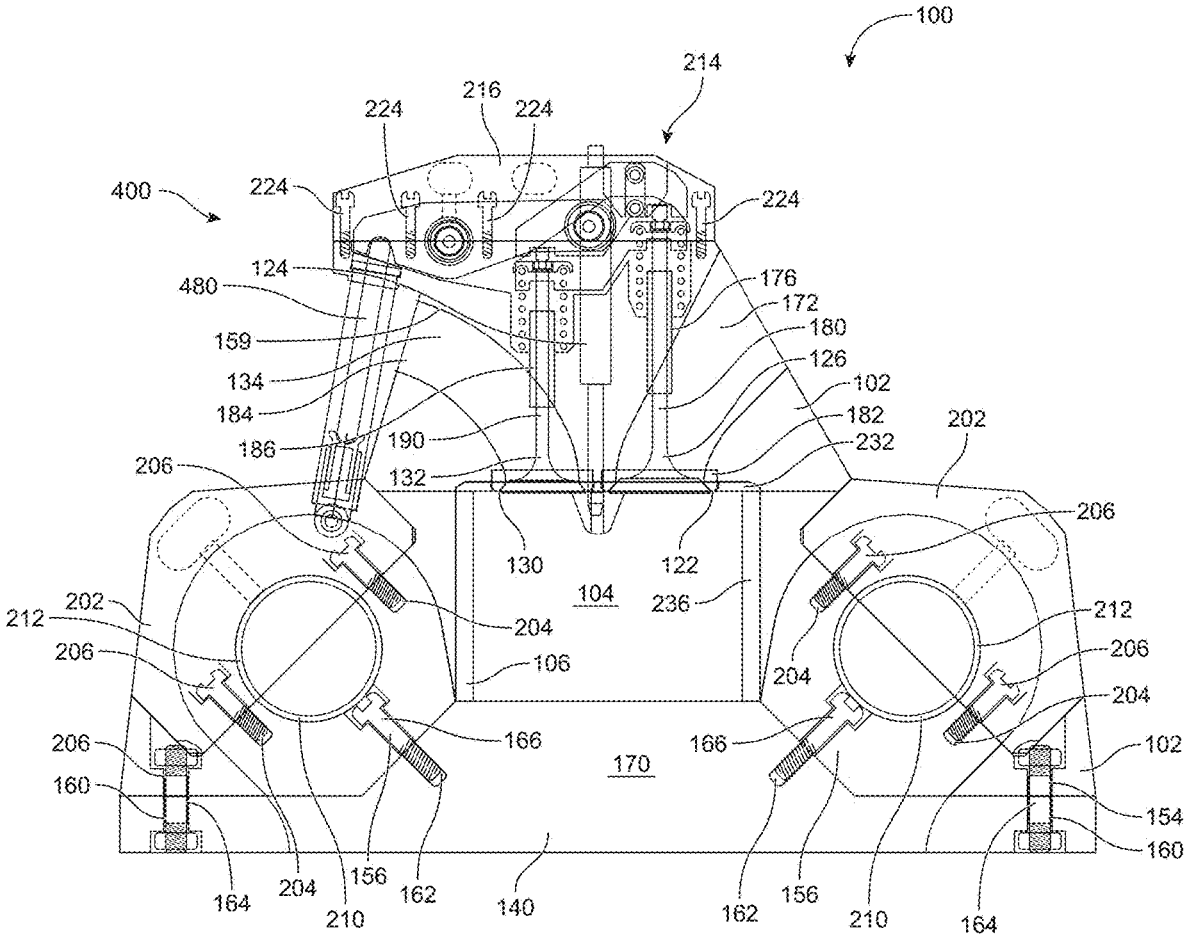
FIG. 7 shows the internal combustion engine of FIG. 6 in an assembled state.
Figure 8:
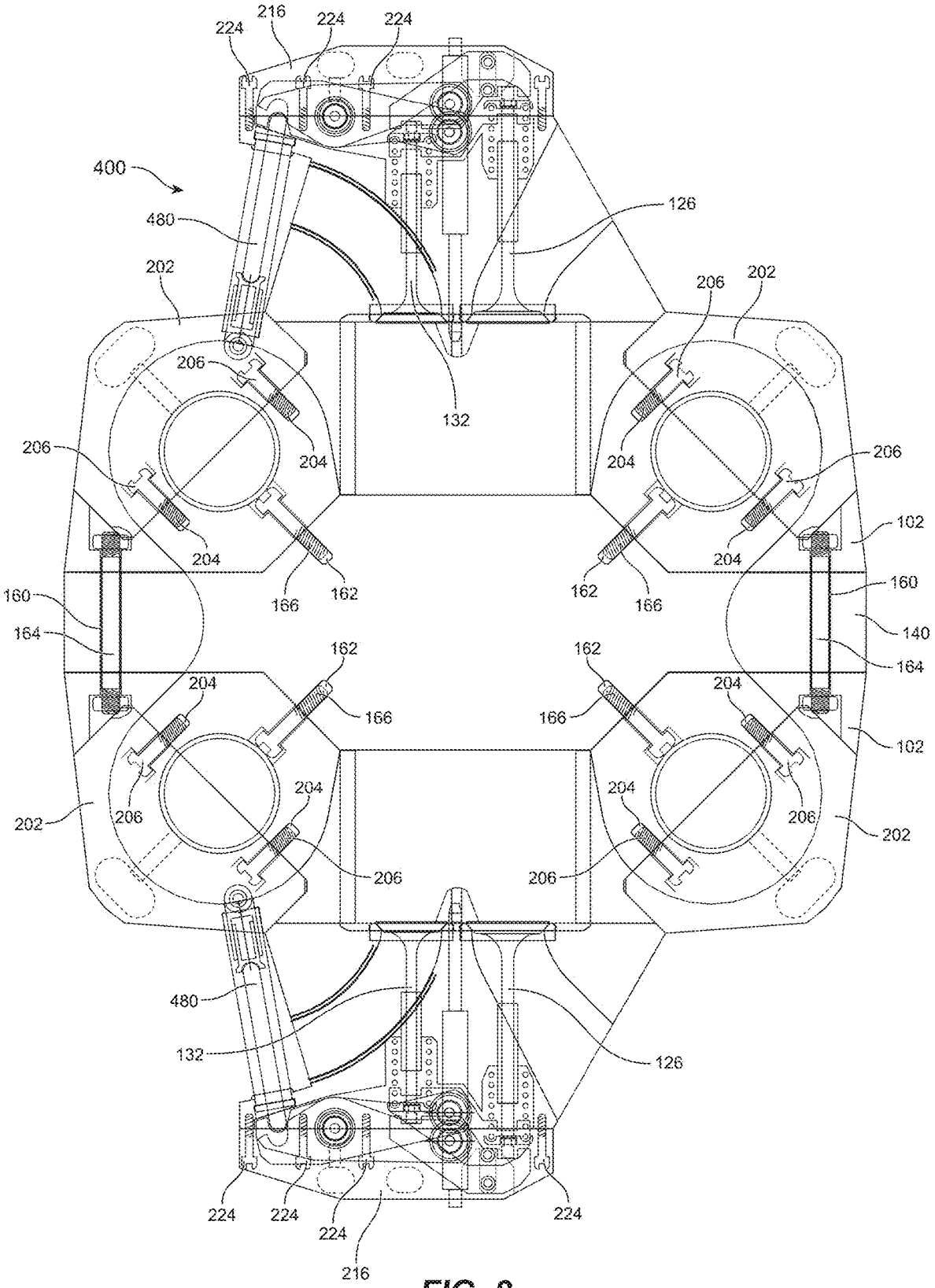
FIG. 8 shows an assembled view of at least a portion of an inline opposed configuration of the internal combustion engine employing at least two uniblocks.

FIG. 6 illustrates an exploded view of an inline configuration of the internal combustion engine 100 using the uniblock 102 and FIG. 7 illustrates the internal combustion engine 100 of FIG. 6 in an assembled state. In the illustrated construction, the internal combustion engine 100 can be a two-stroke engine. FIG. 8 illustrates the internal combustion engine 100 using the uniblock 102 but in an opposed inline construction. In other words, at least one uniblock 102 is mounted to each side of the baseplate 140.

As illustrated, the uniblock 102 can be mounted to the baseplate 140. A mounting region 150 of the uniblock 102 can be positioned on the bottom of the uniblock 102. The mounting region 150 in the illustrated configuration comprises a central recess 152. The central recess 152 is recessed from the bottom of the uniblock 102 towards the combustion chamber 104. In some configurations, the central recess 152 comprises upwardly angled sidewalls that terminate at the edge of the unlined cylinder bore 106. Such a configuration can reduce the overall size of the internal combustion engine 100 while providing adequate strength.

The mounting region 150 can comprise a plurality of outer mounting holes 154 and a plurality of inner mounting holes 156. The baseplate 140 can comprise a plurality of outer mounting holes 160 and a plurality of inner mounting holes 162. The outer mounting holes 154 of the uniblock 102 correspond in location relative to the outer mounting holes 160 of the baseplate 140. The inner mounting holes 156 of the uniblock 102 correspond in location relative to the inner mounting holes 162 of the baseplate 140. The outer mounting holes 154 of the uniblock and the outer mounting holes 160 of the baseplate 140 receive first fasteners 164. The inner mounting holes 156 of the uniblock 102 and the inner mounting holes 162 of the baseplate 140 receive second fasteners 166. The first fasteners 164 and the second fasteners 166 secure the uniblock 102 to the baseplate 140. In some configurations, the first fasteners 164 can comprise dowel studs and nuts. The dowel studs and nuts provide alignment precision and suitable clamping forces. In some configurations, the second fasteners 166 can comprise bolts. Other types of fasteners can be used.

The baseplate 140 comprises an embossed region 170. The inner mounting holes 162 of the baseplate 140 are positioned in the embossed region 170. In the illustrated configuration, the embossed region 170 has sloping side walls 171. The inner mounting holes 162 are positioned along the sloping side walls 171. In the illustrated arrangement, the axes of the inner mounting holes 162 are not parallel to the axes of the outer mounting holes 160. Advantageously, such a configuration improves the structural integrity of the connection between the baseplate 140 and the uniblock 102. For example, while the first fasteners 164 will be loaded primarily with tensile loads, the second fasteners 166 will also have a component of shear loading. This configuration improves the strength of the connection between the baseplate 140 and the uniblocks 102.

With continued reference to FIG. 6, the uniblock 102 comprises an intake passage 172. The intake passage 172 is positioned in an upper portion of the uniblock 102. The intake passage 172 extends downwardly and opens into the combustion chamber 104. In the illustrated configuration, the intake passage 172 has less curvature than the exhaust passage 134. In some configurations, the uppermost portion of the intake passage 172 is positioned on a side surface directly adjacent to the top surface of the uniblock 102. Such a configuration provides as vertical of an entry into the combustion chamber 104 as possible.

The lower end of the intake passage 172 terminates at the intake valve opening 122. One or more than one intake valve openings 122 can be provided. In configurations featuring multiple intake valve openings 122, the intake passage 172 can comprise multiple runners with each runner terminating at the respective intake valve opening 122. Other configurations also are possible.

The intake valve 126 controls flow through the intake valve opening 122. In the illustrated uniblock 102, an intake valve passage 174 extends between an upper region of the uniblock 102 and the intake passage 172. The intake valve passage 174 receives an intake valve guide 176. The intake valve guide 176 can be secured within the intake valve passage 174 in any suitable manner. The intake valve guide 176 is sized and configured to receive an intake valve stem 180 of the intake valve 126. As discussed above, an advantage of the uniblock 102 is that the intake valves 126 can be easily installed from the bottom of the uniblock 102.

The intake valves 126 can seal against corresponding intake valve seats 182. Because of the construction and configuration of the uniblock 102, the intake valve seats 182 can be integrally formed or a recess can be formed that receives the intake valve seats 182. The intake valve seats 182 can be secured in position in any suitable manner.

The uniblock 102 also comprises the exhaust passage 134. The exhaust passage 134 originates at the exhaust valve opening 130 and extends upward and outward in the illustrated configuration. The exhaust passage 134 can be formed within the uniblock 102 in any suitable manner. One or more than one exhaust valve openings 130 can be provided. In configurations featuring multiple exhaust valve openings 130, the exhaust passage 134 can comprise multiple runners with each runner terminating at the respective exhaust valve opening 130. Other configurations also are possible.

The exhaust valve 132 controls flow through the exhaust valve opening 130. In the illustrated uniblock 102, an exhaust valve passage 184 extends between an upper region of the uniblock 102 and the exhaust passage 134. The exhaust valve passage 184 receives an exhaust valve guide 186. The exhaust valve guide 186 can be secured within the exhaust valve passage 184 in any suitable manner. The exhaust valve guide 186 is sized and configured to receive an exhaust valve stem 190 of the exhaust valve 132. As discussed above, an advantage of the uniblock 102 is that the exhaust valves 132 can be easily installed from the bottom of the uniblock 102.

The exhaust valves 132 can seal against exhaust valve seats 192. Because of the construction and configuration of the uniblock 102, the exhaust valve seats 192 can be integrally formed or a recess can be formed that receives the exhaust valve seats 192. The exhaust valve seats 192 can be secured in position in any suitable manner.

Side surfaces 194 of the uniblock 102 can support the two crankshafts 112. In the illustrated configuration, at least one pocket 200 is defined along each side surface 194 of the uniblock 102. While the pockets 200 are used in the illustrated configuration, other arrangements also are possible. Each of the pockets 200 can be enclosed by a corresponding crankshaft cap 202. While the illustrated crankshaft cap 202 is sized and configured such that the crankshaft cap 202 protrudes above the corresponding side surface of the uniblock 102, other configurations are possible. In some configurations, the crankshaft cap 202 and the uniblock 102 are structured such that the uppermost surface of the crankshaft cap 202 is flush with the surrounding surfaces of the uniblock 102. The illustrated crankshaft cap 202 has a five-sided end-view profile. In some configurations, the crankshaft cap 202 can have an arcuate shaped profile or a box shaped profile.

Each of the pockets 200 comprises at least one mounting hole 204. A fastener 206 is received by each of the at least one mounting hole 204. The fastener 206 passes through an opening in the corresponding crankshaft cap 202. The fastener 206 secures the crankshaft cap 202 to the uniblock 102. A sealing gasket (not shown) can be positioned between the crankshaft cap 202 and the uniblock 102.

The uniblock 102 can define one or more saddles 210. The saddles 210 receive appropriate bearings to support the two crankshafts 112. In locations that correspond to the saddles 210, the crankshaft caps 202 comprise top caps 212. Together, the saddles 210 and the top caps 212 secure the two crankshafts 112 in position relative to the uniblock 102. In some configurations, the top caps 212 can be formed separately from the crankshaft caps 202 and the crankshaft caps 202 can simply enclose the two crankshafts 112.

In the illustrated construction, a valve train 214 is positioned above the combustion chamber 104. The valve train 214 in the illustrated construction is a mechanical system that controls the opening and closing of the intake valves 126 and the exhaust valves 132. The valve train 214 is mainly positioned within a chamber 220 defined by a valve train cover 216 and a recess 222 defined within the upper surface of the uniblock 102. Fasteners 224 can be used to secure the valve train cover 216 to the uniblock 102. A sealing gasket (not shown) can be positioned between the valve train cover 216 and the uniblock 102.

As will be discussed in greater detail below, the cylinder bore 106 can be lined. In some configurations, a top end 230 of the cylinder bore 106 can be lined with a top plate 232. In some configurations, the side wall 234 of the cylinder bore 106 can be lined with a cylinder liner 236. The cylinder liner 236 and the top plate 232 can be integrated or can be separately formed and installed. One or both of the top plate 232 and the cylinder liner 236 can be used in any particular configuration. As will be described, the cylinder liner 236 can abut the top plate 232 and can hold the top plate 232 adjacent to the top end 230 of the cylinder bore 106.

Introduction to Valve Timing/Dwell Control

In some configurations, the internal combustion engine 100 can be flexible regarding the type of fuel used at least in part because the internal combustion engine 100 enables improved control of the compression ratio and/or the valve timing. For example, as will be described, the internal combustion engine 100 can precisely, and in continually variable fashion, change the compression ratio from high to low. In some configurations, the internal combustion engine 100 can precisely change the duration of and the timing of scavenging, intake and/or exhaust. In some configurations, as will be discussed, the internal combustion engine 100 has geometry that allows for multiple direct cylinder fuel injectors 124.

A variety of configurations of valve timing and duration control systems (generally referred to herein as valve timing systems) 400 will now be described as well as components that may be associated with the valve timing systems 400. The various disclosed valve timing systems 400 may include various features and components that are identical to each other and used for the same purposes.

With continued reference to FIGS. 7 and 8, in some configurations, the valve timing systems 400 may result in fixed timing of opening and closing of the intake valves 126 and/or the exhaust valves 132. As illustrated, the valve timing system 400 may be driven by one or more of the crankshafts 112 of the internal combustion engine 100, which may reduce the friction losses. In some configurations, a simple mechanical drive can be used to operate the intake valves 126 and/or the exhaust valves 132 without significant parasitic energy loss. In some configurations, the crankshafts 112 can be machined between journals and throws so that valve rods (i.e., pushrods) 480 can be directly driven by the crankshafts 112. Such configurations would result in a fixed valve duration and timing, but would be inexpensive and could be used on small internal combustion engines 100 to keep costs lower. In some configurations, the crankshafts 112 of the internal combustion engine 100 do not carry pushrod lobes or other structures to drive pushrods 480. In such configurations, the internal combustion engine 100 may use camshafts 450 (discussed below) to control the opening and/or closing of one or more of the intake valves 126 and/or one or more of the exhaust valves 132.

As will be described, various other configurations can be used to enable variable valve duration. These configurations can be used with or without the other features, aspects, and advantages of certain configurations described elsewhere in this disclosure. Changing valve duration enables changing of the compression ratio in the internal combustion engines 100 and/or changing the amount of Atkinson cycle effect achieved. The Atkinson cycle is a thermodynamic cycle that improves the fuel efficiency of the internal combustion engine. The Atkinson cycle engine has a shorter intake stroke and a larger expansion ratio than the Otto cycle engine. Typically, the intake valve of an Atkinson cycle engine is delayed until the piston has completed 20-30% of its upward travel on the compression stroke. This reduces the volume of air and fuel introduced on the intake stroke, which burns more efficiently during ignition. When under low load, a high degree of Atkinson cycle is desirable because of the high thermal efficiency that can be attained with the described configurations of the internal combustion engines 100. When under high load, the internal combustion engines 100 can be operated with less thermal efficiency and with less Atkinson cycle effect to improve power output. In addition to controlling the valve duration, these configurations described below can also enable variable valve timing.

As will become apparent, some configurations feature freely rotating cam lobes on main shafts. The freely rotating cam lobes may be on sleeves. Configurations of the valve timing system 400 that include freely rotating cam lobes may include a secondary auxiliary shaft for controlling these lobes. In some configurations, every other lobe is free spinning and controlled by a parallel auxiliary shaft. In one configuration, the two shafts control each other. This is the most compact arrangement. This configuration also enables control of valve timing and valve duration for each single valve. In some configurations, a small computer can drive a stepper motor or a servo motor to control a worm gear. This combination of a stepper motor or servo motor with a worm gear improves precision of valve control. The worm gears can be paired in many different combinations.

The configurations may use a differential gear set together with a worm gear. The worm gear can be driven by a stepper motor or a servo motor. The worm gear allows for fine tuning and the worm gear can hold the differential gear set where it is positioned. One wheel can be driven by the worm gear and then the differential mechanism would be driven to change the timing of the valve opening and closing. In some configurations, the angle can be set to about 115 degrees. In some configurations, the valve timing systems may include two or more worm gears. Configurations that include two worm gears controlling the same shaft, allow a user to control the duration in addition to controlling the start and stop timing of the valves. The configuration will not change valve lift, however. In some configurations, the lift will be about one third of the valve head diameter. The valve drive configuration may run a set of parallel shafts, each with two lobes. For two valves, there will be four lobes. There will be two outside lobes and two inside lobes. The inside lobes can change based upon the differential gearing. The timing and duration can be set by oil pressure or by rotation of the differential gear.

In some configurations, a valve timing system including a camshaft and/or an auxiliary shaft may be configured to actuate one or more of the valve actuation systems. In some configurations, two valve timing systems including two camshafts and/or two auxiliary shafts may be configured to actuate one or more of the valve actuation systems. In some configurations, the camshafts/auxiliary shafts may be positioned primarily on the exhaust valve side of the valve systems. It is recognized that the position of the valve timing systems relative to the cylinders in FIGS. 13-29B are for illustrative purposes only and do not represent the proximity of the camshafts/auxiliary shafts relative to the valve actuation systems. While the camshafts/auxiliary shafts may be positioned on the exhaust valve side in some configurations, the valve timing systems may still be configured to actuate the intake valves. This arrangement may provide certain benefits in terms of intake valve geometry. For example, the intake manifolds can be substantially vertical, which may be preferable for a loop flow. A steep angle with a wide intake manifold (e.g., very ported) can be provided due to the camshafts/auxiliary shaft arrangement.

Scavenging

In some configurations, the internal combustion engine 100 can have a relatively large stroke volume per cylinder volume due to the lack of piston rocking, which allows for short piston skirts, and due to the lack of cylinder side wall intake or exhaust ports. Because of this relatively high stroke volume to cylinder volume ratio, and due to other geometric advantages from having the two crankshafts 112 alongside the cylinder bore 106 and crankshafts 112 with shorter throws (e.g., as opposed to one crankshaft with crank throws that are 50% of the stroke length below the cylinder), the combustion volume can be relatively large compared to the engine block size, as compared to typical engine designs. For example, in a four-stroke design, the combustion volume can be the same as or about the same as the full stroke volume. In a two-stroke design, the combustion volume can be less than the stroke volume, for example due to scavenging. In some configurations, a two-stroke design can be configured to use poppet valve to poppet valve flow. In some configurations, though not necessarily, the piston stroke can be smaller than the cylinder bore 106. In typical engines, scavenging can absorb about 12% to about 50% of the stroke volume, and typically from both expansion and compression strokes. For example, in a typical port to port or port to valve two-stroke engine, the port is partially open throughout at least part of the compression stroke and part of the expansion stroke. According to some configurations described herein, scavenging can occur entirely or almost entirely during one of the compression stroke or the expansion stroke. In some configurations, scavenging can occur during both of the expansion stroke and the compression stroke. In some configurations, scavenging can occur entirely or almost entirely at or near maximum compression and/or maximum expansion, for example, by controlling the timing and/or the duration of the opening of the intake valves 126 and/or the exhaust valves 132. This can have several advantages. For example, an engine can have continuously variable compression ratios (e.g., to optimize for higher power or higher efficiency). In some configurations, a compression ratio can be varied during operation. For example, when in an urban environment, the performance characteristics of the internal combustion engine 100 can be modified to optimize for reducing emission rates. In some configurations, the internal combustion engine 100 can be optimized to reduce particulates, soot, nitrous oxides, and/or other emissions.

Both incomplete scavenging and over scavenging can have negative effects on performance of internal combustion engines. For example, improper scavenging can contribute to reduced efficiency, can cause increased waste heat production, can result in increased particulate emission, and the buildup of combustion byproducts. If scavenging is incomplete, exhaust gases that remain behind can interfere with subsequent combustion cycles, which can lead to reduced power output, reduced efficiency, and so forth. Further, over scavenging can lead to inefficiency and increased particulate emissions.

Worm-Driven Valve Timing Adjustments

FIGS. 9-14 illustrate schematic cross-sectional views of various configurations of housings 402 for various valve timing systems 400. While a variety of configurations are illustrated in FIGS. 9-14, these configurations are examples only. The valve timing systems 400 can include housings 402 with different configurations. Any of the valve timing systems 400 may include any of the housings 402 illustrated in, and described in the context of, FIGS. 9-14 or any other suitable housings.

Figure 9:
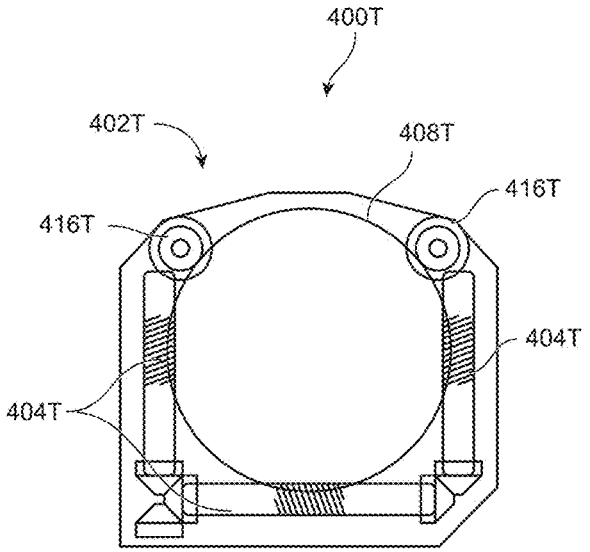
FIGS. 9-14 illustrate schematic section views of various configurations of housings for various valve timing systems.

FIG. 9 illustrates a cross-sectional view of a housing 402T that can be used with a valve timing control system 400T. The housing 402T may house a plurality of worm gears 404T, a ring gear 408T, and one or more locating bearings 416T. As described below with reference to FIG. 15, the plurality of worm gears 404T can be driven by a stepper motor (not shown), for example but without limitation. Other suitable actuators also can be used to move one or more of the worm gears 404T. Rotation of the plurality of worm gears 404T allows for fine tuning of duration and/or timing of one or more intake valve 126 and/or one or more exhaust valve 132.

The teeth of the ring gear 408T are engaged with the teeth of the worm gears 404T. The ring gear 408T may control various other gears and components within the housing 402T, as described below. The one or more locating bearings 416T may be configured to maintain the position of the ring gear 408T within the housing 402T. Generally, the desired number of locating bearings 416T depends at least in part upon the number of worm gears 404T in the system. In the configuration of FIG. 9, the housing 402T includes three worm gears 404T and two locating bearings 416T.

FIGS. 10-14 illustrate further schematic views of additional housings 402U, 402V, 402W, 402X, 402Y, respectively. Some of the features of the housings 402U, 402V, 402W, 402X, 402Y of FIGS. 10-14 are similar to features of the housing 402T of FIG. 9. Thus, reference numerals used to designate the various features or components of the housing 402T are those used for identifying the corresponding features of components of the housings of FIGS. 10-14, except that an "U", "V", "W", "X", or "Y" has been added to the numerical identifier. Therefore, the structure and description for the various features of the housing 402T and how the valve timing control system 400T is operated in FIG. 9 are understood to apply to the corresponding features of the housings 402U, 402V, 402W, 402X, 402Y of FIGS. 10-14, except as described below.

Figure 10:
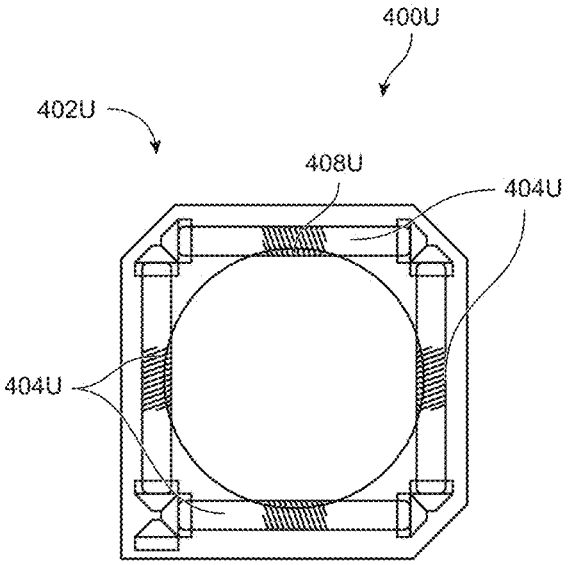

The housing 402U shown in FIG. 10 differs from the housing 402T shown in FIG. 9 in that the housing 402U houses four worm gears 404U. Additionally, the housing 402U does not include any locating bearings. Due to the meshing among the four worm gears 404U and the ring gear 408U, the locating bearings have been omitted.

Figure 11:
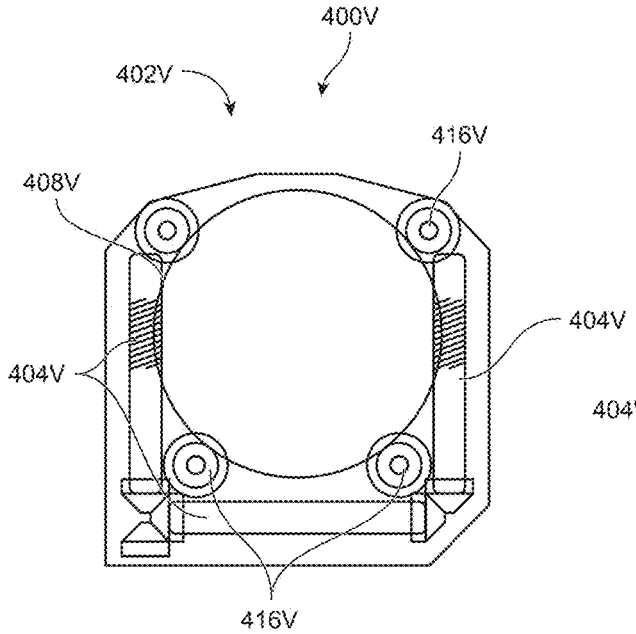

The housing 402V shown in FIG. 11 differs from the housing 402T shown in FIG. 9 in that the housing 402V shown in FIG. 11 houses four locating bearings 416V for two worm gears 404V that are engaged with the ring gear 408V. As illustrated, one of the elements identified as the worm gear 404V includes no teeth but merely couples the other two worm gears 404V to each other and, therefore, couple be considered a stub shaft. Because only two sides of the ring gear 408V are engaged by the worm gears 404V, four locating bearings 416V have been used.

Figure 12:
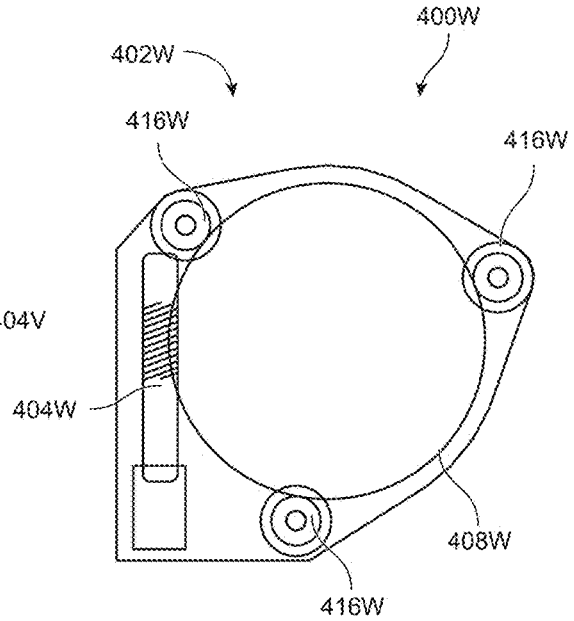

The housing 402W illustrated in FIG. 12 differs from the housing 402T illustrated in FIG. 9 in that the housing 402W houses only one worm gear 404W. Additionally, the housing 402W illustrated in FIG. 12 includes three locating bearings 416W.

Figure 13:
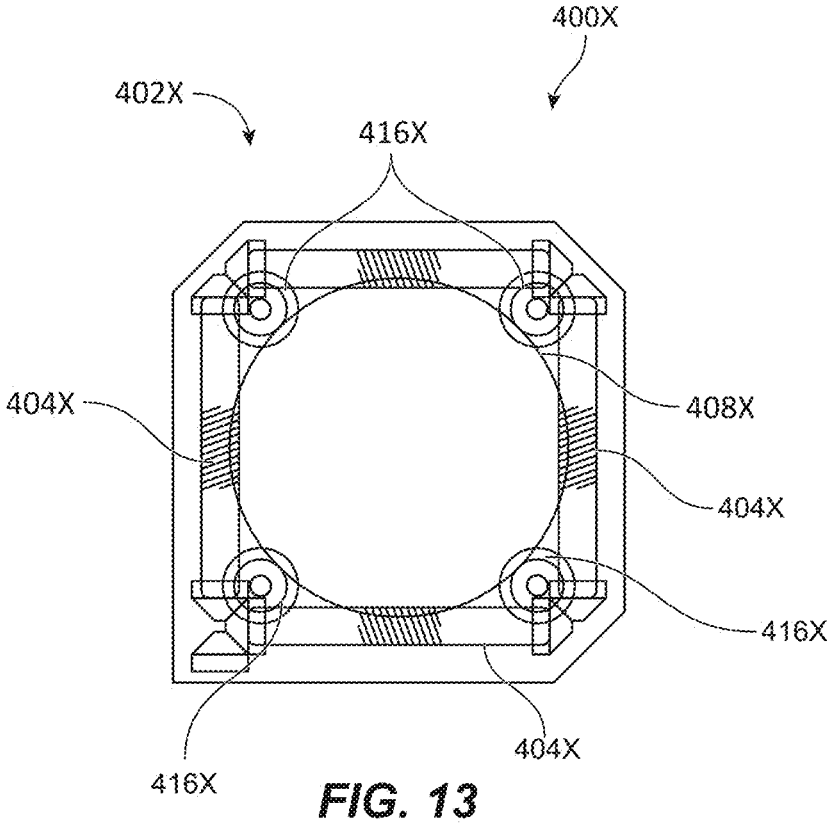

The housing 402X illustrated in FIG. 13 differs from the housing 402T illustrated in FIG. 9 in that the housing 402X houses four worm gears 404X. Additionally, the housing 402X illustrated in FIG. 13 differs from the housing 402U illustrated in FIG. 10 in that the housing 402X includes four locating bearings 416X.

Figure 14:
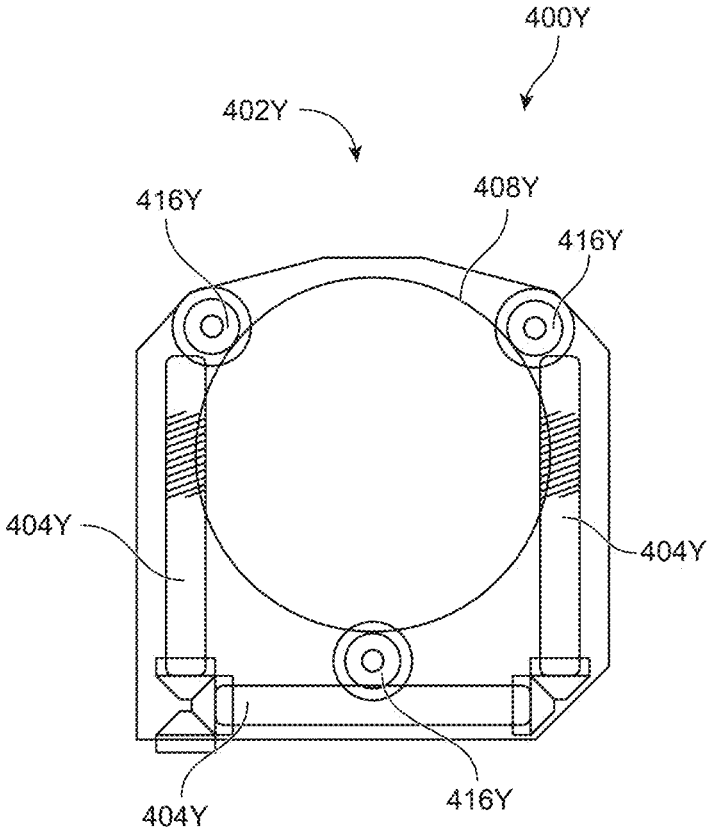

The housing 402Y illustrated in FIG. 14 differs from the housing 402T illustrated in FIG. 9 in that the housing 402Y comprises three locating bearings 416Y. In the illustrated configuration, the locating bearings 416Y define a triangle. In the illustrated configuration, the triangle pattern has an apex that intersects at least one of the three worm gears 404Y.

Figure 15:
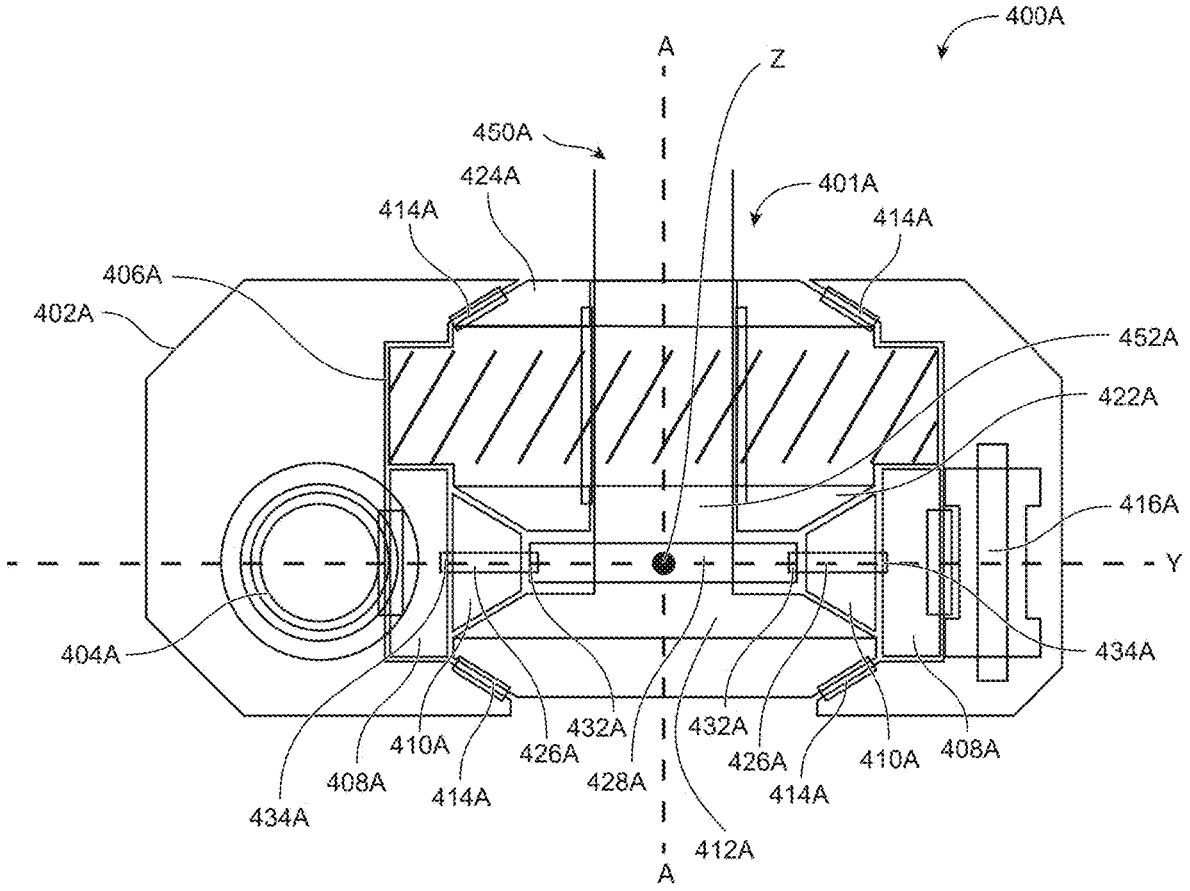
FIG. 15 illustrates a schematic section view of a housing of a valve timing system.
Figure 16:
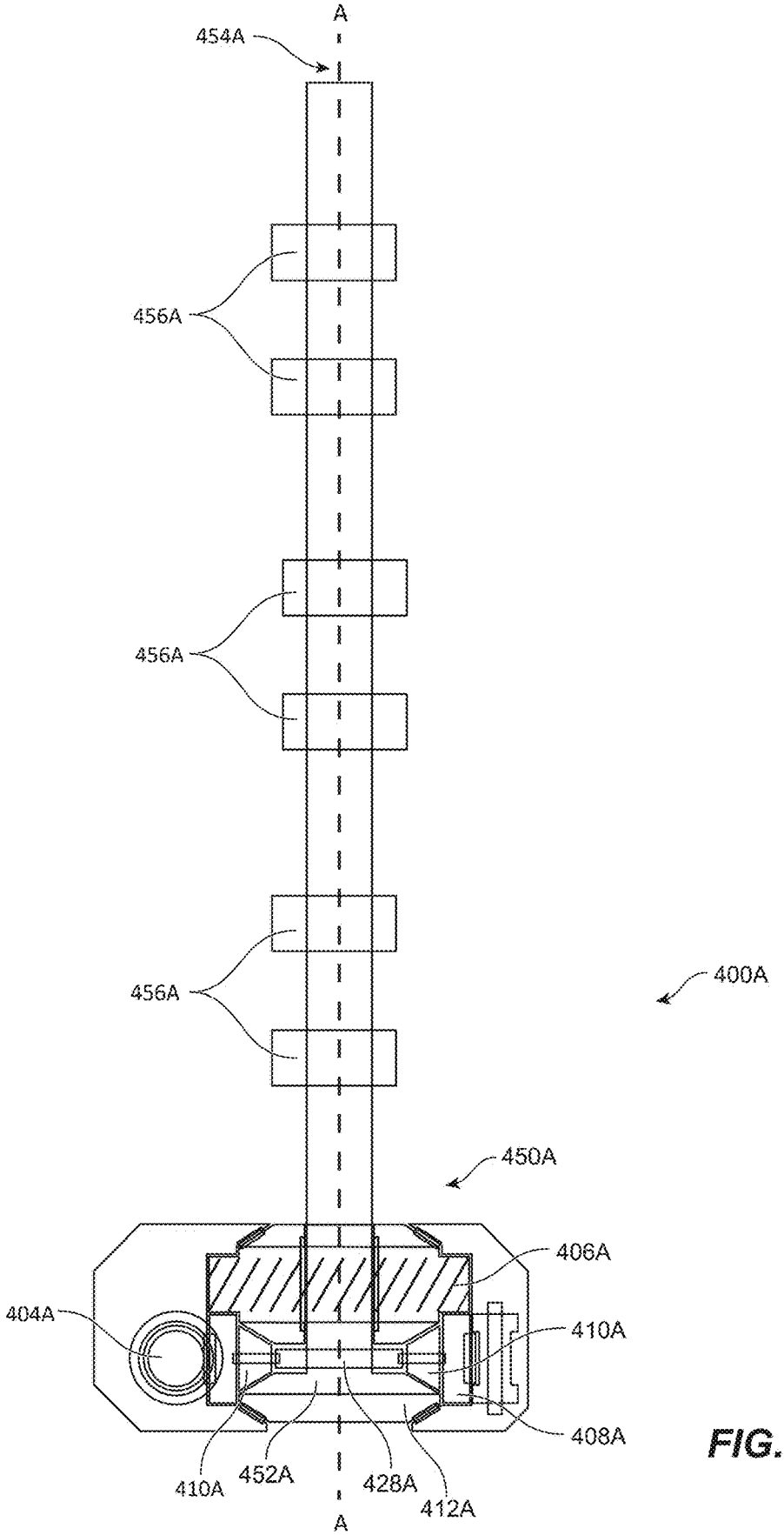
FIG. 16 illustrates the valve timing system of FIG. 15.

With reference now to FIG. 15, the housing 402A of the valve timing system 400A is illustrated in an enlarged schematic section view. In the illustrated configuration, the valve timing system 400A comprises the housing 402A and a camshaft 450A that extends outward from the housing 402A. FIG. 16 illustrates a schematic sectional view of the valve timing system 400A including the camshaft 450A. As discussed above, the housing 402A may house and support a differential assembly 401A (also referred to herein as a "differential gear set" or a "differential mechanism") that can include one or more of: the worm gears 404A, a drive gear 406A, the ring gear 408A, a plurality of planet gears 410A, a beveled gear 412A, a sun gear 428A, a plurality of roller thrust bearings 414A, and one or more locating bearings 416A.

With reference again to FIG. 15, the drive gear 406A may include a top beveled portion 422A and a bottom beveled portion 424A. The top beveled portion 422A and the bottom beveled portion 424A may be coupled to the drive gear 406A such that both the top beveled portion 422A and the bottom beveled portion 424A rotate with the drive gear 406A. Other suitable configurations also can be used.

The plurality of planet gears 410A may be beveled. Each planet gear 410A may include an axle 426A. The axle 426A may extend through the center of the planet gear 410A. Each axle 426A may include a first/internal end 432A and a second/external end 434A. The axles 426A are rotationally coupled to the planet gears 410A such that rotation of the planet gears 410A causes corresponding rotation of the axles 426A. In some configurations, the valve timing system 400A includes between two and four planet gears 410A. In the example illustrated in FIGS. 15 and 16, the valve timing system 400A includes four planet gears 410A (e.g., two planet gears 410A are not shown in FIG. 13). In a configuration where the valve timing system 400A includes four planet gears 410A, the planet gears 410A may be spaced 90 degrees offset from each other.

In the valve timing system 400A illustrated in FIGS. 15 and 16, the camshaft 450A may be coupled for rotation with the beveled gear 412A at a first end 452A, such that rotation of the beveled gear 412A causes corresponding rotation of the camshaft 450A. The camshaft 450A may extend through the drive gear 406A and the sun gear 428A, such that the drive gear 406A and the sun gear 428A rotate independently of the camshaft 450A. The sun gear 428A may also be positioned between the drive gear 406A and the beveled gear 412A, without engaging either the drive gear 406A or the beveled gear 412A. For example, the camshaft 450A may extend through the center of the sun gear 428A without contacting the sun gear 428A. One or both of the beveled gear 412A and the drive gear 406A may be supported by one or more roller thrust bearings 414A. The roller thrust bearings 414A may allow the gears 406A, 412A to rotate freely relative to the housing 402A. For example, in the configuration illustrated in FIG. 15, the drive gear 406A is supported by two or more roller thrust bearings 414A positioned between the beveled portion 424A of the drive gear 406A and the housing 402A. Similarly, the beveled gear 412A is supported by two or more roller thrust bearings 414A positioned between the beveled gear 412A and the housing 402A.

The plurality of planet gears 410A may be positioned between the drive gear 406A and the beveled gear 412A such that the teeth of the plurality of planet gears 410A engage with the teeth of the drive gear 406A and the teeth of the beveled gear 412A. The drive gear 406A and the beveled gear 412A are configured to rotate about an axis of rotation A. The axis of rotation A extends through the central axis of the camshaft 450A from the first end 452A to the second end 454A (see e.g., FIG. 16). Each of the plurality of planet gears 410A are also configured to rotate about the axis of rotation A. Additionally, each planet gear 410A rotates about a planet axis of rotation. The planet axes of rotation extend through the center of the axles 426A. For example, in FIG. 15, the two illustrated planet gears 410A have a planet axis of rotation Y that extends from left to right when the two illustrated planet gears 410A are in the position about the axis of rotation A illustrated in FIG. 15. Similarly, the two planet gears 410A not shown may be 90 degrees offset from the illustrated planet gears 410A about the axis of rotation A, such that planet gears 410A not shown rotate about a planet axis of rotation Z that extends directly into the page when the planet gears 410A not shown are in the 90 degree offset position.

The internal end 432A of each plant gear 410A may be coupled to the sun gear 428A. The sun gear 428A may be rotationally coupled to the plurality of planet gears 410A about the axis of rotation A such that rotation of the plurality of planet gears 410A about the axis of rotation A causes corresponding rotation of the sun gear 428A about the axis of rotation A. However, the sun gear 428A may not be rotationally coupled to the plurality of planet gears 410A about the planet axes of rotation Y, Z. In other words, the plurality of planet gears 410A can freely rotate about the planet axes of rotation Y, Z without causing rotation of the sun gear 428A.

The ring gear 408A may extend around the plurality of planet gears 410A in the same plane as the plurality of planet gears 410A. The one or more locating bearings 416A may be configured to maintain the position of the ring gear 408A. As discussed above, the teeth of the ring gear 408A are engaged with the teeth of the worm gear 404A. The external ends 434A of each axle 426A of the planet gears 410A may be coupled to the ring gear 408A. For example, in the configuration illustrated in FIG. 15, the ring gear 408A is coupled to the four planet gears 410A using the axles 426A. The ring gear 408A may be rotationally coupled to the plurality of planet gears 410A about the axis of rotation A such that rotation of the plurality of planet gears 410A about the axis of rotation A causes corresponding rotation of the ring gear 408A about the axis of rotation A. The ring gear 408A is coaxial with the sun gear 428A. Like the sun gear 428A, the ring gear 408A may not be rotationally coupled to the plurality of planet gears 410A about the planet axes of rotation Y, Z. That is, the plurality of planet gears 410A can freely rotate about the planet axes of rotation Y, Z without causing rotation of the ring gear 408A.

As noted above, FIG. 16 illustrates both the housing 402A and the camshaft 450A of the valve timing system 400A. The camshaft 450A may include a plurality of lobes 456A. Each lobe 456A may be configured to control the opening and closing of at least one valve 126, 132 in the combustion chamber 104 using another system, such as a cam follower system or a pushrod system. The operation of such systems to control the valves 126, 132 is described below. In the arrangement schematically illustrated in FIG. 16, the camshaft 450A has six lobes 456A. Depending on the particular arrangement of the valve actuation system, the six lobes 456A may be configured to control six or twelve valves 126, 132 in the six-cylinder internal combustion engine 100. For example, in some configurations, each lobe 456A controls either one exhaust valve 132 or one intake valve 126. In another configuration, each lobe 456A controls one exhaust valve 132 and one intake valve 126. It is recognized that the number of lobes 456A in the configuration illustrated in FIG. 16 is in part dependent on the number of cylinders in the internal combustion engine 100 as well as the valve actuation system used, and the valve timing system 400A may include more or less lobes 456A. For example, a single lobe (e.g., lobe 456A) can be used to actuate either one, two, or four valves per cylinder. In a configuration where the valve timing system 400 includes three lobes 456A, each lobe 456A may control two exhaust valves 132 and two intake valves 126 for each cylinder. For example, the valve actuation system illustrated in FIG. 51 may be used. The camshaft and the lobe relationship is described further herein with reference to FIGS. 19-28.

In the valve timing system 400A illustrated in FIG. 16, movement of the drive gear 406A drives the plurality of planet gears 410A. The plurality of planet gears 410A in turn drive the beveled gear 412A. In other words, the plurality of planet gears 410A act as transfer gears between the drive gear 406A and the beveled gear 412A. For example, the drive gear 406A rotates about the axis of rotation A and may be driven by another system in the internal combustion engine 100. In some examples, the drive gear 406A may be driven by a flywheel of a crankshaft 112 associated with one or more of the cylinder bores 106. As the drive gear 406A rotates about the axis of rotation A, the teeth of the drive gear 406A engage with the teeth of the plurality of planet gears 410A, causing the plurality of planet gears 410A to rotate about the planet axes of rotation Y, Z. Similarly, the teeth of the plurality of planet gears 410A engage the teeth of the beveled gear 412A, such that rotation of the plurality of planet gears 410A causes rotation of the beveled gear 412A about the axis of rotation A. Because of the arrangement of the gears within the valve timing system 400A, the drive gear 406A rotates in a first direction and the beveled gear 412A rotates in a second opposite direction. For example, when the drive gear 406A rotates clockwise about the axis of rotation A, the beveled gear 412A rotates counterclockwise, and vice versa. Similarly, planet gears 410A that are spaced on opposite ends of the housing 402A rotate in opposite directions about the respective planet axes Y, Z. For example, in FIG. 15, the planet gear 410A on the left side rotates in a first direction and the planet gear 410A on the right side rotates in a second opposite direction about the planet axis of rotation Y.

With reference to FIG. 16, because the beveled gear 412A is coupled to the camshaft 450A, rotation of the beveled gear 412A about the axis of rotation A causes the camshaft 450A to rotate about the axis of rotation A, which in turn changes the position of the noses of the plurality of lobes 456A, which are used to open and close the valves 126, 132 of the combustion chambers 104 of the internal combustion engine 100. The axial positions of the plurality of lobes 456A may be fixed relative to the camshaft 450A between the first end 452A and the second end 454A. The plurality of lobes 456A also may be rotationally fixed to the camshaft 450A such that plurality of lobes 456A rotate with the camshaft 450A about the axis of rotation A.

In the configuration illustrated in at least FIGS. 15 and 16, the valve timing system 400A may be configured to adjust the valve timing. Valve timing, as the term is used herein, refers to the time at which the valve 126, 132 opens and closes relative to the position of the piston 110 of the internal combustion engine 100. In other words, valve timing reflects the relative angular position between the crankshaft 112 and the camshaft 450 (because the lobes 456*a* are fixed against rotation relative to the camshaft 450). For example, when the drive gear 406A is driven by the crankshaft 112 of the internal combustion engine 100 (e.g., using the flywheel), the orientation of the plurality of lobes 456A (and the corresponding angular orientation of the camshaft 450A) relative to the orientation of the crankshaft 112 will determine when each valve 126, 132 opens and closes.

To adjust the valve timing, the worm gear 404A may be driven by a worm gear drive system (e.g., a motor), which in turn causes the ring gear 408A to rotate about the axis of rotation A. Because the plurality of planet gears 410A are coupled to the ring gear 408A, rotation of the ring gear 408A about the axis of rotation A causes corresponding rotation of the plurality of planet gears 410A about the axis of rotation A. Further, rotation of the planet gears 410A causes corresponding rotation of the beveled gear 412A and the attached camshaft 450A about the axis of rotation A in a first direction. Similarly, rotation of the planet gears 410A causes corresponding rotation of the drive gear 406A in a second direction opposite the first direction. For example, the plurality of planet gears 410A may rotate about the planet axes of rotation Y, Z while the ring gear 408A rotates about the axis of rotation A, while causing rotation of the beveled gear 412A about the axis of rotation A in the first direction and causing rotation of the drive gear 406A about the axis of rotation A in the second direction. By adjusting the angular position about the axis of rotation A of the beveled gear 412A and the camshaft 450A relative to the drive gear 406A, the position of the noses of the plurality of lobes 456A are adjusted relative to the crankshaft 112. As a result, the timing of the opening and closing of the valves 126, 132 is changed relative to the angular orientation of the crankshaft 112.

In the valve timing system 400A illustrated in FIGS. 15 and 16, the magnitude of the angular offset between the beveled gear 412A and the drive gear 406A is controlled by the worm gear 404A. For example, minimal rotation of the worm gear 404A causes a corresponding minimal angular offset between the drive gear 406A and the beveled gear 412A. Similarly, further rotation of the worm gear 404A creates a corresponding increase in angular offset between the drive gear 406A and the bevel gear 412A. Changing the valve timing may provide advantages of increasing the amount of control a user has over the operation of the internal combustion engine 100. For example, the user may change the valve timing to increase the efficiency of the internal combustion engine 100. In some examples, the valve timing can be adjusted when the internal combustion engine 100 is running), which may allow the user to adjust the valve timing for different operating conditions of the engine.

Figure 17:
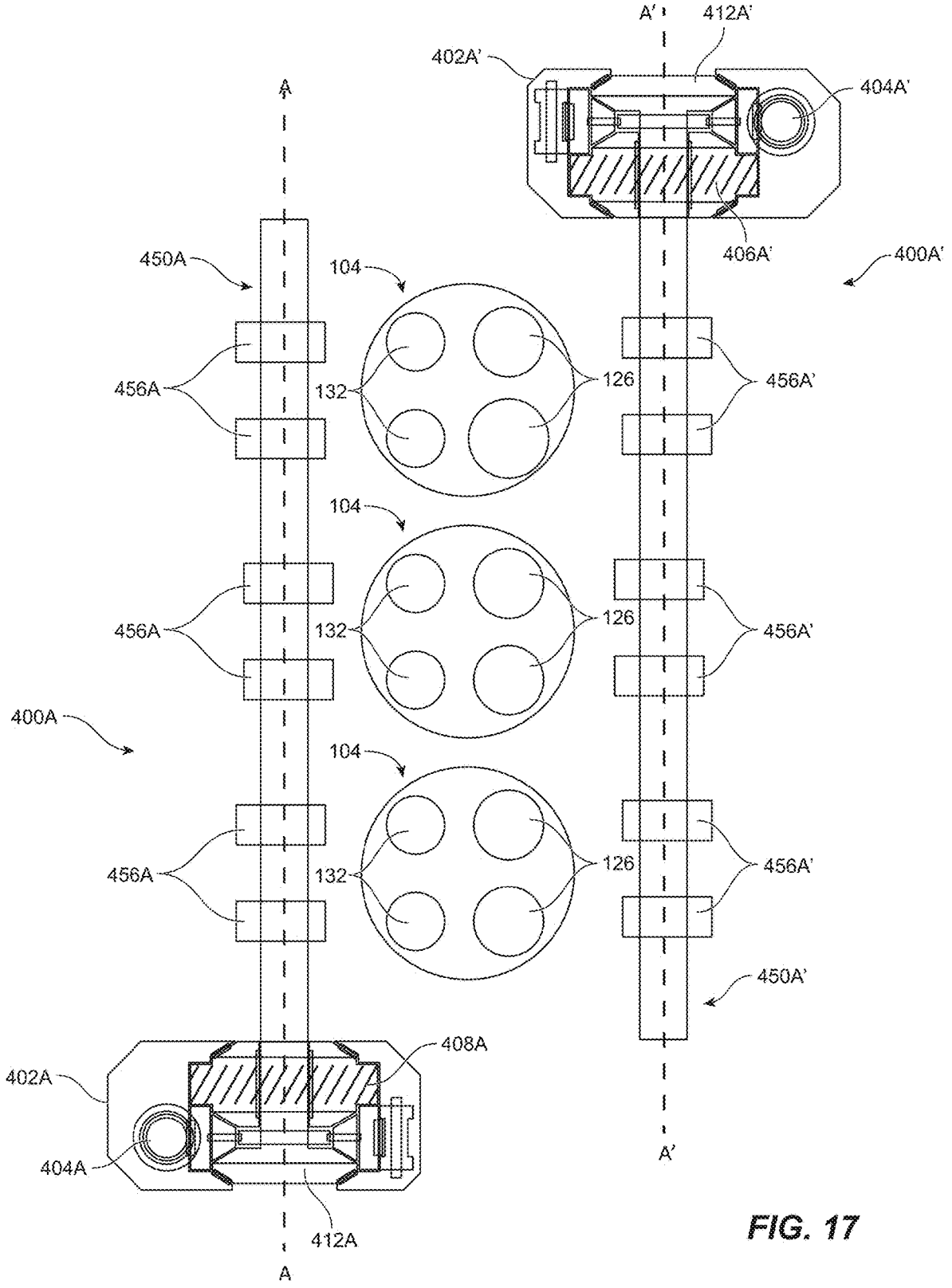
FIG. 17 illustrates two of the valve timing systems of FIG. 15 arranged around three schematically illustrated combustion chambers.

FIG. 17 illustrates two valve timing systems. The two valve timing systems 400A and the valve timing system 400A' operate in parallel. Both of the valve timing systems 400A, 400A' are positioned relative to three schematically illustrated engine combustion chambers 104. The valve timing system 400A' may include all of the components described above in the context of the valve timing system 400A illustrated in FIGS. 15 and 16. The valve timing system 400A' may operate in a similar or identical manner as the valve timing system 400A illustrated in FIGS. 15 and 16. Thus, reference numerals used to designate the various features or components of the valve timing system 400A are identical to those used for identifying the corresponding features of components of the valve timing system 400A' in FIGS. 15 and 16, except that a "prime" has been added to the numerical identifier.

With reference to FIG. 17, each illustrated combustion chamber 104 comprises two exhaust valves 132 and two intake valves 126. In one example, the valve timing system 400A on the left may be configured to control the opening and closing of the exhaust valves 132, while the valve timing system 400A' on the right may be configured to control the opening and closing of the intake valves 126. In this configuration, the valve timing of the exhaust valves 132 can be independent of the valve timing of the intake valves 126. Further, because each lobe 456A of the plurality of lobes 456A is configured to control the valve timing on an individual exhaust valve 132, the valve timing of each exhaust valve 132 can be altered by changing the angular position of the lobe 456A relative to the angular position of the camshaft 450A. Similarly, because each lobe 456A' of the plurality of lobes 456A' is configured to control the valve timing on one intake valve 126, the valve timing of each intake valve 126 can be altered by changing the angular position of the lobe 456A' relative to the angular position of the camshaft 450A'.

The number of lobes 456A, 456A' is in part dependent on the number of engine cylinder bores 106 included in the internal combustion engine 100. For example, in FIG. 17, three cylinder bores 106 are included, indicating that the engine likely would be a six-cylinder internal combustion engine 100. As such, the six-cylinder internal combustion engine 100 may include four valve timing systems 400, which would include a pair of each of the valve timing systems 400A, 400A'. In a two-cylinder internal combustion engine 100, each of the valve timing systems 400 may include two lobes 456A. In a four-cylinder internal combustion engine 100, each of the valve timing systems 400 may include four lobes 456A. In an eight-cylinder internal combustion engine 100, each of the valve timing systems 400 may include eight lobes 456A. However, these configurations are used when each lobe 456A actuates a single intake valve 126 or a single exhaust valve 132. In configurations where a single lobe 456A actuates multiple intake valves 126 or multiple exhaust valves 132, less lobes 456A may be included in each valve timing system 400.

Figure 18:
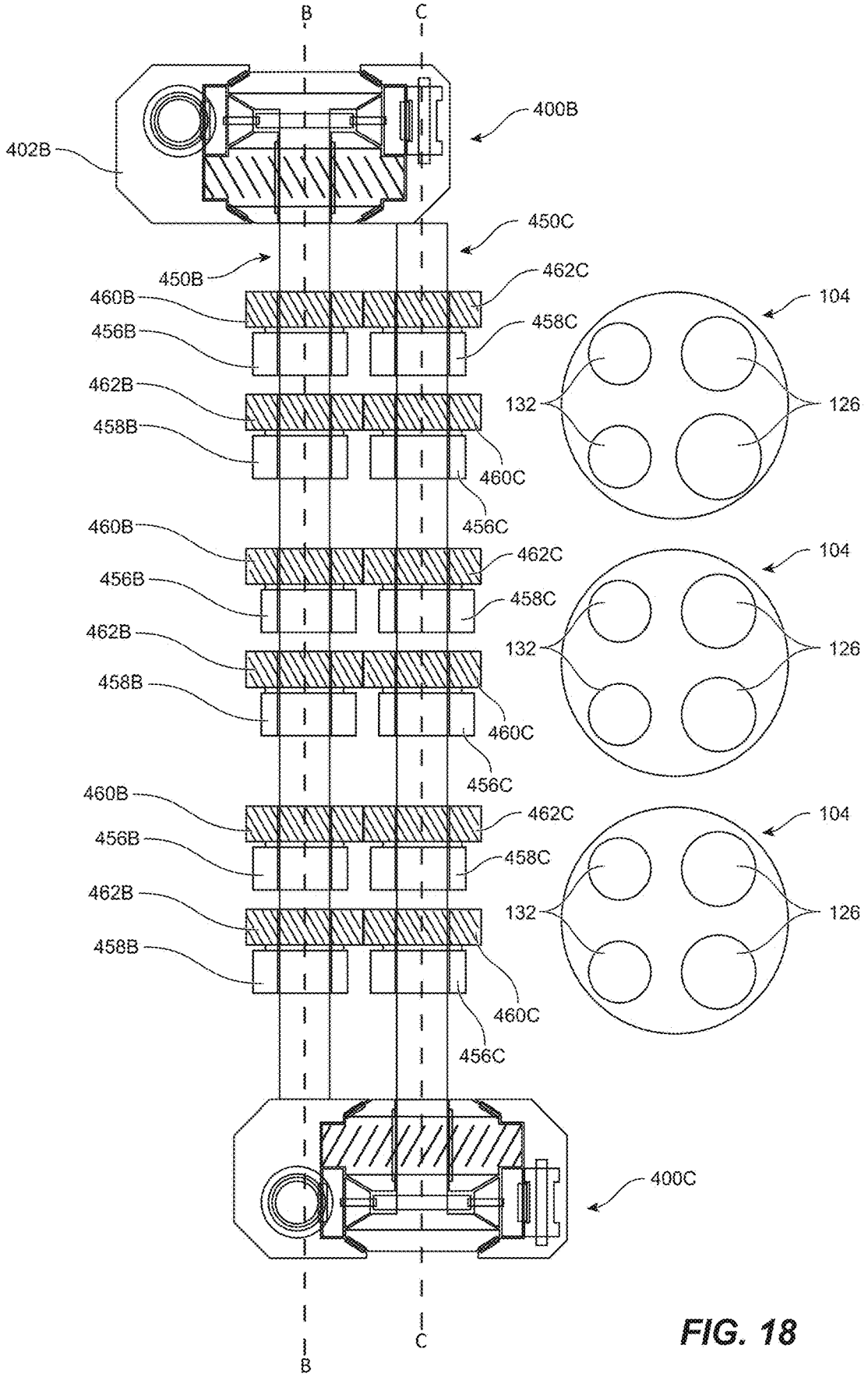
FIG. 18 illustrates a schematic section view of two valve timing systems of FIG. 15 arranged around three schematically illustrated combustion chambers.

FIG. 18 illustrates a cross-sectional view of a configuration of a first valve timing system 400B and a second valve timing system 400C. Both of the first valve timing system 400B and the second valve timing system 400C are positioned relative to three schematically illustrated combustion chambers 104. Both of the first valve timing system 400B and the second valve timing system 400C may include all of the components of the valve timing system 400A discussed above. Both of the first valve timing system 400B and the second valve timing system 400C may operate in a similar or identical manner to the valve timing system 400A discussed above. Specifically, the first valve timing system 400B includes a first housing 402B and the second valve timing system 400C includes a second housing 402C. The first housing 402B and the second housing 402C operate in the same manner as the housing 402A discussed above. Thus, reference numerals used to designate the various features or components of the valve timing system 400A are identical to those used for identifying the corresponding features of components of the first valve timing system 400B and the second valve timing system 400C illustrated in FIG. 18, except that a "B" and a "C" respectively have been added to the numerical identifiers. Therefore, the structure and description for the various features of the valve timing system 400A and how the valve timing system 400A is operated in FIGS. 15-17 are understood to also apply to the corresponding features of the first valve timing system 400B and the second valve timing system 400C illustrated in FIG. 18. However, each of the first valve timing system 400B and the second valve timing system 400C has a different camshaft and lobe arrangement, as well as other differences, which will be described below.

The first valve timing system 400B may include a plurality of fixed lobes 456B, a plurality of free lobes 458B, a plurality of fixed cam gears 460B, and a plurality of free cam gears 462B. Each of the plurality of fixed lobes 456B and each of the plurality of free lobes 458B may be configured to control the opening and closing of one or more of the exhaust valves 132 in the combustion chamber 104 using another system, such as a cam follower system or a pushrod system, for example but without limitation. In the configuration illustrated in FIG. 18, the camshaft 450B has three fixed lobes 456B and three free lobes 458B to control six of the exhaust valves 132 in the six-cylinder internal combustion engine 100. Similarly, the camshaft 450C has three fixed cam gears 460C and three free cam gears 462C to control six of the intake valves 126 in a six-cylinder engine. It is recognized that the number of fixed lobes 456B, the number of free lobes 458B, the number of fixed cam gears 460B, and the number of free cam gears 462B in the configuration illustrated in FIG. 18 is dependent on the number of cylinder bores 106 in the internal combustion engine 100 and the valve timing system 400B may include more or less of any or all of these components.

The fixed cam gears 460B may be rotationally coupled to the camshaft 450B such that rotation of the camshaft 450B about an axis of rotation B causes a corresponding rotation of the fixed cam gears 460B about the axis of rotation B. The fixed lobes 456B may be fixed to either the camshaft 450B or to the fixed cam gears 460B or both. In one example, the fixed lobes 456B are coupled to the fixed cam gears 460B by one or more dowel pins (not shown). In some configurations, the fixed lobes 456B can be fixed to the camshaft 450B directly using dowel pins or the like. See, for example, FIG. 30, which configuration of the valve timing system 400D illustrates the use of dowel pins 464D to join the fixed lobes 456D to the camshafts 450D. Regardless of the technique used, the fixed lobes 456B can be coupled to rotate with the camshaft 450B. Other methods can be used to secure the fixed lobes 456B and/or the fixed cam gears 460B to the camshaft 450B. As will be described, FIGS. 20-28 illustrate an alternative method of fixing lobes and gears to a camshaft that can be used in any of the valve timing systems 400.

Figure 19:
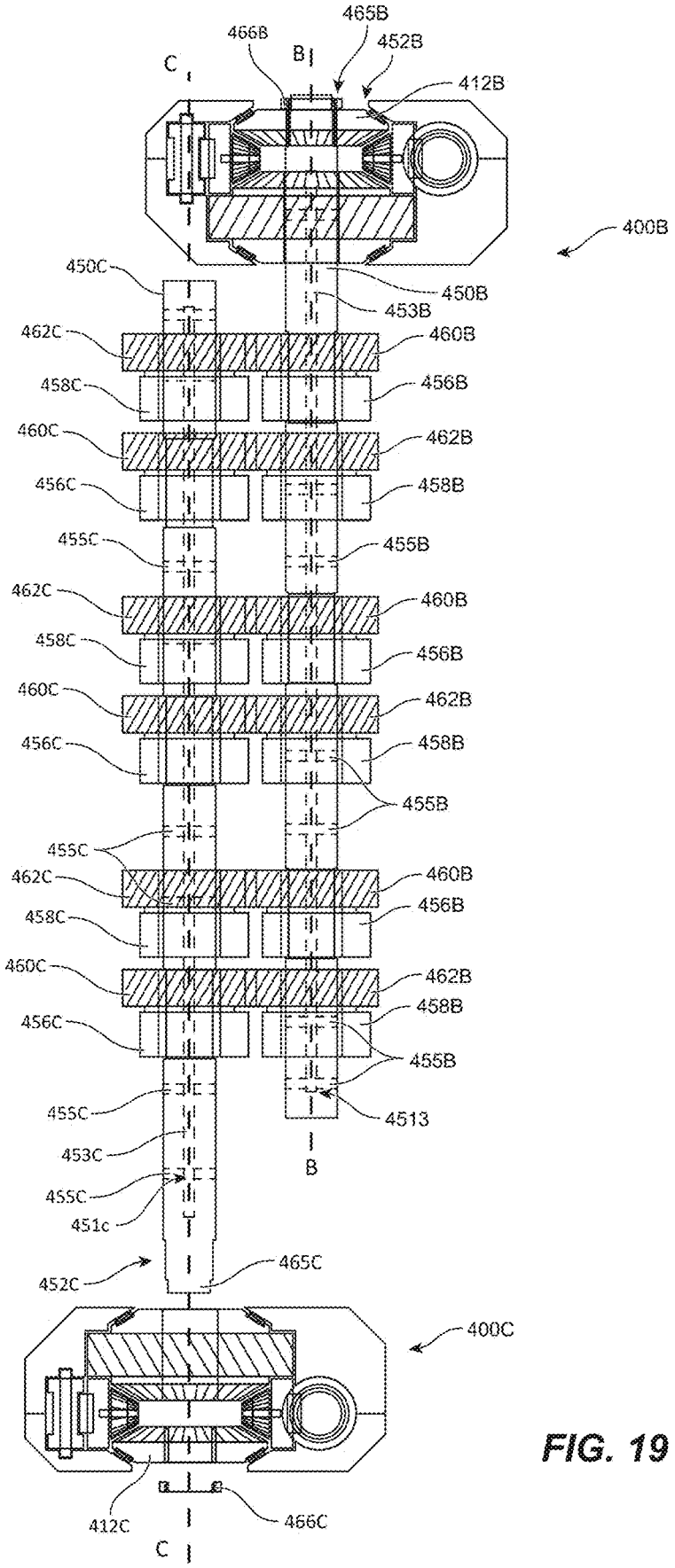
FIGS. 19-28 illustrate various components that can be used in a valve timing system.

With reference still to FIGS. 18 and 19, the free cam gears 462B are not coupled to the camshaft 450B against rotation. In other words, rotation of the camshaft 450B does not cause rotation of the free cam gears 462B. In one example, the free cam gears 462B may be milled such that the camshaft 450B may freely rotate within and extend through the free cam gears 462B. In one example, the free lobes 458B may be milled such that the camshaft 450B may freely rotate within and extend through the free lobes 458B. The free lobes 458B may be coupled to the free cam gears 462B. Any suitable technique can be used to secure the free lobes 458B to the free cam gears 462B. As a result of this arrangement, the free lobes 458B are coupled to rotate with the free cam gears 462B.

Like the valve timing system 400B illustrated in FIG. 18, the valve timing system 400C may include a plurality of fixed lobes 456C, a plurality of free lobes 458C, a plurality of fixed cam gears 460C, and a plurality of free cam gears 462B. The plurality of fixed lobes 456C, the plurality of free lobes 458C, the plurality of fixed cam gears 460C, and the plurality of free cam gears 462C are arranged in the same manner relative to the camshaft 450C as the plurality of fixed lobes 456B, the plurality of free lobes 458B, the plurality of fixed cam gears 460B, and the plurality of free cam gears 462B with respect to the camshaft 450B. Additionally, each of the plurality of fixed lobes 456C and each of the plurality of free lobes 458C may be configured to control the opening and closing of the intake valves 126 and/or the exhaust valves 132 in the combustion chamber 104 using another system, such as a cam follower system or pushrod system, for example but without limitation. For example, as illustrated in the configuration shown in FIG. 18, the camshaft 450C has three fixed lobes 456C and three free lobes 458C to control six of the intake valves 126 in the six-cylinder internal combustion engine 100. Similarly, the camshaft 450C has the three fixed cam gears 460C and the three free cam gears 462C.

With reference still to FIG. 18, the valve timing system 400B and the valve timing system 400C may be arranged with the housing 402B and the housing 402C at opposite ends of the camshafts 450B, 450C. The camshaft 450B extends parallel to the camshaft 450C. In this arrangement, the fixed cam gears 460B of the first camshaft 450B may mesh with and drive the free cam gears 462B of the second camshaft 450C. Similarly, the fixed cam gears 460C of the second camshaft 450C may mesh with and drive the free cam gears 462B of the first camshaft 450B. As such, the first valve timing system 400B controls the rotation of the fixed lobes 456B of the first camshaft 450B and the free lobes 458C, while the second valve timing system 400C controls the rotation of the fixed lobes 456C and the free lobes 458B. As shown in FIG. 18, this arrangement allows both the first valve timing system 400B and the second valve timing system 400C to each control the valve timing of half of the intake valves 126 and half of the exhaust valves 132. For example, in the configuration illustrated in FIG. 18, the first valve timing system 400B controls the top exhaust valves 132 and the top intake valves 126 in each combustion chamber 104 while the second valve timing system 400C controls the bottom exhaust valves 132 and the bottom intake valves 126 in each combustion chamber 104. It is recognized that top and bottom refer to the positions of the intake valves 126 and the exhaust valves 132 in the orientation of FIG. 18, not the actual orientation in the internal combustion engine 100.

Like the valve timing system 400A illustrated in FIG. 15-17, in the first valve timing system 400B and the second valve timing system 400C, the valve timing can be adjusted by driving respectively the first worm gear 404B and the second worm gear 404C using a worm gear drive system (e.g., causing the first ring gear 408B and the second ring gear 408C to rotate about the axes of rotation B and C respectively). The configuration of FIG. 18 provides certain benefits in terms of at least valve timing and valve duration control. Valve duration, as the term is used herein, refers to the amount of time that a valve remains open or closed.

In the example of FIG. 18, the valve timing of each exhaust valve 132 and each intake valve 126 in a single combustion chamber 104 can be changed independently (e.g., by rotating the first worm gear 404B and the second worm gear 404C different amounts). This independent adjustment results in the intake valve duration and exhaust valve duration in a single engine combustion chamber 104 being altered. For example, one exhaust valve 132 can be opened ahead of another exhaust valve 132 in a single combustion chamber 104, extending the duration/length of time the exhaust valves 132 as a group are open. Similarly, one intake valve 126 can be opened ahead of another intake valve 126 in a single combustion chamber 104, extending the duration/length of time the intake valves 126 as a group are open.

Another benefit of the configuration of FIG. 18 is that the first camshaft 450B and the second camshaft 450C can be rotated at different speeds, which also allows for control on the valve timing.

With reference now to FIGS. 19-28, various components are illustrated that can be used in any of the valve timing systems 400. For ease of reference, like numbers will refer to like components. It is recognized that while the arrangements of the components in the valve timing systems 400 may differ from those shown in FIGS. 19-28, the same components can be used in any valve timing system 400.

FIG. 19 illustrates the first valve timing system 400B and the second valve timing system 400C. FIG. 19 illustrates an example system of securing the camshaft 450B to the beveled gear 412B and the camshaft 450C to the beveled gear 412C. For example, with reference to the valve timing system 400C, the camshaft 450C may include a step down in diameter near the first end 452C of the camshaft 450C. The step down in diameter of the camshaft 450C is received within the beveled gear 412C. The first end 452C of the camshaft 450C may extend through the center of the beveled gear 412C. In some configurations, there may be an interference fit between the beveled gear 412C and the camshaft 450C.

The camshaft 450C may also include a threaded portion 465C at the first end 452C. The threaded portion 465C may be tapered. The threaded portion 465C is configured to interface with a captive nut 466C. Once the second beveled gear 412C is positioned on the first end 452C of the camshaft 450C, the captive nut 466C may be threaded on the threaded portion 465C to secure the position of the beveled gear 412C on the camshaft 450C. The first end 452C of the second camshaft 450C can comprise one or more splines to join the second camshaft 450C to the second beveled gear 412C. The splines operate to secure the second beveled gear 412C to the second camshaft 450C such that that the two components rotate together.

In the first valve timing system 400B, the first beveled gear 412B is illustrated in an assembled configuration where the first beveled gear 412B is fixed to the first end 452B of the camshaft 450B with the captive nut 466B engaged with the threaded portion 465B and the first bevel gear 412B engaged with splines of the first end 452B of the first camshaft 450B.

FIG. 19 also illustrates example oil passages that can be included in any of the camshafts 450. For example, the second camshaft 450C includes a second oil passage system 451C and the first camshaft 450B includes a first oil passage system 451B. The second oil passage system 451C may include a second primary oil passage 453C and a plurality of second secondary oil passages 455C. The plurality of second secondary oil passages 455C are fed by the second primary oil passage 453C. Similarly, the first oil passage system 451B may include a first primary oil passage 453B and a plurality of first secondary oil passages 455B. The plurality of first secondary oil passages 455B are fed by the first primary oil passage 453B.

The second primary oil passage 453C may extend along the axis of rotation C of the second camshaft 450C. The second primary oil passage 453C may extend along all or a portion of the length of the second camshaft 450C. For example, the second primary oil passage 453C may extend between 50% and 100% (e.g., between 50% and 100%, between 60% and 90%, between 70% and 80%, or any values between the foregoing ranges) along the length of second camshaft 450C. The plurality of second secondary oil passages 455C are connected to the second primary oil passage 453C. The plurality of second secondary oil passages 455C extend across a width or a diameter of the camshaft 450C. The plurality of second secondary oil passages 455C may be perpendicular to the second primary oil passage 453C. The location of the second secondary oil passages 455C may be adjusted along the length of the second camshaft 450C, depending on a number of factors. In some configurations, a second secondary oil passage 455C may be beneath one or more of the free lobes 458C. Positioning a second secondary oil passage 455C beneath the free lobe 458C may provide a benefit of providing a direct source of lubricant to the free lobes 458C such that the free lobes 458C can freely rotate about the second camshaft 450C as desired. In some configurations, one or more second secondary oil passages 455C may be positioned beneath one or more of the fixed lobes 456C. The first oil passage system 451B functions in the same manner as the second oil passage system 451C. The first oil passage system 451B includes a first primary oil passage 453B and a plurality of first secondary oil passages 455B.

Figure 20:
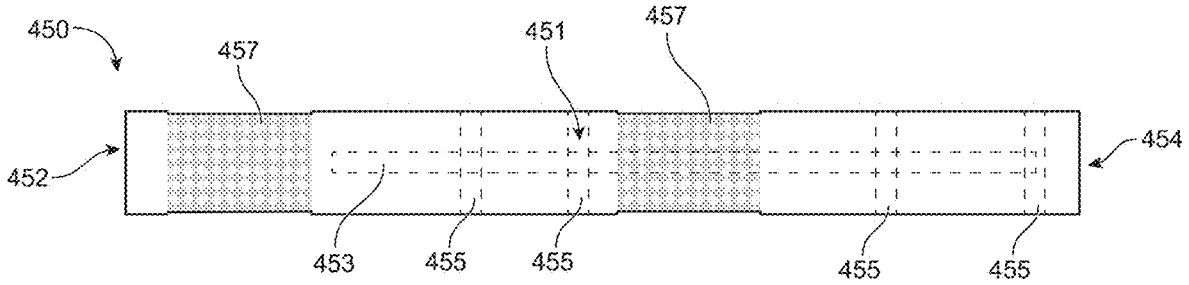
Figure 28:
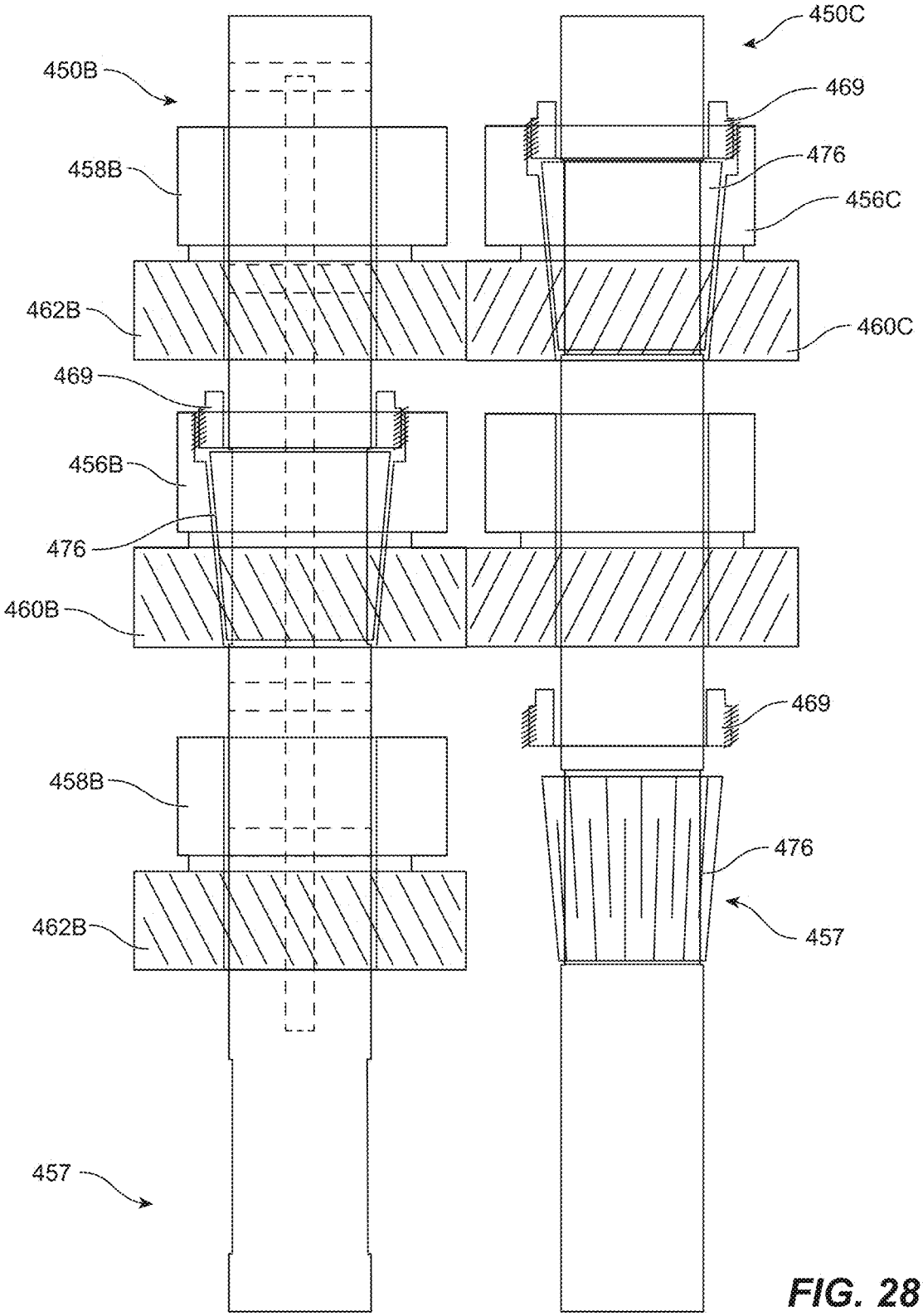

FIG. 20 illustrates a configuration of the camshaft 450. The camshaft 450 may represent any of the camshafts (e.g., camshaft 450A, camshaft 450B, camshaft 450C, etc.). As shown, the camshaft 450 includes an oil passage system 451. Like the oil passage system 451C that is described with reference to FIG. 19, the oil passage system 451 include a primary oil passage 453 and a plurality of secondary oil passages 455. The camshaft 450 may also include a plurality of mounting surfaces 457. When assembling the camshaft 450, at least a portion of the fixed cam lobes 456 (see FIG. 21) and the fixed cam gears 460 (see FIG. 21) may be positioned over the mounting surfaces 457, as illustrated in FIG. 28. The plurality of mounting surfaces 457 may be comprise a knurled or otherwise roughened surface to assist with securing the various cam gears and cam lobes in place. Conversely, the majority of the outer surface of the camshaft 450 may be a smooth bearing surface. Having a smooth bearing surface may allow the free lobes 458 (see FIG. 22) to rotate about the outer surface of the camshaft 450 with less resistance. As shown in FIG. 20, the plurality of secondary oil passages 455 may not be positioned at the locations of the mounting surfaces 457 as lubricant may not be desirable at these locations.

Figure 21:
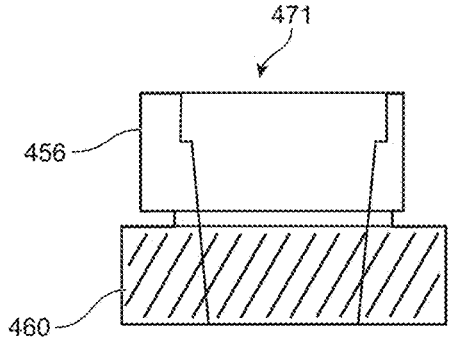
Figure 22:
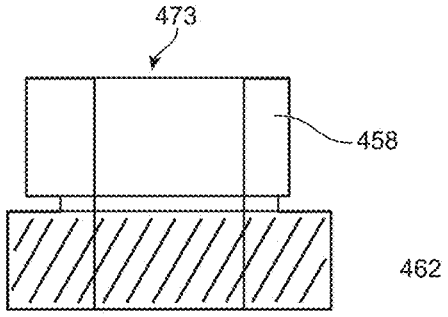

FIG. 21 illustrates a configuration of a fixed cam lobe 456 and a fixed cam gear 460. FIG. 22 illustrates configurations of a free lobe 458 and a free cam gear 462. The fixed cam lobe 456 may be coupled to, or integrally formed with, the fixed cam gear 460 such that the two components rotate together as desired. The fixed cam lobe 456 and the fixed cam gear 460 can include a tapered through hole 471. Similarly, the free lobe 458 may be coupled to, or integrally formed with, the free cam gear 462 such that the two components rotate together as desired. The free cam gear 462 and lobe 458 can include a cylindrical through hole 473 for mounting the free cam gear 462 and the lobe 458 on the camshaft 450.

The fixed cam lobe 456 and the fixed cam gear 460 may be secured to the camshaft 450 using any suitable technique. With reference to FIG. 21, in some configurations, the fixed cam gear 460 and the fixed cam lobe 456 may include the tapered through hole 471. The tapered through hole 471 may be configured to receive a collet 476 such as the collet 476 that is illustrated in FIGS. 23 and 24, or a collet 476' such as the collet 476' illustrated in FIGS. 25 and 26, or a collet 476" such as the collet 476" illustrated in FIG. 27.

Figure 23:
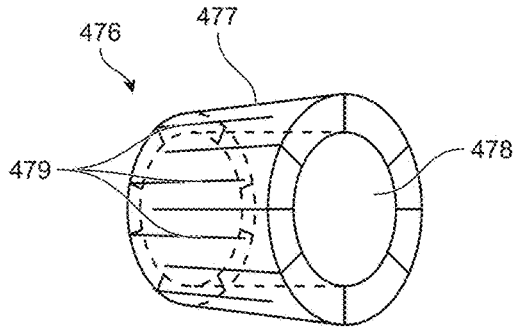
Figure 24:
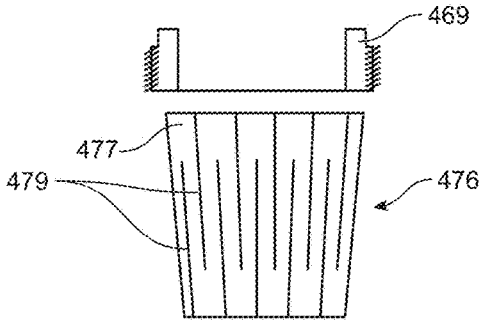

With reference to FIGS. 23 and 24, the collet 476 may include a cylindrical inner surface 478 and a tapered outer surface 477. As shown more clearly in FIG. 24, the tapered outer surface 477 of the collet 476 may be cone shaped. The cylindrical inner surface 478 is configured to interface with the camshaft 450. The tapered outer surface 477 is configured to interface with the tapered through hole 471 of the fixed cam gear 460 and/or the fixed lobe 456. The wall defined between the tapered outer surface 477 and the cylindrical inner surface 478 of the collet 476 may include a plurality of slits 479. The plurality of slits 479 may function in an accordion manner to allow for compression once the collet 476 is properly placed around the camshaft 450. In the illustrated configuration, half of the plurality of slits 479 may extend downward from a top of the collet 476 and half of the plurality of slits 479 may extend upward from a bottom of the collet 476.

As shown in FIG. 24, the collet 476 may have a companion nut 469. The companion nut 469 may include threads configured to interface with the hole 471 of the fixed lobe 456. In some configurations, the threads may interface with the portion of the hole 471 that extends through the fixed cam gear 460.

Figure 25:
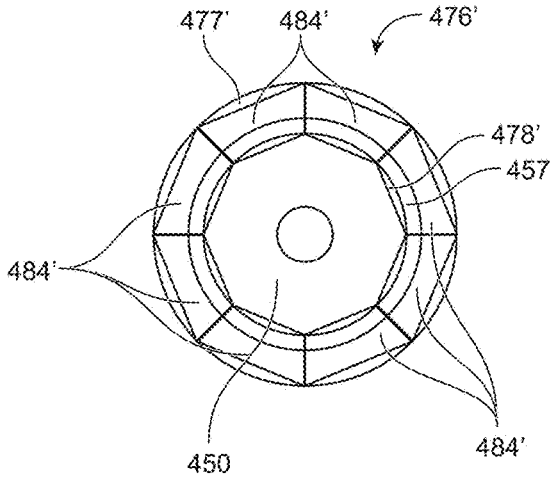
Figure 26:
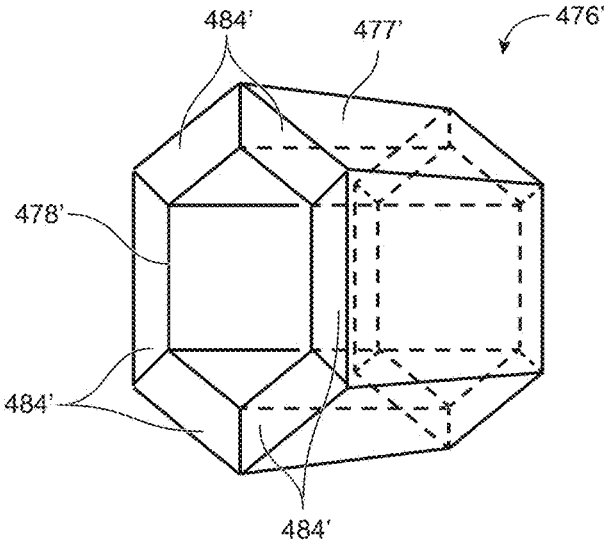

FIGS. 25 and 26 illustrate two more configurations of the collet 476'. The only difference between the two configurations are the number of sides. Accordingly, for efficiency of description, the two configurations will be jointly described.

FIG. 25 shows the collet 476' positioned on a surface 457 of the camshaft 450. FIG. 26 show the collet 476' without the camshaft 450. The collet 476' functions in a similar manner as the collet 476 that is illustrated in FIGS. 23 and 24. The collet 476' may comprise a plurality of collet wedges 484'. In the illustrated configuration, the plurality of collet wedges 484' comprise the inner surface 478' and a tapered outer surface 477' of the collet 476'. The collet 476' also may be cone shaped, similar to the collet 476 illustrated in FIGS. 23 and 24, instead of being hexagonal. In the illustrated configuration, the inner surface 478' of the collet 476' is configured to interface with the camshaft 450. The tapered outer surface 477' of the collet 476' is configured to interface with the tapered through hole 471 of the fixed cam gear 460 and/or lobe 456, respectively.

The plurality of collet wedges 484' may define a trapezoidal cross section. As a result of the trapezoidal cross section, the inner surface 478' of the collet 476' is not perfectly cylindrical. The inner surface 478' becomes more cylindrical as the number of collet wedges 484' increases. The collet 476' can include any number of collet wedges 484'. For example, the collets 476' shown in FIG. 25 includes eight collet wedges 484' and the collet 476' shown in FIG. 26 includes six collet wedges 484'. Other numbers of collet wedges 484' are possible. The plurality of collet wedges 484' may be separable and may allow for compression once the collet 476' is fixed to the camshaft 450. In some configurations, the adjoining collet wedges 484' may be at least partially separated from each other. In some configurations, the adjoining collet wedges 484' may be only partially separated from each other.

The collet 476' may include a companion nut (not shown). The companion nut can function similar to, or identical to, the companion nut 469 illustrated in FIG. 24. The companion nut may include threads configured to interface with threads formed in the hole 471 that passes through the fixed cam gear 460 and the lobe 456. The combination of the tapered opening, the gaps, and the threaded connection enables the collet 476' (and the collet 476 and the collet 476") to be tightened into position against the inner surface of the opening 471' to squeeze against the camshaft 450.

Figure 27:
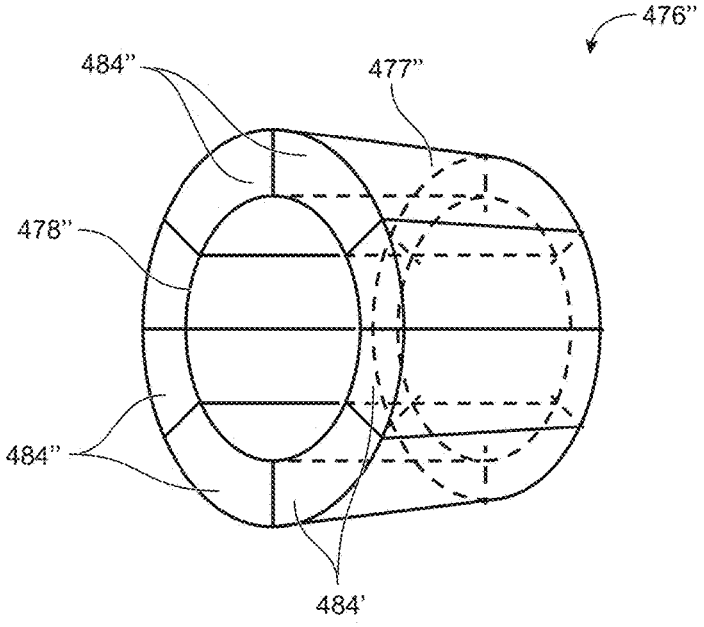

FIG. 27 illustrates a further configuration of the collet 476". The collet 476" illustrated in FIG. 27 functions in a similar manner to the collet 476 illustrated in FIGS. 23 and 24 as well as the collet 476' illustrated in FIGS. 25 and 26. The collet 476" may comprise a plurality of collet wedges 484". The plurality of collet wedges 484" form the inner surface 478" and a tapered outer surface 477" of the collet 476". The collet 476" may be cone shaped, like the collet 476 illustrated in FIGS. 23 and 24. The inner surface 478" is configured to interface with the camshaft 450. The tapered outer surface 477" is configured to interface with the tapered through hole 471 of the fixed cam gear 460 and/or the fixed lobe 456. The plurality of collet wedges 484" may have a curved or arc shaped cross section. As a result of the arc cross section, the inner surface 478" is cylindrical. The collet 476" can include any number of collet wedges 484". The plurality of collet wedges 484" may be at least partially separable (or only partially separable). As with the description above, the plurality of collet wedges 484" allow compression once the collet 476" is properly positioned on the camshaft 450. The collet 476" may have a companion nut (not shown) similar or identical to the companion nut 469. The companion nut may include threads configured to interface with threads of the hole 471 of the fixed cam gear 460 and/or the fixed lobe 456.

FIG. 28 illustrates the camshaft 450B in an assembled state and the camshaft 450C in a partially assembled state. To secure the fixed cam gear 460C and the adjoining fixed lobe 456C to the camshaft 450C, the nut 469 may be slid along the camshaft 450C until the nut 469 is positioned adjacent the mounting surface 457. The collet 476 (or the collet 476' or the collet 476") can be slid along the camshaft 450C until the collet 476 is positioned adjacent a mounting surface 457 or a mounting location. These positions of the collet 476 and the nut 469 are illustrated along the camshaft 450C in FIG. 28. The fixed cam gear 460 and/or the fixed lobe 456 may be slid along the camshaft 450 until the fixed cam gear 460 and the fixed lobe 456 are at least partially aligned with one of the plurality of mounting surfaces 457. The collect 476 can be inserted into the hole 471 defined through at least a portion of the fixed cam gear 460 and/or the fixed lobe 456. The nut 469 may then be threaded into the fixed cam gear 460 and the fixed lobe 456. Threading the nut 469 compresses the collet 476 against the camshaft 450 such that the fixed cam gear 460 and the fixed lobe 456 are secured to the camshaft 450.

Using the collet 476 to secure the fixed cam gears 460 and the fixed lobes 456 to the camshaft 450 may provide some advantages. In one example, the fixed cam gears 460 and the fixed lobes 456 can be easily replaced if any break without having to replace the entire camshaft. Additionally, the collet 476 may provide an improved manner of fixation over, for example, a dowel-based system because the collet system is less likely to wear down over time. Additionally, dowels introduce a stress point that may not exist in a collet system. In another example, the collet system may allow the angular orientation of the nose of the fixed lobes 456 to be adjusted relative to the central axis of the camshaft 450. By adjusting the angular orientation of the nose, the valve timing can also be adjusted, without replacing the camshaft 450.

Figure 29:
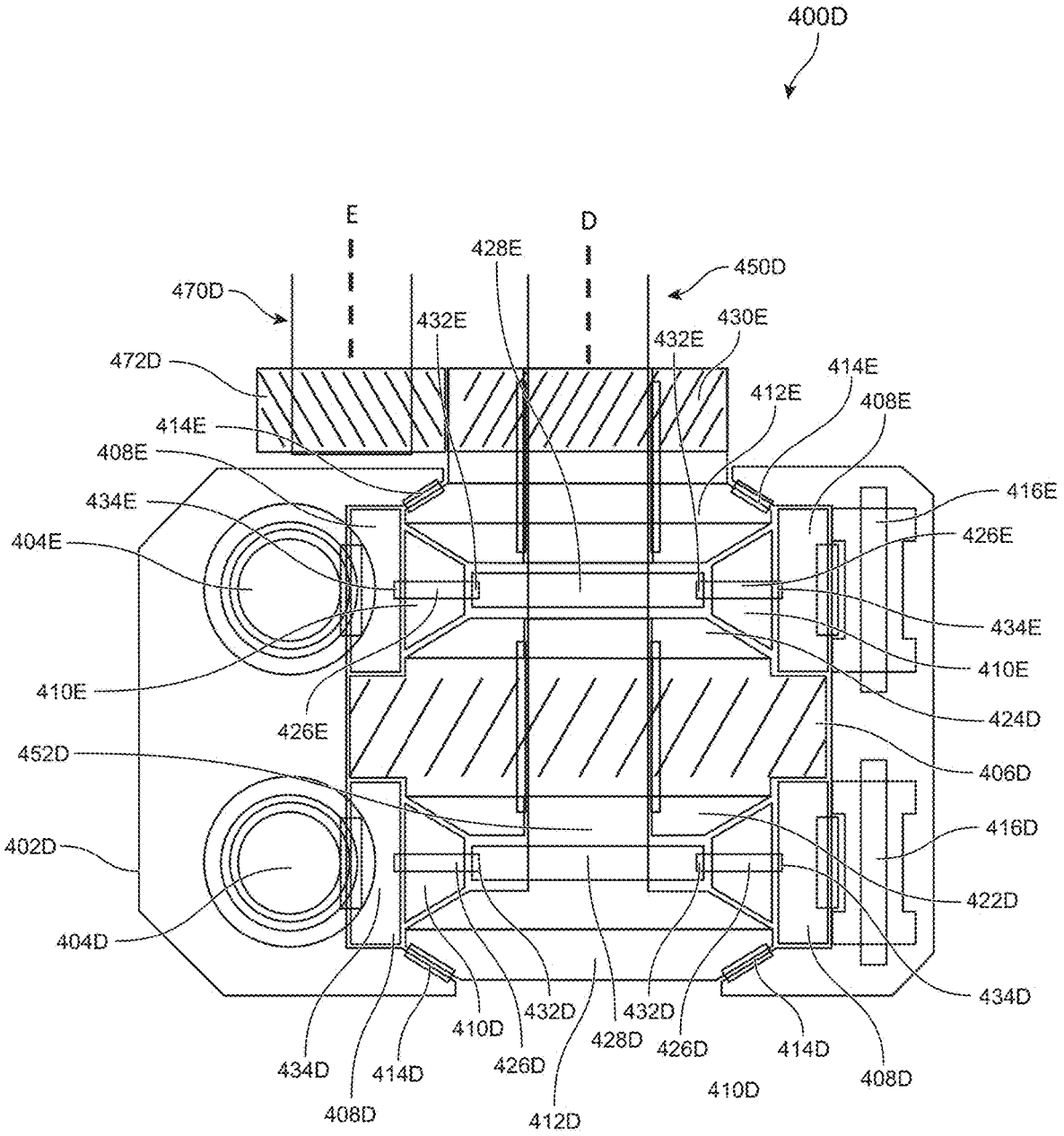
FIG. 29 illustrates a schematic section view of a housing of another valve timing system.
Figure 30:
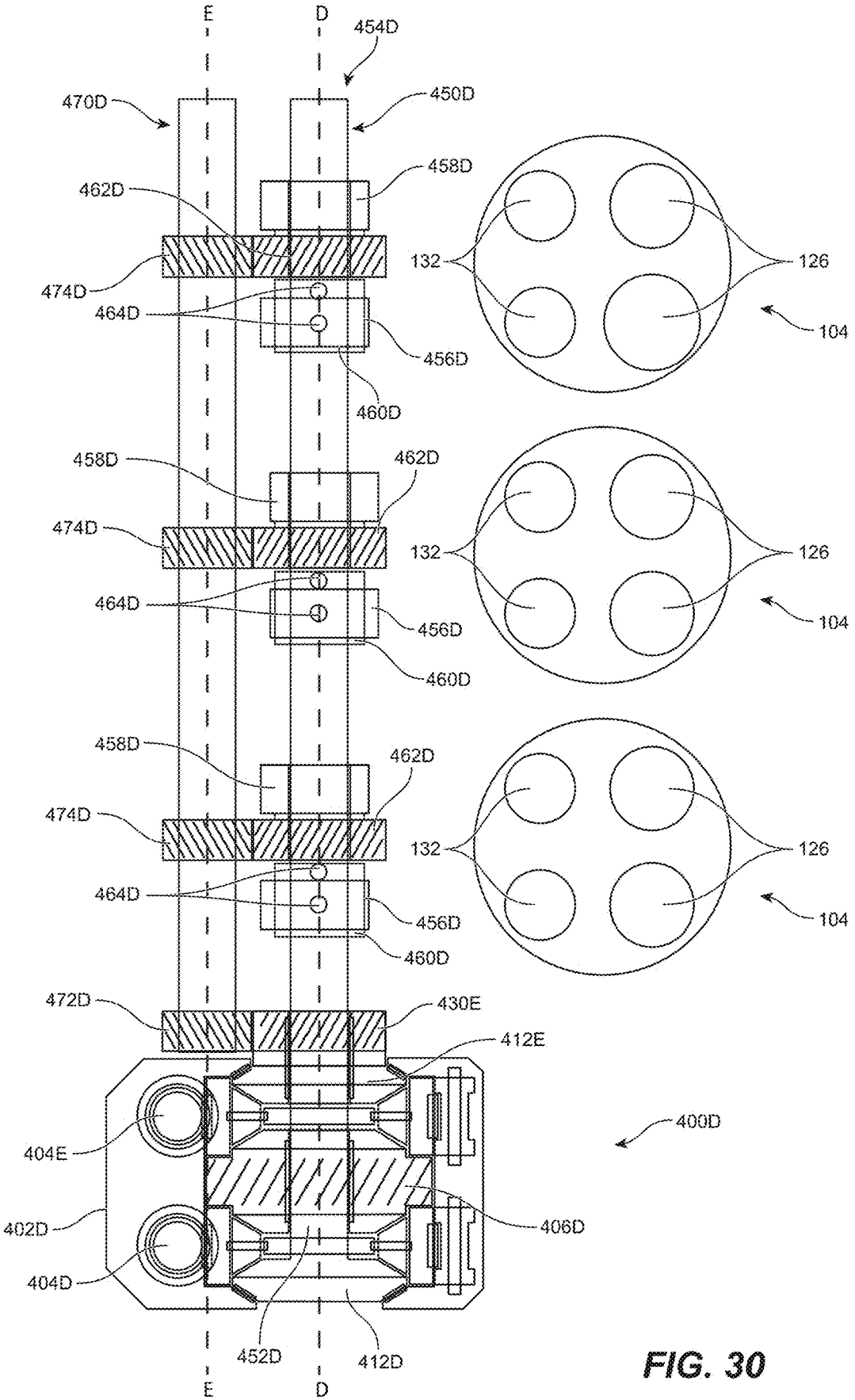
FIG. 30 illustrates the valve timing system of FIG. 29 arranged around three schematically illustrated combustion chambers.

FIG. 29 illustrates a cross-sectional view of a configuration of the housing 402D of the valve timing system 400D. The valve timing system 400D may include the housing 402D, the camshaft 450D and an auxiliary shaft 470D. FIG. 30 illustrates a schematic partial sectional view of the valve timing system 400D, including the camshaft 450D and the auxiliary shaft 470D positioned relative to three schematically illustrated combustion chambers 104. The valve timing system 400D illustrated in FIGS. 29 and 30 includes many similar or identical components to the valve timing system 400A illustrated in FIGS. 15 and 16. The valve timing system 400D operates in a similar manner to the valve timing system 400A illustrated in FIGS. 15 and 16. Thus, reference numerals used to designate the various features or components of the valve timing system 400A are identical to those used for identifying the corresponding features of components of the valve timing system 400D that is illustrated in FIGS. 29 and 30, except that a "D" or an "E" has been added to the numerical identifier. Therefore, the structure and description for the various features of the valve timing system 400A of FIGS. 15 and 16 are understood to apply to the various features of the valve timing system 400D illustrated in FIGS. 29 and 30. However, the valve timing system 400D illustrated in FIGS. 29 and 30 includes additional components related to driving the auxiliary shaft 470D and other differences, as described below.

In the illustrated valve timing system 400D, the housing 402D may house and support one or more of: the first worm gear 404D, the second worm gear 404E, the drive gear 406D, the first ring gear 408D, the second ring gear 408E, the first plurality of planet gears 410D, the second plurality of planet gears 410E, the first beveled gear 412D, the second beveled gear 412E, the first sun gear 428D, the second sun gear 428E, the plurality of first roller thrust bearings 414D, the plurality of second roller thrust bearings 414E, and at least the first locating bearing 416D and the second locating bearing 416E. The valve timing system 400D may also include a primary auxiliary gear 430E. The primary auxiliary gear 430E may extend at least partially into the housing 402D.

The drive gear 406D may include the top beveled portion 422D and the bottom beveled portion 424D. The top beveled portion 422D and the bottom beveled portion 424D may be coupled to the drive gear 406D such that both the top beveled portion 422D and the bottom beveled portion 424D rotate with the drive gear 406D. Both the first plurality of planet gears 410D and the second plurality of planet gears 410E may be beveled. Each planet gear of the first plurality of planet gears 410D and the second plurality of planet gears 410E may include the axle 426D and the axle 426E respectively. The axles 426D and the axles 426E may extend through the center of the respective first planet gears 410D and the respective second planet gears 410E. Each axle 426D and each axle 426E may include a respective first/internal end 432D and a respective first/internal end 432E as well as a respective second/external end 434D and a respective second/external end 434E. The axles 426D and the axles 426E are rotationally coupled to the respective first planet gears 410D and the respective second planet gears 410E such that rotation of the first planet gears 410D and the second planet gears 410E causes corresponding rotation of the axles 426D and the axles 426E. In some configurations, the valve timing system 400D has between two and four first planet gears 410D and between two and four second planet gears 410E. In the example illustrated in FIGS. 29 and 30, the valve timing system 400D includes four first planet gears 410D and four second planet gears 410E (e.g., two planet gears 410D and two planet gears 410E are not shown in FIGS. 29 and 30). In an example where the valve timing system 400D includes four first planet gears 410D and four second planet gears 410E, the first planet gears 410D each may be offset 90 degrees from the adjacent first planet gears 410D and the second planet gears 410E each may be offset 90 degrees from the adjacent second planet gears 410E.

In the valve timing system 400D, the camshaft 450D may be coupled to the first beveled gear 412D at the first end 452D of the camshaft 450D, such that rotation of the first beveled gear 412D causes corresponding rotation of the camshaft 450D. The camshaft 450D may extend through the drive gear 406D, the first sun gear 428D, the second sun gear 428E, the second beveled gear 412E, and the primary auxiliary gear 430E, such that the drive gear 406D, the first sun gear 428D, the second sun gear 428E, the second beveled gear 412E, and the primary auxiliary gear 430E rotate independently of the camshaft 450D. The first sun gear 428D may be positioned between the drive gear 406D and the first beveled gear 412D without engaging either the drive gear 406D or the first beveled gear 412D. Similarly, the second sun gear 428E may be positioned between the drive gear 406D and the second beveled gear 412E, without engaging either the drive gear 406D or the second beveled gear 412E. For example, the camshaft 450D may extend through the center of the first sun gear 428D and the second sun gear 428E without contacting either the first sun gear 428D or the second sun gear 428E. One or both of the first beveled gear 412D and the second beveled gear 412E may be supported by one or more first roller thrust bearings 414D and/or one or more second roller thrust bearings 414E. The first roller thrust bearings 414D and/or the second roller thrust bearings 414E may allow the first beveled gear 412D and/or the second beveled gear 412E to rotate freely relative to the housing 402D. For example, in the configuration illustrated in FIG. 29, the first beveled gear 412D is supported by at least two first roller thrust bearings 414D positioned between the first beveled gear 412D and the housing 402D and the second beveled gear 412E is supported by at least two second roller thrust bearings 414D positioned between the second beveled gear 412E and the housing 402D.

The plurality of first planet gears 410D may be positioned between the drive gear 406D and the first beveled gear 412D such that the teeth of the first planet gears 410D engage with the teeth of the drive gear 406D and the teeth of the first beveled gear 412D. Similarly, the plurality of second planet gears 410E may be positioned between the drive gear 406D and the second beveled gear 412E such that the teeth of the second planet gears 410E engage with the teeth of the drive gear 406D and the teeth of the second beveled gear 412E.

The drive gear 406D, the first beveled gear 412D, and the second beveled gear 412E are configured to rotate about an axis of rotation D. As illustrated in FIG. 30, The axis of rotation D extends through the central axis of the camshaft 450D from the first end 452D to the second end 454D. Each of the plurality of first planet gears 410D and each of the plurality of second planet gears 410E are configured to rotate about the axis of rotation D. Additionally, each first planet gear 410D and each second planet gear 410E rotates about a planet axis of rotation. The planet axes of rotation extend through the center of the axles 426D and the center of the axles 426E. For example, as illustrated in FIG. 29, the two illustrated first planet gears 410D rotate about the planet axis of rotation Y that extends from left to right and the two illustrated second planet gears 410E have a planet axis of rotation W that extends from left to right when the illustrated first planet gears 410D and the illustrated second planet gears 410E are in the position about the axis of rotation D illustrated in FIG. 29. Similarly, the two not illustrated first planet gears 410D and the two not illustrated second planet gears 410E not shown may be 90 degrees offset from the illustrated first planet gears 410D and the illustrated second planet gears 410E respectively about the axis of rotation D such that the not illustrated first planet gears 410D rotate about a planet axis of rotation Z and the not illustrated second planet gears 410E rotate about a planet axis of rotation X, both of which extend directly into the page when the not illustrated first planet gears 410D and the illustrated second planet gears 410E are in the illustrated positions.

The internal end 432D of the axle 426D of each first plant gear 410D may be coupled to the first sun gear 428D and the internal end 432E of the axle 426E of each second planet gear 410E may be coupled to the second sun gear 428E. The first sun gear 428D and the second sun gear 428E may be rotationally coupled to the plurality of first planet gears 410D and the plurality of second planet gears 410E about the axis of rotation D such that rotation of the plurality of first planet gears 410D and rotation of the plurality of second planet gears 410E about the axis of rotation D causes corresponding rotation of the first sun gear 428D and the second sun gear 428E about the axis of rotation D. However, the first sun gear 428D and the second sun gear 428E may not be rotationally coupled to the plurality of first planet gears 410D and the plurality of second planet gears 410E about the planet axes of rotation Y, Z, W, and X. In other words, the plurality of first planet gears 410D and the plurality of second planet gears 410E can freely rotate about the planet axes of rotation Y, Z, W, and X without causing rotation of the first sun gear 428D and the second sun gear 428E.

The first ring gear 408D may extend around the plurality of first planet gears 410D in the same plane as the plurality of first planet gears 410D and the second ring gear 408E may extend around the plurality of second planet gears 410E in the same plane as the plurality of second planet gears 410E. The first locating bearing 416D and the second locating bearing 416E may be configured to maintain the position of the first ring gear 408D and the second ring gear 408E respectively. The teeth of the first ring gear 408D and the teeth of the second ring gear 408E are engaged with the teeth of the first worm gear 404D and the teeth of the second worm gear 404E respectively. The first external ends 434D and the second external end 434E of the respective axles 426D, 426E may be coupled to the respective first ring gear 408D and the respective second ring gear 408E. For example, in the configuration illustrated in FIG. 29, the first ring gear 408D is coupled to the four first planet gears 410D and the second ring gear 408E is coupled to the four second planet gears 410E. The first ring gear 408D and the second ring gear 408E may be rotationally coupled to the plurality of first planet gears 410D and the plurality of second planet gears 410E about the axis of rotation D such that rotation of the plurality of first planet gears 410D and rotation of the plurality of second planet gears 410E about the axis of rotation D causes corresponding rotation of the first ring gear 408D and corresponding rotation of the second ring gear 408E about the axis of rotation D. The first ring gear 408D is coaxial with the first sun gear 428D and the second ring gear 408E is coaxial with the second sun gear 428E. Like the first sun gear 428D and the second sun gear 428E, the first ring gear 408D and the second ring gear 408E may not be rotationally coupled to the plurality of first planet gears 410D and the plurality of second planet gears 410E about the planet axes of rotation Y, Z, W, and X. In other words, the plurality of first planet gears 410D and the plurality of second planet gears 410E can freely rotate about the planet axes of rotation Y, Z, W, and X without causing rotation of the first ring gear 408D and the second ring gear 408E.

With reference now to FIG. 30, the primary auxiliary gear 430E may comprise any suitable gear. The primary auxiliary gear 430E may be coupled for rotation with the second beveled gear 412E. In some examples, the primary auxiliary gear 430E and the second beveled gear 412E are defined by a single monolithic structure. In either arrangement, the primary auxiliary gear 430E joined for rotation with the second beveled gear 412E such that the primary auxiliary gear 430E rotates about the axis of rotation D in the same direction as the second beveled gear 412E.

The primary auxiliary gear 430E may partially extend into the housing 402D through a suitable opening in the housing 402D. The primary auxiliary gear 430E may be milled so that the camshaft 450D can extend through the primary auxiliary gear 430E without causing the primary auxiliary gear 430E to rotate with the camshaft 450D. The primary auxiliary gear 430E can mesh with a first auxiliary shaft gear 472D of the auxiliary shaft 470D. Accordingly, rotation of the camshaft 450D causes rotation of the auxiliary shaft 470D.

As noted above, FIG. 30 illustrates the housing 402D, the camshaft 450D, and the auxiliary shaft 470D of the valve timing system 400D. The camshaft 450D may include a plurality of fixed lobes 456D, a plurality of free lobes 458D, and a plurality of free cam gears 462D. In some configurations, the camshaft 450D may include a plurality of cam cylinders 460D, which are discussed in further detail below. In some configurations, the camshaft 450D may include a plurality of dowel pins 464D.

Figure 48:
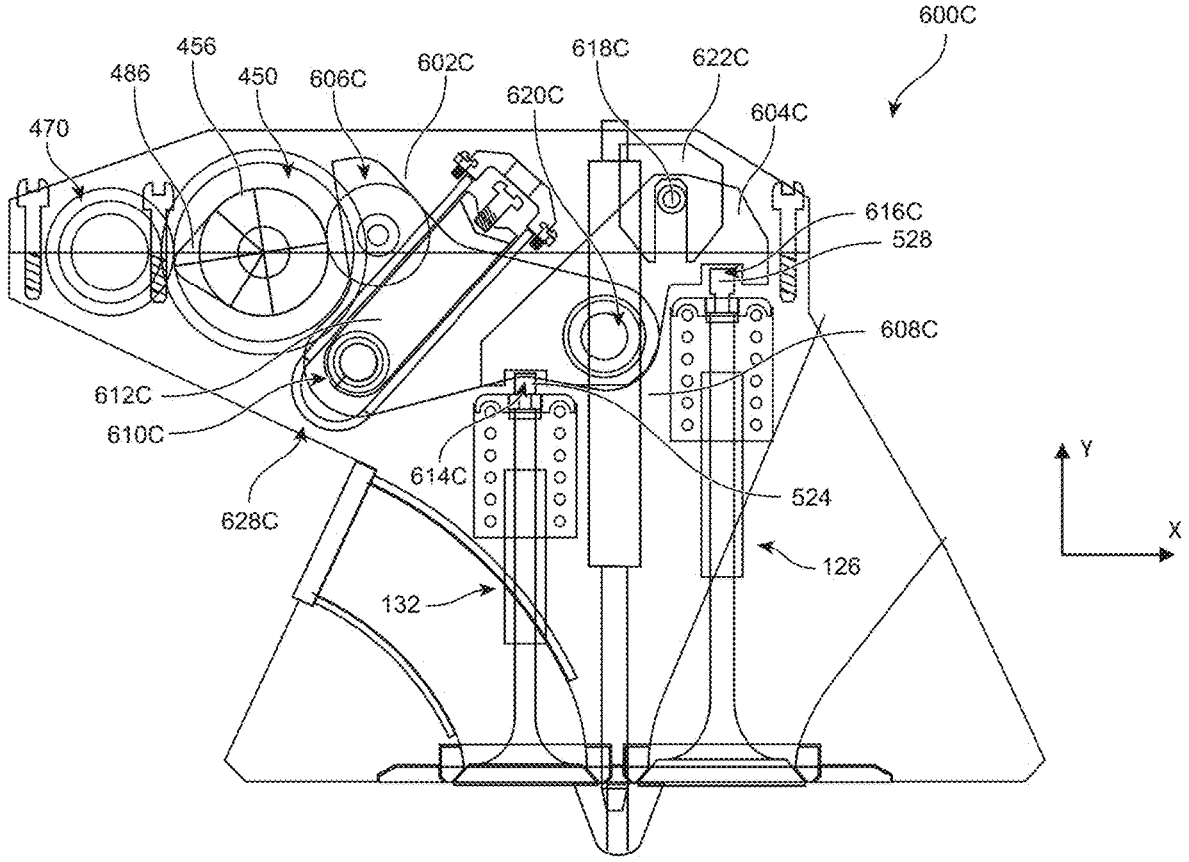
FIG. 48 illustrates a schematic section view of a configuration of another valve actuation system.

Each fixed lobe 456D and each free lobe 458D may be configured to control the opening and closing of both the exhaust valve 132 and the intake valve 126 in a cylinder 550. For example, the valve actuation system 600C that is illustrated in FIG. 48 is one example of an actuation system 600C that can actuate the exhaust valve 132 and the intake valve 126 associated with each fixed lobe 456D and each free lobe 458D. Other multiple valve actuating actuation systems also could be used with the valve timing system 400D.

The auxiliary shaft 470D can be secured to rotate with the first auxiliary shaft gear 472D. A plurality of second auxiliary shaft gears 474D can be secured to rotate with the auxiliary shaft 470D. For example, as illustrated in FIG. 30, the camshaft 450D can include three fixed lobes 456D and three free lobes 458D to control six exhaust valves 132 and six intake valves 126 in the six-cylinder internal combustion engine 100. The number of fixed lobes 456D, the number of free lobes 458D, the number of cam cylinders 460D, the number of cam gears 462D, and the number of second auxiliary shaft gears 474D can be dependent on the number of combustion chambers 104 in the internal combustion engine 100. The valve timing system 400D may include more or fewer fixed lobes 456D, more or fewer free lobes 458D, more or fewer cam cylinders 460D, more or fewer cam gears 462D, and more or fewer second auxiliary shaft gears 474D.

The cam cylinders 460D may be rotationally coupled to the camshaft 450D. Rotation of the camshaft 450D about an axis of rotation D causes a corresponding rotation of the cam cylinders 460D about the axis of rotation D. The fixed lobes 456D may be fixed to either the camshaft 450D or to the cam cylinders 460D. In one configuration, the fixed lobes 456D are coupled to the cam cylinders 460D by one or more dowel pins 464B. In another configuration, the fixed lobes 456D may be coupled to the cam cylinders 460D by other conventional means. In some configurations, the valve timing system 400D does not include any cam cylinders 460D. In some configurations, the fixed lobes 456D are coupled to the camshaft 450D using a collet system, such as the collet 476, 476', 486" discussed above. As a result of this arrangement, the fixed lobes 456D also are rotationally coupled to the camshaft 450D. Conversely, the free cam gears 462D are not coupled to the camshaft 450D, such that rotation of the camshaft 450D does not cause rotation of the free cam gears 462D. In one example, the free cam gears 462D may be formed such that the camshaft 450D may freely rotate and extend through the free cam gears 462D. The free lobes 458D may be rotationally coupled to the free cam gears 462D. In one example, the free lobes 458D may be formed such that the camshaft 450D may freely rotate and extend through the free lobes 458D.

Both the first auxiliary shaft gear 472D and the second auxiliary shaft gears 474D are joined to the auxiliary shaft 470D such that rotation of the auxiliary shaft 470D about the axis of rotation E causes a corresponding rotation of the auxiliary shaft gear 472D and the second auxiliary shaft gears 474D about the axis of rotation E. The teeth of the first auxiliary shaft gear 472D engage with the teeth of the primary auxiliary gear 430E such that rotation of the camshaft 450D about the axis of rotation D causes corresponding rotation of the auxiliary shaft 470D about the axis of rotation E in the opposite direction. The teeth of the second auxiliary shaft gears 474D may engage with the teeth of the free cam gears 462D such that the second auxiliary shaft gears 474D drive the rotation of the free cam gears 462D and the free lobes 458D. As such, the rotation of the free lobes 458D about the axis of rotation D is driven by rotation of the auxiliary shaft 470D about the axis of rotation E.

In the valve timing system 400D illustrated in FIG. 30, the drive gear 406D drives the plurality of first planet gears 410D and the plurality of second planet gears 410E, which in turn drive the first beveled gear 412D and the second beveled gear 412E respectively. In this manner, the plurality of first planet gears 410D and the plurality of second planet gears 410E act as transfer gears between the drive gear 406D and the first beveled gear 412D and the second beveled gear 412E. For example, the drive gear 406D rotates about the axis of rotation D and may be driven by another system in the internal combustion engine 100. For example, the drive gear 406D may be driven by a flywheel of the crankshaft 112. As the drive gear 406D rotates about the axis of rotation D, the teeth of the drive gear 406D engage with the teeth of the plurality of first planet gears 410D and the plurality of second planet gears 410E, causing the plurality of first planet gears 410D and the plurality of second planet gears 410E to rotate about the planet axes of rotation Y, Z, X, and W. Similarly, the teeth of the first planet gears 410D engage the teeth of the first beveled gear 412D and the teeth of the second planet gears 410E engage the teeth of the second beveled gear 412E, such that rotation of the plurality of first planet gears 410D and rotation of the plurality of second planet gears 410E causes rotation of the first beveled gear 412D and the second beveled gear 412E about the axis of rotation D. Because of the arrangement of the gears within the valve timing system 400D, the drive gear 406D rotates in a first direction and the first beveled gear 412D and the second beveled gear 412E rotate in a second opposite direction. For example, when the drive gear 406D rotates clockwise about the axis of rotation D, the first beveled gear 412D and the second beveled gear 412E rotate counterclockwise, and vice versa. Similarly, the plurality of first planet gears 410D and the plurality of second planet gears 410E that are spaced on opposite ends of the housing 402D rotate in opposite directions about the respective planet axes. For example, in the configuration illustrated in FIG. 30, the first planet gears 410D and the second planet gears 410E on the left side rotate in a first direction and the first planet gears 410D and the second planet gears 410E on the right side rotate in a second opposite direction about the planet axes of rotation Y and W.

With reference still to FIG. 30, because the first beveled gear 412D is coupled to the camshaft 450D, rotation of the first beveled gear 412D about the axis of rotation D causes the camshaft 450D to rotate about the axis of rotation D, which in turn changes the position of the noses of the plurality of fixed lobes 456D, which open and close the intake valves 126 and the exhaust valves 132 of the combustion chambers 104 of the internal combustion engine 100. As noted above, the angular orientations of the plurality of fixed lobes 456D relative to the camshaft 450 may be fixed between the first end 452D and the second end 454D of the camshaft 450 such that the plurality of fixed lobes 456D rotate with the camshaft 450D about the axis of rotation D. Because the second beveled gear 412E is coupled to the primary auxiliary gear 430E and the primary auxiliary gear 430E engages with and drives the first auxiliary shaft gear 472D, rotation of the second beveled gear 412E about the axis of rotation D causes the auxiliary shaft 470D to rotate about the axis of rotation E, which in turn changes the position of the noses of the free lobes 458D, opening and closing the intake valves 126 and the exhaust valves 132 of the internal combustion engine 100, as explained above.

In the configuration illustrated in at least FIGS. 29 and 30, the valve timing system 400D may be configured to adjust the valve timing. To adjust the valve timing, the first worm gear 404D may be driven by a worm gear drive system. Movement of the first worm gear 404D in turn causes the first ring gear 408D to rotate about the axis of rotation D. Because the plurality of first planet gears 410D are coupled to the first ring gear 408D, rotation of the first ring gear 408D about the axis of rotation D causes corresponding rotation of the plurality of first planet gears 410D about the axis of rotation D. Rotation of the first planet gears 410D causes corresponding rotation of the first beveled gear 412D and therefore the camshaft 450D about the axis of rotation D in a first direction. Similarly, rotation of the first planet gears 410D causes corresponding rotation of the drive gear 406D in a second direction opposite the first direction. For example, the plurality of first planet gears 410D may rotate about the planet axes of rotation Y, Z as the first ring gear 408D rotates about the axis of rotation D, while causing rotation of the first beveled gear 412D about the axis of rotation D in the first direction and causing rotation of the drive gear 406D about the axis of rotation D in the second direction. By adjusting the angular position about the axis of rotation D of the first beveled gear 412D and therefore the camshaft 450D relative to the drive gear 406D, the position of the plurality of fixed lobes 456D are adjusted relative to the angular orientation of the crankshaft 112. As a result, the timing (i.e., the opening and the closing) of both the exhaust valve 132 and the intake valve 126 in each combustion chamber 104 is changed relative to the position of the crankshaft 112. In the example of FIG. 30, the plurality of fixed lobes 456D control the valve timing of the bottommost intake valve 126 and the bottommost exhaust valve 132 in each combustion chamber 104 in the orientation of FIG. 30.

Additionally, rotation of the drive gear 406D (e.g., as driven by the first worm gear 404D) about the axis of rotation D in the second direction causes rotation of the plurality of second planet gears 410E about the planet axes of rotation X, W, which causes rotation of the second beveled gear 412E about the axis of rotation D in the first direction. As explained above, rotation of the second beveled gear 412E in the first direction causes the auxiliary shaft 470D to rotate about the axis of rotation E in the second direction. By adjusting the angular position about the axis of rotation D of the second beveled gear 412E and by thereby adjusting the angular position of the auxiliary shaft 470D relative to the drive gear 406D, the position of the free lobes 458D are adjusted relative to the crankshaft 112. As a result, the timing (i.e., the opening and the closing) of the exhaust valve 132 and the intake valve 126 in each combustion chamber 104 is changed relative to the position of the crankshaft 112. In the example of FIG. 30, the plurality of free lobes 458D control the valve timing of the topmost intake valve 126 and the topmost exhaust valve 132 in each combustion chamber 104 in the orientation illustrated in FIG. 30.

In the example provided above, the valve timing of each intake valve 126 and each exhaust valve 132 can be changed by rotation of the first worm gear 404D. However, the first worm gear 404D and/or the second worm gear 404E can be used to change the valve timing. Use of the second worm gear 404E would provide a similar change in angular offset between the angular orientation of the crankshaft 112 and the angular orientation of the camshaft 450D and the auxiliary shaft 470D about their respective axes of rotation D, E. In this manner, the magnitude of the angular offset between the first beveled gear 412D and the second beveled gear 412E and the drive gear 406D can be controlled by the one or both of the first worm gear 404D and the second worm gear 404E. For example, minimal rotation of the first worm gear 404D and/or the second worm gear 404E causes a corresponding minimal angular offset between the drive gear 406D and the first beveled gear 412D and the second beveled gear 412E. Similarly, further rotation of the first worm gear 404D and/or the second worm gear 404E creates a corresponding increase in angular offset between the drive gear 406D and the first beveled gear 412D and the second beveled gear 412E.

Figure 31:
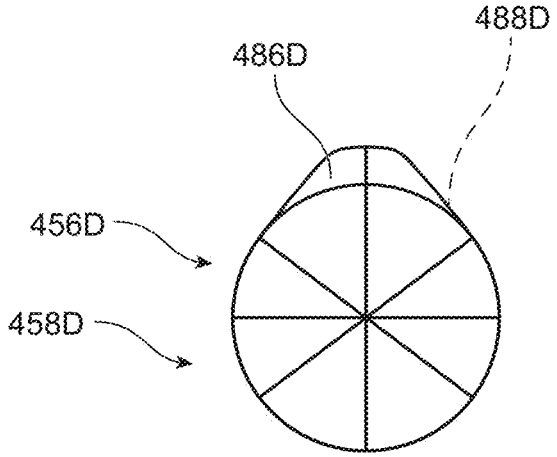
FIGS. 31 and 32 illustrate schematic side views of cam lobes that can be used in a valve timing system.
Figure 32:
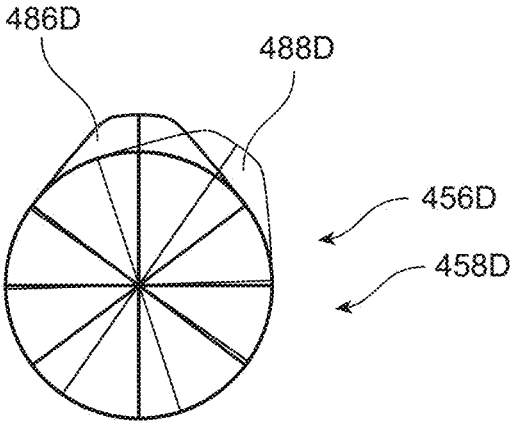

Changing the valve timing using the valve timing system 400D with the first worm gear 404D and the second worm gear 404E can also cause a change in the valve duration or dwell. For example, when the angular offset between the drive gear 406D and the first beveled gear 412D and the second beveled gear 412E changes, so does the angular offset between the camshaft 450D and the auxiliary shaft 470D. Because the camshaft 450D controls both the intake valve 126 and the exhaust valve 132 in the combustion chamber 104 and the auxiliary shaft 470D controls a different intake valve 126 and a different exhaust valve 132 in the same combustion chamber 104, the change in angular offset between the camshaft 450D and the auxiliary shaft 470D can change the valve duration or dwell. For example, with reference to FIG. 31, which illustrates schematic view along the axis of rotation D of the fixed lobe 456D and the free lobe 458D, when the valve duration is unchanged, the nose 486D of the fixed lobe 456D may be aligned with the nose 488D of the free lobe 458D. As such, the nose 488D is hidden from view. However, if the valve duration is adjusted, as described above, the position of the nose 486D of the fixed lobe 456D and the nose 488D of the free lobe 458D are changed, as shown in FIG. 32. In this position, the valve duration or dwell has been increased, because the nose 488D of the free lobe 458D will actuate the exhaust valve 132 and the intake valve 126 before the nose 486D of the fixed lobe 456D will actuate the other exhaust valve 132 and the other intake valve 126 in the same combustion chamber 104 assuming clockwise rotation of the fixed lobe 456D and the free lobe 458D. Additionally, any of the lobes described herein can be arranged with noses offset from the other noses of other lobes along the same camshaft. This type of arrangement allows for the valve duration to be set and increased compared to an arrangement where the noses of the lobes are aligned.

The valve timing system 400D may provide certain benefits in terms of valve timing control and valve duration control. For example, both valve timing and valve duration can be controlled by one valve timing system 400D. Use of one valve timing system 400 with only one housing results in less material and less space being used in the internal combustion engine 100. Additionally, in the valve timing system 400D, two valves are controlled for each fixed lobe 456D and two valves are controlled for each free lobe 458D, which also allows for less material and less space used in the internal combustion engine 100. Further, by controlling two valves with the fixed lobe 456D and by controlling two valves with the free lobe 458D, there may be less energy losses due to friction, as explained elsewhere.

Figure 33:
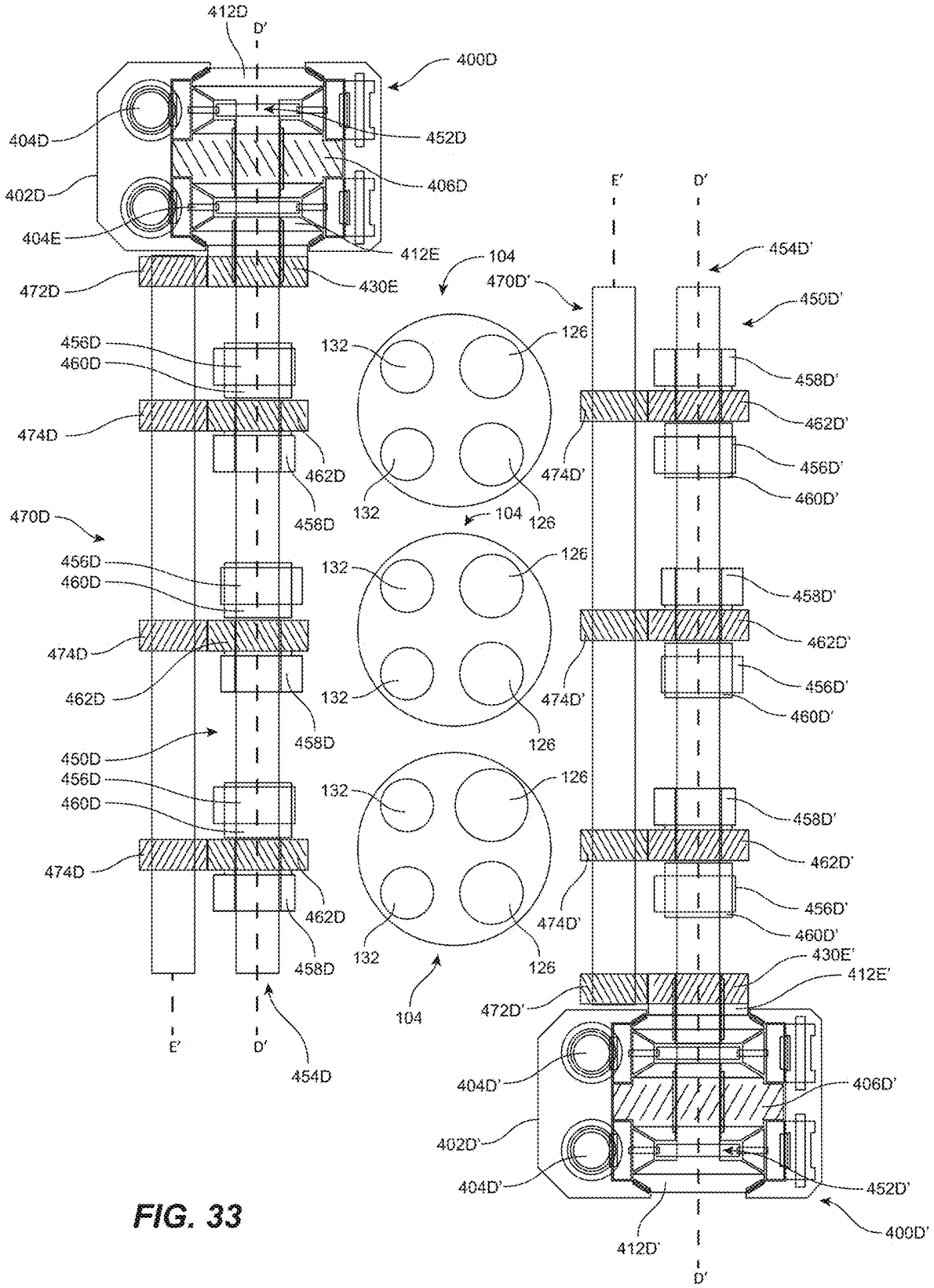
FIG. 33 illustrates two of the valve timing systems of FIG. 29 arranged around three schematically illustrated combustion chambers.

FIG. 33 illustrates a schematic sectional view of the valve timing system 400D and a second valve timing system 400D'. The features of the second valve timing system 400D' are similar or identical to the features of the valve timing system 400D. Thus, reference numerals used to designate the various features or components of the second valve timing system 400D' are identical to those used for identifying the corresponding features of components of the valve timing system 400D, except that a "prime" has been added to the numerical identifier. Therefore, the structure and description for the various features and operations of the valve timing system 400D illustrated in FIGS. 29 and 30 are understood to also apply to the corresponding features of the valve timing system 400D'.

In FIG. 33, the valve timing system 400D and the second valve timing system 400D' are positioned relative to three schematically illustrated combustion chambers 104. In this configuration, the valve timing system 400D is positioned on one side of the combustion chambers 104 and the second valve timing system 400D' is positioned on the opposite side of the combustion chambers 104. Additionally, the housing 402D is opposite the second housing 402D'. Unlike the configuration illustrated in FIGS. 29 and 30, in the configuration of FIG. 33, each of the fixed lobes 456D, 456D' and each of the free lobes 458D, 458D') may be configured to actuate the single intake valve 126 or the single exhaust valve 132. For example, the configuration illustrated in FIG. 33 may be used with the valve actuation system 600I in FIG. 75, the valve actuation system 600J in FIG. 76, or another suitable valve actuation system.

Figure 34:
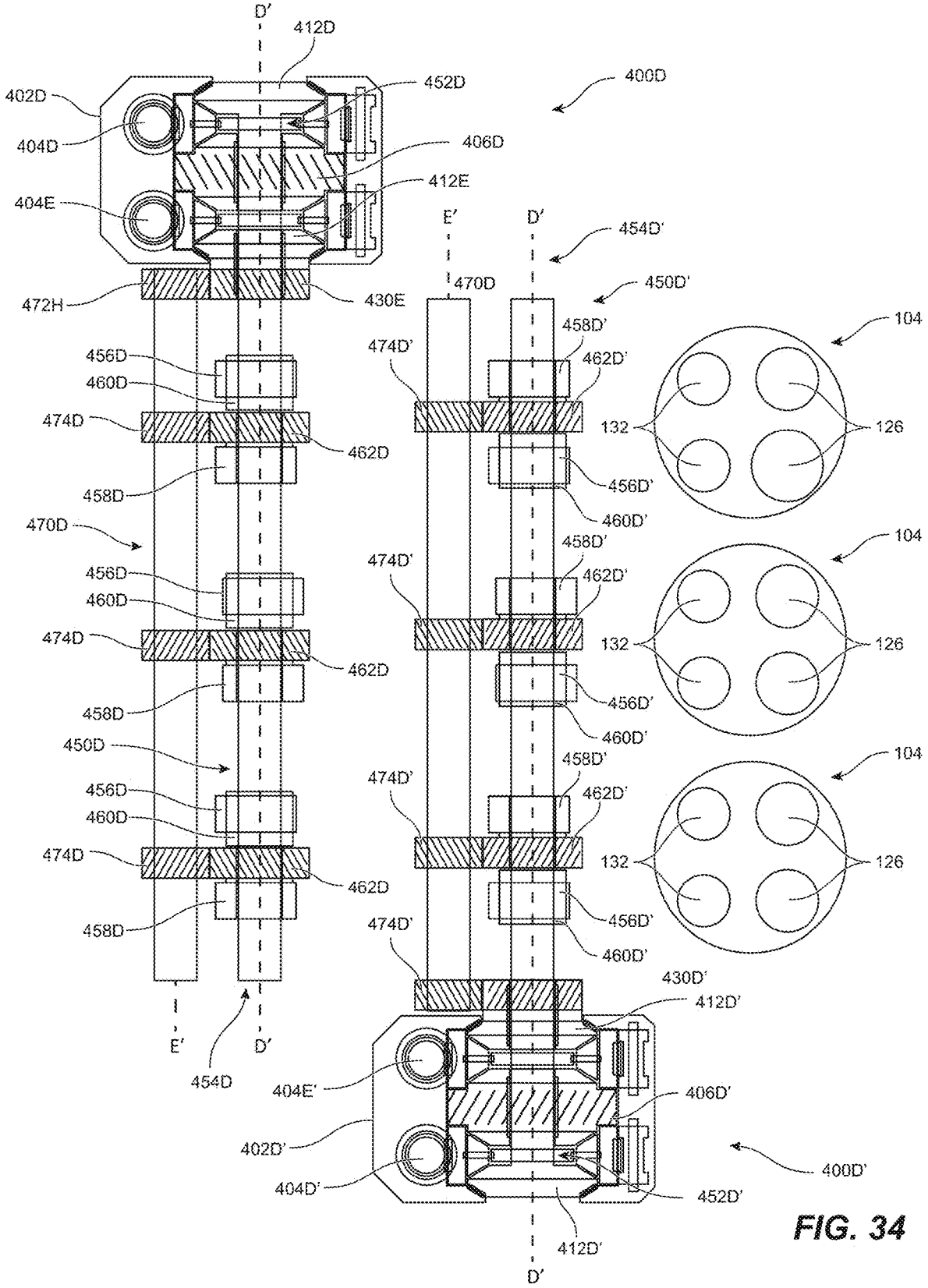
FIG. 34 illustrates two of the valve timing systems of FIG. 29 arranged around three schematically illustrated combustion chambers.

FIG. 34 illustrates a schematic cross-sectional view of the valve timing system 400D and the second valve timing system 400D'. The valve timing system 400D and the second valve timing system 400D' are positioned relative to three schematically illustrated combustion chambers 104. In this configuration, the valve timing system 400D is positioned on the same side of the combustion chamber 104 as the second valve timing system 400D'. Additionally, the second housing 402D' is opposite the housing 402D. Unlike the configuration illustrated in FIGS. 29 and 30, in the configuration of FIG. 34, each of the fixed lobes 456D, 456D' and each of the free lobes 458D, 458D' can be configured to actuate one intake valve 126 or one exhaust valve 132. For example, the configuration illustrated in FIG. 34 may be used with a valve actuation system, such the valve actuation system 600D illustrated in FIG. 59, or any other suitable valve actuation system, whether described in this description or not.

Figure 35:
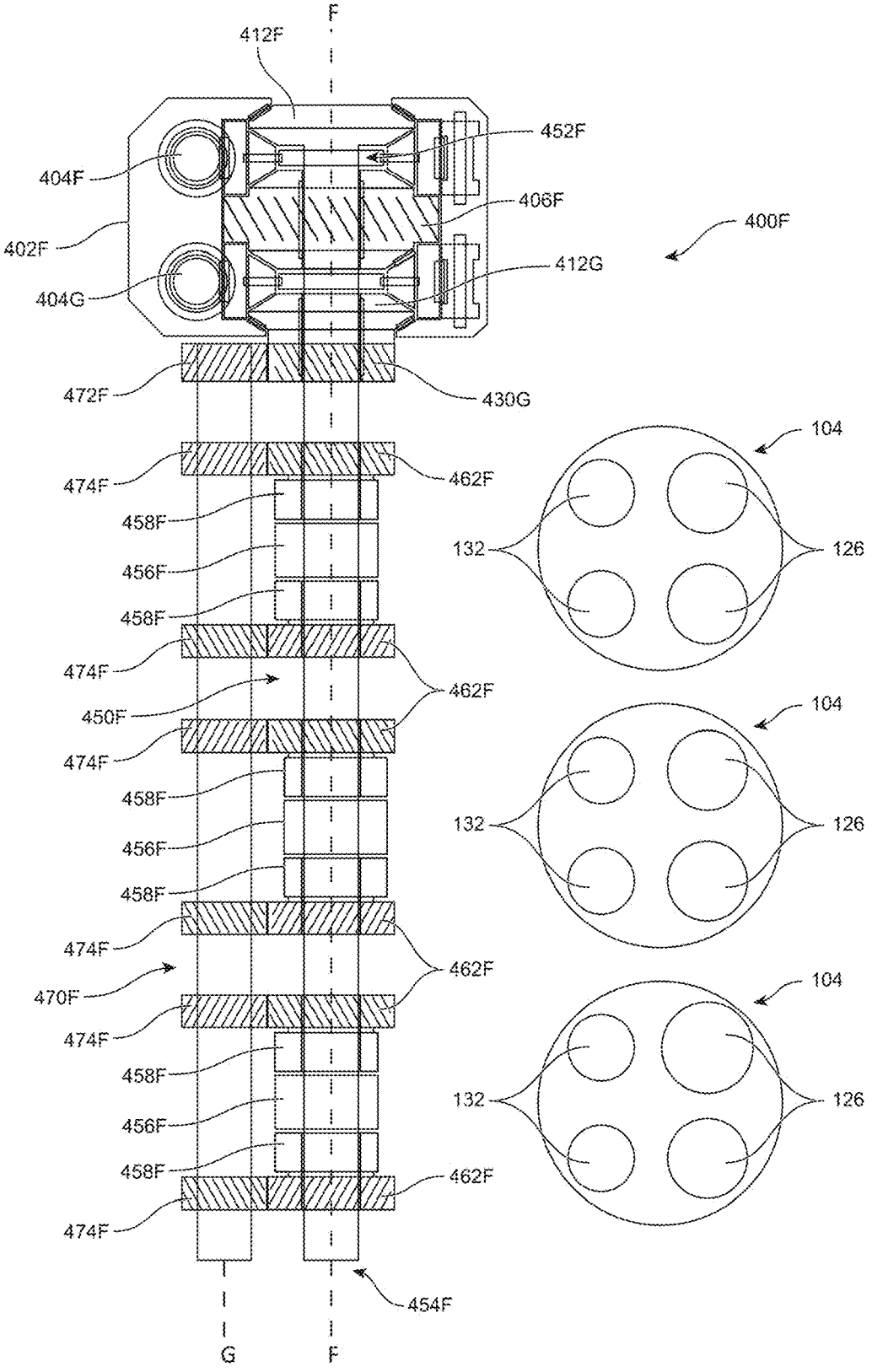
FIG. 35 illustrates a schematic section view of another valve timing system arranged around three schematically illustrated combustion chambers.

FIG. 35 illustrates a schematic sectional view of the valve timing system 400F. A majority of the features of the valve timing system 400F illustrated in FIG. 35 are similar or identical to features of the valve timing system 400D illustrated in FIGS. 29 and 30. Thus, reference numerals used to designate the various features or components of the valve timing system 400F illustrated in FIG. 35 are identical to those used for identifying the corresponding features of components of the valve timing system 400D illustrated in FIGS. 29 and 30, except that an "F" or a "G" has been added to the numerical identifier. Therefore, the structure and description for the various features and operation of the valve timing system 400D illustrated in FIGS. 29 and 30 are understood to apply to the corresponding features of the valve timing system 400F illustrated in FIG. 35, except as described below or apparent from the present application.

The valve timing system 400F illustrated in FIG. 35 differs from the valve timing system 400D illustrated in FIGS. 29 and 30 in that the valve timing system 400F illustrated in FIG. 35 includes a greater number of the free lobes 458F, a greater number of the free cam gears 462F, and a greater number of the second auxiliary shaft gears 474F than the valve timing system 400D that is illustrated in FIGS. 29 and 30. In the valve timing system 400D, some configurations include a fixed lobe 456D to free lobe 458D ratio of 1:1. In the configuration illustrated in FIG. 35, the valve timing system 400F includes a fixed lobe 456F to free lobe 458F ratio of 1:2. In some configurations, a combination of two free lobes 458F and one fixed lobe 456F are used to actuate two intake valves 126 and two exhaust valves 132 in the combustion chamber 104. For example, the valve actuation system illustrated in FIG. 48 with the arrangement shown in FIG. 51 can be used with the valve timing system 400F of FIG. 35. In some configurations, the combination of two free lobes 458F and one fixed lobe 456F can be used to actuate one exhaust valve 132 and one intake valve 126 in the combustion chamber 104. For example, the valve actuation system 600D illustrated in FIG. 59 with the arrangement shown in FIG. 62 and/or FIG. 63 may be used with the valve timing system 400F. Other combinations of the disclosed structure are within the scope of the present disclosure.

Figure 36:
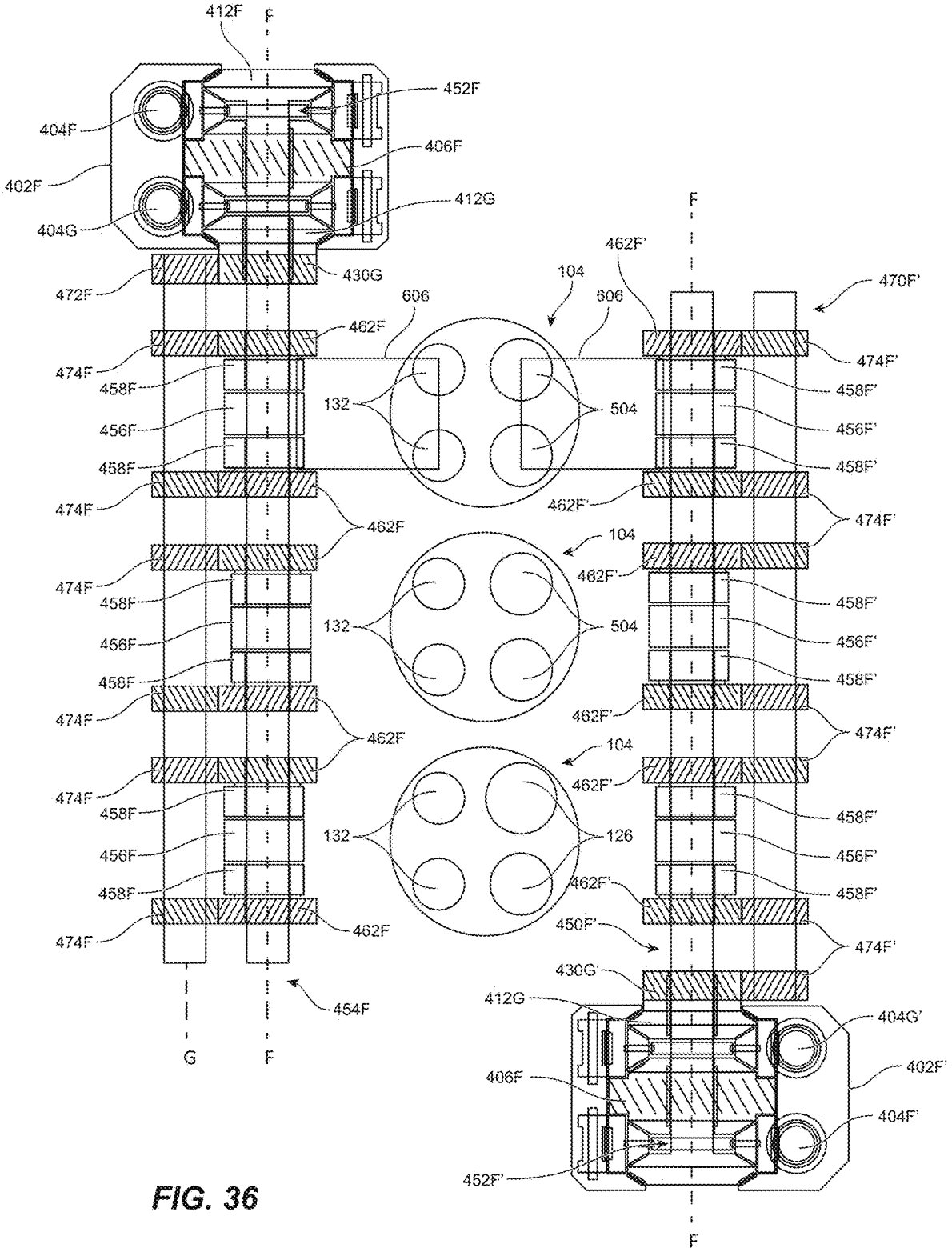
FIG. 36 illustrates two of the valve timing systems of FIG. 35 arranged around three schematically illustrated cylinders.

FIG. 36 illustrates a schematic sectional view of the valve timing system 400F and a second valve timing system 400F'. The features of the second valve timing system 400F' are similar or identical to the features of the valve timing system 400F. Thus, reference numerals used to designate the various features or components of the valve timing system 400F' are identical to those used for identifying the corresponding features of components of the valve timing system 400F, except that a "prime" has been added to the numerical identifier. Therefore, the structure and description for the various features and operation of the valve timing system 400F illustrated in FIG. 35 are understood to also apply to the corresponding features of the valve timing system 400F' illustrated in FIG. 36.

With reference to FIG. 36, the valve timing system 400F and the second valve timing system 400F' are positioned relative to three schematically illustrated combustion chambers 104. In this configuration, the valve timing system 400F is positioned on one side of the combustion chamber 104 and the second valve timing system 400F' is positioned on the opposite side of the combustion chamber 104. Additionally, the housing 402F is opposite the housing 402F'. Two cam followers 606 are schematically illustrated in FIG. 36.

With reference to the topmost combustion chamber 104, in illustrated configuration, a combination of two free lobes 458F and one fixed lobe 456F of the valve timing system 400F are used to actuate one exhaust valve 132. Similarly, a combination of two free lobes 458F' and one fixed lobe 456F' of the valve timing system 400F' are used to actuate one intake valve 126. For example, the valve actuation system 600D illustrated in FIG. 59 with the arrangement shown in FIG. 62 and/or FIG. 63 can be used with the valve timing system 400F and the second valve timing system 400F'. In some configurations, the noses of the fixed lobes 456F and the noses of the free lobes 458F can be offset from each other (e.g., as shown in FIG. 32) such that the exhaust valves 132 remain open for longer than if the noses were aligned (e.g., as shown in FIG. 31). Similarly, the noses of the fixed lobes 456F' and the noses of the free lobes 458F' can be offset from each other such that the intake valves 126 remain open for longer than if the noses were aligned. While only two cam followers 606 are illustrated in FIG. 36, the internal combustion engine 100 would include the cam followers 606 for all of the combustion chambers 104.

Figure 37:
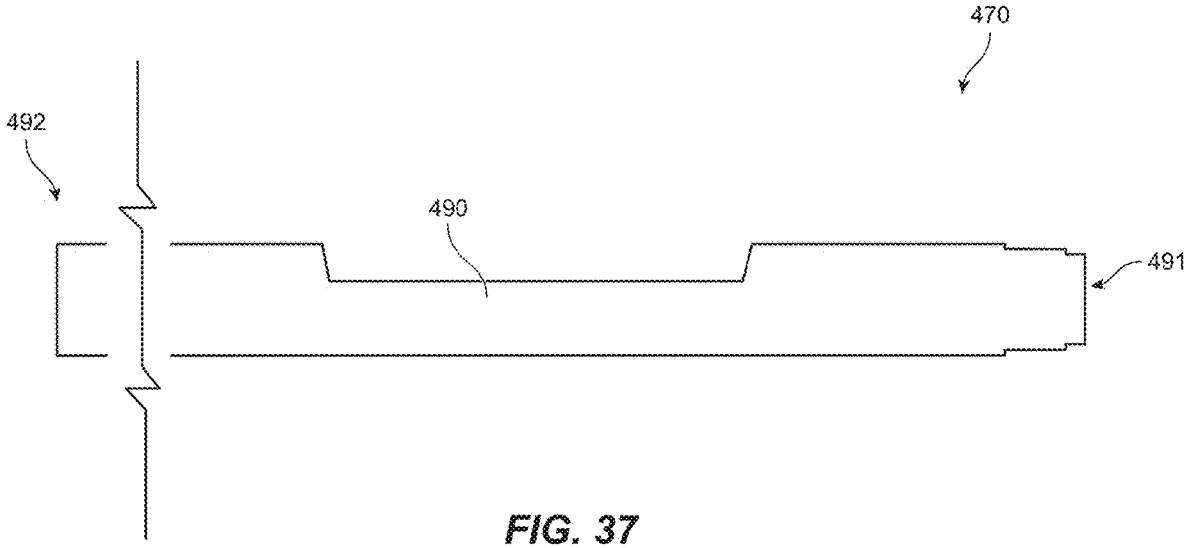
FIGS. 37-39 illustrate various views of components that can be used with a valve timing system.
Figure 38:
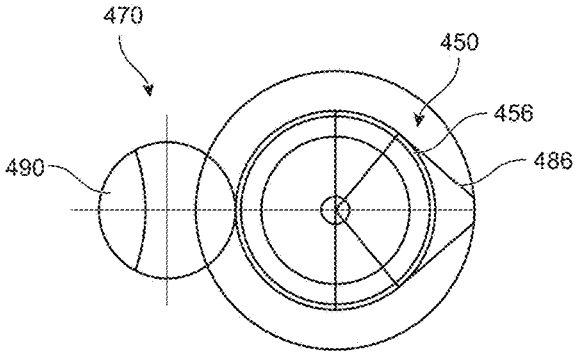

FIG. 37 illustrates a schematic side-section view of a configuration of the auxiliary shaft 470. FIG. 38 illustrates an axial view of the auxiliary shaft 470 aligned with the camshaft 450. The auxiliary shaft 470 can represent any of the auxiliary shafts described herein and can be used with any of the valve timing systems described herein. The auxiliary shaft 470 can include one or more cut-out sections or recessed regions 490 positioned between a first end 491 of the auxiliary shaft 470 and a second end 492 of the auxiliary shaft 470.

Figure 39:
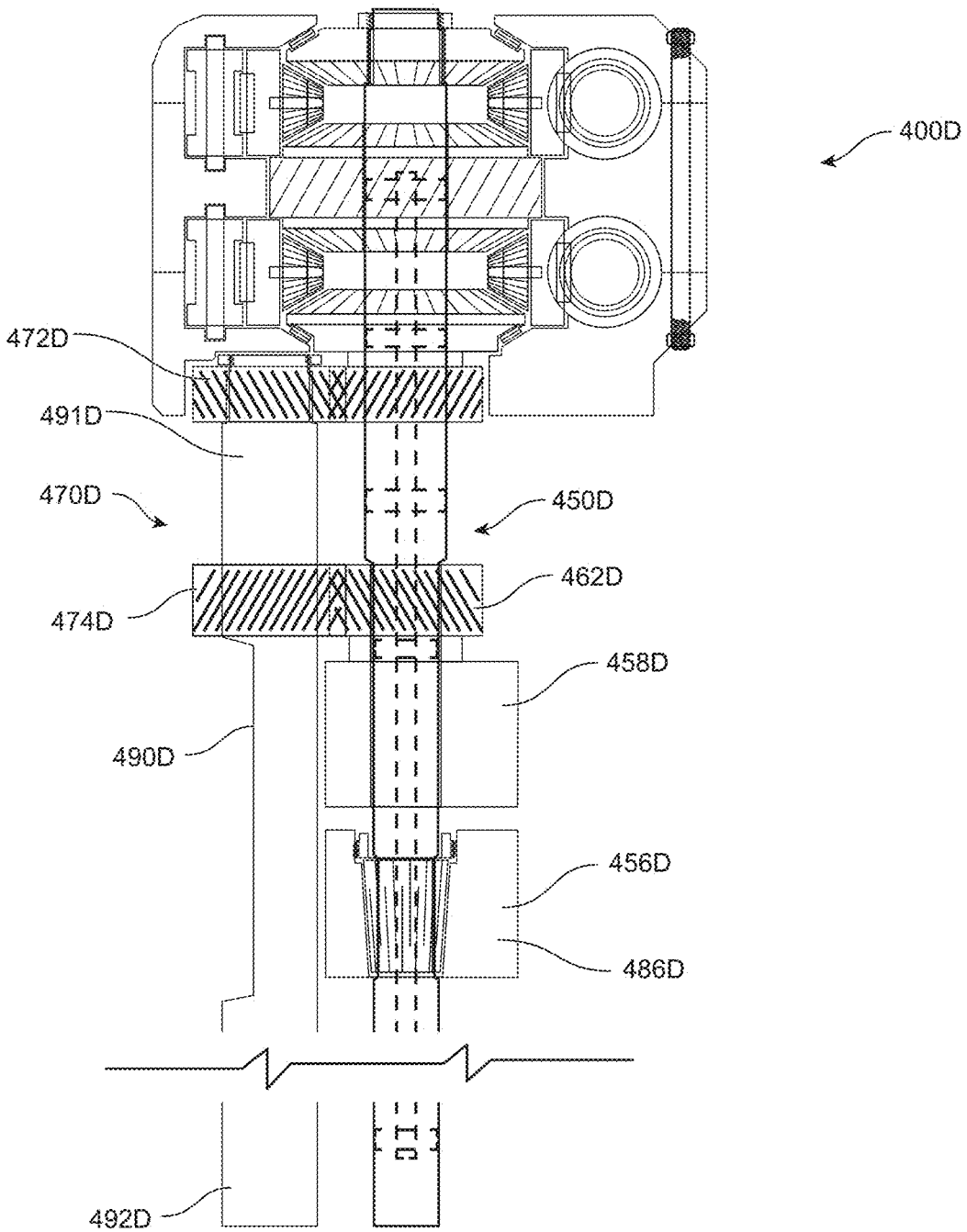

As shown in FIG. 39, the first end 491D of the auxiliary shaft 470D is configured to receive the first auxiliary shaft gear 472D. The cut-out sections 490D are sections of the auxiliary shaft 470D with a recess carved into the shaft diameter (i.e., the cut-out sections 490D extend into only a portion of the circumference of the auxiliary shaft 470D). The cut-out sections 490D are configured to allow the auxiliary shaft 470D and the camshaft 450D to rotate in close proximity together without interference between the cam lobes 456D of the first camshaft 450D and the body of the auxiliary shaft 470D. For example, the cut-out sections 490D can accommodate the nose 486D (see the nose portion 486 illustrated in FIG. 38) of the cam lobe 456D during rotation of the camshaft 450D and the auxiliary shaft 470D. Because the camshaft 450D and the auxiliary shaft 470D rotate at the same speed, the nose 486D can be aligned with the recessed regions 490 during rotation. Given the ability to adjust the orientation of the nose 486D in some embodiments, the cut-out sections 490D can span a sufficient cord length of the cross-section of the auxiliary shaft 470D to accommodate those anticipated adjustments.

FIG. 39 illustrates a configuration of the valve timing system 400D. As shown, the valve timing system 400D includes the auxiliary shaft 470D that includes the cut-out section 490D. The cut-out section 490D is axially positioned along the auxiliary shaft 470D such that the free lobe 458D and the fixed lobe 456D can be axially disposed within the region of the cut-out section 490D. While only a portion of the valve timing system 400D is shown, the auxiliary shaft 470D can include the cut-out section 490D along the length of the camshaft 450D for each fixed lobe 456D and each free lobe 458D.

Including one or more cut-out sections in the auxiliary shaft can provide an advantage of allowing the camshaft and the auxiliary shaft to be positioned closer together in a valve timing system, which can reduce the size of the valve timing system. Additionally, this arrangement allows the components that extend between the camshaft and the auxiliary shaft to have a reduced size, such as the second auxiliary shaft gears, the free cam gears, etc. Reducing the size of the components in the valve timing system reduces the cost of the system and the amount of space taken up in the internal combustion engine.

Valve Systems

Figure 40:
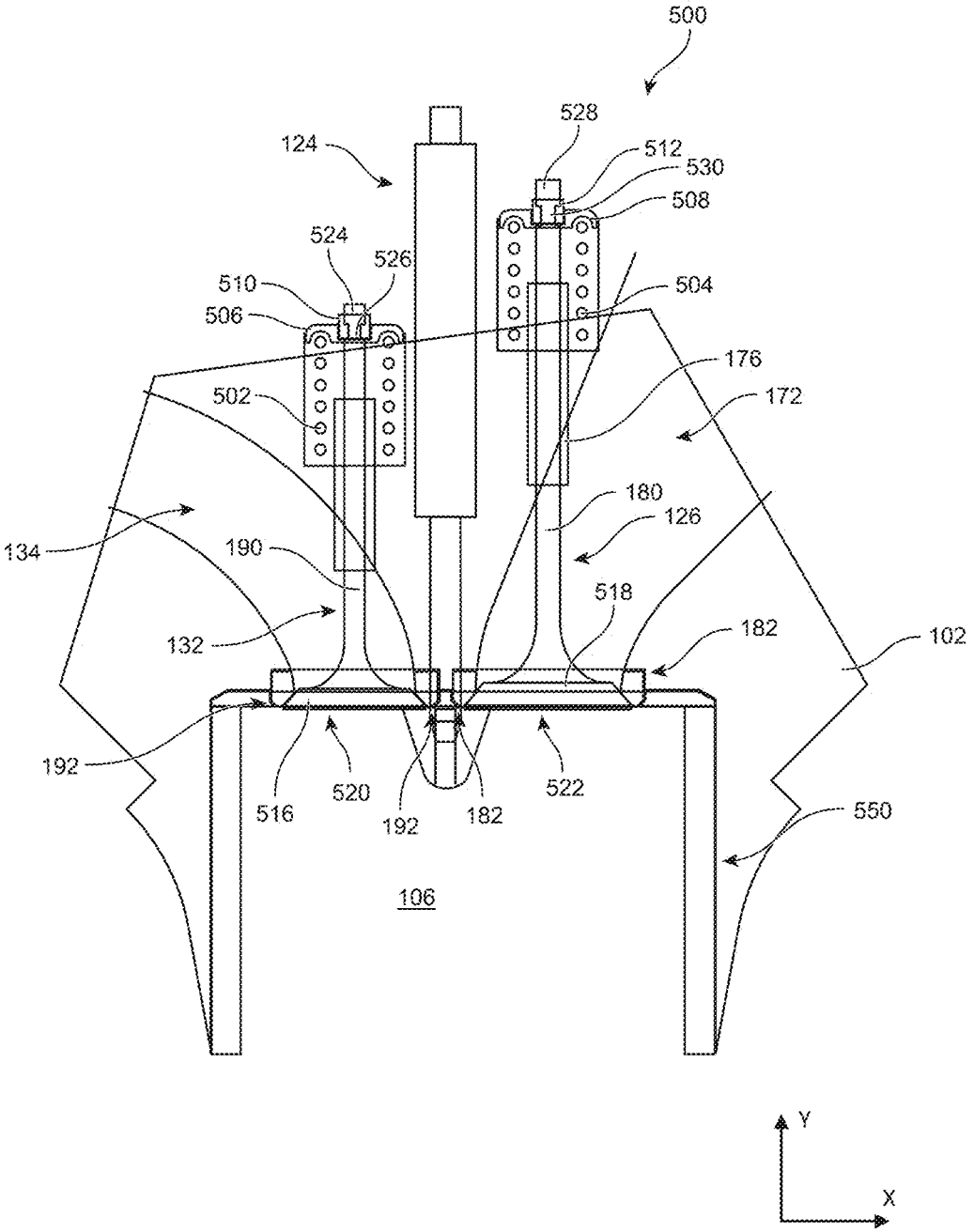
FIG. 40 illustrates a schematic section view of a valve system that can be used with the internal combustion engine of FIG. 1.

FIG. 40 illustrates a schematic sectional view of a configuration of a valve system 500. FIG. 40 illustrates the general working of valves within the valve system 500. The valve system 500 illustrated in FIG. 40 can be used with any suitable valve actuator systems, including those described herein.

The illustrated valve system 500 may include one or more exhaust valves 132, one or more intake valves 126, one or more exhaust valve seats 192, one or more intake valve seats 182, one or more intake valve guides 176, one or more exhaust valve guides 186, one or more exhaust valve springs 502, one or more intake valve springs 504, one or more exhaust valve spring retainers 506, one or more intake valve spring retainers 506, one or more exhaust valve spring collets 510, and one or more intake valve spring collets 512.

In some configurations, the valve system 500 is used with the internal combustion engine 100 that includes one or more fuel injectors 124. With continued reference to FIG. 40, the valve system 500 is illustrated in conjunction with the internal combustion engine 100 that comprises the cylinder bore 106, the uniblock 102, the exhaust passages 134, the intake passages 556, and the combustion chamber 104. The valve system 500 can be used with any suitable internal combustion engine.

In the illustrated valve system 500, the exhaust valves 132 may include an exhaust valve head 516 and the intake valves 126 may include an intake valve head 518. Each of the exhaust valve heads 516 comprises an exhaust combustion face 520 and each of the intake valve heads 518 includes an intake combustion face 522. Each of the exhaust valves 132 comprises the exhaust valve stem 190. Each exhaust valve stem 190 comprises an exhaust valve tip 524 and an exhaust valve keeper groove 526. Each of the intake valves 126 comprises the intake valve stem 190. Each intake valve stem 190 comprises an intake valve tip 528 and an intake valve keeper groove 530. While FIG. 40 illustrates only one intake valve 126 and one exhaust valve 132, each combustion chamber 104 generally comprises two exhaust valves 132 and two intake valves 126 (see e.g., FIGS. 49-51).

In the valve system 500, the exhaust valves 132 and the intake valves 126 are arranged such that the exhaust valves 132 and the intake valves 126 are positioned above and partially within the combustion chamber 104. For example, the inserts that define the intake valve seats 182 and the inserts that define the exhaust valve seats 192 are positioned within the uniblock 102. The inserts are aligned with the exhaust passages 134 and the intake passages 172. Generally, the exhaust valve stems 190 and the intake valve stems 180 are substantially parallel to each other. For example, the exhaust valve stems 190 and the intake valve stems 180 may be at approximately a 90-degree angle relative to a horizontal axis. In other words, the exhaust valve stems 190 and the intake valve stems 180 are parallel with the axis of the cylinder bore 106. The exhaust valve stems 190 can be inserted through the exhaust valve guides 186 and the intake valve stems 180 can be inserted through the intake valve guides 176. The exhaust valves 132 are positioned such that the exhaust valve heads 516 are aligned with and in contact with the exhaust valve seats 192 when the exhaust valves 132 are in the closed position or in a default position. The intake valves 126 are positioned such that the intake valve heads 518 are aligned with and in contact with the intake valve seats 182 when the intake valves 126 are in the closed position or in a default position. In this position, the exhaust valve combustion faces 520 and the intake valve combustion faces 522 are directed towards the combustion chamber 104.

In operation, the exhaust valves 132 and the intake valves 126 move from the closed configured (e.g., illustrated in FIG. 40) to an open position. In the open position, the exhaust valves 132 and the intake valves 126 move downward and into the combustion chamber 104, allowing gases within the combustion chamber 104 to be exchanged with outside environments via the exhaust passages 134 and the intake passages 172. The intake valves 126 and the exhaust valves 132 move between the open and closed positions under the control of one of the actuator systems described further herein.

In some configurations, including the configuration illustrated in FIG. 40, one fuel injector 124 is positioned between the exhaust valve 132 and the intake valve 126. Generally, one or more fuel injector 124 can be located near the center of the combustion chamber 104, such that the fuel injector 124 can be positioned between each pair of the intake valves 126 and each pair of the exhaust valves 132 (see e.g., FIGS. 49-51).

For each intake valve 126, the valve stem 180 is coupled to the intake valve spring retainer 508 by the intake spring collet 512 at the keeper groove 530. The intake valve spring retainer 508 holds the intake valve spring 504 in place. The intake valve spring retainer 508 creates a compressive force on the intake valve spring 504 when the intake valve 126 moves from the closed position to the open position.

In operation, an actuator system provides a downwards force on the intake valve tip 528. The force on the intake valve tip 528 causes the intake valve spring retainer 508 to move downward, compressing the intake valve spring 504 and moving the intake valve head 518 away from the intake valve seat 182 and into the combustion chamber 104 (e.g., into the open position). As the force on the intake valve tip 528 decreases or is removed (e.g., as the cam lobe continues to rotate), the compression in the intake valve spring 504 moves the intake valve 126 upwardly such that the intake valve head 518 moves out of the combustion chamber 104 and returns to contact the intake valve seat 182. The intake valve 126 moves from the closed position and the opened position when force is applied to the intake valve tip 528 while the internal combustion engine 100 is operating.

For each exhaust valve 132, the valve stem 190 is coupled to the exhaust valve spring retainer 506 by the exhaust spring collet 510 at the keeper groove 526. The exhaust valve spring retainer 506 holds the exhaust valve spring 502 in place. The exhaust valve spring retainer 506 creates a compressive force on the exhaust valve spring 502 when the exhaust valve 132 moves from the closed position to the open position.

In operation, an actuator system provides a downwards force on the exhaust valve tip 524. The force on the exhaust valve tip 524 causes the exhaust valve spring retainer 506 to move downward, compressing the exhaust valve spring 502 and moving the exhaust valve head 516 away from the exhaust valve seat 192 and into the combustion chamber 104 (e.g., into the open position). As the force on the exhaust valve tip 524 decreases or is removed (e.g., as the cam lobe continues to rotate), the compression in the exhaust valve spring 502 moves the exhaust valve 132 upwardly such that the exhaust valve head 516 moves out of the combustion chamber 104 and returns to contact the exhaust valve seat 192. The exhaust valve 132 moves from the closed position and the opened position when force is applied to the exhaust valve tip 524 while the internal combustion engine 100 is operating.

In some configurations, the intake valve stems 180 and the exhaust valve stems 190 may be generally vertical, such that the intake valve stems 180 and the exhaust valve stems 190 are at a minimum angle relative to the vertical Y-axis. The minimal angle may be at an angle between 0 degrees and 45 degrees (e.g., between 0 degrees and 45 degrees, between 0 degrees and 35 degrees, between 0 degrees and 25 degrees, between 0 degrees and 15 degrees, and at values between the foregoing ranges, etc.) relative to the y-axis. In some configurations, the intake valve stems 180 and the exhaust valve stems 190 may be angled relative to the vertical Y-axis. For example, the intake valve stems 180 and the exhaust valve stems 190 may be at an angle between 15 degrees and 60 degrees (e.g., between 15 degrees and 60 degrees, between 20 degrees and 50 degrees, between 25 degrees and 4-degrees, and any values between the foregoing ranges, etc.) relative to the Y-axis.

Figure 41:
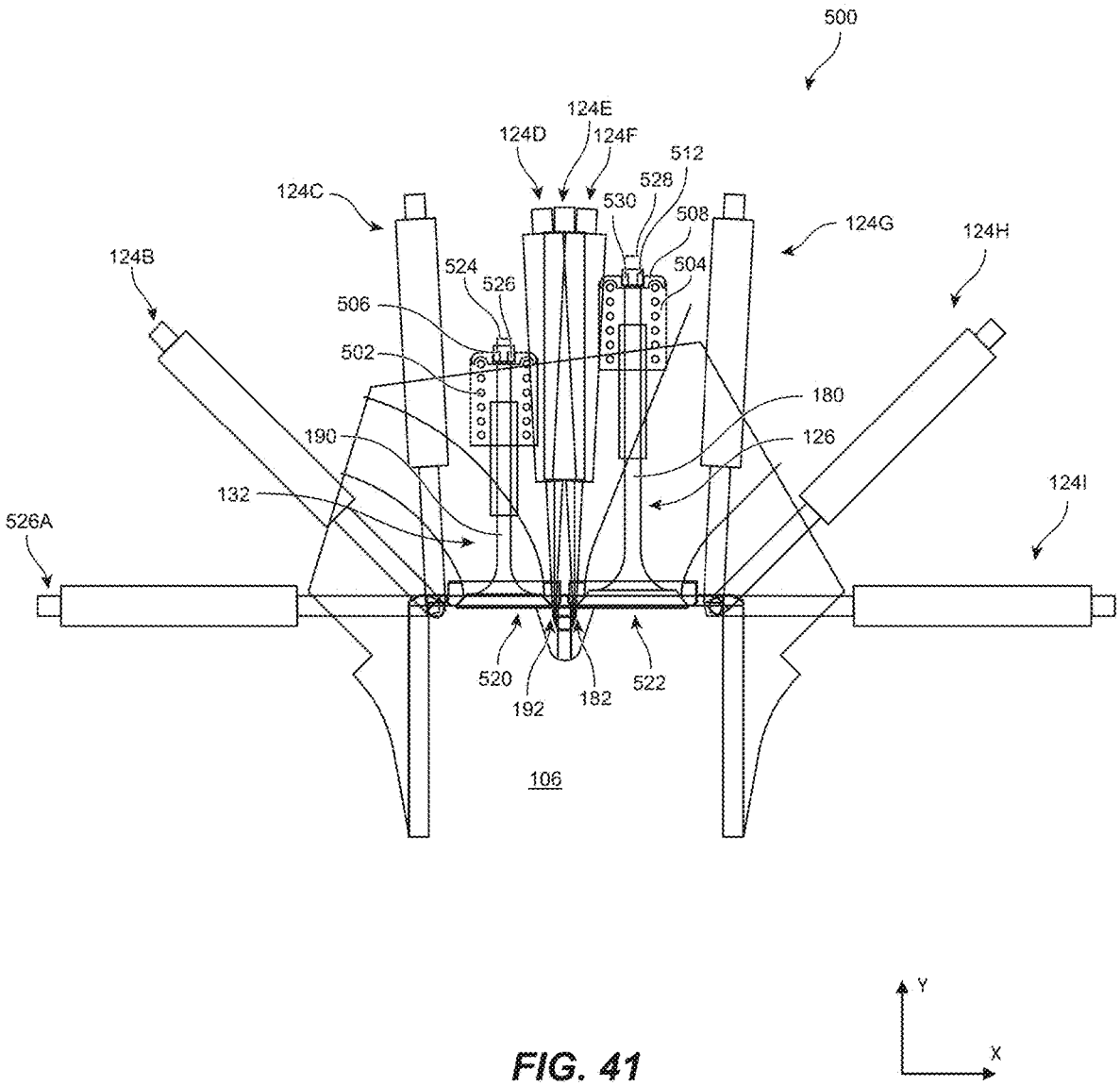
FIG. 41 illustrates a schematic section view of the valve system of FIG. 40 with additional fuel injectors.

FIG. 41 illustrates a schematic sectional view of the valve system 500 with additional fuel injectors 124. As shown, the valve system 500 can include a plurality of fuel injectors 124A-124I, which can be at various positions relative to the combustion chamber 104. For example, the configuration illustrated in FIG. 41 includes nine fuel injectors 124. However, the valve system 500 can include more or less fuel injectors 124. In the illustrated configuration, the fuel injectors 124A-124I are positioned approximately horizontal relative to the combustion chamber 104 (i.e., at approximately a 90-degree angle relative to the vertical Y axis). The fuel injectors 124A, 124I are positioned to inject fuel near the edges of the combustion chamber 104. Similarly, the fuel injectors 124B, 124H are positioned at an angle between 0-degrees and 90-degrees (e.g., approximately 45-degrees) relative to the vertical Y axis, and are positioned to inject fuel near the edges of the combustion chamber 104. Similarly, the fuel injectors 124C, 124G are positioned at an angle between 45-degrees and 0-degrees relative to the vertical Y axis, and are positioned to inject fuel near the edges of the combustion chamber 104. The fuel injectors 124D, 124F are positioned at an angle between 0-degrees and 15-degrees relative to the vertical Y axis, and are positioned to inject fuel closer to the center of the combustion chamber 104. Similarly, the fuel injector 126E is positioned at approximately a 0-degree angle relative to the vertical Y axis, and is positioned to inject fuel closer to the center of the cylinder.

Having more than one fuel injector 124 may provide certain benefits. For example, multiple different types of fuel may be used in the same combustion chamber 104 when there are multiple fuel injectors 124. Use of multiple types of fuel may provide benefits of using different fuels for different operating conditions and different efficiencies created by the internal combustion engine 100.

Valve Actuator Systems

FIGS. 42-85 illustrate various valve actuation systems. The valve actuation systems are configured to cause the intake valves 126 and/or the exhaust valves 132 to move between the opened position and the closed position.

Generally, the intake valves 126 and/or the exhaust valves 132 are actuated through a series of mechanical linkages. In some configurations, the valve actuation systems include pushrods that generate the forces on the mechanical linkages to actuate the intake valves 126 and/or the exhaust valves 132. In some configurations, the valve actuation systems include cam lobes rotationally coupled to camshafts that generate the forces on the mechanical linkages to actuate the intake valves 126 and/or the exhaust valves 132.

Generally, the valve actuation systems include one or more lash adjusters. The lash adjusters may be used to maintain zero valve clearance in the engine. For example, lash adjusters may be coupled to a rocker arm to maintain lash. In some examples, a lash adjuster may be positioned above the pivot point in the rocker arm. In some examples, a lash adjuster may be positioned below the pivot point in the rocker arm. In some configurations, the lash control can be angled. For example, a triangle configuration may help to keep the lash adjusters out of the way of the intake valve opening 122 and/or the exhaust valve opening 130.

In some configurations, the valve actuation systems include one or more rocker arms as part of the mechanical linkages. The rocker arms may rotate about pivot points. In some configurations, the pivot points may be near or at the center of the rocker arms. In some configurations, the pivot points may be be at or near an end of the rocker arms. As the rocker arms rotate about the pivot points, the rocker arms may actuate the intake valves 126 and/or the exhaust valves 132. In some configurations, the rocker arms may actuate the intake valves 126 and/or the exhaust valves 132 directly (e.g., by contacting the intake valve tips 528 and/or the exhaust valve tips 524). In some configurations, the rocker arms may actuate the intake valves 126 and/or the exhaust valves 132 indirectly (e.g., through additional mechanical linkages).

Figure 42:
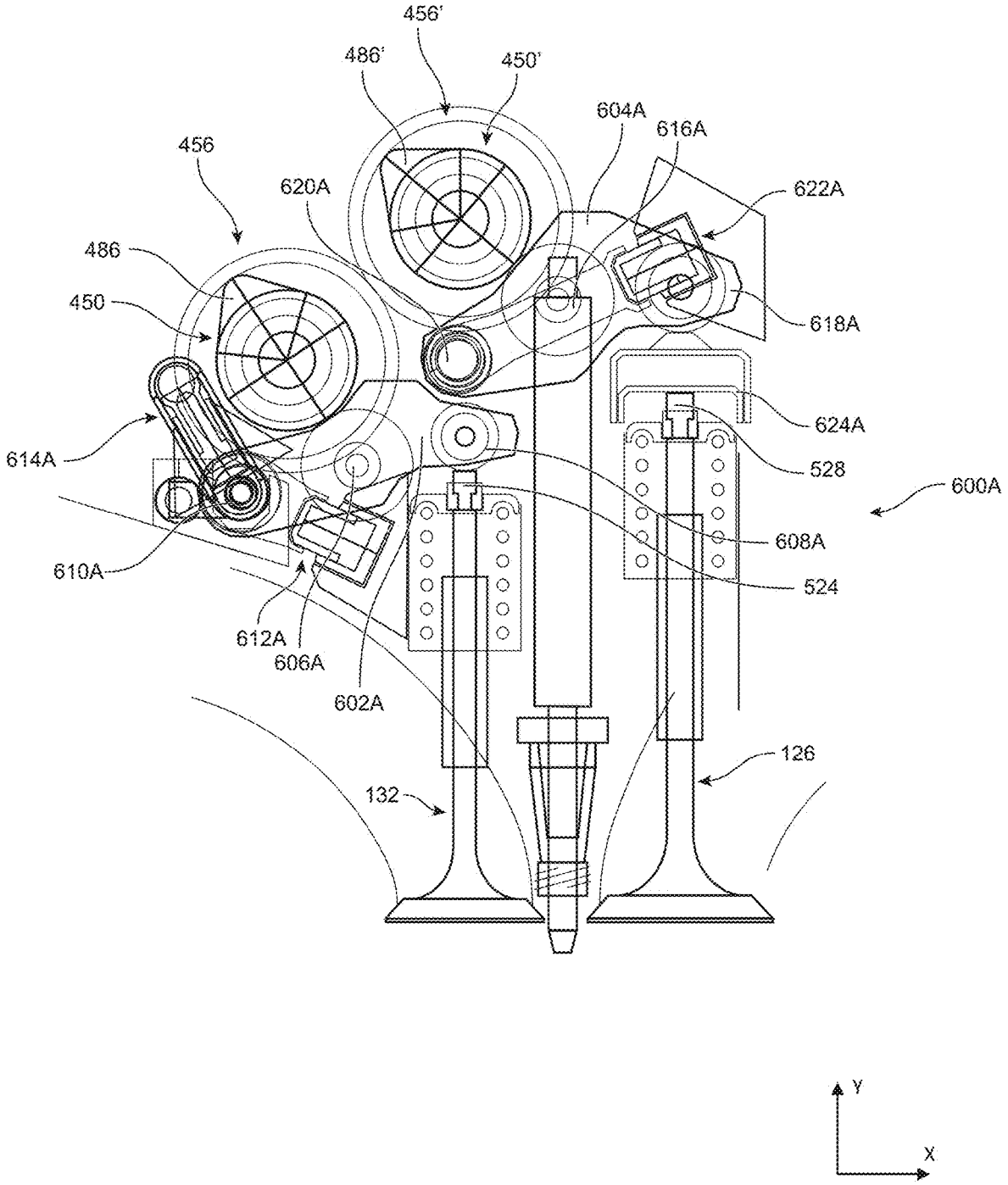
FIG. 42 illustrates a schematic section view of a configuration of a valve actuation system.

FIG. 42 illustrates a schematic sectional view of a configuration of a valve actuation system 600A. The valve actuation system 600A may be used with any of the valve timing systems described herein. For example but without limitation, the valve actuation system 600A of FIG. 42 may be used with the valve timing system 400A shown in FIGS. 15 and 16 or the valve timing system 400A' shown in FIG. 17. The valve actuation system 600A is configured to actuate at least one exhaust valve 132 and at least one intake valve 126 in the valve system 500. Generally, the valve actuation system 600A is configured to actuate two exhaust valves 132 and two intake valves 126 in the valve system 500.

With reference still to FIG. 42, in the illustrated valve actuation system 600A, the first camshaft 450 and the second camshaft 450' provide the driving forces for the valve actuation system 600A using a plurality of first cam lobes 456 and a plurality of second cam lobes 456' respectively. The first camshaft 450 comprises the first cam lobe 456 to cause movement of the first exhaust valve 132 and the second camshaft 450' comprises the second cam lobe 456' to cause movement of the intake valve 126. The first camshaft 450 and the second camshaft 450' may be any of the camshafts described herein. Similarly, the first cam lobe 456 and the second cam lobe 456' may be any of the lobes described herein.

The valve actuation system 600A may include a first rocker arm 602A and a second rocker arm 604A. The first rocker arm 602A is configured to actuate one or both of the exhaust valves 132. The second rocker arm 604A is configured to actuate one or both of the intake valves 126.

The first rocker arm 602A comprises a first cam follower 606A and a first finger 608A. The first rocker arm 602A is configured to pivot about a first pivot point 610A. The first rocker arm 602A may be supported at the first pivot point 610A by at least one lash adjuster. For example, in the configuration illustrated in FIG. 42, the first rocker arm 602A is supported at the first pivot point 610A by a first lash adjuster 612A and a second lash adjuster 614A.

As shown more clearly in a similar system (i.e., the valve actuation system 600D illustrated in FIG. 60), the body of the first lash adjuster 612A and the second lash adjuster 614A may extend around the first rocker arm 602A. The first pivot point 610A may comprise a rod that extends through the first rocker arm 602A. The rod can be coupled to the first lash adjuster 612A and the second lash adjuster 614A. A central axis about which the first cam lobe 456 rotates may be above both of the first lash adjuster 612A and the second lash adjuster 614A.

The first lash adjuster 612A can extend downwardly from the first pivot point 610A in a direction towards the combustion chamber 104. The first lash adjuster 612A may be at an angle relative to the X-axis and the Y-axis. The second lash adjuster 614A may extend upwardly from the first pivot point 610A in a direction away from the combustion chamber 104. The second lash adjuster 614A may be at an angle relative to the X-axis and the Y-axis. In this arrangement, the first lash adjuster 612A and the second lash adjuster 614A provide opposite horizontal and vertical forces on the first pivot point 610A.

In operation, as the first cam lobe 456 rotates, the first cam follower 606A acts as a guide roller for the first cam lobe 456. When the nose portion 486 of the first cam lobe 456 contacts the first cam follower 606A, the first rocker arm 602A rotates about the first pivot point 610A, which causes the first finger 608A to depress the exhaust valve 132. The first finger 608A indirectly or directly contacts the exhaust valve tip 524 of the exhaust valve 132, which moves the exhaust valve 132 into the open position. As the first cam lobe 456 continues to rotate, the nose portion 486 moves out of contact with the first cam follower 606A. As a result of the rotation, the spring tension in the compressed exhaust valve spring 502 causes the exhaust valve 132 to return to the closed position.

The second rocker arm 604A comprises a second cam follower 616A and a second finger 618A. The second rocker arm 604A is configured to pivot about a second pivot point 620A. The second rocker arm 604A may be supported at the second pivot point 620A by at least one lash adjuster. For example, in the configuration illustrated in FIG. 42, the second rocker arm 604A is supported at the second pivot point 620A by a third lash adjuster 622A.

As shown more clearly in a similar system (i.e., the valve actuation system 600D illustrated in FIG. 60), the body of the third lash adjuster 622A may extend around the rocker arm 604A. The second pivot point 620A may be a rod that extends through the second rocker arm 604A. The rod can be coupled to the third lash adjuster 622A on each end of its body. A central axis about which the second cam lobe 456' rotates can be above the third lash adjuster 622A. The third lash adjuster 622A may extend upwardly from the second pivot point 620A in a direction away from the combustion chamber 104. The third lash adjuster 622A can be at an angle relative to the X-axis and the Y-axis.

In operation, as the second cam lobe 456' rotates, the second cam follower 616A acts as a guide roller for the second cam lobe 456'. When the nose portion of the second cam lobe 456' contacts the second cam follower 616A, the second rocker arm 604A rotates about the second pivot point 620A, which causes the second finger 618A to depress the intake valve 126. The second finger 618A indirectly or directly contacts the intake valve tip 528 of the intake valve 126, which moves the intake valve 126 into the open position. As the second cam lobe 456' continues to rotate, the nose portion moves out of contact with the second cam follower 616A. As a result of the rotation, the spring tension in the compressed intake valve spring 504 causes the intake valve 126 to return to the closed position.

In some configurations, including the configuration illustrated in FIG. 42, the valve actuation system 600A may include a tappet 624A. The tappet 624A may be a hydraulic lifter. The tappet 624A may be positioned between the second finger 618A and the intake valve tip 528. As the second rocker arm 604A rotates, the second finger 618A may contact the tappet 624A, which in turn moves downwardly, forcing the intake valve 126 to move into the open position. This arrangement may provide a benefit of allowing the second rocker arm 604A to be positioned higher than first rocker arm 602A, while still allowing the second rocker arm 604A to actuate the intake valve 126.

Figure 43:
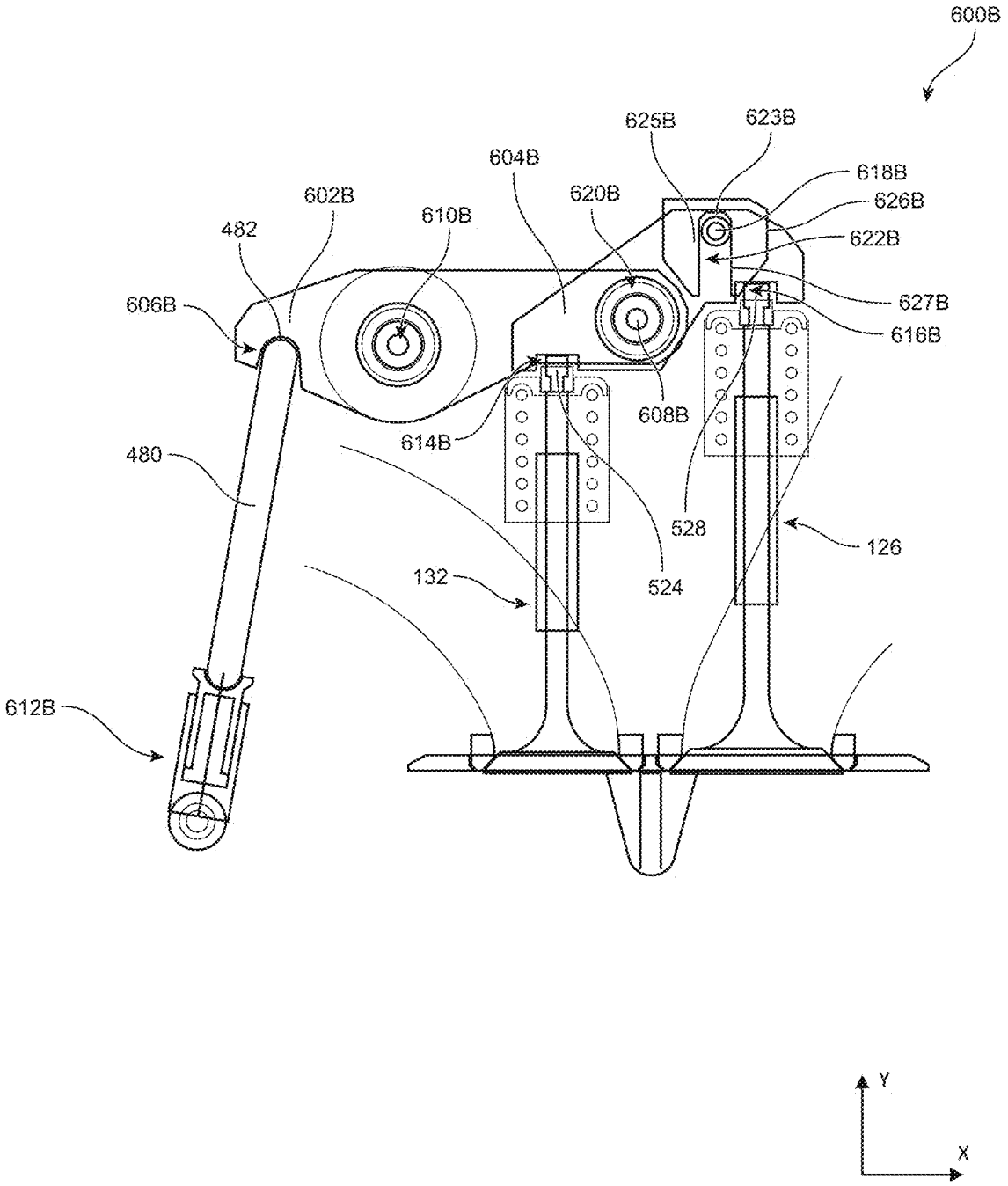
FIG. 43 illustrates a schematic section view of a configuration of another valve actuation system.

FIG. 43 illustrates a schematic sectional view of a configuration of the valve actuation system 600B. The valve actuation system 600B is configured to actuate the exhaust valves 132 and the intake valves 126 in the illustrated valve system 500. In some configurations, the valve actuation system 600B is configured to actuate one exhaust valve 132 and one intake valve 126 per combustion chamber 104. For example, the illustrated configuration would have a similar top view to that shown and described in FIGS. 49 and 50, except a pushrod provides the driving force in the valve actuation system 600B. In another configuration, the valve actuation system 600B is configured to actuate two exhaust valves 132 and two intake valves 126 per cylinder. For example, this configuration would have a similar top view as shown and described with reference to FIG. 51, except a pushrod provides the driving force in the valve actuation system 600B.

In the valve actuation system 600B illustrated in FIG. 43, the pushrod 480 provides the driving forces for the valve actuation system 600B. As discussed above, the pushrod 480 may be driven by the crankshaft 112 of the internal combustion engine 100. In some configurations, the pushrod 480 may be directly coupled to the crankshaft 112. In other configurations, the pushrod 480 may be indirectly coupled to the crankshaft 112 using one or more linkages, which may include the first lash adjuster 612B. In the example illustrated in FIG. 43, at least one exhaust valve 132 and at least one intake valve 126 are driven by the same pushrod 480. As noted above, in some configurations, both of the exhaust valves 132 and both of the intake valves 126 can be driven by the same pushrod 480.

The valve actuation system 600B may include a first rocker arm 602B and a valve actuating arm 604B. The first rocker arm 602B may be configured to drive the valve actuating arm 604B. The valve actuating arm 604B may be configured to move the exhaust valve 132 and the intake valve 126. The rocker arm 602B may comprise a pushrod slot 606B and a first finger 608B. As shown more clearly in FIGS. 49 and 50, the first finger 608B may include a pair of tines or prongs that extend around the valve actuating arm 604B. The rocker arm 602B is configured to pivot about a first pivot point 610B. The rocker arm 602B may be supported at the pushrod slot 606B by the pushrod 480. For example, a first end 482 of the pushrod 480 may be received in and/or connected to the rocker arm 602B at the pushrod slot 606B.

The valve actuating arm 604B may include a second finger 614B and a third finger 616B. The valve actuating arm 604B may include a paw 618B. The valve actuating arm 604B may be pivotably connected to the first rocker arm 602B at a second pivot point 620B. The valve actuating arm 604B is configured to pivot about the second pivot point 620B. The second pivot point 620B may be a rod that extends between the two tines of the first finger 608B. The rod that defines the second pivot point 620B also can extend through the valve actuating arm 604B.

The second finger 614B is configured to move the exhaust valve 132. The third finger 616B is configured to move the intake valve 126. In some configurations, including the configuration illustrated in FIG. 43, the third finger 616B extends a greater horizontal distance (e.g., along the x-axis) from the second pivot point 620B than the second finger 614B. More particularly, the point of contact between the third finger 616B and the intake valve 126 and is further from the second pivot point 620B than the point of contact between the second finger 614B and the exhaust valve 132. As a result of this arrangement, the second finger 614B acts as a shorter lever arm than the third finger 616B.

Figure 49:
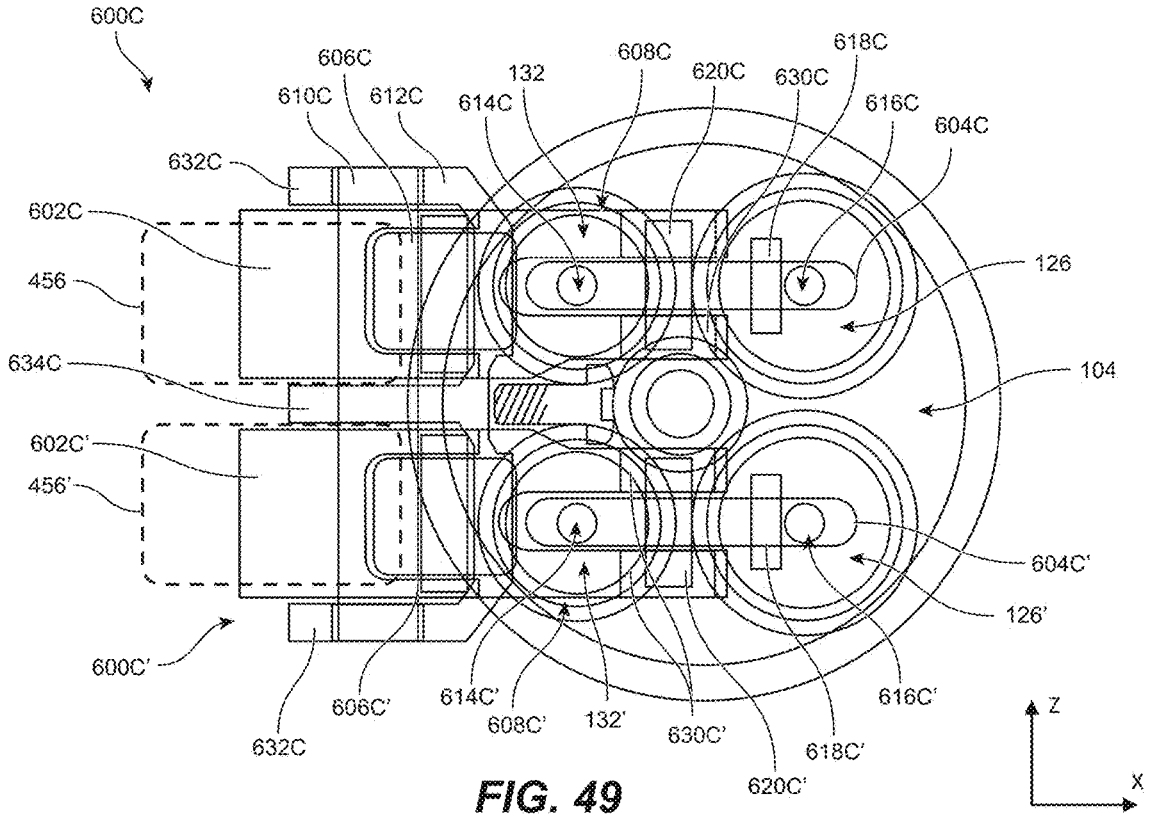
FIGS. 49-51 illustrate top schematic views of the valve actuation system of FIG. 48 in various configurations.
Figure 50:
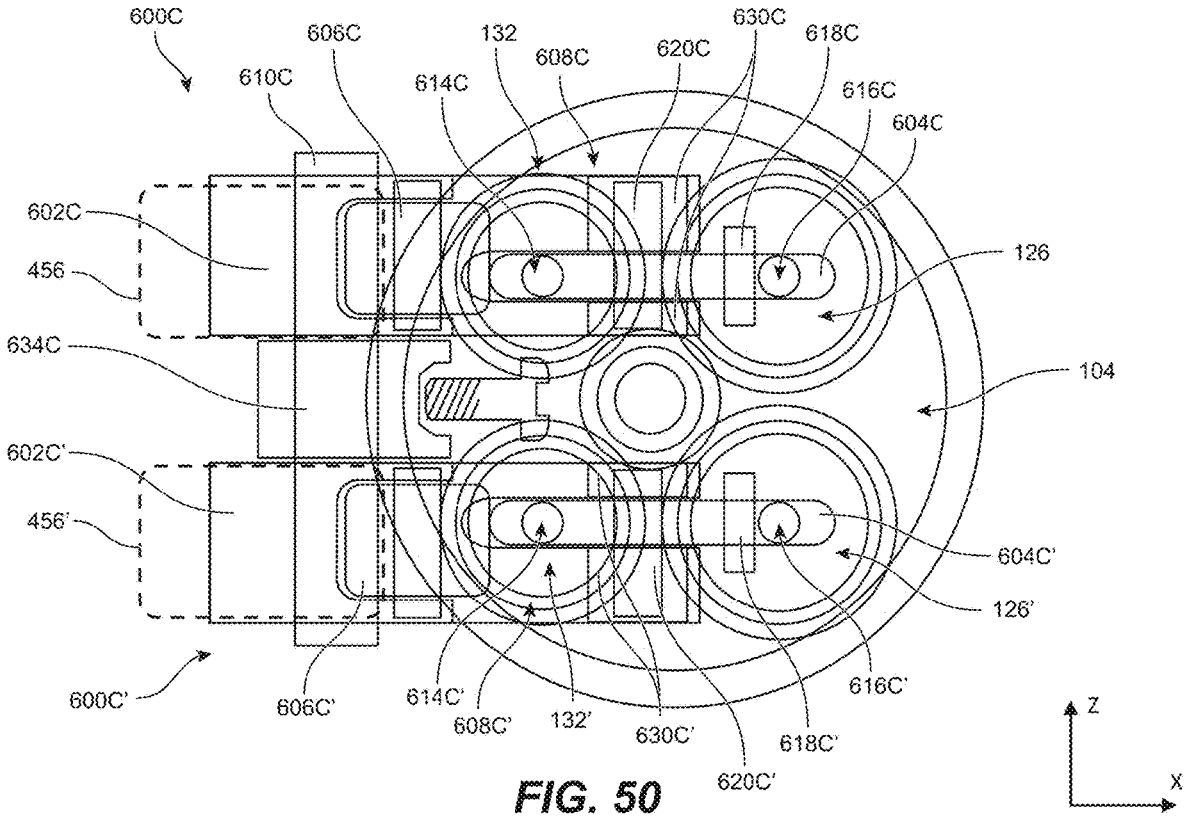

As shown more clearly in at least FIGS. 49 and 50, the paw 618B may comprise a rod. The paw 618B may extend out of one or both sides of the valve actuating arm 604B in the Z-direction (e.g., into and/or out of the page). The paw 618B may extend through the valve actuating arm 604B. The paw 618B is configured to be received in a paw slot 622B of a slot member 626B of the internal combustion engine 100. The paw member 626B may be any suitable shape that includes a paw slot 622B to receive the paw 618B. The interaction between the paw 618B and the paw slot 622B restrains the movement of the valve actuating arm 604B.

Figure 44:
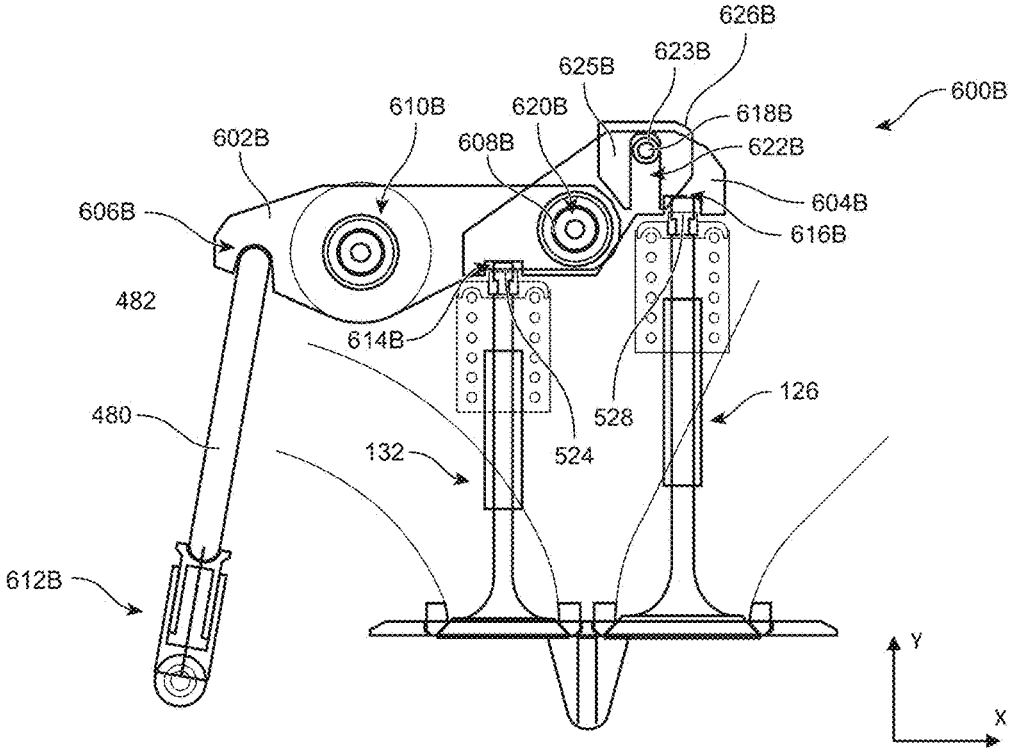
FIGS. 44-47 illustrate the operation of the valve actuation system of FIG. 43.
Figure 45:
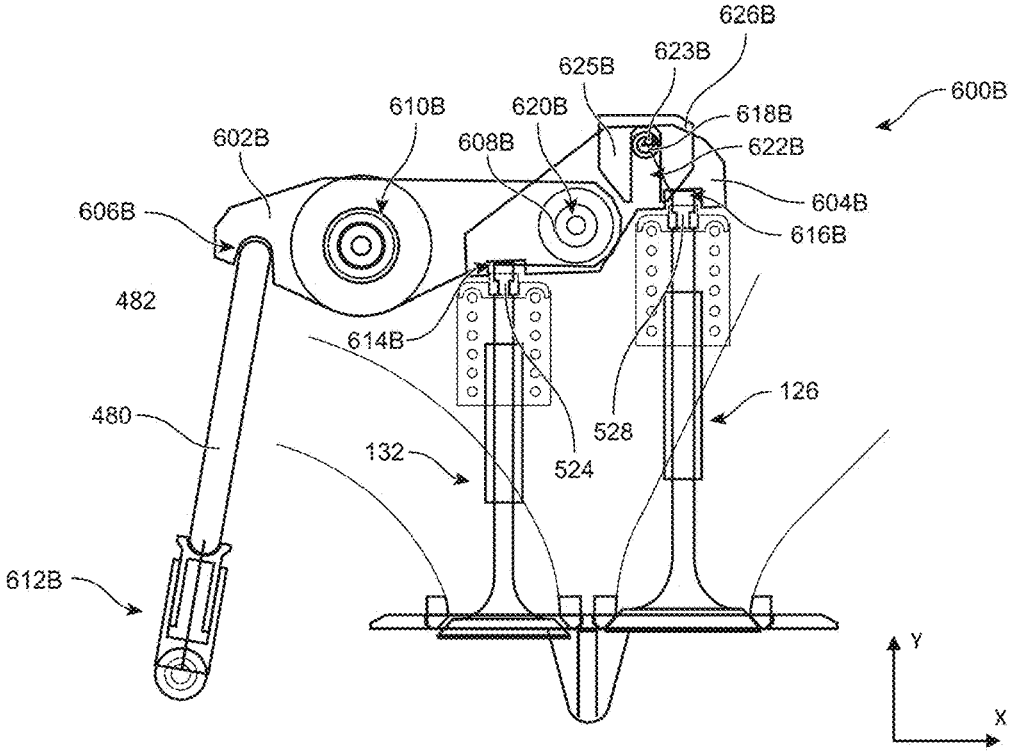
Figure 46:
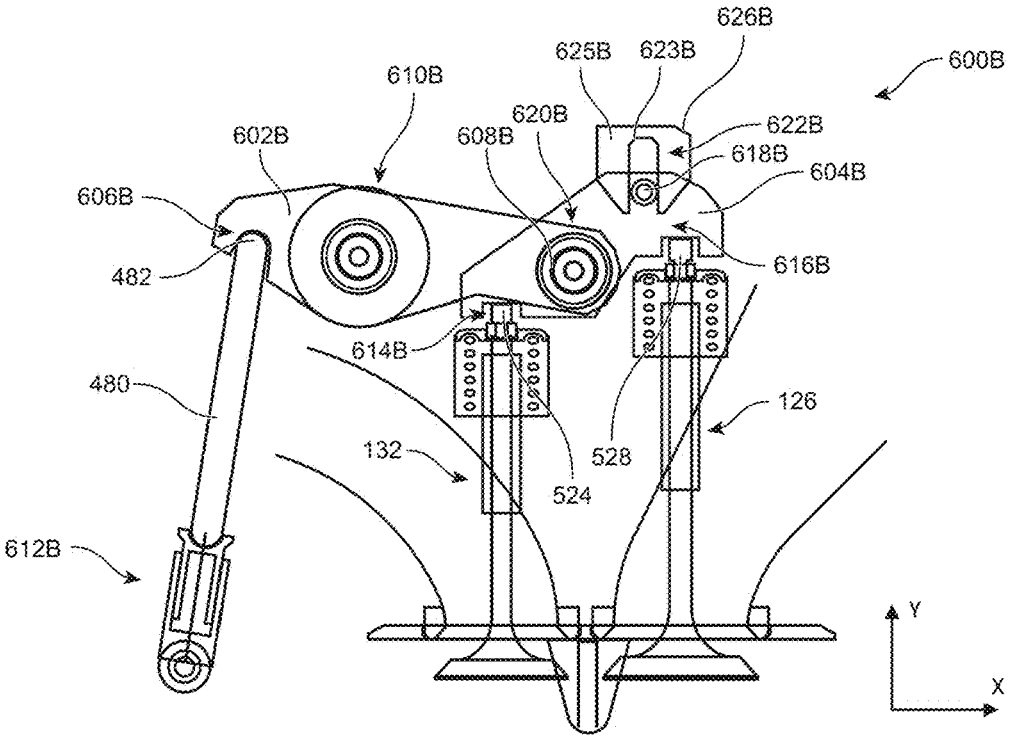
Figure 47:
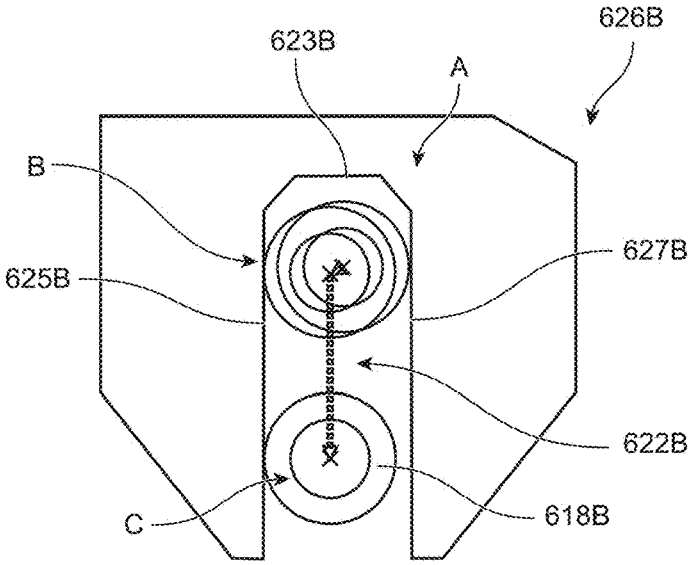

FIGS. 44-47 further illustrate the features and operation of the valve actuation system 600B. FIG. 44 illustrates the valve actuation system 600B when the intake valves 126 and the exhaust valves 132 are in the closed position. FIG. 45 illustrates the valve actuation system 600B when the exhaust valves 132 are initially opened. FIG. 46 illustrates the valve actuation system 600B when the intake valves 126 and the exhaust valves 132 are in the open position. FIG. 47 illustrates the three positions of the paw 618B within the paw slot 622B corresponding to the positions illustrated in FIGS. 44-46.

In operation, prior to beginning a valve cycle, the components of the valve actuation system 600B are in the positions illustrated in FIG. 44. In this position, the paw 618B may be in position A of FIG. 47, where the paw 618B is near the top of the paw slot 622B. Additionally, depending on the size of the paw slot 622B, the paw 618B may be in contact with a first/outside wall 627B of the paw slot 622B.

As the crankshaft 112 rotates, the pushrod 480 causes the rocker arm 602B to pivot in a first direction about the first pivot point 610B. When the pushrod 480 moves in an upward direction (e.g., in the positive Y direction), the rocker arm 602B rotates in the first direction (e.g., clockwise in the view illustrated in FIG. 44), which causes the first finger 608B to move in a downward direction (e.g., in the negative Y direction). Because the valve actuating arm 604B is pivotably connected to the rocker arm 602B at the second pivot point 620B, the valve actuating arm 604B initially pivots in a second direction (e.g., counterclockwise in the view illustrated in FIG. 32) as the valve actuating arm 604B is driven downwards. The valve actuating arm 604B pivots initially in the second direction in part because of the different lever arm lengths provided by the second finger 614B and the third finger 616B. As valve actuating arm 604B moves downwards and pivots about the second pivot point 620B, the second finger 614B begins to depress the exhaust valve 132. The second finger 614B indirectly or directly contacts the exhaust valve tip 524 of the exhaust valve 132, causing the exhaust valve 132 to move into the open position, as shown in FIG. 45. As the valve actuating arm 604B continues to move downwards and pivot in the second direction, spring compressive load builds in the exhaust valve spring 502. Additionally, movement of the valve actuating arm 604B causes the paw 618B to move within the paw slot 622B of the slot member 626B.

When the valve actuating arm 604B initially begins pivoting in the second direction, the paw 618B may travel in the paw slot 622B to position B of FIG. 47, where the paw 618B may contact a second/inside edge 625B and/or a top surface 623B of the paw slot 622B. Once the paw 618B contacts the inside edge 625B of the paw slot 622B, pivoting of the valve actuating arm 604B about the second pivot point 620B in the second direction is restricted (e.g., as shown in FIG. 47). At this point, when the valve actuating arm 604B continues to move downward, the third finger 616B begins to depress the intake valve 126. The third finger 616B indirectly or directly contacts the intake valve tip 528, causing the intake valve 126 to move into the open position. The open position is illustrated in FIG. 46. As the intake valve 126 is depressed, the paw 618B may travel downwards along the inside edge 625B of the paw slot 622B to position C of FIG. 47.

As the crankshaft 112 continues to rotate, the pushrod 480 stops providing an upwards force on the rocker arm 602C. As a result, the spring compressive load in the compressed exhaust valve springs 502 and the compressed intake valve springs 504 in the exhaust valves 132 and the intake valves 126 cause the exhaust valves 132 and the intake valves 126 to return to the closed position, as shown in FIG. 44.

The valve actuation system 600B may provide certain benefits in terms of valve timing and/or valve duration control. In one example, because of the arrangement of the rocker arm 602B and the valve actuating arm 604B, the exhaust valve 132 is opened prior to the intake valve 126. Additionally, in some configurations, the valve actuation system 600B may be configured such that both the intake valve 126 and the exhaust valve 132 are closed at approximately the same time. As such, the exhaust valve 132 may be open for longer than the intake valve 126. The amount of time the exhaust valve 132 opens before the intake valve 126 may be dependent upon a number of factors, including but not limited to the spring constant of the exhaust valve springs 502 and the intake valve springs 504, the relative sizes of the paw 618B and the paw slot 622B.

FIG. 48 illustrates a schematic sectional view of a configuration of the valve actuation system 600C. Some of the features of the valve actuation system 600C are similar to features of the valve actuation system 600B. Thus, reference numerals used to designate the various features or components of the valve actuation system 600C are identical to those used for identifying the corresponding features of components of the valve actuation system 600B, except that a "C" has been added to the numerical identifier. Therefore, the structure and operation of the various features of the valve actuation system 600B are understood to also apply to the corresponding features of the valve actuation system 600C, except as described below.

The valve actuation system 600C differs from the valve actuation system 600B primarily in that one or more lobes (e.g., first cam lobe 456) of the camshaft (e.g., camshaft 450) provide the driving force for the intake valves 126 and the exhaust valves 132 as opposed to the pushrod 480 of the valve actuation system 600B. Additionally, the first rocker arm 602C has a different shape than the first rocker arm 602B in part because of the different driving forces.

Figure 51:
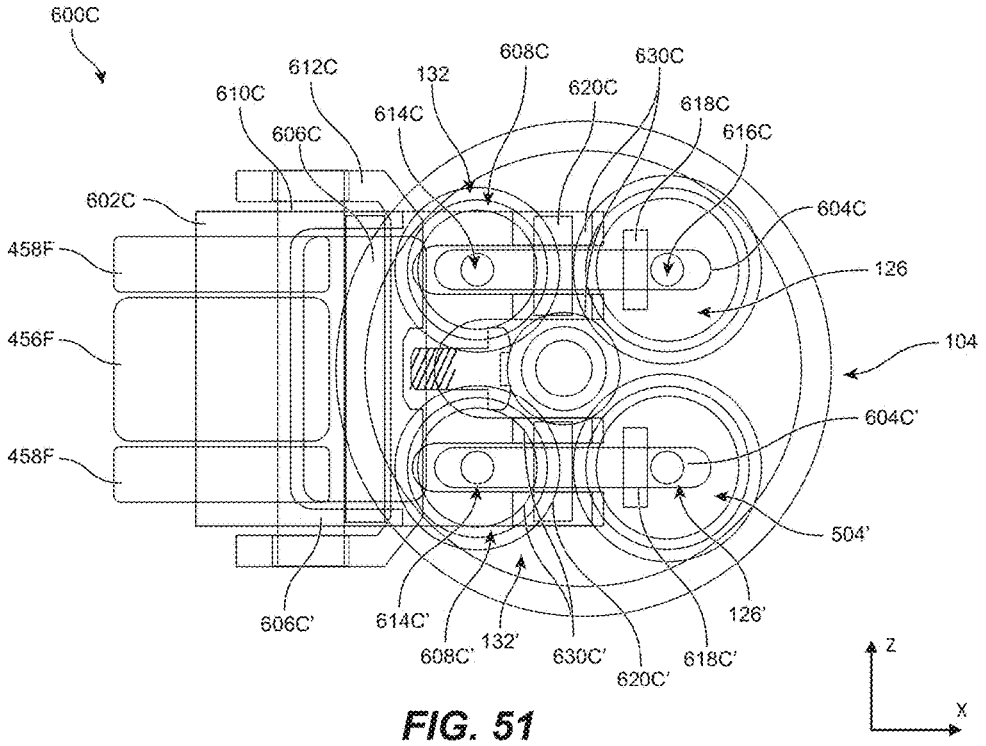

FIGS. 49-51 illustrate schematic top views of the valve actuation system 600C in various configurations. The different configurations may depend at least in part on the type of valve timing system that is used with the valve actuation system 600C. In the configurations illustrated in FIGS. 49 and 50, the valve actuation system 600C is configured to actuate the first exhaust valve 132 and the first intake valve 126 in the combustion chamber 104. As such, an additional valve actuation system 600C' is used to actuate the second exhaust valve 132' and the second intake valve 126'. Features of the valve actuation system 600C' are similar or identical to features of the valve actuation system 600C. Thus, reference numerals used to designate the various features or components of the valve actuation system 600C' are identical to those used for identifying the corresponding features of components of the valve timing system valve actuation system 600C, except that a "prime" has been added to the numerical identifier. Therefore, the structure and operation of the various features of the valve actuation system 600C are understood to also apply to the corresponding features of the valve actuation system 600C, except as described below.

With reference to FIG. 48, the valve timing system 400A, including the camshaft 450, provides the driving forces for the valve actuation system 600C using a plurality of cam lobes (e.g., the first cam lobe 456). In some configurations, the valve timing system 400A may optionally also include the auxiliary shaft 470. For example, the valve timing system 400A of FIG. 16, which does not include an auxiliary shaft 470, can be used to drive the valve actuation systems 600C, 600C' in the configurations illustrated in FIGS. 49 and 50. In another example, the valve timing system 400D of FIG. 30, which includes the auxiliary shaft 470D, can be used to drive the valve actuation systems 600C, 600C'. Any other valve timing system, including but not limited to the other valve timing systems 600 described herein, can be used to drive the valve actuation system 600C and/or valve actuation system 600C' in various configurations.

As illustrated in FIG. 48, the camshaft 450 includes the first cam lobe 456. The first cam lobe 456 drives the movement of the first exhaust valve 132 and the first intake valve 126. The first camshaft 450 may be any of the camshafts described herein. Similarly, the first cam lobe 456 may be any of the lobes described herein (e.g., the lobe 456A, the fixed lobes 456D, the free lobe 458D). The camshaft 450 comprises the second cam lobe 456' (e.g., FIGS. 49 and 50). The second cam lobe 456' drives the movement of the second exhaust valve 132' and the second intake valve 126'. The second cam lobe 456' may be any of the lobes described herein (e.g., the lobes 456A, the fixed lobes 456D, the free lobe 458D). In the example where the valve timing system 400D is used with the valve actuation system 600D, the first cam lobe 456 may represent one of the fixed lobes 456D and the second cam lobe 456' may represent one of the free lobes 458D, or vice versa.

The valve actuation system 600C may include the rocker arm 602C and the valve actuating arm 604C. The rocker arm 602C may be configured to move the valve actuating arm 604C. The valve actuating arm 604C may be configured to move the first exhaust valve 132 and the first intake valve 126.

The rocker arm 602C may include the cam follower 606C and the first finger 608C. As shown more clearly in FIGS. 49 and 50, the first finger 608B may include the pair of tines 630C. The pair of tines 630C extend around the valve actuating arm 604C. The rocker arm 602C is configured to pivot about the first pivot point 610C.

The rocker arm 602C may be supported at the first pivot point 610C by at least one lash adjuster. For example, in the configuration illustrated in FIG. 48, the rocker arm 602C is supported at the first pivot point 610C by the first lash adjuster 612C. The first lash adjuster 612C may be positioned in a slotted guide 628C. The slotted guide 628C may be a portion of the engine housing. The slotted guide 628C may be a separate guide (e.g., a machined guide) placed in the engine housing. In the configuration illustrated in FIG. 49, the body 632C of the lash adjuster 612C may extend around both the first rocker arm 602C and the first rocker arm 602C' with a central member 634C of the first lash adjuster 612C being positioned between the first rocker arm 602C and the first rocker arm 602C'.

In the configuration illustrated in FIG. 50, the first lash adjuster 612C may not include the stirrup shaped body 632C shown in FIG. 49. In the configuration shown in FIG. 50, the central member 634C is positioned between the first rocker arm 602C and the first rocker arm 602C'. The first pivot point 610C may be a rod that extends through the first rocker arm 602C and that is coupled to first lash adjuster 612C.

In the configuration illustrated in FIG. 49, the first pivot point 610C extends through both the first rocker arm 602C and the first rocker arm 602C' and the first pivot point 610C is coupled to the body 632C and/or the central member 634C. In the configuration illustrated in FIG. 50, the first pivot point 610C extends through both the first rocker arm 602C and the first rocker arm 602C' and the first pivot point 610C is coupled to the central member 634C.

The central axis of the camshaft 450 may be above the first lash adjuster 612C. In some configurations, the central axis of the auxiliary shaft 470 may be above the first lash adjuster 612C. The first lash adjuster 612C may extend upwardly from the first pivot point 610C in a direction away from the combustion chamber 104. The first lash adjuster 612C may be at an angle relative to the X-axis and the Y axis. The first lash adjuster 612C may extend between the V-shaped first rocker arm 602C between the two main points of contact for the first rocker arm 602C (e.g., the location of the cam follower 606C where the first cam lobe 456 exerts a force on the first rocker arm 602C and the location of the second pivot point 620C where the first rocker arm 602C exerts a force on the valve actuating arm 604C. The angle of the first lash adjuster 612C may be selected to balance the forces on the first rocker arm 602C.

The valve actuating arm 604C may include the second finger 614C and the third finger 616C. The valve actuating arm 604C may include the paw 618C. The valve actuating arm 604C may be pivotably coupled to the rocker arm 602C at the second pivot point 620C. As shown in FIGS. 49 and 50, the second pivot point 620C may be a rod that extends between the tines 630C of the first rocker arm 602C and through the second rocker arm 604C. The valve actuating arm 604C is configured to pivot about the second pivot point 620C. The second finger 614C is configured to actuate the first exhaust valve 132. The third finger 616C is configured to actuate the first intake valve 126. In some configurations, including the configuration illustrated in FIG. 48, the third finger 616C extends a greater horizontal distance (e.g., along the X-axis) from the second pivot point 620C than the second finger 614C is from the second pivot point 620C. More particularly, the point of contact between the third finger 616C and the intake valve 126 and is further from the second pivot point 620C than the point of contact between the second finger 614C and the exhaust valve 132. As a result of this arrangement, the second finger 614C acts as a shorter lever arm than the third finger 616C.

As shown more clearly in at least FIGS. 49 and 50, the paw 618C may have a rod. The paw 618C may extend out of one or both sides of the valve actuating arm 604C in the z-direction (e.g., into and/or out of the page in the view illustrated in FIG. 48). The paw 618C may extend through the valve actuating arm 604C. The paw 618C is configured to be received in the paw slot 622C of the slot member 626C of the internal combustion engine 100. The paw member 626C may be any suitable shape that includes the paw slot 622C. The paw slot 622C receives the paw 618C. The interaction between the paw 618C and the paw slot 622C restrains the movement of the valve actuating arm 604C.

As noted above, the valve actuation system 600C actuates the first set of intake valves 126 and exhaust valves 132 in a similar manner as the valve actuation system 600B. However, the valve actuation system 600C is driven by the camshaft 450 instead of the pushrod 480. In operation, as the first cam lobe 456 rotates, the cam follower 606C acts as a guide roller for the first cam lobe 456. When the nose portion 486 of the first cam lobe 456 contacts the cam follower 606C, the first rocker arm 602C pivots about the first pivot point 610C in the first direction (e.g., clockwise in the view illustrated in FIG. 48), which causes the first finger 608C to move in a downward direction (e.g., in the negative Y direction). Because the valve actuating arm 604C is pivotably coupled to the rocker arm 602C at the second pivot point 620C, the valve actuating arm 604C initially pivots in the second direction (e.g., counterclockwise in the view illustrated in FIG. 48) when the valve actuating arm 604C is driven downwards. The valve actuating arm 604C pivots initially in the second direction in part because of the different lever arm lengths provided by the second finger 614C and the third finger 616C. When the valve actuating arm 604C moves downwards and pivots about the second pivot point 620C, the second finger 614C begins to depress the first exhaust valve 132. The second finger 614C indirectly or directly contacts the exhaust valve tip 524, causing the first exhaust valve 132 to move into the open position (see e.g., FIG. 45). As the valve actuating arm 604C continues to move downwards and pivot in the second direction, the spring load builds in the exhaust valve spring 502. Additionally, movement of the valve actuating arm 604C causes the paw 618C to move within the paw slot 622C. As the valve actuating arm 604C initially begins rotating in the second direction, the paw 618C may travel in the paw slot 622C and may contact the second/inside edge 625C and/or the top surface 623C of the paw slot 622C (see e.g., position B of FIG. 47). Once the paw 618C contacts the inside edge 625C of the paw slot 622C, the rotation of the valve actuating arm 604C about the second pivot point 620C in the second direction is restricted (see e.g., FIG. 45). As the first cam lobe 456 continues to engage the cam follower 606C with the nose portion 486, the valve actuating arm 604C continues to move downward and the third finger 616C begins to depress the first intake valve 126. The third finger 616C indirectly or directly contacts the intake valve tip 528 of the first intake valve 126, causing the first intake valve 126 to move into the open position (see, e.g., FIG. 46). As the first intake valve 126 is depressed, the paw 618C may travel downwards along the inside edge 625C of the paw slot 622C (see e.g., position C of FIG. 47). As the first cam lobe 456 continues to pivot, the nose portion 486 moves out of contact with the cam follower 606C. As a result, the spring load in the compressed exhaust valve springs 502 and the compressed intake valve springs 504 cause the first intake valve 126 and the first exhaust valve 132 to return to the closed position.

With reference to FIGS. 49 and 50, the valve actuation system 600C' functions in the same manner as the valve actuation system 600C. The valve actuation system 600C' moves the second exhaust valve 132' and the second intake valve 126'. Because the first exhaust valve 132 and the first intake valve 126 are operated independently of the second exhaust valve 132' and the second intake valve 126', the first exhaust valve 132 and the first intake valve 126 can be actuated at a different time than the second exhaust valve 132' and the second intake valve 126', depending on the arrangement of the first lobes 456 and the second lobes 456'. For example, the second exhaust valve 132' and the second intake valve 126' can be actuated slightly after the first exhaust valve 132 and the first intake valve 126, increasing the valve duration.

FIG. 51 illustrates an additional configuration of the valve actuation system 600C. In the configuration illustrated in FIG. 51, the first rocker arm 602C includes a first finger 608C including a pair of tines 630C and a second finger 608C' including a pair of tines 630C'. The first rocker arm 602C includes a single cam follower 606C. The configuration illustrated in FIG. 51 functions in the same manner as the valve actuation system 600C in the configurations illustrated in FIGS. 49 and 50, except that the first exhaust valve 132 and the first intake valve 126 are actuated at the same time as the second exhaust valve 132' and the second intake valve 126'. The valve actuation system 600C illustrated in FIG. 51 can be driven by one of more lobes 456. For example, when used with the valve timing system 400A, the single lobe 456A can be used to actuate all of the valves in the combustion chamber 104. In this example, the valve timing system 400A would include one lobe 456A per combustion chamber 104. In another example, the valve timing system 400F can be used to actuate the valve actuation system 600C, where two free lobes 458F and one fixed lobe 456F all contact the cam follower 606C. This arrangement is schematically illustrated in FIG. 51. In this configuration, the free lobes 458F and the fixed lobe 456F can include nose portions that are offset from each other (see e.g., FIG. 32). When the noses of the free lobes 458F and the fixed lobe 456F are offset, the valve duration will be generally be increased, because each nose contacts and continues to actuate the valve actuation system 600C longer than a single nose of a single lobe 456.

Figure 52:
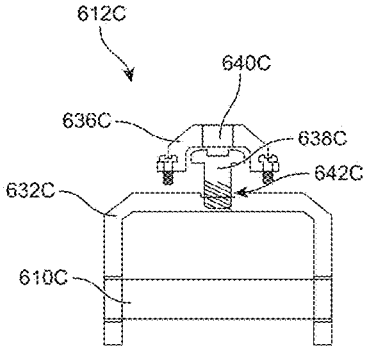
FIGS. 52-54 illustrate schematic side views of lash adjusters that can be used with a valve actuation system.
Figure 53:
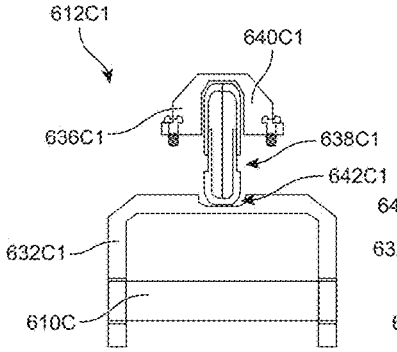
Figure 54:
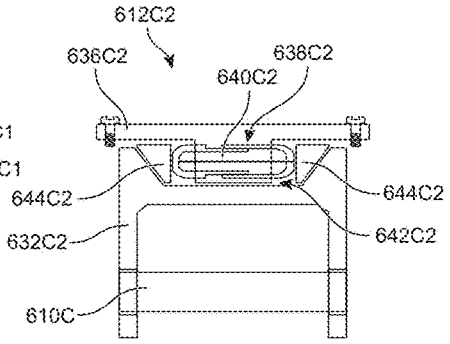
Figure 55:
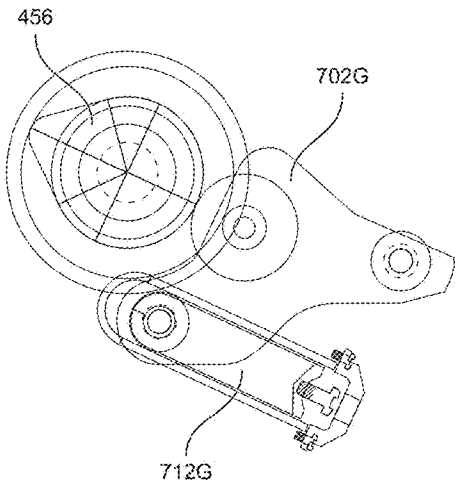
FIGS. 55-58 illustrate schematic side views of various additional lash adjusters that can be used with a valve actuation system.
Figure 56:
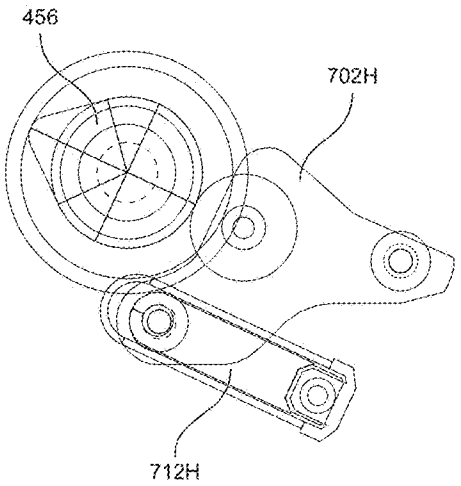
Figure 57:
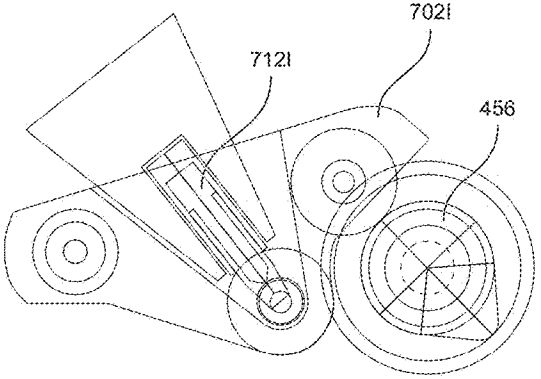
Figure 58:
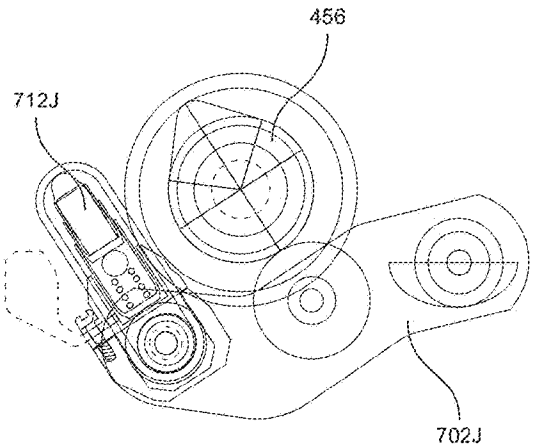

FIGS. 52-54 illustrate various configurations of lash adjusters 612 that may be used with the valve actuation systems described herein (e.g., the valve actuation system 600C). Any of the lash adjusters 612 illustrated in FIGS. 52-54 can function as the first lash adjuster 612C of the valve actuation system 600C of FIG. 48, for example but without limitation. For example, the lash adjusters 612 can receive a force generator to maintain lash.

FIG. 52 illustrates a schematic side view of the first lash adjuster 612C. The first lash adjuster 612C may include the body 632C, the backplate 636C, and the threaded fastener/screw 638C. The first lash adjuster 612C is configured to maintain lash within the valve system 500. For example, the screw 638C may exert a force (e.g., act as a force generator) on the body 632C to maintain lash. The body 632C may be stirrup-shaped and may be configured to extend around one or more rocker arms (e.g., first rocker arm 602C, first rocker arm 602C', etc.). The first pivot point 610C extends through the body 632C.

The body 632C may include a screw slot 642C. The screw slot 642C can receive and/or couple with the screw 638C. In some configurations, the screw slot 642C is threaded to mate with the threads of the screw 638C. The backplate 636C may be fixed within the internal combustion engine 100. The backplate 636C may include the opening 640C configured to be positioned above the screw 638C. The opening 640C may allow an operator to insert a tool to adjust the screw 638C and, as a result, adjust the desired lash.

FIG. 53 illustrates a schematic side view of the hydraulic lash adjuster 612C1. The hydraulic lash adjuster 612C1 may be used as the first lash adjuster 612C in the valve actuation system 600C. The hydraulic lash adjuster 612C1 may include the body 632C1, the backplate 636C1, and the hydraulic cylinder 638C1. The hydraulic lash adjuster 612C1 is configured to maintain lash within the valve system 500. For example, the hydraulic cylinder 638C1 may exert a force (e.g., act as a force generator) on the body 632C1 to maintain lash. The body 632C1 may be stirrup-shaped and may be configured to extend around one or more rocker arms (e.g., first rocker arm 602C, first rocker arm 602C1, etc.). The first pivot point 610C extends through the body 632C1.

The body 632C1 may include the cylinder slot 642C1. The cylinder slot 642C1 receives and/or couples with the hydraulic cylinder 638C1. The backplate 636C1 may be fixed within the internal combustion engine 100. The backplate 636C1 may include an opening 640C1 that is configured to receive the hydraulic cylinder 638C1. The hydraulic cylinder 638C1 may be coupled to the backplate 636C1.

FIG. 54 illustrates a schematic side view of a hydraulic lash adjuster 612C2. The hydraulic lash adjuster 612C2 may be used as the first lash adjuster 612C in the valve actuation system 600C. The hydraulic lash adjuster 612C2 may include the body 632C2, the backplate 636C2, and the hydraulic cylinder 638C2. The body 632C2 may be stirrup-shaped and may be configured to extend around one or more rocker arms (e.g., first rocker arm 602C, first rocker arm 602C1, etc.). The first pivot point 610C extends through the body 632C2.

The body 632C2 may include the cylinder slot 642C2. The cylinder slot 642C1 receives and/or couples with the hydraulic cylinder 638C2. The pair of wedges 644C2 may be positioned on either side of the hydraulic cylinder 638C2 within the cylinder slot 642C2. The hydraulic lash adjuster 612C2 is configured to maintain lash within the valve system 500. For example, the hydraulic cylinder 638C2 may exert a force on the pair of wedges 644C2, which in turn exert a force on the body 632C2 to maintain lash. The backplate 636C2 may be fixed within the engine.

The backplate 636C2 may include an extension member 640C2 configured to extend into the cylinder slot 642C2 and couple with the hydraulic cylinder 638C2. The arrangement of the hydraulic cylinder 638C2 within the cylinder slot 642C2 may allow for the size of the hydraulic lash adjuster 612C2 to be reduced, which may provide space saving benefits within the engine.

FIGS. 55-58 illustrate schematic side views of various additional lash adjusters 712G-712J that can be used with any of the valve actuation systems 600 described herein. The lash adjusters 712G-712J are shown in conjunction with various rocker arms 702G-702J as well as cam lobes 456.

Figure 59:
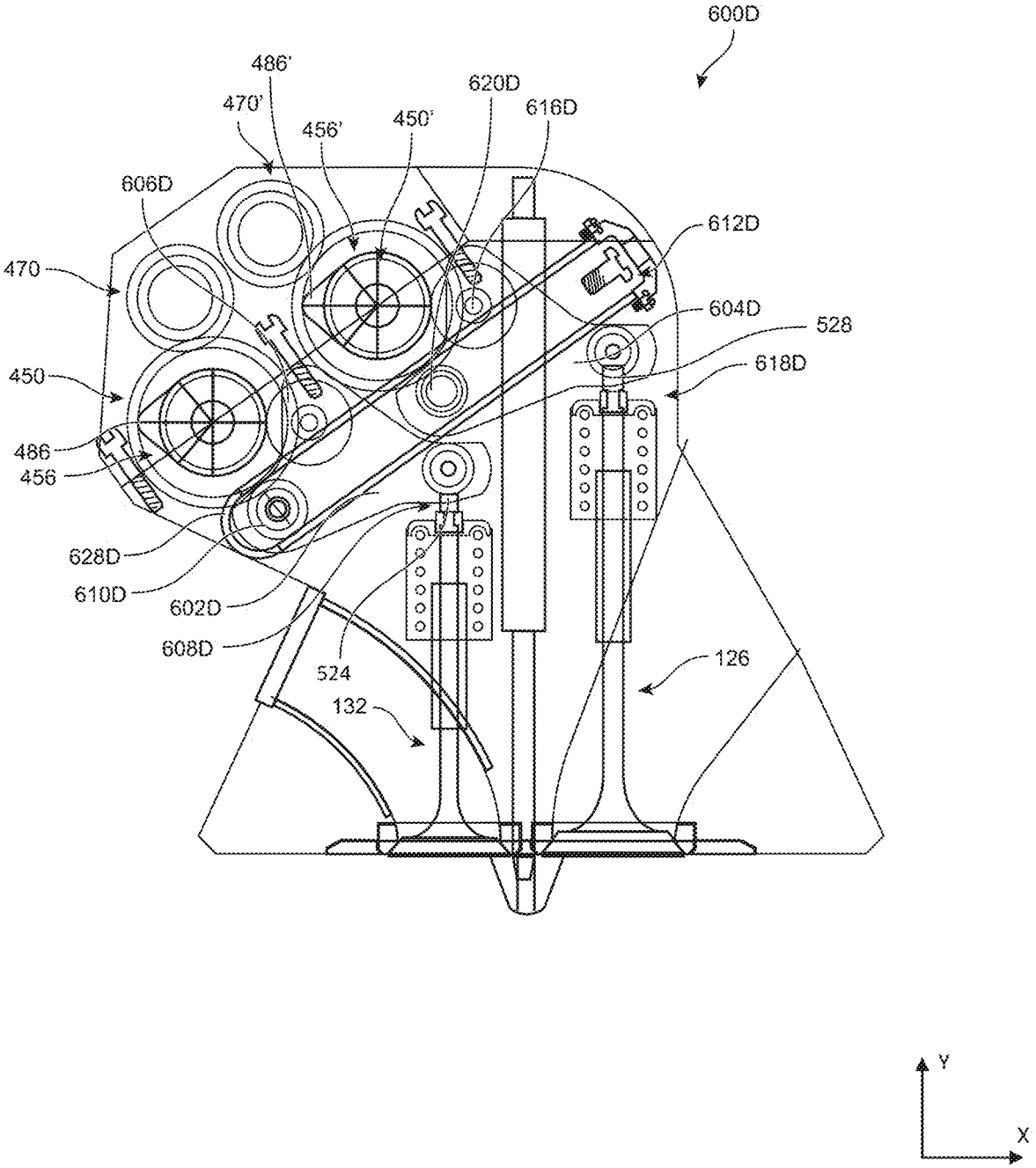
FIG. 59 illustrates a schematic section view of a configuration of another valve actuation system.

FIG. 59 illustrates a schematic sectional view of a configuration of the valve actuation system 600D. Some of the features of the valve actuation system 600D are similar to features of the valve actuation system 600A illustrated in FIG. 42. Thus, reference numerals used to designate the various features or components of the valve actuation system 600D are identical to those used for identifying the corresponding features of components of the valve actuation system 600C illustrated in FIG. 42, except that a "D" has been added to the numerical identifier. Therefore, the structure and operation of the various features of the valve actuation system 600A are understood to also apply to the corresponding features of the valve actuation system 600D, except as described below.

The valve actuation system 600D differs from the valve actuation system 600A primarily in that a single lash adjuster 612D can be used to maintain lash in both the first rocker arm 602D and the second rocker arm 604D. FIGS. 64-69 illustrate various configurations of the single lash adjuster 612D. The shapes of the first rocker arms 602D and the second rocker arms 604D may also differ. Additionally, the first rocker arm 602C has a different shape than the first rocker arm 602B in part because of the different driving forces. For ease of explanation, the various features of the valve actuation system 600D will be described below with reference to the various configurations illustrated in FIGS. 60-63.

Figure 60:
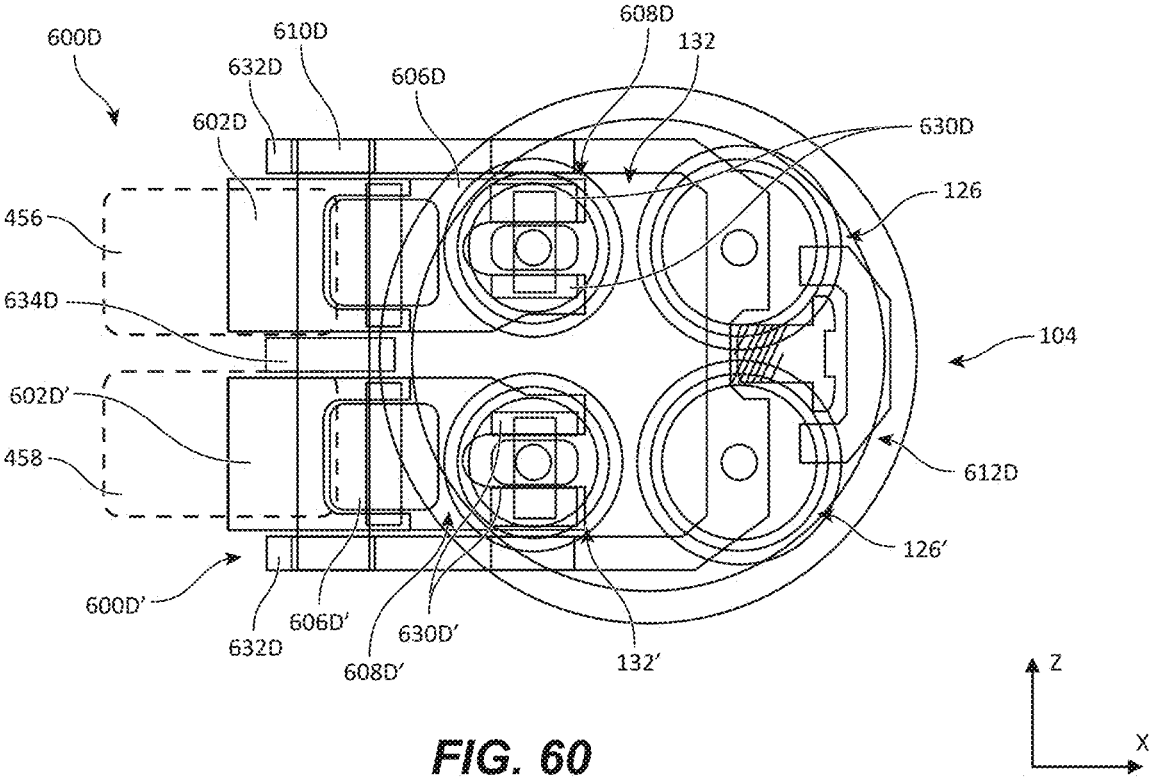
FIGS. 60-63 illustrate top schematic views of the valve actuation system of FIG. 48 in various configurations.
Figure 61:
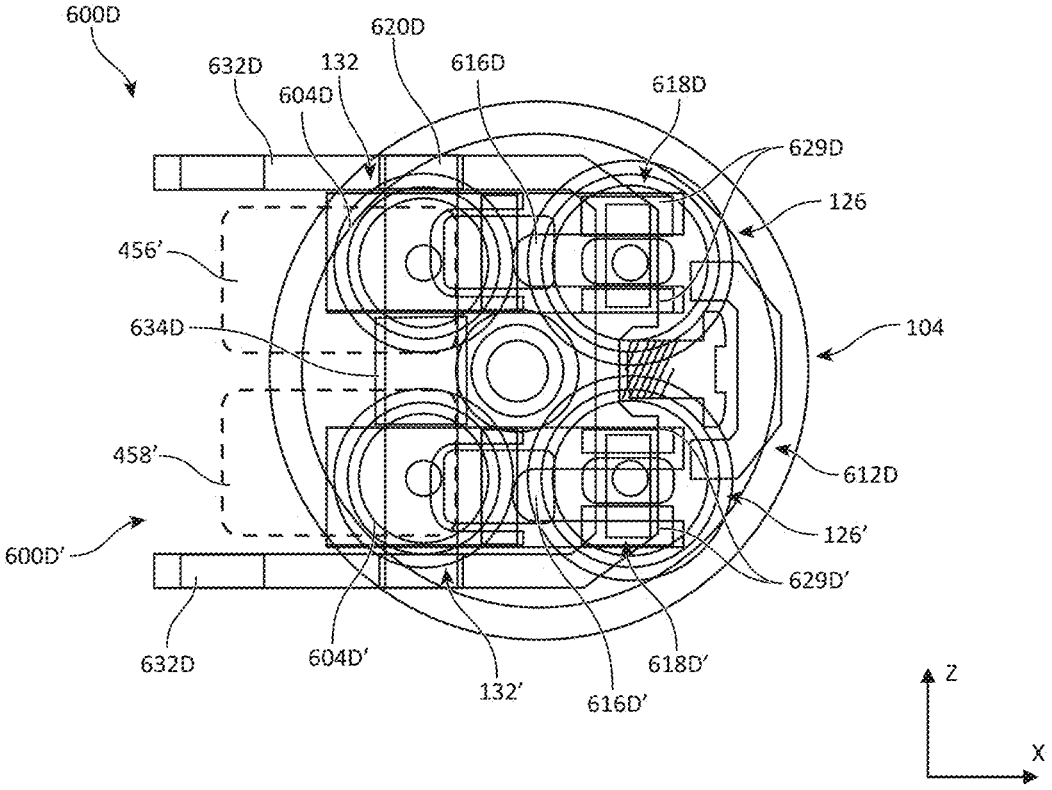
Figure 62:
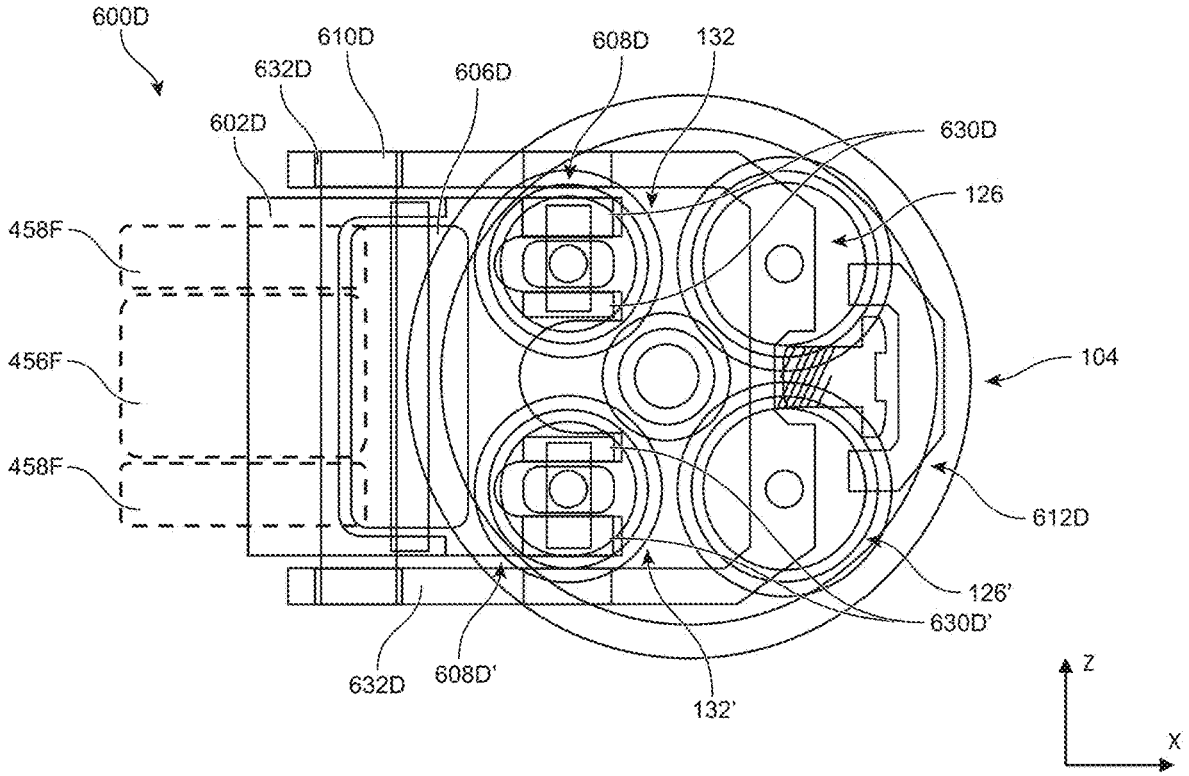
Figure 63:
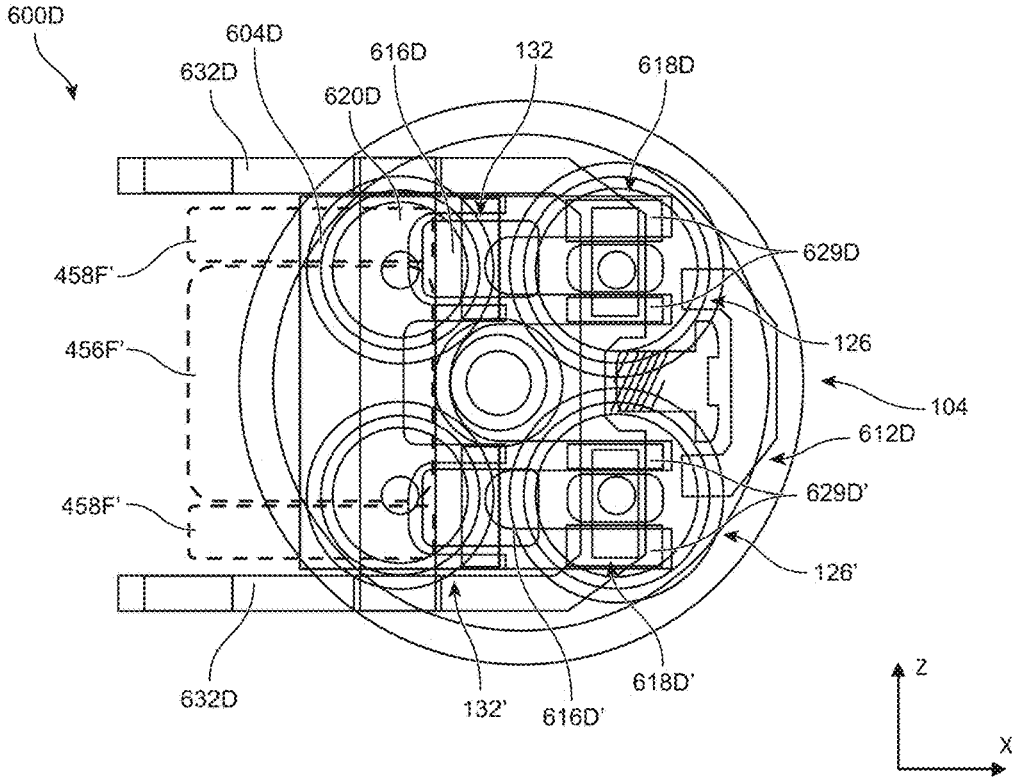

FIGS. 60 and 61 illustrate schematic top views of the valve actuation system 600D and the valve actuation system 600D' in various configurations. FIGS. 62 and 63 illustrate schematic top views of the valve actuation system 600D in various configurations. The different configurations may depend in part on the type of valve timing system that is used with the valve actuation system 600D and/or the valve actuation system 600D'.

In the configurations illustrated in FIGS. 60 and 61, the valve actuation system 600D is configured to actuate the first exhaust valve 132 and the first intake valve 126 in the combustion chamber 104. As such, the additional valve actuation system 600D' is used to actuate the second exhaust valve 132' and the second intake valve 126'. Features of the valve actuation system 600D' are similar or identical to features of the valve actuation system 600D. Thus, reference numerals used to designate the various features or components of the valve actuation system 600D' are identical to those used for identifying the corresponding features of components of the valve timing system valve actuation system 600D, except that a "prime" has been added to the numerical identifier. Therefore, the structure and operation of the various features of the valve actuation system 600D are understood to also apply to the corresponding features of the valve actuation system 600D', except as described below.

With reference to FIG. 59, one or more valve timing systems including the first camshaft 450 and the second camshaft 450' provide the driving forces for the valve actuation system 600D using a plurality of cam lobes (e.g., first cam lobe 456, second cam lobe 456'). In some configurations, the one or more valve timing systems may optionally include one or more auxiliary shafts, such as first auxiliary shaft 470 and second auxiliary shaft 470'. For example, the valve timing system 400B and the valve timing system 400C in the arrangement illustrated in FIG. 18, which do not include auxiliary shafts, may be used to drive the first valve actuation system 600D and/or the second valve actuation system 600D' (e.g., in the configurations illustrated in FIGS. 60 and 61). In the configuration illustrated in FIGS. 62 and 63, one fixed lobe (e.g., fixed lobe 456B) and one free lobe (e.g., free lobe 458B) may work together to actuate a single cam follower (e.g., cam follower 606D) of the valve actuation system 600D. In another example, the valve timing system 400D and the valve timing system 400D' in the configuration illustrated in FIG. 34, which include two auxiliary shafts (e.g., auxiliary shaft 470D and auxiliary shaft 470D'), may be used to drive the valve actuation systems 600D (e.g., in the configurations illustrated in FIGS. 60 and 61). In the configuration of FIGS. 62 and 63, one fixed lobe (e.g., fixed lobe 456D) and one free lobe (e.g., free lobe 458D) may work together to actuate a single cam follower (e.g., cam follower 606D) of the valve actuation system 600D. In yet another example, the two valve timing system 400F illustrated in FIG. 35, may be used to drive the valve actuation systems 600D (e.g., in the configurations illustrated in FIGS. 62 and 63). The other valve timing systems described herein can also be used to drive the valve actuation system 600D and/or the valve actuation system 600D' in various configurations.

As illustrated in FIG. 59, the first camshaft 450 may include the first cam lobe 456. The first cam lobe 456 drives the movement of at least the first exhaust valve 132. The first camshaft 450 may also include the third cam lobe 458 to drive the movement of at least the second exhaust valve 132' (see e.g., FIG. 60). In the configurations illustrated in FIGS. 62 and 63, the first cam lobes 456 and the second cam lobes 456' drive the movement of the first exhaust valves 132 and the second exhaust valves 132'. The second camshaft 450' may include the second cam lobe 456'. The second cam lobe 456' can drive the movement of at least the first intake valve 126. The second camshaft 450' may also include the fourth cam lobe 458' to drive the actuation of at least the second intake valve 126' (see e.g., FIG. 61). In the configurations illustrated in FIGS. 62 and 63, the third cam lobes 458 and the fourth cam lobes 458' drive the actuation of the first intake valves 126 and the second intake valves 126'. The first camshaft 450 and the second camshaft 450' may be any of the camshafts described herein. Similarly, the cam lobes may be any of the lobes described herein (e.g., lobes 456A, fixed lobes 456D, free lobes 458D, etc.).

The valve actuation system 600D may include the first rocker arm 602D and the second rocker arm 604D. The first rocker arm 602D is configured to move one or both of the first exhaust valves 132 and the second exhaust valves 132' in the combustion chamber 104. The second rocker arm 604D is configured to move one or both of the first intake valves 126 and the second intake valves 126'. The first rocker arm 602D includes the first cam follower 606D and the first finger 608D. As shown more clearly in FIG. 59, the first finger 608D may include a pair of tines 630D that extend around the exhaust valve tip 524.

The first rocker arm 602D is configured to pivot about the first pivot point 610D. The first rocker arm 602D may be supported at the first pivot point 610D by at least one lash adjuster. For example, in the configuration illustrated in FIG. 42, the first rocker arm 602D is supported at the first pivot point 610D by the lash adjuster 612D. The lash adjuster 612D may be positioned in the slotted guide 628D. The slotted guide 628D may be a portion of the housing of the internal combustion engine 100. The slotted guide 628D may be a separate guide (e.g., machined guide) placed in the housing of the internal combustion engine 100. The body 632D (see e.g., FIGS. 60 and 61) of the lash adjuster 612D may extend around one or both of the first rocker arm 602D and the first rocker arm 602D' (e.g., in the configuration of FIG. 60) or just the first rocker arm 602D (e.g., in the configuration of FIG. 62). In some configurations, the central member 634D of the lash adjuster 612D is positioned between the first rocker arm 602D and the first rocker arm 602D'. The first pivot point 610D may be a rod that extends through the first rocker arm 602D and that is coupled to the lash adjuster 612D. In the configuration illustrated in FIG. 60, the first pivot point 610D extends through the first rocker arm 602D and the first rocker arm 602D' and the first pivot point 610D is coupled to the body 632D and/or the central member 634D. The central axis of the first camshaft 450 may be above the first pivot point 610D. In some configurations, the central axis of the first auxiliary shaft 470 may be above the first pivot point 610D.

The lash adjuster 612D may extend upwardly from the first pivot point 610D in a direction away from the combustion chamber 104. The lash adjuster 612D may be at an angle relative to the X-axis and the Y-axis. The lash adjuster 612D may extend between the V-shaped first rocker arm 602D between the two main points of contact for the first rocker arm 602D (e.g., the location of the cam follower 606D where the first cam lobe 456 exerts a force on the first rocker arm 602D and the location of the connection between the exhaust valve tip 524 and the first finger 608D, where the first rocker arm 602D exerts a force on the first exhaust valve 132.) The angle of the lash adjuster 612D may be selected to balance the forces on the first rocker arm 602D.

In operation, in the configuration illustrated in FIG. 61, as the first cam lobe 456 rotates, the first cam follower 606D acts as a guide roller for the first cam lobe 456. When the nose portion 486 of the first cam lobe 456 contacts the first cam follower 606D, the first rocker arm 602D rotates about the first pivot point 610D, which causes the first finger 608D to depress the first exhaust valve 132. The first finger 608D indirectly or directly contacts the exhaust valve tip 524 of the first exhaust valve 132, causing the first exhaust valve 132 to move into the open position. As the first cam lobe 456 continues to rotate, the nose portion 486 moves out of contact with the first cam follower 606D. As a result of the rotation, the spring load in the compressed exhaust valve spring 502 causes the first exhaust valve 132 to return to the closed position.

The second rocker arm 604D includes the second cam follower 616D and the second finger 618D. As shown more clearly in FIG. 61, the second finger 618D may include a pair of tines 629D that extend around the intake valve tip 528. The second rocker arm 604D is configured to rotate about the second pivot point 620D. The second rocker arm 604D may be supported at the second pivot point 620D by at least one lash adjuster. For example, in the configuration illustrated in FIG. 59, the second rocker arm 604D is supported at the second pivot point 620D by the lash adjuster 612D. The lash adjuster 612D provides lash to both the first rocker arm 602D and the valve actuating arm 604D. The body 632D (see e.g., FIGS. 60-63) of the lash adjuster 612D may extend around one or both of the second rocker arm 604D and the second rocker arm 604D' in the configuration of FIG. 61, or just the second rocker arm 604D in the configuration of FIG. 63. In some configurations, the central member 634D of the lash adjuster 612D is positioned between the second rocker arm 604D and the second rocker arm 604D'. The second pivot point 620D may be a rod that extends through the second rocker arm 604D and that is coupled to the lash adjuster 612D. In the configuration illustrated in FIG. 61, the second pivot point 620D extends through the second rocker arm 604D and the second rocker arm 604D' and the second pivot point 620D is coupled to the body 632D and/or the central member 634D.

The central axis of the second camshaft 450' may be above the second pivot point 620D. In some configurations, the central axis of the second auxiliary shaft 470' may be above the second pivot point 620D. The lash adjuster 612D may extend upwardly from the second pivot point 620D in a direction away from the combustion chamber 104. The lash adjuster 612D may be at an angle relative to the X axis and the Y axis. The lash adjuster 612D may extend between the V-shaped second rocker arm 604D between the two main points of contact for the second rocker arm 604D (e.g., the location of the cam follower 616D, where the second cam lobe 456' exerts a force on the second rocker arm 604D, and the location of the connection between the intake valve tip 528 and the second finger 618D, where the second rocker arm 604D exerts a force on the first intake valve 126. The angle of the lash adjuster 612D may be selected to balance the forces on the second rocker arm 604D.

In operation, as the second cam lobe 456' rotates, the second cam follower 616D acts as a guide roller for the second cam lobe 456'. When the nose portion 486' of the second cam lobe 456' contacts the second cam follower 616D, the second rocker arm 604D rotates about the second pivot point 620D, which causes the second finger 618D to depress the first intake valve 126. The second finger 618D indirectly or directly contacts the intake valve tip 528, causing the first intake valve 126 to move into the open position. As the second cam lobe 456' continues to rotate, the nose portion 486' moves out of contact with the second cam follower 616D. As a result of the rotation, the spring load in the compressed intake valve spring 504 causes the first intake valve 126 to return to the closed position.

In some configurations, the valve actuation system 600D may include one or more tappets (not shown). The tappets may be hydraulic lifters. The tappets may be positioned between the first finger 608D and the exhaust valve tip 524 and/or between the second finger 618D and the intake valve tip 528.

In some configurations, the valve actuation system 600D may include a separate lash adjuster for the first rocker arm 602D and the second rocker arm 604D. In some configurations, one or more of the separate lash adjusters of the valve actuation system 600D may have a bend, similar to the second lash adjuster 622G of valve actuation system 600G described herein.

With reference to FIGS. 60 and 61, the valve actuation system 600D' functions in the same manner as the valve actuation system 600D to move the second exhaust valve 132' and the second intake valve 126'. Because the first exhaust valve 132 and the first intake valve 126 are operated independently of the second exhaust valve 132' and the second intake valve 126' in these configurations, the first exhaust valve 132 and the first intake valve 126 can be actuated at a different time than the second exhaust valve 132' and the second intake valve 126', depending on the arrangement of the lobes 456, the lobes 456', the lobes 458, and the lobes 458'. For example, the second exhaust valve 132' and the second intake valve 126' can be actuated slightly after the first exhaust valve 132 and the first intake valve 126, increasing the valve duration.

FIGS. 62 and 63 illustrate additional configurations of the valve actuation system 600D. In the configuration of FIG. 62, the first rocker arm 602D includes a first finger 608D, including a pair of tines 630D, and a second finger 608D', including a pair of tines 630D'. The first rocker arm 602D includes a single cam follower 606D. The configuration of FIG. 62 functions in the same manner as the valve actuation system 600D in the configuration of FIG. 60, except that the first exhaust valve 132 is actuated at the same time as the second exhaust valve 132'. Similarly, in the configuration of FIG. 63, the second rocker arm 604D includes the first finger 618D, including the pair of tines 629D, and the second finger 618D', including the pair of tines 629D'. In some configurations, the second rocker arm 604D may include the single cam follower 616D. In some configurations, the second rocker arm 604D may include the cam follower 616D and the cam follower 616D' (e.g., as shown in FIG. 63). The configuration of FIG. 63 functions in the same manner as the valve actuation system 600D in the configurations of FIG. 61, except that the first intake valve 126 is actuated at the same time as the second intake valve 126'. The valve actuation system 600D of FIGS. 62 and 63 can be driven by one or more cam lobes. For example, when used with two valve timing systems, such as the valve timing system 400A and the valve timing system 400A', the single lobe 456A can engage the first rocker arm 602D to move the exhaust valve 132 and the exhaust valve 132', and the single lobe 456A' can engage the second rocker arm 604D to move the intake valve 126 and the intake valve 126'. In this example, the valve timing system 400A may include one lobe 456A per combustion chamber 104 and the valve timing system 400A' may include one lobe 456A' per combustion chamber 104. In another example, the valve timing system 400F and the valve timing system 400F' can be used to move the valve actuation system 600D, where two free lobes 458F and one fixed lobe 456F all contact the cam follower 606D and two free lobes 458F' and one fixed lobe 456F' all contact either the single cam follower 616D or the free lobes 458F' and the fixed lobe 456F' contact the cam follower 616D and the same fixed lobe 456F' and an additional free lobe 458F' contact the cam follower 616D'. This arrangement is schematically illustrated in FIGS. 62 and 63. In this configuration, the free lobes 458F and the fixed lobe 456F and the free lobes 458F' and the fixed lobe 456' may include nose portions that are offset from each other (see e.g., FIG. 32). When the nose portions of the lobes are offset, the valve duration will be generally be increased, because each nose contacts and continues to actuate the valve actuation system 600D longer than a single nose portion of a single lobe 456.

FIGS. 64-69 illustrate various configurations of lash adjusters that may be used with the valve actuation systems described herein (e.g., the valve actuation system 600D). Any of the lash adjusters illustrated in FIGS. 64-69 can function as the lash adjuster 612D of the valve actuation system 600D of FIG. 59, for example but without limitation.

Figure 64:
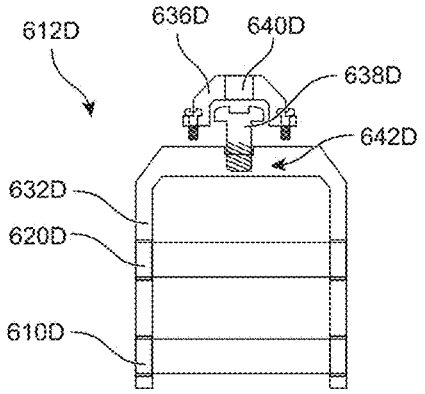
FIGS. 64-69 illustrate schematic section view of lash adjusters that can be used with a valve actuation system.
Figure 65:
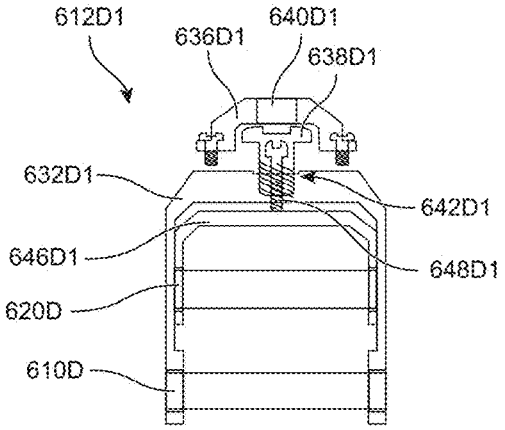

FIG. 64 illustrates a schematic side view of the lash adjuster 612D. FIG. 65 illustrates a schematic side view of the lash adjuster 612D1. Either of the lash adjuster 612D or the lash adjuster 612D1 may be used as the lash adjuster 612D in the valve actuation system 600D. Some of the features of the lash adjuster 612D and the lash adjuster 612D1 are similar to features of the first lash adjuster 612C illustrated in FIG. 52. Thus, reference numerals used to designate the various features or components of the lash adjuster 612D and the lash adjuster 612D1 are identical to those used for identifying the corresponding features of components of the lash adjuster 612C in FIG. 52, except that a "D" has been added to the numerical identifier for the lash adjuster 612D and a "D1" has been added to the numerical identifier for the lash adjuster 612D1. Therefore, the structure and operation of the various features of the lash adjuster 612C are understood to also apply to the corresponding features of the lash adjuster 612D in FIG. 64 and the lash adjuster 612D1 in FIG. 65, except as described below.

The lash adjuster 612D differs from the lash adjuster 612C in that two pivot points, the first pivot point 610D and the second pivot point 620D, extend across the body 632D. The lash adjuster 612D1 differs from the lash adjuster 612C in that the lash adjuster 612D1 includes the inner body 646D1 and the second screw 648D1. The inner body 646D1 may be stirrup-shaped and may be configured to extend around one or more rocker arms (e.g., the second rocker arm 604D, the second rocker arm 604D', etc.). The inner body 646D1 may be positioned within the body 632D1. The inner body 646D1 may be configured to move relative to the body 632D1. The first pivot point 610D may extend across the body 632D1. The first pivot point 610D may be isolated from the inner body 646D1. The second pivot point 620D may extend across the inner body 646D1. The second pivot point 620D may be isolated from the body 632D1. The second screw 648D1 may extend through the body 632D1 to contact the inner body 646D1. In some configurations, the second screw 648D1 extends through the screw 638D1. The lash adjuster 612D1 is configured to maintain lash within the valve system 500. For example, the screw 638D1 may exert a force on the body 632D1 to maintain lash on the first rocker arm 602D and/or the first rocker arm 602D' and the second screw 648D1 may exert a force on inner body 646D1 to maintain lash on second rocker arm 604D and/or the second rocker arm 604D'. Isolating the lash on the first pivot point 610D from the second pivot point 620D may provide benefits for more precise lash in the valve system 500.

Figure 66:
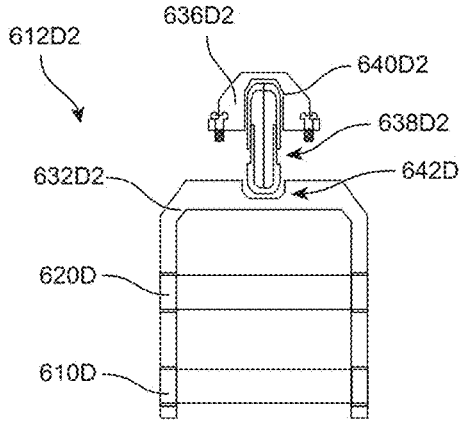
Figure 67:
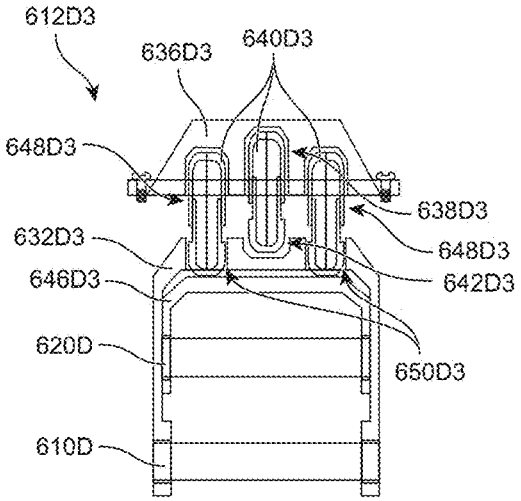

FIG. 66 illustrates a schematic side view of the hydraulic lash adjuster 612D2. FIG. 67 illustrates a schematic side view of the hydraulic lash adjuster 612D3. The hydraulic lash adjuster 612D2 and/or the hydraulic lash adjuster 612D3 may be used as the lash adjuster 612D in the valve actuation system 600D. Some of the features of the lash adjuster 612D2 and the lash adjuster 612D3 are similar to features of the hydraulic lash adjuster 612C1 illustrated in in FIG. 53. Thus, reference numerals used to designate the various features or components of the lash adjuster 612D2 and/or the lash adjuster 612D3 are identical to those used for identifying the corresponding features of components of the hydraulic lash adjuster 612C1 illustrated in FIG. 53, except that a "D2" has been added to the numerical identifier for the hydraulic lash adjuster 612D2 and a "D3" has been added to the numerical identifier for the hydraulic lash adjuster 612D3. Therefore, the structure and operation for the various features of the hydraulic lash adjuster 612C1 are understood to also apply to the corresponding features of the hydraulic lash adjuster 612D2 illustrated in FIG. 66 and the hydraulic lash adjuster 612D3 illustrated in FIG. 67, except as described below.

The hydraulic lash adjuster 612D2 differs from the hydraulic lash adjuster 612C1 in that the first pivot point 610D and the second pivot point 620D extend across the body 632D2. The hydraulic lash adjuster 612D3 differs from the hydraulic lash adjuster 612C1 in that the hydraulic lash adjuster 612D3 includes the inner body 646D3 and one or more second hydraulic cylinders 648D3. For example, the hydraulic lash adjuster 612D3 may include two second hydraulic cylinders 648D3. The inner body 646D3 may be stirrup-shaped and may be configured to extend around one or more rocker arms (e.g., the second rocker arm 604D, the second rocker arm 604D', etc.). The inner body 646D3 may be positioned within the body 632D3. The inner body 646D3 may be configured to move relative to the body 632D3. The first pivot point 610D may extend across the body 632D3. The first pivot point 610D may be isolated from the inner body 646D3. The second pivot point 620D may extend across the inner body 646D3. The second pivot point 620D may be isolated from the body 632D3. The second hydraulic cylinders 648D3 may extend through slots 650D3 in the body 632D3 to contact the inner body 646D3. The backplate 636D3 may include a plurality of openings 640C1 configured to receive the hydraulic cylinders 638D3, 648D3. The hydraulic cylinders 638D3, 648D3 may be coupled to the backplate 636D3. The hydraulic lash adjuster 612D3 is configured to maintain lash within the valve system 500. For example, the hydraulic cylinder 638D3 may exert a force on the body 632D3 to maintain lash on the first rocker arm 602D and/or the first rocker arm 602D' and the second hydraulic cylinders 648D3 may exert forces on inner body 646D3 to maintain lash on second rocker arm 604D and/or the second rocker arm 604D'. Isolating the lash on the first pivot point 610D from the second pivot point 620D may provide benefits for more precise lash in the valve system 500.

Figure 68:
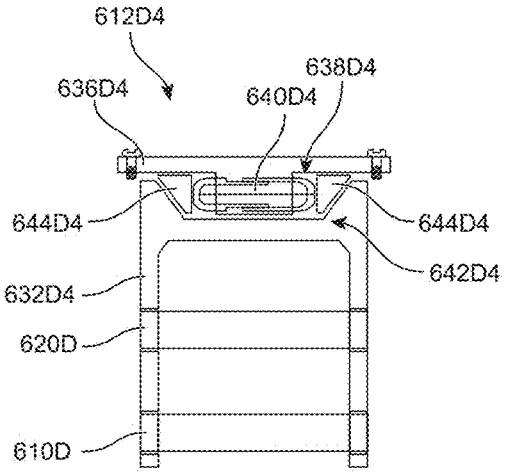
Figure 69:
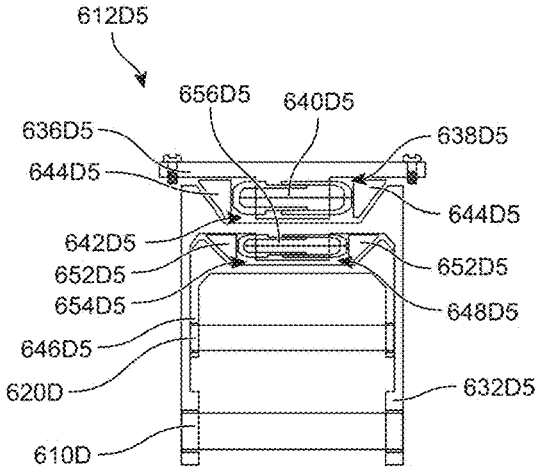

FIG. 68 illustrates a schematic side view of the hydraulic lash adjuster 612D4. FIG. 69 illustrates a schematic side view of the hydraulic lash adjuster 612D5. Either of the hydraulic lash adjuster 612D4 or the hydraulic lash adjuster 612D5 may be used as the lash adjuster 612D in the valve actuation system 600D. Some of the features of the lash adjusters 612D4, 612D5 are similar to features of the hydraulic lash adjuster 612C2 in FIG. 65. Thus, reference numerals used to designate the various features or components of the lash adjusters 612D4, 612D5 are identical to those used for identifying the corresponding features or components of the hydraulic lash adjuster 612C2, except that a "D4" has been added to the numerical identifier for the hydraulic lash adjuster 612D4 and a "D5" has been added to the numerical identifier for the hydraulic lash adjuster 612D5. Therefore, the structure and operation of the various features of the hydraulic lash adjuster 612C2 are understood to also apply to the corresponding features of the hydraulic lash adjuster 612D4 illustrated in FIG. 68 and the hydraulic lash adjuster 612D5 illustrated in FIG. 69, except as described below.

The hydraulic lash adjuster 612D4 differs from the hydraulic lash adjuster 612C2 in that the two pivot points, the first pivot point 610D and the second pivot point 620D, extend through the body 632D4. The hydraulic lash adjuster 612D5 differs from the hydraulic lash adjuster 612C2 in that the hydraulic lash adjuster 612D5 includes the inner body 646D5 and the second hydraulic cylinder 648D5. The inner body 646D5 may be stirrup-shaped. The inner body 646D5 may be configured to extend around one or more rocker arms (e.g., the second rocker arm 604D, the second rocker arm 604D'). The inner body 646D5 may be positioned within the body 632D5. The inner body 646D5 may be configured to move relative to the body 632D5.

The first pivot point 610D may extend through the body 632D5. The first pivot point 610D may be isolated from the inner body 646D5. The second pivot point 620D may extend through the inner body 646D5. The second pivot point 620D may be isolated from the body 632D5.

The inner body 646D5 may include the cylinder slot 654D5 that is configured to receive and/or couple with the second hydraulic cylinder 648D5. The pair of wedges 652D5 may be positioned on either side of the second hydraulic cylinder 648D5 within the cylinder slot 654D5.

The hydraulic lash adjuster 612D5 can be configured to maintain lash within the valve system 500. For example, the hydraulic cylinder 638D5 may exert a force on the pair of wedges 644D2, which in turn exert a force on the body 632D5 to maintain lash on the first rocker arm 602D and/or the first rocker arm 602D'. Similarly, the second hydraulic cylinder 648D5 may exert a force on the pair of wedges 652D5, which in turn exert a force on the inner body 646D5 to maintain lash on the second rocker arm 604D and/or the second rocker arm 604D'.

The body 632D5 may include an extension member 656D5 configured to extend into the cylinder slot 654D5. The extension member 656D5 can be configured to couple with the second hydraulic cylinder 648D5. The arrangement of the hydraulic cylinder 638D5 within the cylinder slot 642D5 and/or the second hydraulic cylinder 648D5 within the cylinder slot 654D5 may allow for the size of the hydraulic lash adjuster 612D5 to be reduced, which may provide space saving benefits within the engine. Isolating the lash on the first pivot point 610D from the second pivot point 620D may provide benefits for more precise lash in the valve system 500.

Figure 70:
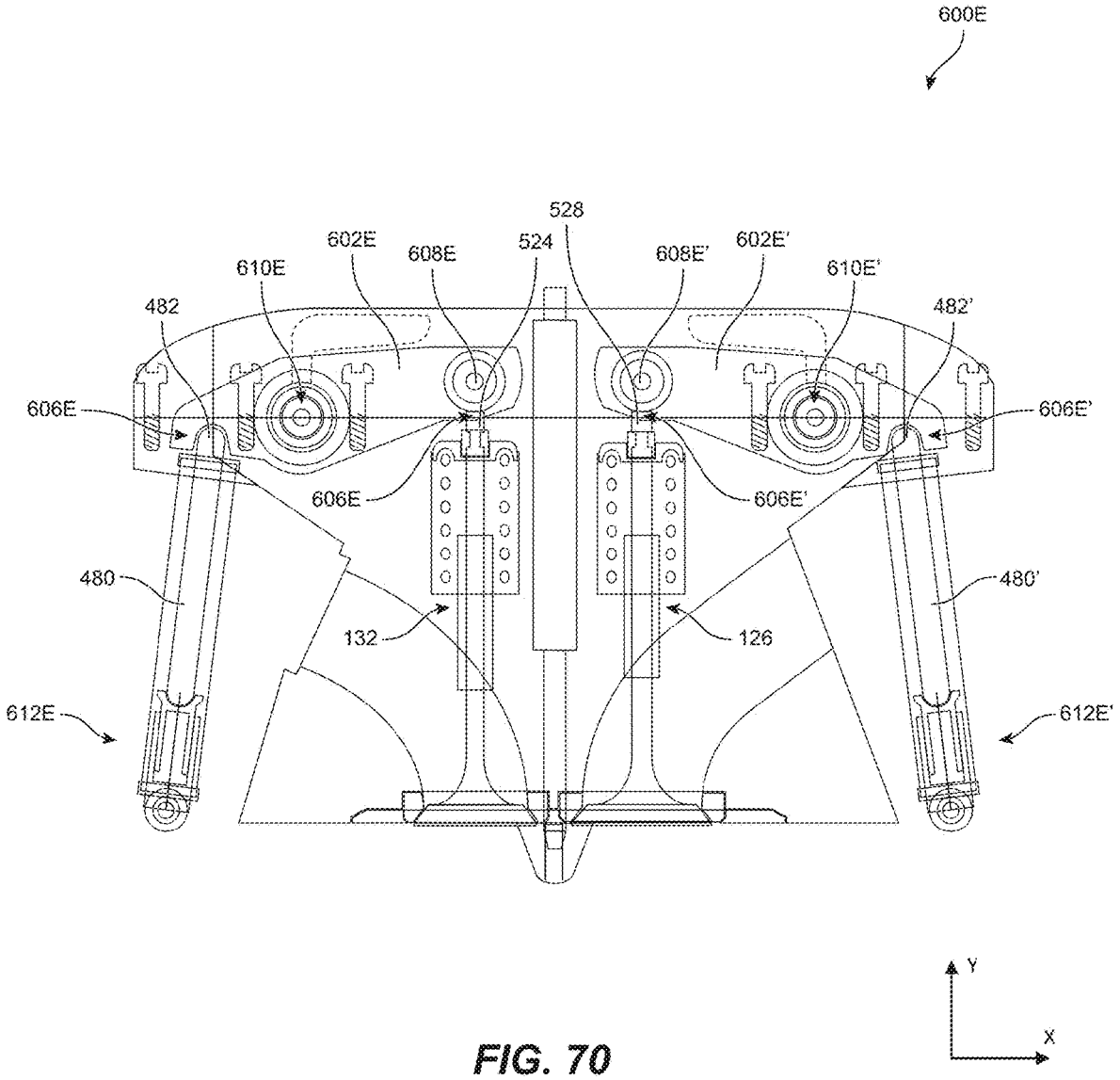
FIGS. 70-83 illustrate schematic section view of additional configurations of valve actuation systems.

FIG. 70 illustrates a schematic sectional view of a configuration of the valve actuation system 600E. The valve actuation system 600E is configured to actuate the intake valves 126 and the exhaust valves 132 in the valve system 500. Some of the features of the valve actuation system 600E are similar to features of the valve actuation system 600B illustrated in FIG. 43. Thus, reference numerals used to designate the various features or components of the valve actuation system 600E are identical to those used for identifying the corresponding features of components of the valve actuation system 600B that is illustrated in FIG. 43, except that a "E" or an "E'" has been added to the numerical identifier for the valve actuation system 600E. Therefore, the structure and description for the various features and operation of the valve actuation system 600B are understood to also apply to the corresponding features of the valve actuation system 600E illustrated in FIG. 70, except as described below.

The valve actuation system 600E differs from the valve actuation system 600B in that the valve actuation system 600E does not include a valve actuating arm and instead includes the second rocker arm 602E'. The second rocker arm 602E' is similar or identical to the first rocker arm 602E, except that the second rocker arm 602E' drives the movement of one or both of the intake valves 126 in the combustion chamber 104 while the first rocker arm 602E drives the movement of one or both of the exhaust valves 132 in the combustion chamber 104. The second rocker arm 602E' is actuated by the second pushrod 480'.

In the valve actuation system 600E, the first finger 608E is configured to indirectly or directly contact the exhaust valve tip 524, causing the exhaust valve 132 to move into the open position in operation. Similarly, the first finger 608E' is configured to indirectly or directly contact the intake valve tip 528, causing the first intake valve 126 to move into the open position in operation. In some configurations, the first rocker arm 602E and the second rocker arm 602E' actuate only one exhaust valve 132 and one intake valve 126 respectively per combustion chamber 104. In this configuration, the first rocker arm 602E and the second rocker arm 602E' may have a similar shape and function as the first rocker arm 602D illustrated in FIG. 60 and the second rocker arm 604D illustrated in FIG. 61 respectively. In some configurations, the first rocker arm 602E and the second rocker arm 602E' actuate two exhaust valves 132 and two intake valves 126 respectively per combustion chamber 104. In this configuration, the first rocker arm 602E and the second rocker arm 602E' may have a similar shape and function as the first rocker arm 602D illustrated in FIG. 62 and the second rocker arm 604D of FIG. 63 respectively.

Figure 71:
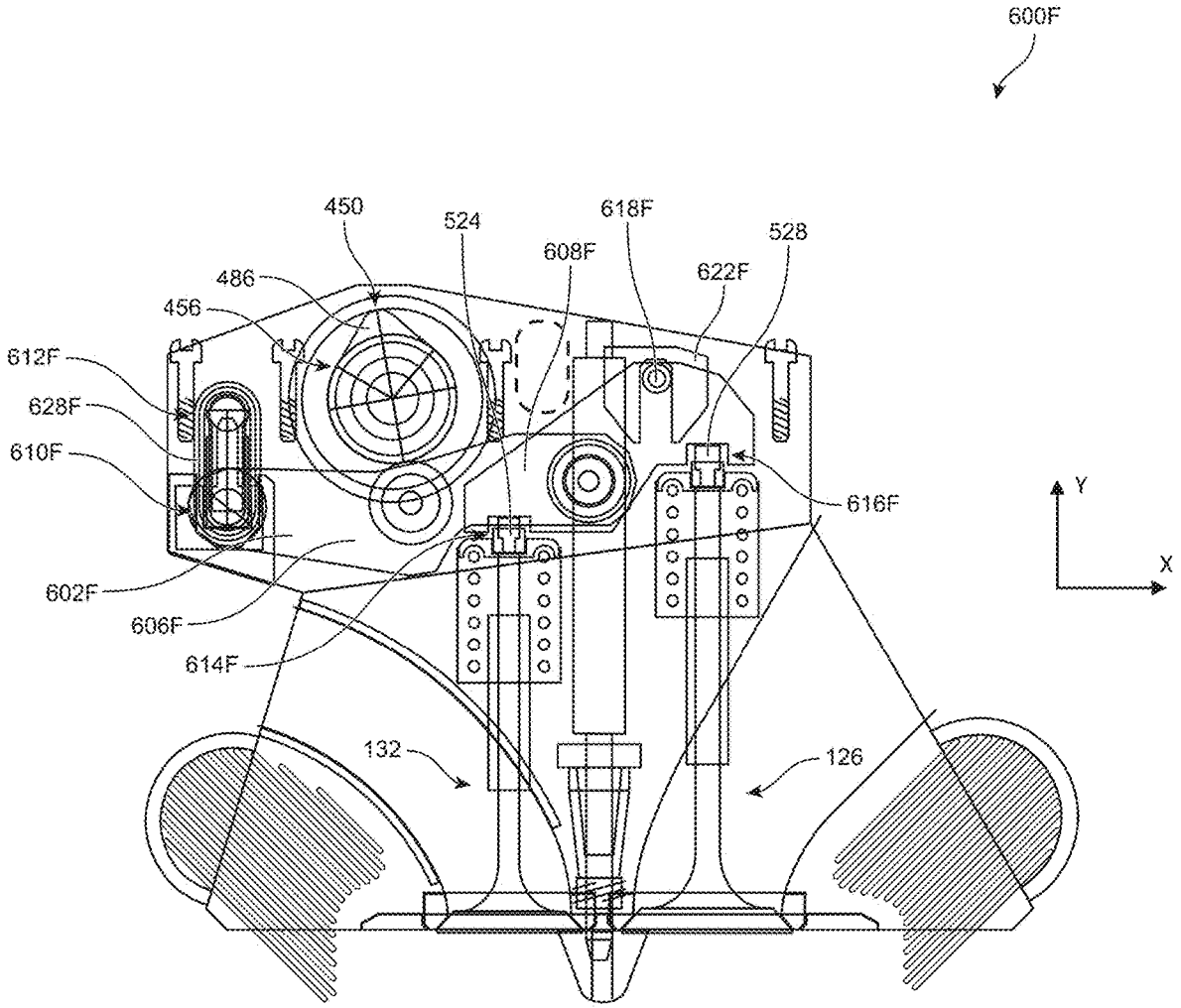

FIG. 71 illustrates a schematic sectional view of a configuration of the valve actuation system 600F. Some of the features of the valve actuation system 600F are similar to features of the valve actuation system 600C illustrated in FIG. 48. Thus, reference numerals used to designate the various features or components of the valve actuation system 600F are identical to those used for identifying the corresponding features of components of the valve actuation system 600C illustrated in FIG. 48, except that an "F" has been added to the numerical identifier for the valve actuation system 600F. Therefore, the structure and operation of the various features of the valve actuation system 600C are understood to also apply to the corresponding features of the valve actuation system 600F illustrated in FIG. 71, except as described below.

The valve actuation system 600F differs from the valve actuation system 600C primarily in the shape of the rocker arm 602F. The shape of the rocker arm 602F may be different from the shape of the first rocker arm 602C. The different shape may impact the placement of the first lash adjuster 612F and the position of the first camshaft 450 relative to the valve actuation system 600F. For example, the first lash adjuster 612F may extend substantially vertically (e.g., along the Y-axis) from the first pivot point 610F instead of crossing the body of the rocker arm 602F. Additionally, the first camshaft 450 can be positioned above the cam follower 606F such that the central axis of the first camshaft 450 is above the first pivot point 610F and the cam follower 606F.

The valve actuation system 600F can be driven by any suitable valve timing system, including but not limited to those described herein. In some configurations, the valve actuation system 600F is configured to actuate only one exhaust valve 132 and one intake valve 126 respectively per combustion chamber 104. In this configuration, the valve actuation system 600F functions in a similar manner to the valve actuation system 600C and the rocker arm 602F may have a similar shape to the first rocker arm 602C illustrated in FIG. 49 and/or FIG. 50. In some configurations, the valve actuation system 600F can be configured to actuate two exhaust valves 132 and two intake valves 126 per combustion chamber 104. In some such configurations, the valve actuation system 600F functions in a similar manner to the valve actuation system 600C and the rocker arm 602F may have a similar shape to the first rocker arm 602C illustrated in FIG. 51.

Figure 72:
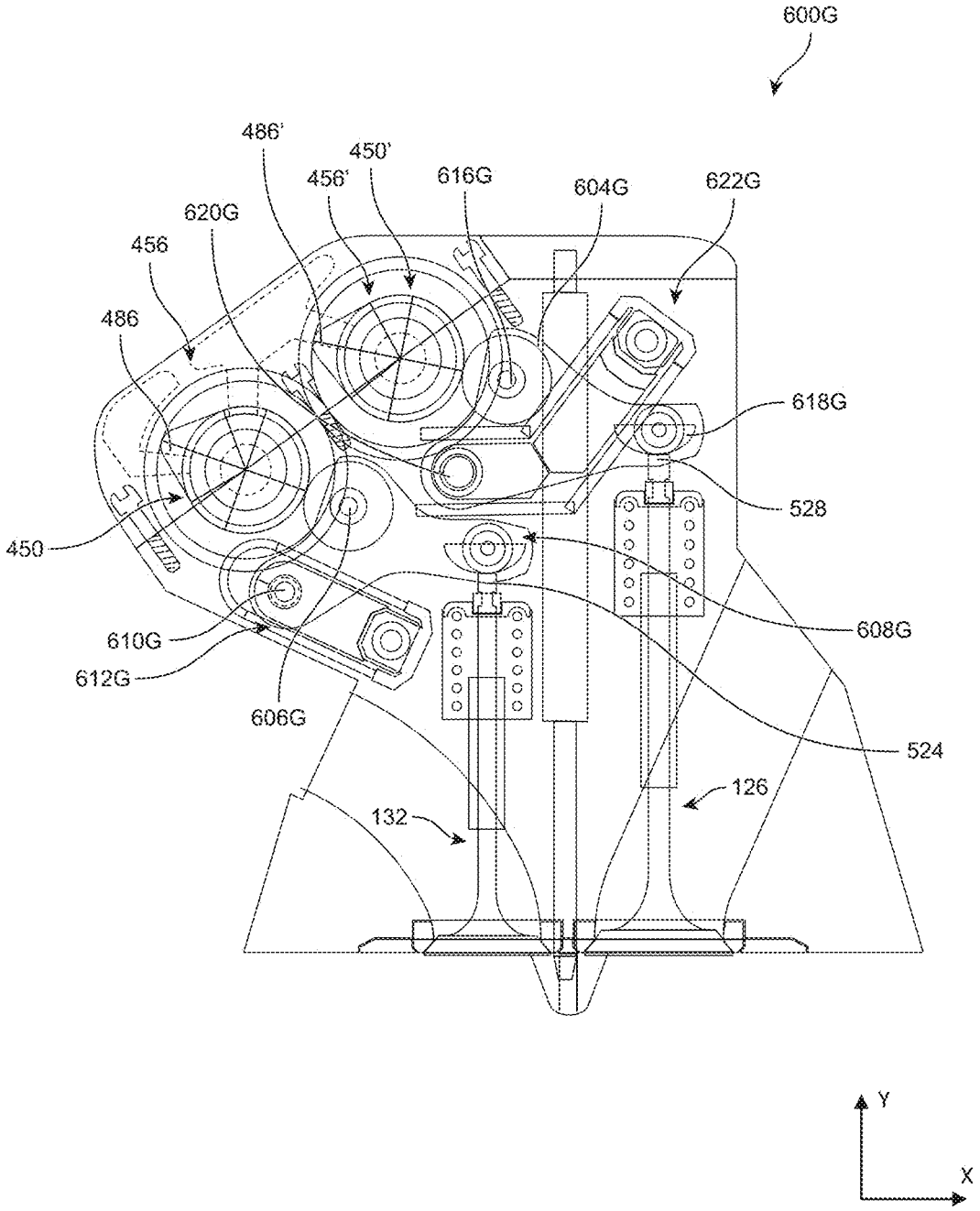
Figure 73:
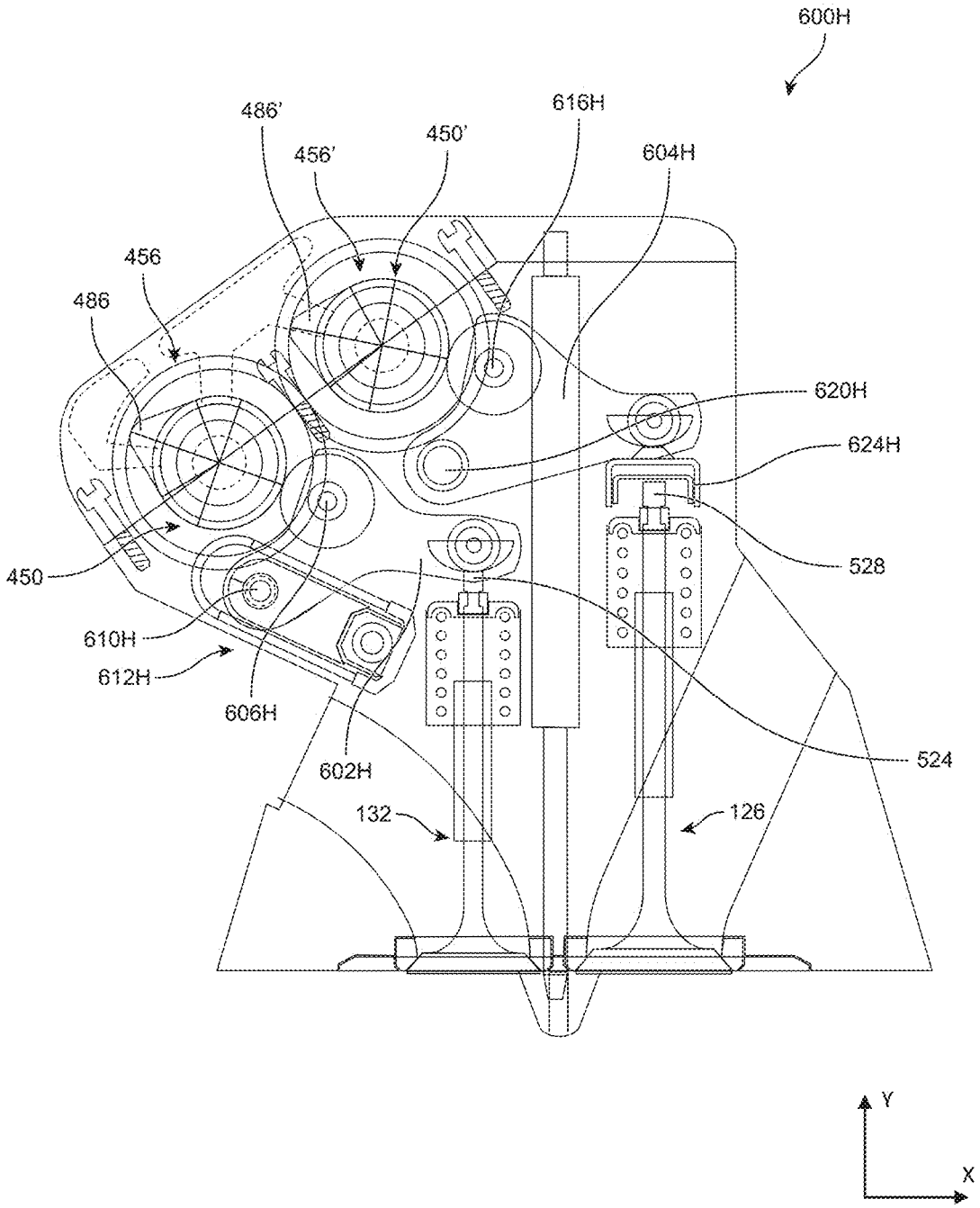

FIGS. 72 and 73 illustrate schematic sectional views of a configuration of a valve actuation system 600G and a configuration of a valve actuation system 600H. Some of the features of the valve actuation system 600G and the valve actuation system 600H are similar to features of the valve actuation system 600A illustrated in FIG. 42. Thus, reference numerals used to designate the various features or components of the valve actuation system 600G and/or the valve actuation system 600H are identical to those used for identifying the corresponding features of components of the valve actuation system 600A illustrated in FIG. 42, except that a "G" has been added to the numerical identifier for the valve actuation system 600G and an "H" has been added to the numerical identifier for the valve actuation system 600H. Therefore, the structure and description for the various features and operation of the valve actuation system 600A are understood to also apply to the corresponding features of the valve actuation system 600G illustrated in FIG. 72 and the valve actuation system 600H illustrated in FIG. 73, except as described below.

The valve actuation system 600G differs from the valve actuation system 600A primarily in the shape of the first rocker arm 602G and/or the second rocker arm 604G. For example, the first rocker arm 602G may be different than the shape of first rocker arm 602A. Similarly, the second rocker arm 604G may be a different shape than the second rocker arm 604A, which may impact the position of the second camshaft 450' relative to the valve actuation system 600G. For example, the second cam follower 616G may be positioned above the second camshaft 450' such that the central axis of the second cam follower 616G can be above the central axis of the second camshaft 450'.

The valve actuation system 600G may include only one lash adjuster for the first rocker arm 602G (e.g., the first lash adjuster 612G) and may optionally not include an additional lash adjuster for the first rocker arm 602G (see e.g., the second lash adjuster 614A in FIG. 42). The lash adjuster for the second rocker arm 604G (e.g., the second lash adjuster 622G) may also differ from the third lash adjuster 622A. For example, the second lash adjuster 622G may include two portions such that the first portion of the second lash adjuster 622G extends in a first direction and the second portion of the second lash adjuster 622G extends in a second direction with a bend between the first portion and the second portion.

This arrangement for the second lash adjuster 622G may provide a benefit of reducing the size of the valve actuation system 600G. An additional benefit can be that the central axis of the second camshaft 450' can be above (e.g., in the Y-direction) the central axis of the second cam follower 616G. Additionally, the valve actuation system 600G may not include a tappet (see e.g., tappet 624A in FIG. 42).

The valve actuation system 600H may be similar to the valve actuation system 600G, except that the valve actuation system 600H may not include the lash adjuster for the second rocker arm 604H (e.g., like the second lash adjuster 622G). Instead, the valve actuation system 600H may include the tappet 624H, which can be similar to the tappet 624A, associated with the second rocker arm 604H and the intake valves 126.

The valve actuation system 600G and the valve actuation system 600H can be driven by any of the valve timing systems described herein. In some configurations, the first rocker arm 602G and the first rocker arm 602H and the second rocker arm 604G and the second rocker arm 604H can be configured to actuate only one exhaust valve 132 and one intake valve 126 respectively per combustion chamber 104 in each embodiment. In this configuration, the rocker arms 602G and the rocker arm 602H as well as the rocker arm 604G and the rocker arm 604H may have a similar shape and function as the first rocker arm 602D illustrated in FIG. 60 and the second rocker arm 604D illustrated in FIG. 61 respectively. In some configurations, the first rocker arm 602G and the first rocker arm 602H as well as the second rocker arm 604G and the second rocker arm 604H are configured to actuate two exhaust valves 132 and two intake valves 126 respectively per combustion chamber 104. In this configuration, the first rocker arm 602G and the first rocker arm 602H as well as the second rocker arm 604G and the second rocker arm 604H may have a similar shape and function as the first rocker arm 602D of FIG. 62 and the second rocker arm 604D of FIG. 63 respectively.

Figure 74:
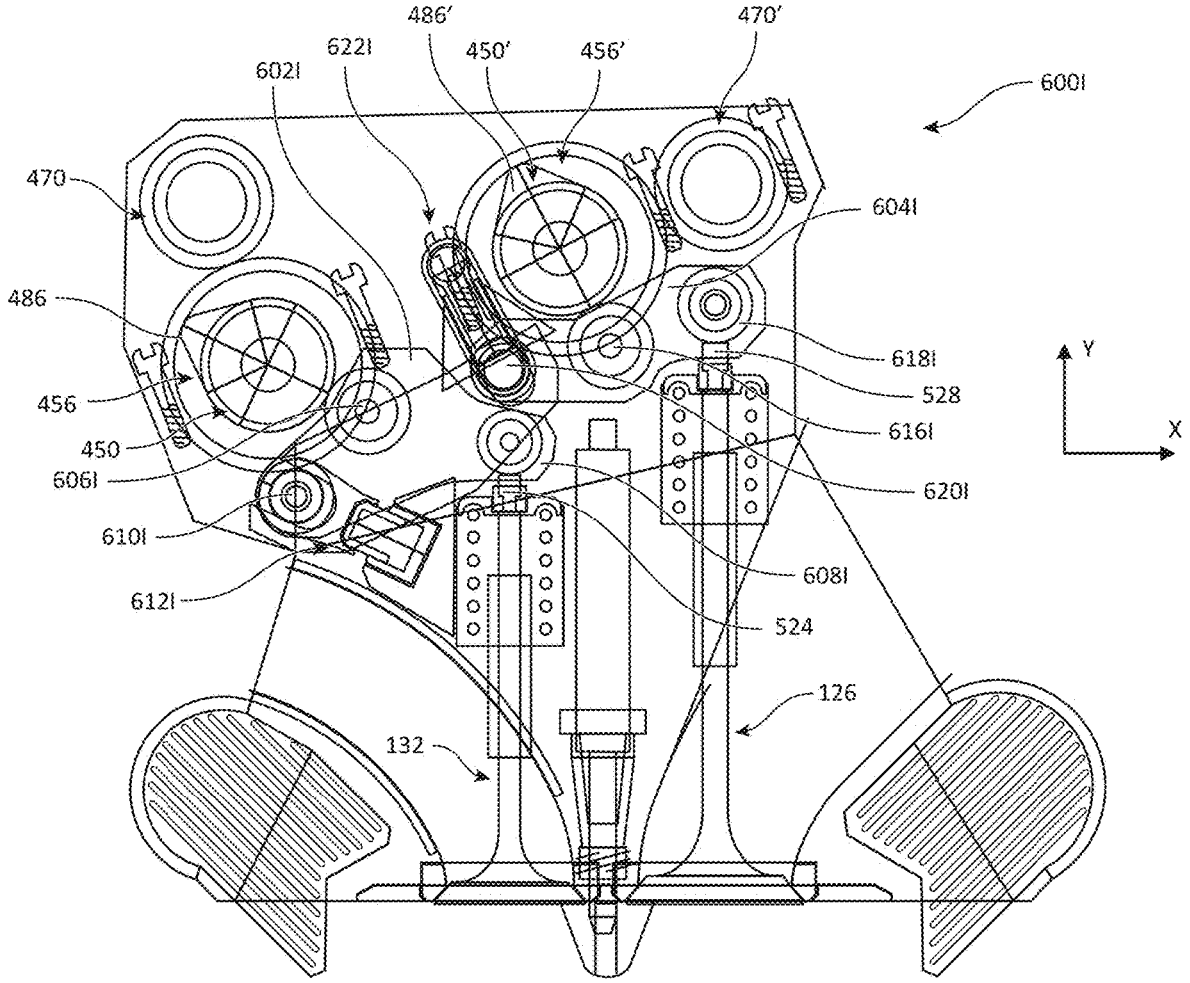
Figure 75:
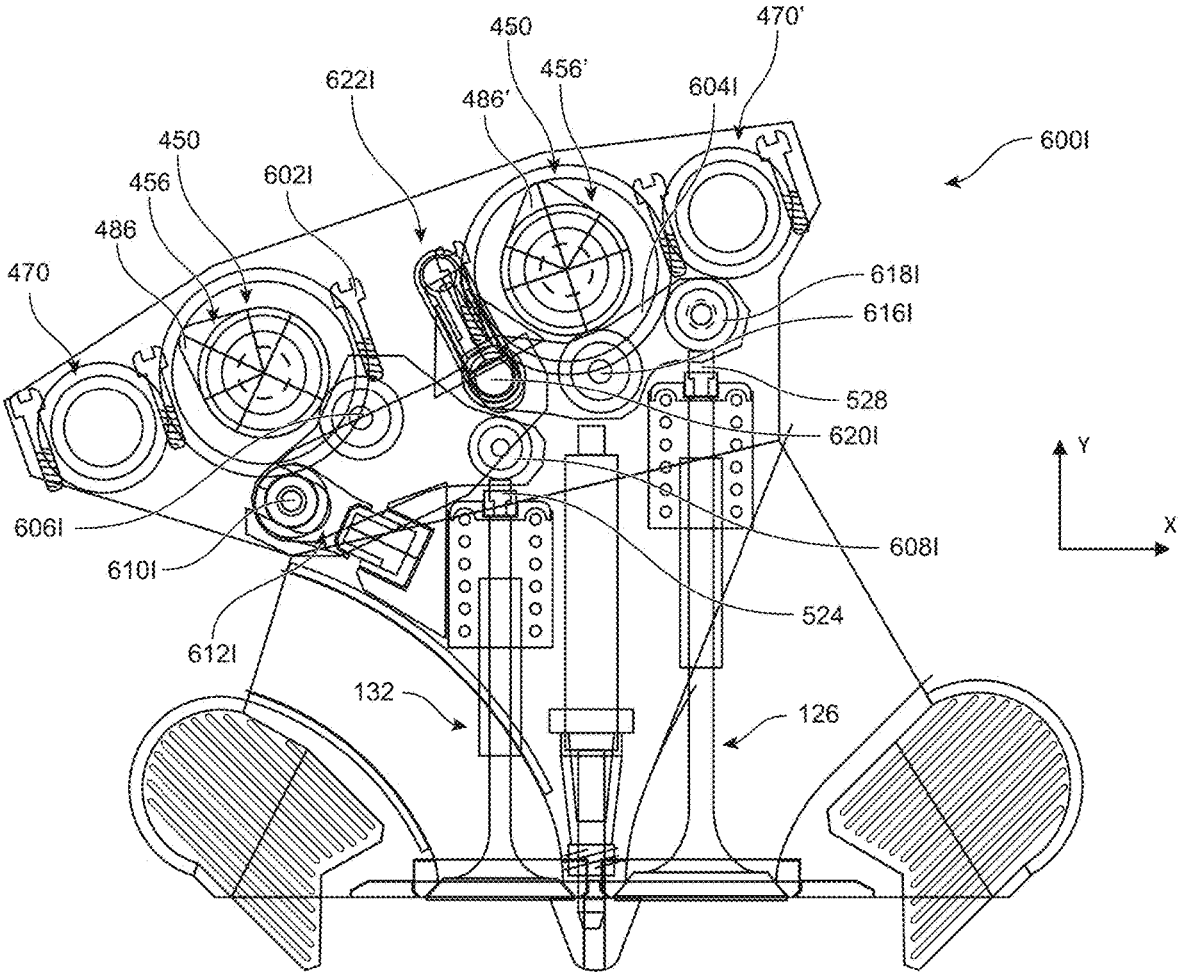

FIGS. 74 and 75 illustrate schematic sectional views of a configuration of a valve actuation system 600I. FIG. 74 illustrates the valve actuation system 600I with the camshaft 450, the camshaft 450', the auxiliary shaft 470, and the auxiliary shaft 470' in a first configuration. FIG. 75 illustrates the valve actuation system 600I with the camshaft 450, the camshaft 450', the auxiliary shaft 470, and the auxiliary shaft 470' in a second configuration.

Some of the features of the valve actuation system 600I are similar to features of the valve actuation system 600A illustrated in FIG. 42. Thus, reference numerals used to designate the various features or components of the valve actuation system 600I are identical to those used for identifying the corresponding features of components of the valve actuation system 600A illustrated in FIG. 42, except that an "I" has been added to the numerical identifier for the valve actuation system 600I. Therefore, the structure and operation of the various features of the valve actuation system 600A are understood to also apply to the corresponding features of the valve actuation system 600I illustrated in FIGS. 74 and 75, except as described below.

The valve actuation system 600I differs from the valve actuation system 600A primarily in the shapes of the first rocker arm 602I and the second rocker arm 604I. The shapes of the first rocker arm 602I and the second rocker arm 604I may be different than the shapes of the first rocker arm 602A and the second rocker arm 604A respectively, which may impact the positions of the valve timing systems used with the valve actuation system 600I and/or the position of the second lash adjuster 622I. For example, the second lash adjuster 622I may not extend across the body of the second rocker arm 604I. Instead, the second lash adjuster 622I may extend away from the second rocker arm 604I in the positive Y-axis direction and a negative X-axis direction, such that the second lash adjuster 622I is at an angle relative to the X-axis and the Y-axis. The second lash adjuster 622I may extend between the two valve timing systems configured to integrate with the valve actuation system 600I. The valve actuation system 600I may include only one lash adjuster for the first rocker arm 602I (e.g., the first lash adjuster 612I). The valve actuation system 600I may optionally not include an additional lash adjuster for the first rocker arm 602I (see e.g., second lash adjuster 614A illustrated in FIG. 42). Additionally, the valve actuation system 600I may not include a tappet (see e.g., tappet 624A in FIG. 42).

As noted above, FIG. 74 shows the valve actuation system 600I in a first configuration and FIG. 75 shows the valve actuation system 600I in a second configuration. In the first configuration, the auxiliary shaft 470 is positioned above the first camshaft 450. The auxiliary shaft 470 and the first camshaft 450 may be associated with a first valve timing system (e.g., the valve timing system 400D). In the second configuration, the auxiliary shaft 470 is positioned to the side and partially below the first camshaft 450. For example, the central axis of the first camshaft 450 is above the central axis of the auxiliary shaft 470 in the second configuration.

Figure 76:
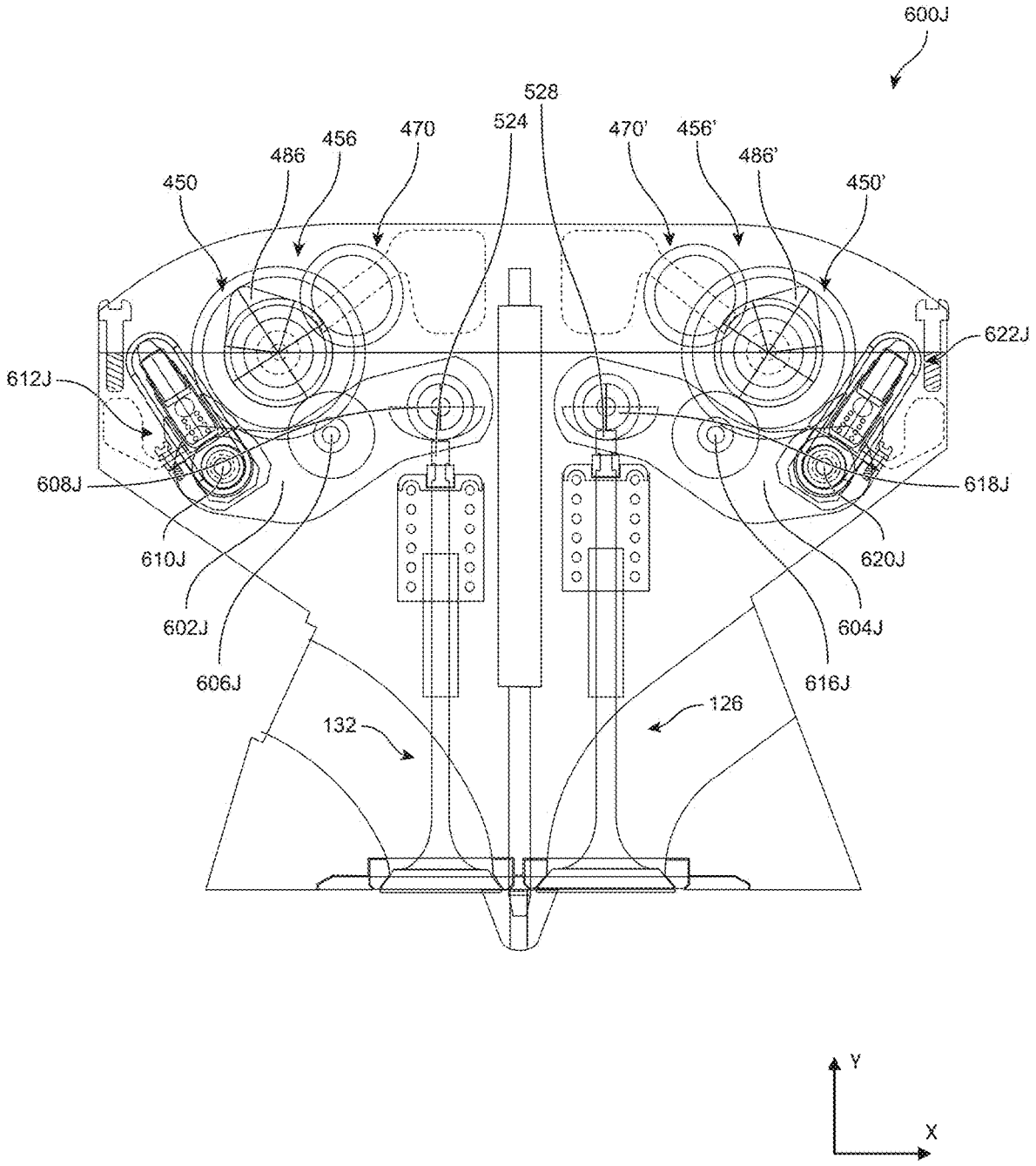

The valve actuation system 600I can be driven by any suitable valve timing systems including any of those described herein. As illustrated in FIGS. 75 and 76, two valve timing systems including the auxiliary shaft 470 and the auxiliary shaft 470' may drive the valve actuation system 600I. In one example, the valve timing system 400D and the valve timing system 400D' in the configuration illustrated in FIG. 33 may be used with the valve actuation system 600I. In some configurations, the first rocker arm 602I and the second rocker arm 604I are configured to actuate only one exhaust valve 132 and one intake valve 126 respectively per combustion chamber 104. In this configuration, the first rocker arm 602I and the second rocker arm 604I may have a similar shape and function as the first rocker arm 602D illustrated in FIG. 60 and the second rocker arm 604D illustrated in FIG. 61 respectively. In some configurations, the first rocker arm 602I and the second rocker arm 604I are configured to actuate two exhaust valves 132 and two intake valves 126 respectively per combustion chamber 104. In this configuration, the first rocker arm 602I and the second rocker arm 604I may have a similar shape and function as the first rocker arm 602D illustrated in FIG. 62 and the second rocker arm 604D illustrated in FIG. 63 respectively.

FIG. 76 illustrates a schematic sectional view of a configuration of the valve actuation system 600J. Some of the features of the valve actuation system 600J are similar to features of the valve actuation system 600A illustrated in FIG. 42. Thus, reference numerals used to designate the various features or components of the valve actuation system 600J are identical to those used for identifying the corresponding features of components of the valve actuation system 600A, except that a "J" has been added to the numerical identifier for the valve actuation system 600J. Therefore, the structure and operation of the various features of the valve actuation system 600A are understood to also apply to the corresponding features of the valve actuation system 600J illustrated in FIG. 76, except as described below.

The valve actuation system 600J differs from the valve actuation system 600A primarily in that the shapes and positions of the first rocker arm 602J and the second rocker arm 604J may be different than the shapes and positions of the first rocker arm 602A and the second rocker arm 604A respectively. For example, the second pivot point 620J may be positioned near the outside of the valve actuation system 600J such that the second rocker arm 604J extends from the second pivot point 620J towards the intake valve 126. In part because of this arrangement, the pair of valve timing systems (e.g., the valve timing system 400D and the valve timing system 400D') can be arranged with the camshaft 450 and the camshaft 450' generally aligned along the horizontal axes with the auxiliary shaft 470 and the auxiliary shaft 470', as opposed to an arrangement where the camshaft 450 and the camshaft 450' are generally stacked vertically with the auxiliary shaft 470 and the auxiliary shaft 470' (see e.g., the first camshaft 450 and the auxiliary shaft 470 of FIG. 74). Additionally, in part because of this arrangement, the second lash adjuster 622J may not extend across the body of the second rocker arm 604J. Instead, the second lash adjuster 622J may extend away from the second rocker arm 604J in the positive X-axis direction and the position Y-axis direction, such that the second lash adjuster 622J extends away from the intake valves 126 and the exhaust valves 132 and is at an angle relative to the X-axis and the Y-axis. The valve actuation system 600J may include only one lash adjuster for the first rocker arm 602J (e.g., the first lash adjuster 612J) and may optionally not include an additional lash adjuster for the first rocker arm 602J (see e.g., the second lash adjuster 614A in FIG. 42). The first lash adjuster 612J may be generally aligned with the vertical Y-axis. Additionally, the valve actuation system 600J may not include a tappet (see e.g., tappet 624A in FIG. 42).

The valve actuation system 600J can be driven by any of the valve timing systems described herein. As illustrated in FIG. 76, two valve timing systems including the auxiliary shaft 470 and the auxiliary shaft 470' may drive the valve actuation system 600J. In one example, the valve timing system 400D and the valve timing system 400D' in the configuration illustrated in FIG. 33 (with the auxiliary shaft 470D and the auxiliary shaft 470D' positioned beside each other) may be used with the valve actuation system 600J. In some configurations, the first rocker arm 602J and the second rocker arm 604J are configured to actuate only one exhaust valve 132 and one intake valve 126 respectively per combustion chamber 104. In this configuration, the rocker arm 602J and the rocker arm 604J may have a similar shape and function as the first rocker arm 602D of FIG. 60 and the second rocker arm 604D of FIG. 61 respectively. In some configurations, the first rocker arm 602J and the second rocker arm 604J are configured to actuate two exhaust valves 132 and two intake valves 126 respectively per combustion chamber 104. In this configuration, the first rocker arm 602J and the second rocker arm 604J may have a similar shape and function as the first rocker arm 602D illustrated in FIG. 62 and the second rocker arm 604D illustrated in FIG. 63 respectively.

FIG. 44 illustrates a schematic sectional view of a configuration of the valve actuation system 600K. Some of the features of the valve actuation system 600K are similar to features of the valve actuation system 600A illustrated in FIG. 42 and the valve actuation system 600B illustrated in FIG. 43. Thus, reference numerals used to designate the various features or components of the valve actuation system 600K are identical to those used for identifying the corresponding features of components of the valve actuation system 600A illustrated in FIG. 42 and the valve actuation system 600B illustrated in FIG. 43, except that a "K" has been added to the numerical identifier for the valve actuation system 600K. Therefore, the structure and operation of the various features of the valve actuation system 600A and the valve actuation system 600B are understood to also apply to the corresponding features of the valve actuation system 600K illustrated in FIG. 77, except as described below.

The valve actuation system 600K differs from the valve actuation system 600A primarily in that the exhaust valves 132 are controlled by the pushrod 480K while the intake valves 126 are controlled by the camshaft 450, similar to the intake valves 126 in the valve actuation system 600A. The pushrod 480K may function in a similar manner to the pushrod 480 in valve actuation system 600B, except that the pushrod 480K actuates the exhaust valves 132 using the rocker arm 602K. For example, the first finger 608K of the rocker arm 602K may engage the exhaust valve tip 524.

Figure 77:
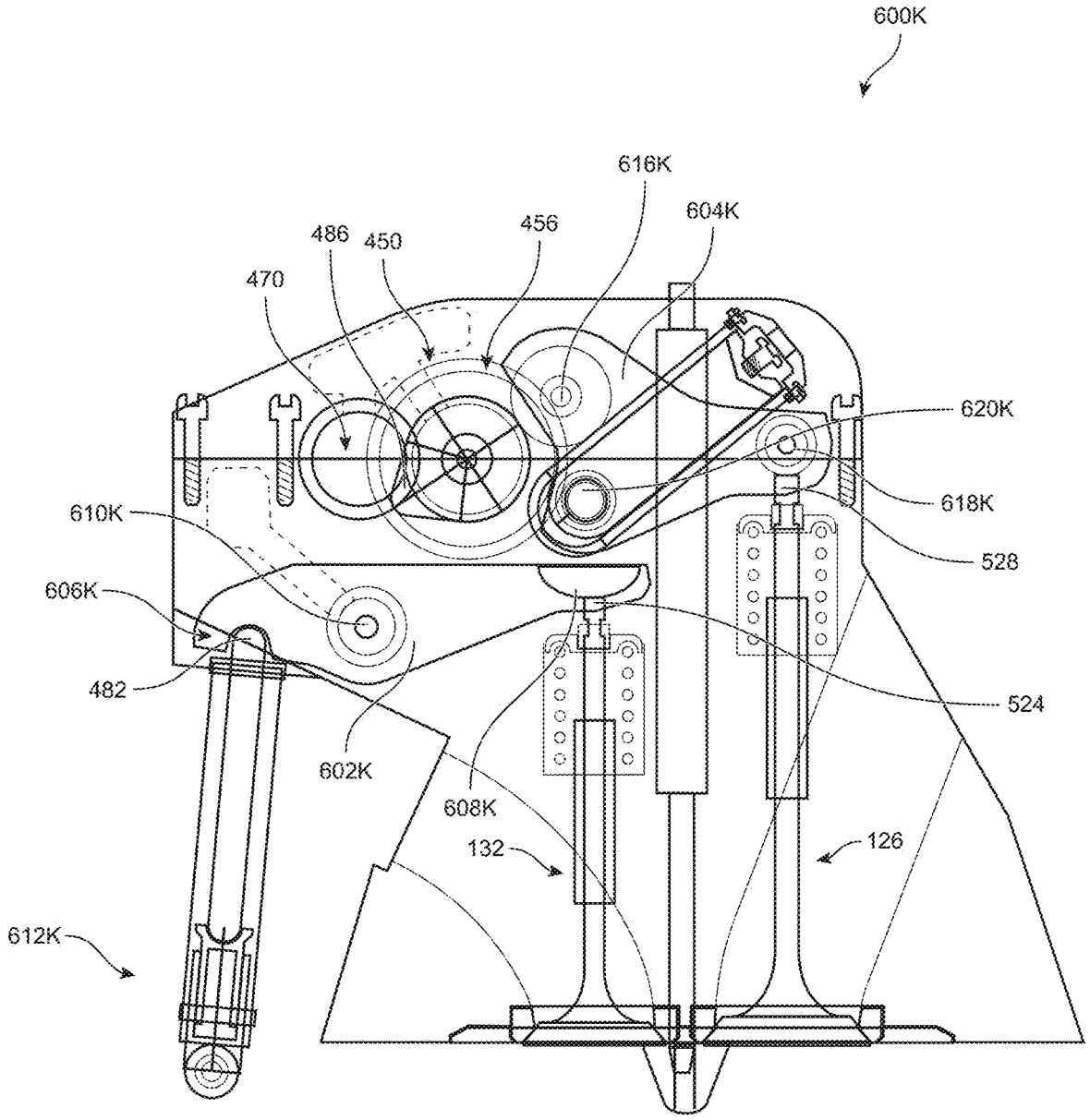

The shape of the second rocker arm 604K may differ from the shape of the second rocker arm 604A. The second rocker arm 604K may be similar to the first rocker arm 602C of the valve actuation system 600C. The valve actuation system 600K may include the lash adjuster 622K that is similar to the first lash adjuster 612C of the valve actuation system 600C. While the auxiliary shaft 470 is illustrated in FIG. 77, it is recognized that some configurations of the valve actuation system 600K may be used with a valve timing systems 400 that include the auxiliary shaft 470 and that do not include the auxiliary shaft 470. The valve actuation system 600K may provide certain advantages, such as allowing the exhaust valve 132 to be driven by the pushrod 480K and allowing the intake valves 126 to be driven by any suitable valve timing system.

The valve actuation system 600K can be driven by any suitable valve timing systems including but not limited to those described herein. As illustrated in FIG. 77, one valve timing system including the auxiliary shaft 470 may in part drive the valve actuation system 600K. In one example, the valve timing system 400D may be used with the valve actuation system 600K. In some configurations, the first rocker arm 602K and the second rocker arm 604K are configured to actuate only one exhaust valve 132 and one intake valve 126 respectively per combustion chamber 104. In this configuration, the first rocker arm 602K and the second rocker arm 604K may have a similar shape and function as the first rocker arm 602D illustrated in FIG. 60 and the second rocker arm 604D illustrated in FIG. 61 respectively. In some configurations, the first rocker arm 602K and the second rocker arm 604K are configured to actuate two exhaust valves 132 and two intake valves 126 respectively per combustion chamber 104. In this configuration, the first rocker arm 602K and the second rocker arm 604K may have a similar shape and function as the first rocker arm 602D illustrated in FIG. 62 and the second rocker arm 604D illustrated in FIG. 63 respectively.

Figure 78:
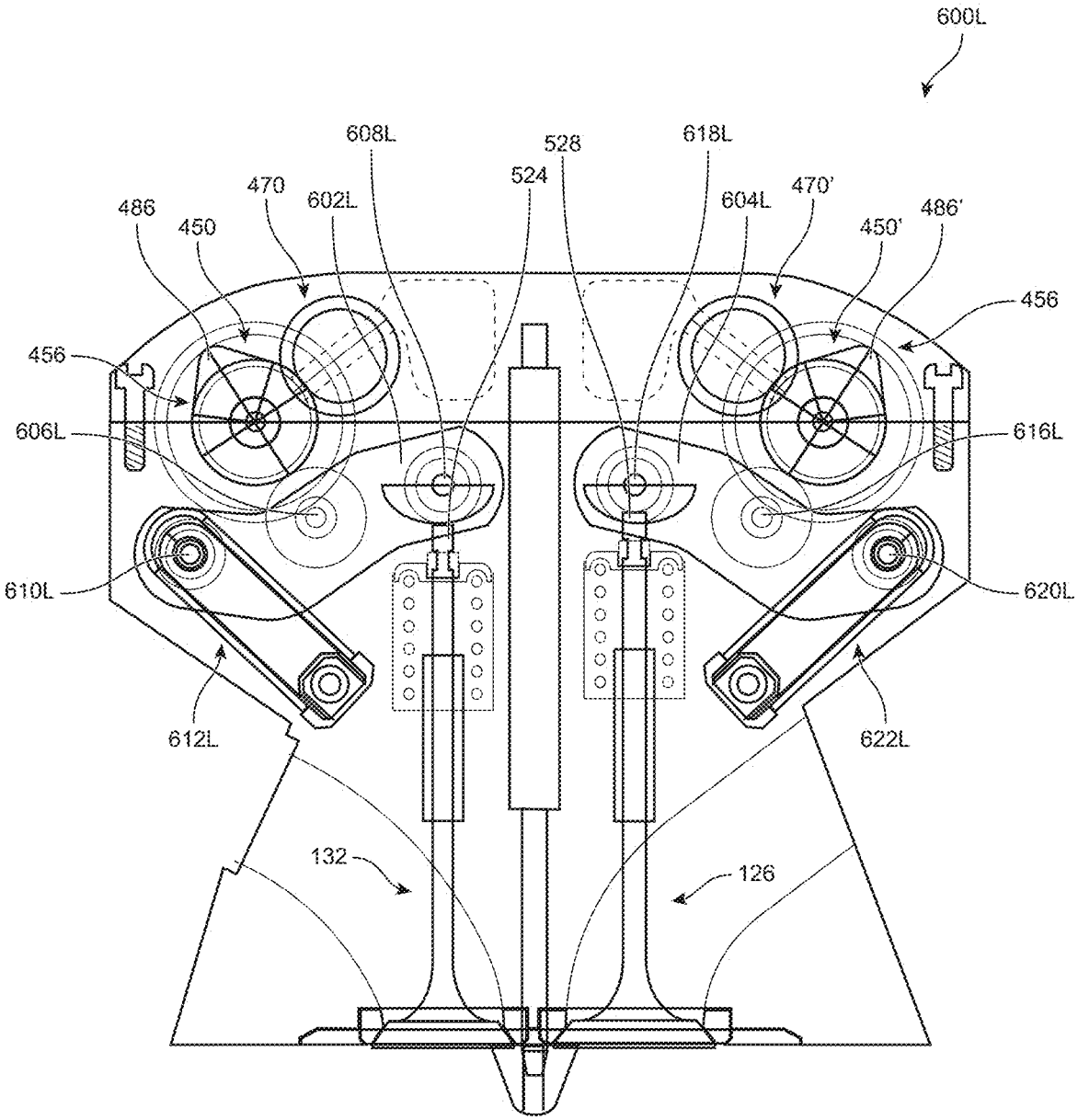
Figure 79:
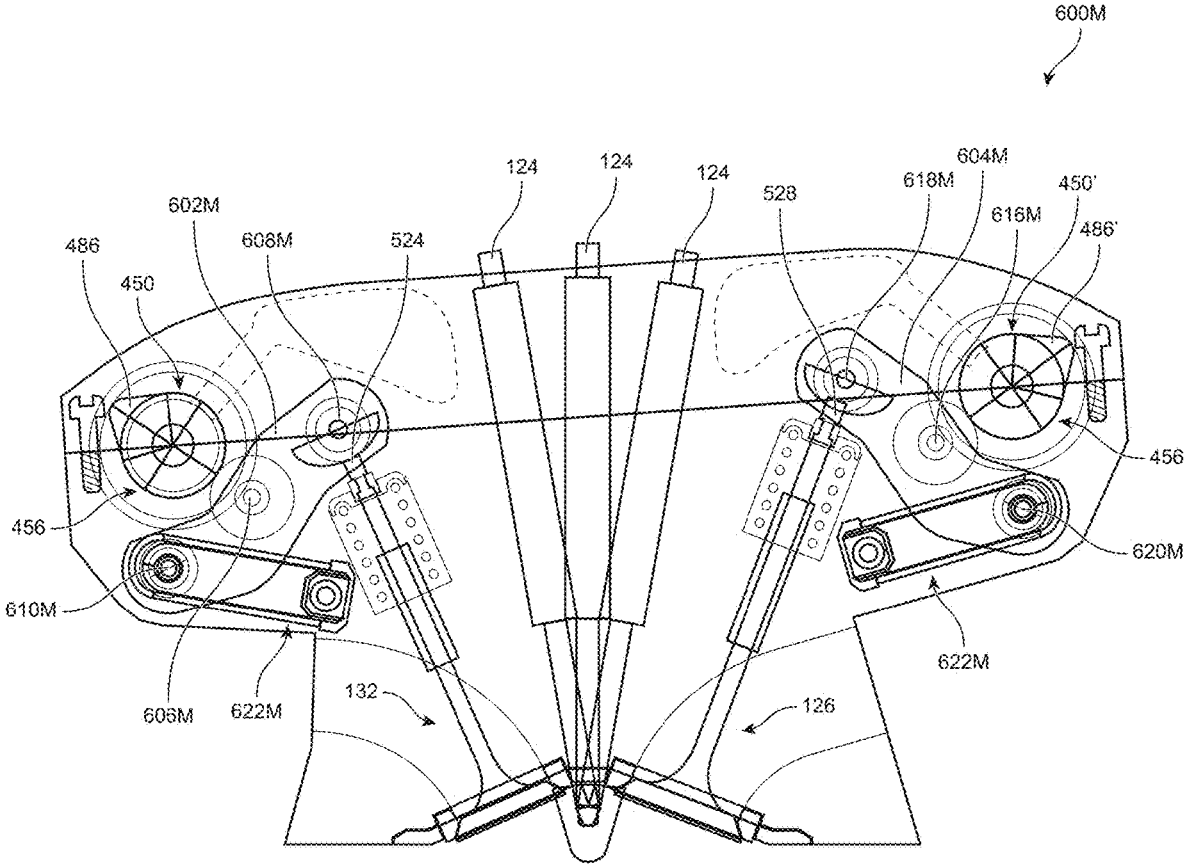
Figure 80:
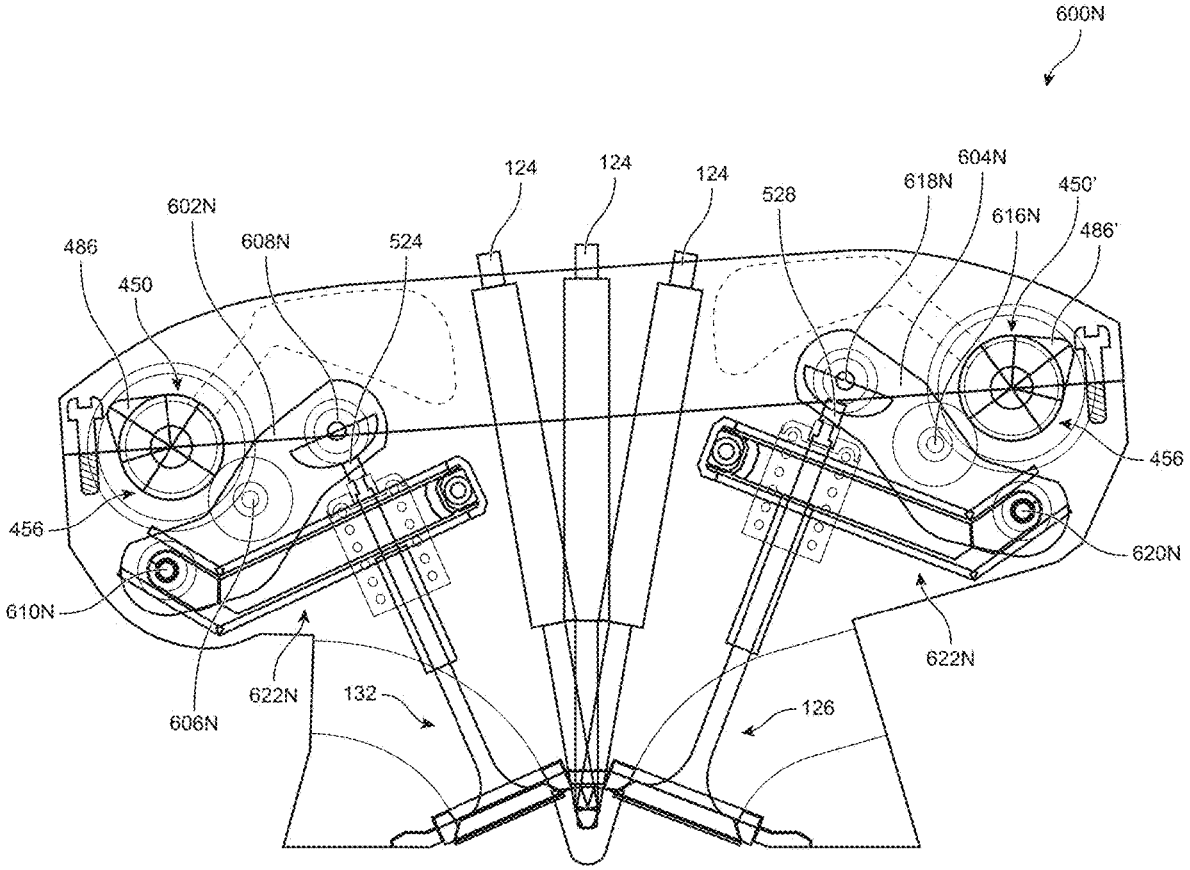

FIGS. 78-80 illustrate schematic sectional views of configurations of the valve actuation system 600L, the valve actuation system 600M, and the valve actuation system 600N respectively. Some of the features of the valve actuation system 600L, the valve actuation system 600M, and the valve actuation system 600N are similar to features of the valve actuation system 600A illustrated in FIG. 42. Thus, reference numerals used to designate the various features or components of the valve actuation system 600L, the valve actuation system 600M, and the valve actuation system 600N are identical to those used for identifying the corresponding features of components of the valve actuation system 600A, except that an "L" has been added to the numerical identifier for the valve actuation system 600L, an "M" has been added to the numerical identifier for the valve actuation systems 600M, and an "N" has been added to the numerical identifier for the valve actuation systems 600N. Therefore, the structure and operation for the various features of the valve actuation system 600A are understood to also apply to the corresponding features of the valve actuation system 600L, the valve actuation system 600M, and the valve actuation system 600N, except as described below.

The valve actuation system 600L, the valve actuation system 600M, and the valve actuation system 600N differ from the valve actuation system 600A in a similar manner to which the valve actuation system 600J differs from the valve actuation system 600A, as described herein. Additionally, in each of the valve actuation system 600L, the valve actuation system 600M, and the valve actuation system 600N, the first lash adjuster 612L, the first lash adjuster 612M, and the first lash adjuster 612N extend from the first pivot point 610L, the first pivot point 610M, and the first pivot point 610N away from the first camshaft 450 (e.g., in the negative Y-axis direction). Similarly, in each of the valve actuation system 600M, and the valve actuation system 600N, the second lash adjuster 622L, the second lash adjuster 622M, and the second lash adjuster 622N extend from the second pivot point 620L, the second pivot point 620M, and the second pivot point 620N away from the second camshaft 450' (e.g., in the negative Y-axis direction).

The valve actuation system 600M may differ further in that the exhaust valves 132 and the intake valves 126 may be at an angle relative to the Y-axis. Additionally, the valve actuation systems 600M may include additional fuel injectors 124. The angle of the exhaust valves 132 and the intake valves 126 can provide room for the additional fuel injectors 124. The exhaust valves 132 and the intake valves 126 in the valve actuation systems 600N may also be at an angle relative to the Y-axis. Additionally, the lash adjuster 612N and the lash adjuster 622N may be bent, similar to the second lash adjuster 622G.

The valve actuation system 600L, the valve actuation system 600M, and the valve actuation system 600N can be driven by any suitable valve timing systems including but not limited to those described herein. As illustrated in FIGS. 78-80, two valve timing system may drive the valve actuation system 600L, the valve actuation system 600M, and the valve actuation system 600N. In one example, the valve timing system 400A and the valve timing system 400A' in the configuration illustrated in FIG. 17 may be used with the valve actuation system 600L, the valve actuation system 600M, and the valve actuation system 600N. In some configurations, the first rocker arm 602L, the first rocker arm 602M, and the first rocker arm 602N and the second rocker arm 604L, the second rocker arm 604M, and the second rocker arm 604N are configured to move only one exhaust valve 132 and one intake valve 126 respectively per combustion chamber 104. In this configuration, the rocker arms may have a similar shape and function as the first rocker arm 602D of FIG. 60 and the second rocker arm 604D of FIG. 61 respectively. In some configurations, the first rocker arm 602L, the first rocker arm 602M, and the first rocker arm 602N and the second rocker arm 604L, the second rocker arm 604M, and the second rocker arm 604N are configured to actuate two exhaust valves 132 and two intake valves 126 respectively per combustion chamber 104. In this configuration, the rocker arms may have a similar shape and function as the first rocker arm 602D illustrated in FIG. 62 and the second rocker arm 604D illustrated in FIG. 63 respectively.

Figure 81:
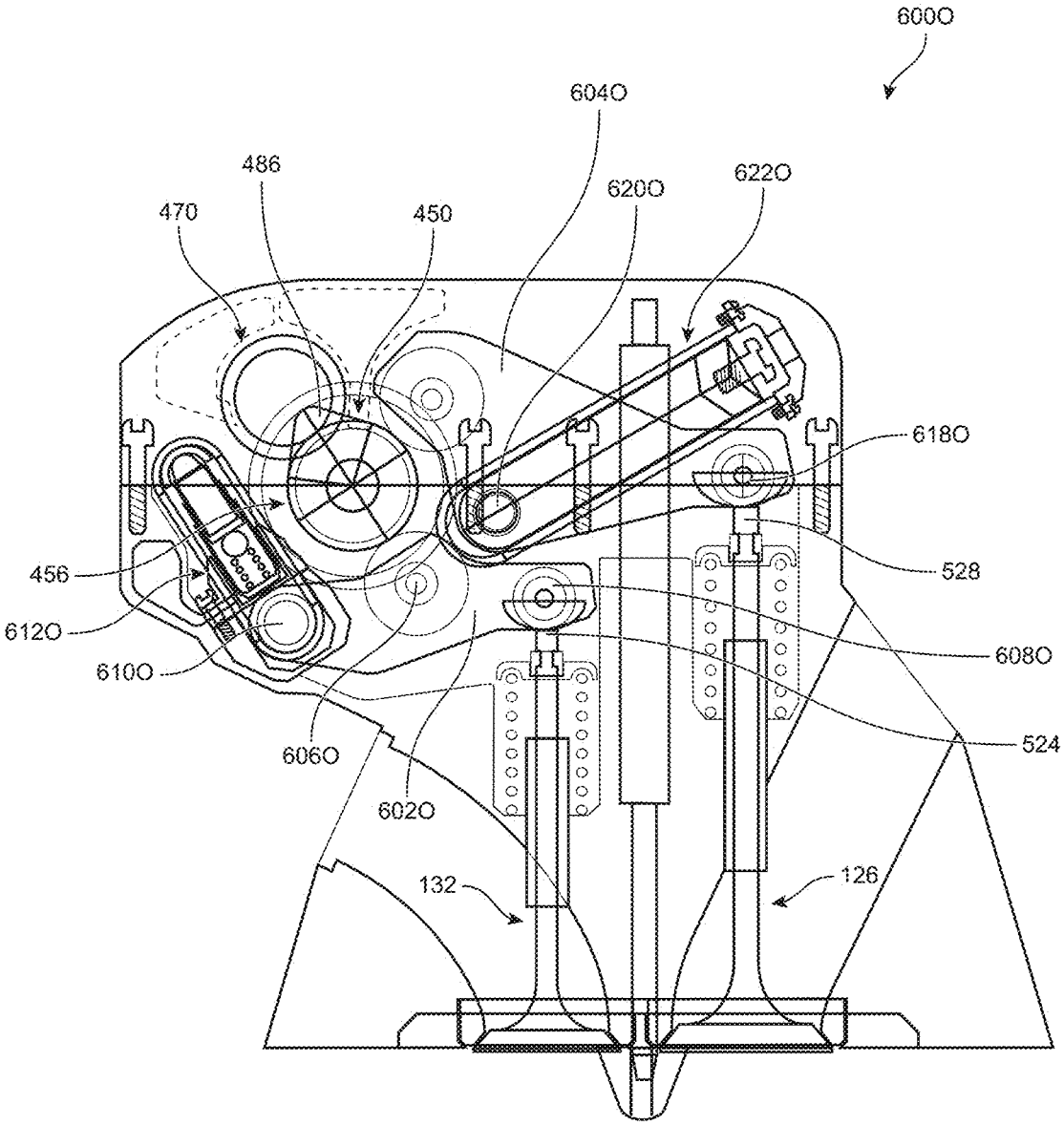
Figure 82:
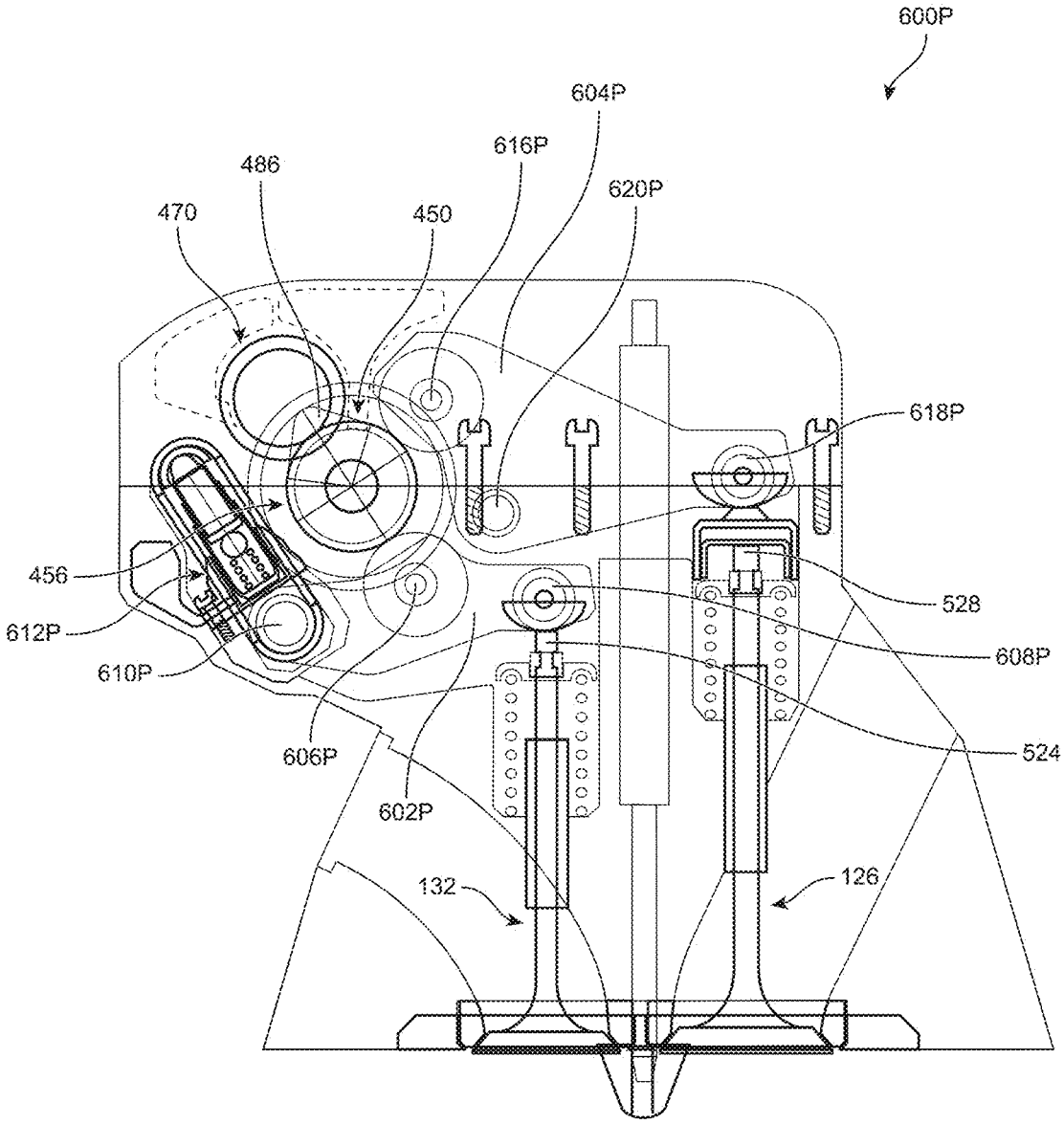

FIGS. 81 and 82 illustrate schematic sectional views of configurations of the valve actuation system 600O and the valve actuation system 600P respectively. Some of the features of the valve actuation system 600O and the valve actuation system 600P are similar to features of the valve actuation system 600A illustrated in FIG. 42. Thus, reference numerals used to designate the various features or components of the valve actuation system 600O and the valve actuation system 600P are identical to those used for identifying the corresponding features of components of the valve actuation system 600A, except that an "O" has been added to the numerical identifier for the valve actuation system 600O and a "P" has been added to the numerical identifier for the valve actuation system 600P. Therefore, the structure and operation of the various features of the valve actuation system 600A are understood to also apply to the corresponding features of the valve actuation system 600O illustrated in FIG. 81 and the valve actuation system 600P illustrated in FIG. 82, except as described below.

The valve actuation system 600O and the valve actuation system 600P differ from the valve actuation system 600A primarily in that one cam lobe 456 engages both the first rocker arm 602O and the second rocker arm 604O and the first rocker arm 602P and the second rocker arm 604P. For example, the cam lobe 456 can engage the first cam follower 606O and the second cam follower 616O and the cam lobe 456 can engage the first cam follower 606P and the second cam follower 616P to cause the actuation of the intake valves 126 and the exhaust valves 132.

The shapes of the first rocker arm 602O, the first rocker arm 602P, the second rocker arm 604O, and the second rocker arm 604P can also differ from the valve actuation system 600A. The valve actuation system 600O can include the first lash adjuster 612O for the first rocker arm 602O and the second lash adjuster 622O for the second rocker arm 604O. The valve actuation system 600P can include the first lash adjuster 612P for the first rocker arm 602P and the hydraulic tappet 624P for the second rocker arm 604P.

The valve actuation system 600O and the valve actuation system 600P can be driven by any of the valve timing systems described herein. As illustrated in FIGS. 81 and 82, a single valve timing system may drive the valve actuation system 600O and/or the valve actuation system 600P. In one example, the valve timing system 400A and the valve timing system 400A' in the configuration illustrated in FIG. 17 may be used with the valve actuation system 600O and/or the valve actuation system 600P. In another example, the valve timing system 400A in the configuration illustrated in FIG. 16 may be used with the valve actuation system 600O and/or the valve actuation system 600P. In some configurations, the first rocker arm 602O and/or the first rocker arm 602P and the second rocker arm 604O and/or the second rocker arm 604P can be configured to actuate only one exhaust valve 132 and one intake valve 126 respectively per combustion chamber 104. In this configuration, the rocker arms may have a similar shape and function as the first rocker arm 602D illustrated in FIG. 60 and the second rocker arm 604D illustrated in FIG. 61 respectively. In some configurations, the first rocker arm 602O and/or the first rocker arm 602P and the second rocker arm 604O and/or the second rocker arm 604P are configured to actuate two exhaust valves 132 and two intake valves 126 respectively per combustion chamber 104. In this configuration, the rocker arms may have a similar shape and function as the first rocker arm 602D illustrated in FIG. 62 and the second rocker arm 604D illustrated in FIG. 63 respectively.

The actuation system 600O and the actuation system 600P, which include a single overhead cam lobe (e.g., represented by the cam lobe 456) can be used in both two-stroke and four-stroke engines. In a four-stroke engine, the cam lobe 456 may actuate the exhaust valve 132 and the intake valve 126 in a sequential manner. In a two-stroke engine, the exhaust valve 132 and the intake valve 126 may be actuated at the same time. For example, two cam lobes 456 may be positioned side by side with offset nose portions 486 such that the cam lobes 456 engage the first cam follower 606O and/or the first cam follower 606P and the second cam follower 616O and/or the second cam follower 616P at the same time. In another example, the cam lobe 456 may include a two offset nose portions 486 to engage the first cam follower 606O and/or the first cam follower 606P and the second cam follower 616O and/or the second cam follower 616P.

Figure 83:
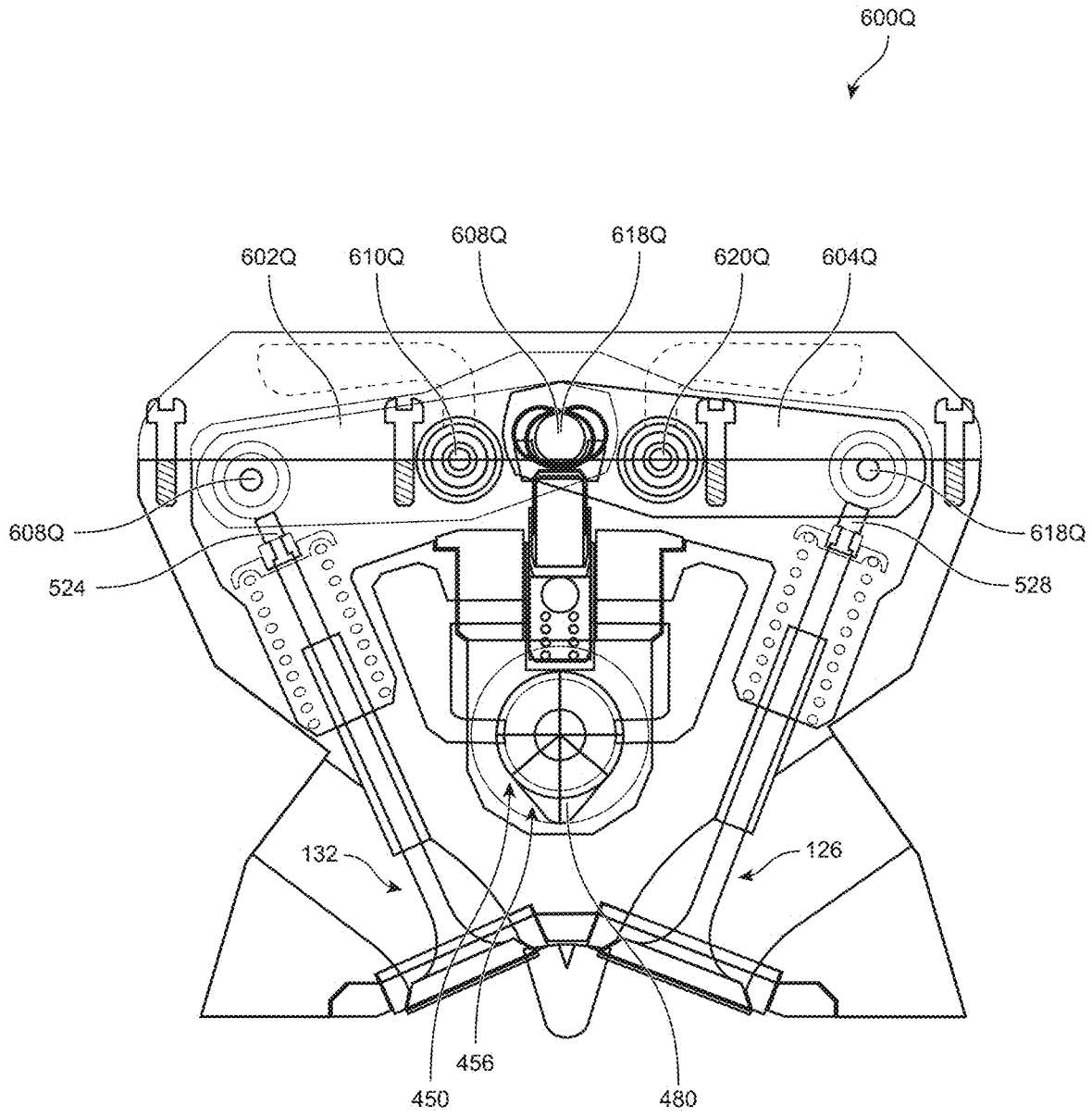

FIG. 83 illustrates a schematic sectional view of a configuration of the valve actuation system 600Q. Some of the features of the valve actuation system 600Q are similar to features of the valve actuation system 600A in FIG. 42. Thus, reference numerals used to designate the various features or components of the valve actuation system 600Q are identical to those used for identifying the corresponding features of components of the valve actuation system 600A, except that a "Q" has been added to the numerical identifier for the valve actuation system 600Q. Therefore, the structure and operation of the various features of the valve actuation system 600A are understood to also apply to the corresponding features of the valve actuation system 600Q, except as described below.

The valve actuation system 600Q differs from the valve actuation system 600A in that the first camshaft 450 extends between the exhaust valves 132 and the intake valves 126. As a result, the valve actuation system 600Q can have a compact configuration. The cam lobe 456 can engage a single lash adjuster 612Q that engages both the first rocker arm 602Q and the second rocker arm 622Q. When the nose portion 486 of the cam lobe 456 engages the single lash adjuster 612Q, both of the first rocker arm 602Q and the second rocker arm 622Q can pivot about their respective pivot points (e.g., the first pivot point 610Q and the second pivot point 620Q), causing the exhaust valves 132 and the intake valves 126 to move from the closed position to the open position. The intake valves 126 and the exhaust valves 132 may be at an angle relative to the Y-axis.

The valve actuation system 600Q can be driven by any of the valve timing systems described herein. As illustrated in FIG. 83, the single valve timing system may drive the valve actuation system 600Q. In one example, the valve timing system 400A in the configuration illustrated in FIG. 16 may be used with the valve actuation system 600Q. In some configurations, the first rocker arm 602Q and the second rocker arm 604Q are configured to actuate only one exhaust valve 132 and one intake valve 126 respectively per combustion chamber 104. In this configuration, the rocker arms may have a similar shape and function as the first rocker arm 602D illustrated in FIG. 60 and the second rocker arm 604D illustrated in FIG. 61 respectively. In some configurations, the first rocker arm 602Q and the second rocker arm 604Q are configured to actuate two exhaust valves 132 and two intake valves 126 respectively per combustion chamber 104. In this configuration, the rocker arms may have a similar shape and function as the first rocker arm 602D of FIG. 62 and the second rocker arm 604D of FIG. 63 respectively.

While a number of valve actuation systems are illustrated herein as being driven by either camshafts with cam lobes, pushrods, or both, various implementations of internal combustion engines described herein can include any valve actuation system that includes cam-less valve control actuators. The cam-less valve control actuators can be electric, hydraulic, pneumatic, and/or the like. The cam-less valve control actuators can include spring return and/or integrated lash adjustment. In some implementations, the various components of the valve actuation systems described herein can include one or more valves that are actuated by cam-less valve control actuators. In some implementations, cam-less valve actuators can be combined with one or more cam-operated valve actuation systems and/or pushrod actuation systems. In a cam-less valve actuation system, the lack of a cam shaft allows injectors and/or spark plugs to be positioned vertically between the intake valves 126 and the exhaust valves 132 and can reach the center of the top of the combustion chamber 104.

Figure 84:
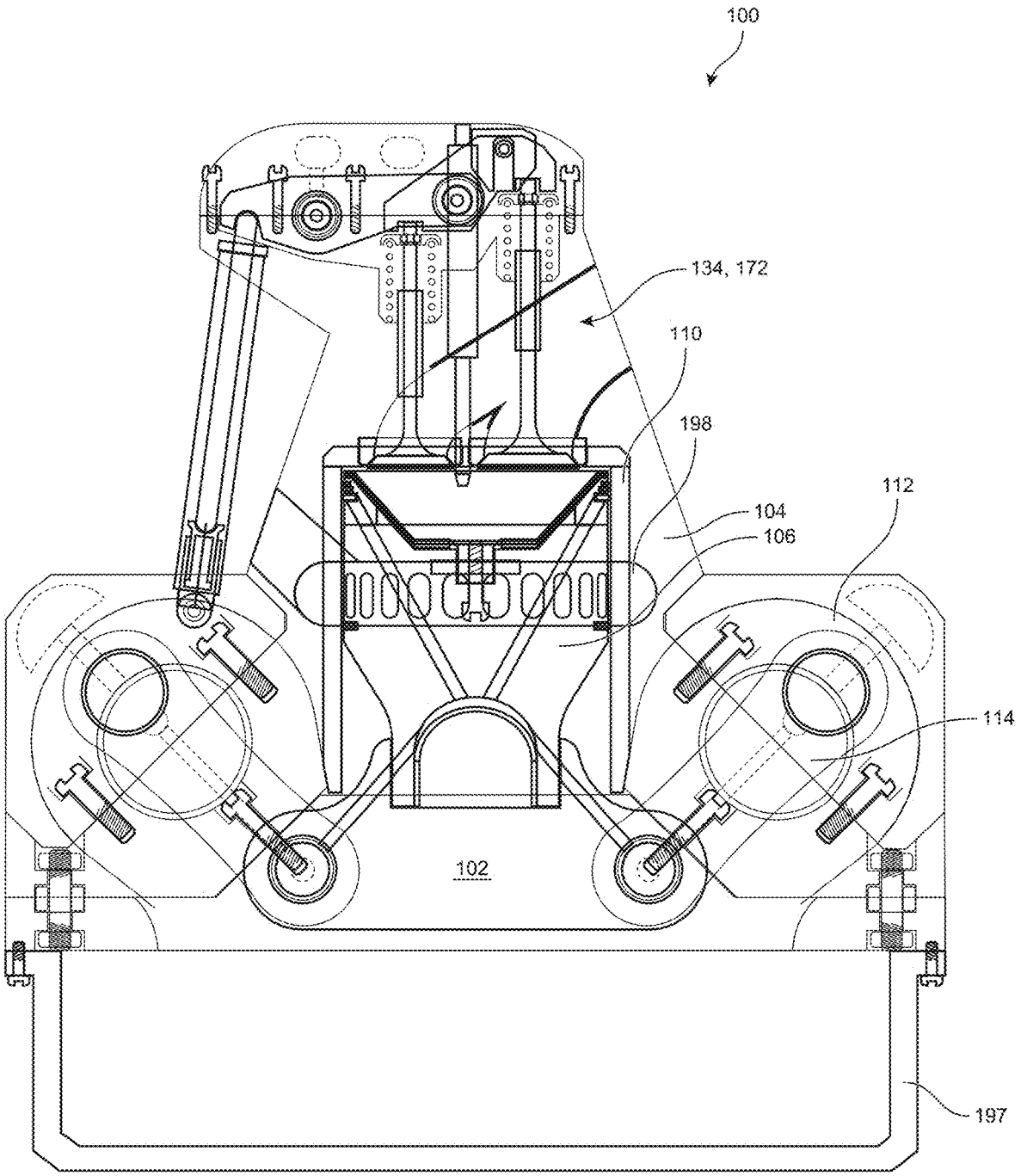
FIGS. 84 and 85 illustrate implementations of a portion of the internal combustion engine of FIG. 1.
Figure 85:
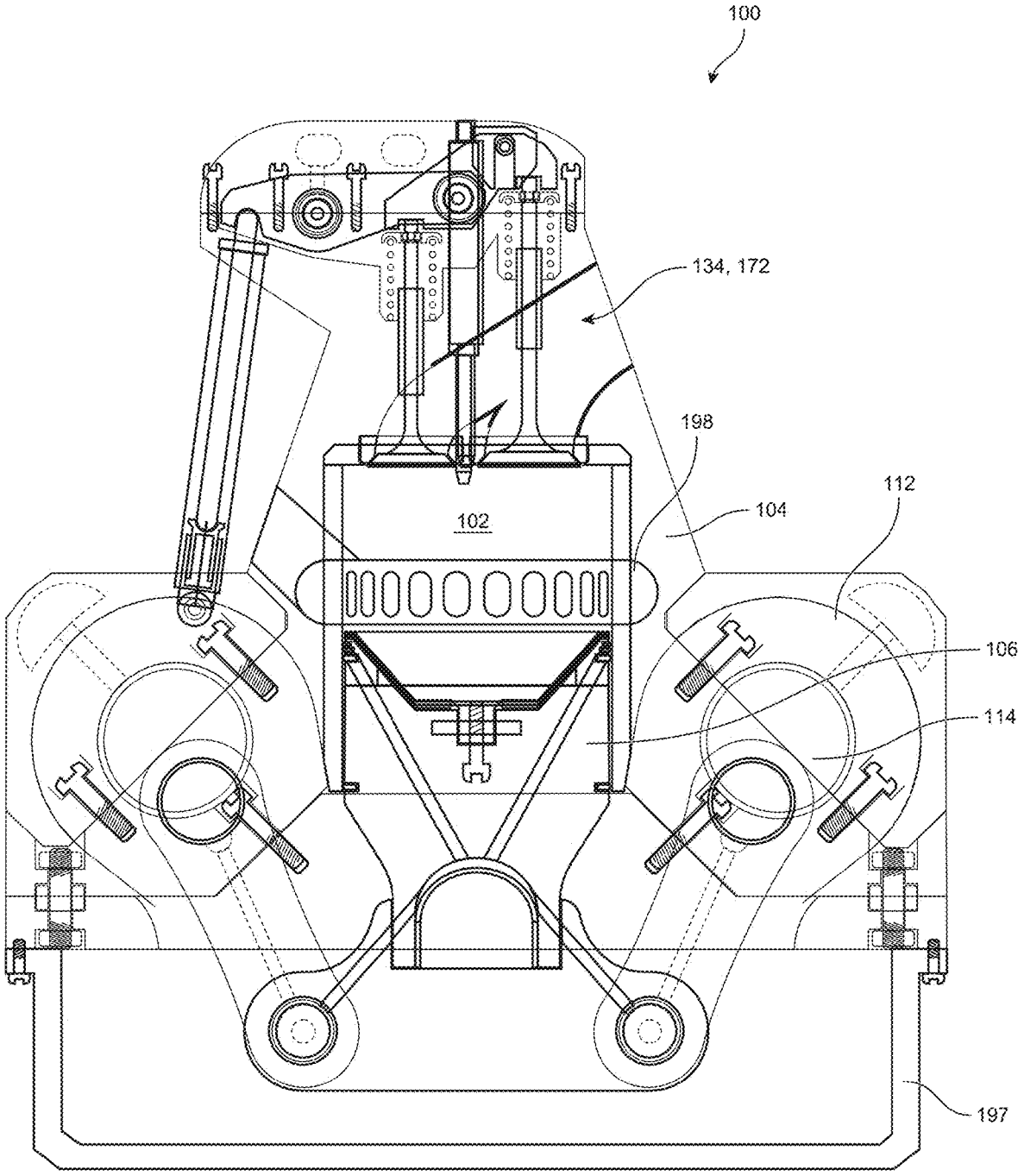

FIGS. 84 and 85 illustrate implementations of a portion of the internal combustion engine 100. The internal combustion engine 100 illustrated in FIGS. 84 and 85 differs from other implementations of the internal combustion engine 100 described herein in that the cylinder bore 106 can include a uniflow valve 198. Because the configurations of FIGS. 84 and 85 are uniflow, these configurations show that the piston-controlled intake ports are opened when the piston is in bottom dead center. Additionally, the intake passage 172 and the exhaust passage 134 merge to form a single port. As a result of this arrangement, the internal combustion engine 100 may omit a flow baffle. The uniflow valve 198 may be formed in the cylinder bore 106 of the uniblock 102. The uniflow valve 198 can be configured to allow fluid to enter and exit the cylinder bore 106 during a combustion cycle. As such, the internal combustion engine 100 can exchange fluid with the environment for both intake and exhaust through the uniflow valve 198. In some implementations, the cylinder bore 106 may be longer compared to other implementations of the internal combustion engine 100 to accommodate the uniflow valve 198.

FIG. 84 shows the piston 110 in a top dead center position and FIG. 85 shows the piston 110 in a bottom dead center position. The piston 110 may include a sealing ring to seal the cylinder bore 106 when in the top dead center position. As shown in FIGS. 84 and 85, when the piston 110 is in the top dead center position, the piston 110 prevents fluid exchange through the uniflow valve 198. When the piston 110 is in the bottom dead center position, the piston 110 does not block the uniflow valve 198. As such, fluid can be exchanged with the cylinder bore 106. While FIGS. 84 and 85 illustrate the uniflow valve design with the valve actuation systems 600 similar to valve actuation system 600B, it is recognized that any suitable valve actuation system 600 can be used, including but not limited to those described herein.

As discussed above, in some configurations, the intake valves 126 and the exhaust valves 132 can be driven from lobes on the crankshaft 112. In such configurations, being able to adjust one portion of the crankshaft 112 relative to another portion of the crankshaft 112 can be useful. In other words, there is a desire to be able to spin index two shafts relative to each other.

FIGS. 86-91 present a plurality of indexing arrangements 700 that can be used to join a first shaft end 702 to a second shaft end 704. The first shaft end 702 can be a portion of a first shaft and the second shaft end 704 can be a portion of a second shaft. In some configurations, such as the configuration illustrated in FIGS. 86-87, the second shaft end 704 can be nested within the first shaft end 702. In some configurations, such as the configuration illustrated in FIGS.

88-89, the first shaft end 702 and the second shaft end 704 can be joined with a butt joint or the like. Other configurations are possible.

Figure 86:
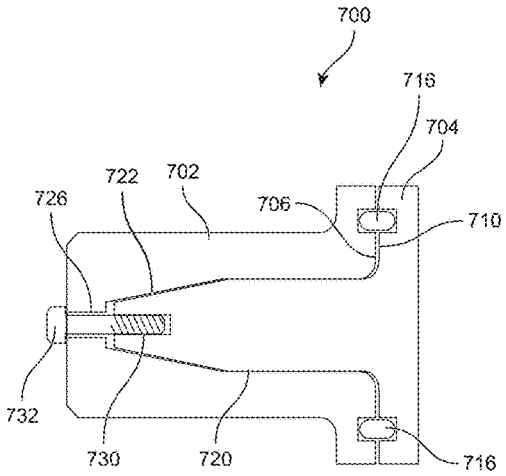
FIGS. 86-91 illustrate implementations of indexing arrangements that can be used to join a first shaft end to a second shaft end.
Figure 87:
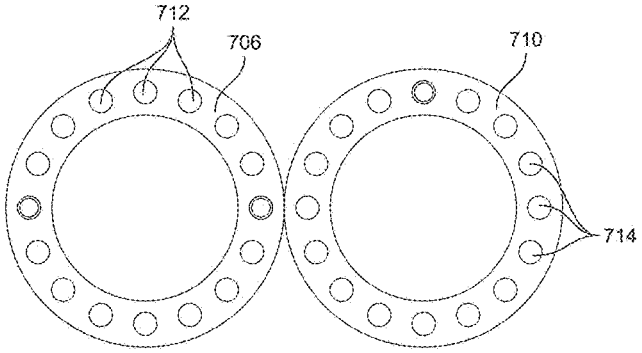

With reference now to FIG. 86, the first shaft end 702 can comprise a first coupling face 706 while the second shaft end 704 can comprise a second coupling face 710. The first coupling face 706 and the second coupling face 710 face each other. In the illustrated configuration, the first coupling face 706 abuts the second coupling face 710.

The first coupling face 706 comprises a plurality of first openings 712. The second coupling face 710 comprises a plurality of second openings 714. The plurality of first openings 712 and the plurality of second openings 714 are arranged and configured such that a pin 716 can be positioned with one end in one of the plurality of first openings 712 and with an opposing end in one of the plurality of second openings 714. In some configurations, two or more pins 716 can be used.

The plurality of first openings 712 can comprise any number of first openings. In some configurations, the number of the plurality of first openings 712 is an even number. In some configurations, the number of the plurality of first openings 712 is an odd number. In some configurations, the number of the plurality of first openings 712 is a prime number. Preferably, the number is an odd prime number.

The plurality of second openings 714 can comprise any number of second openings. In some configurations, the number of the plurality of second openings 714 is an even number. In some configurations, the number of the plurality of second openings 714 is an odd number. In some configurations, the number of the plurality of second openings 714 is a prime number. Preferably, the number is an odd prime number.

The number of possible mating orientations corresponds to the product of the number of plurality of first openings 712 and the number of plurality of second openings 714. Accordingly, depending upon the configuration, the number of degrees of rotational adjustment between the first shaft end 702 and the second shaft end 704 can be as large as 180 degrees or 2 degrees (e.g., 30 first openings and 24 second openings with two pins).

With continued reference to FIG. 86, the first shaft end 702 comprises a bore 720. The bore 720 can comprise a tapering sidewall 722. The second shaft end 704 can comprise an outer surface 724. The outer surface 724 can complement the tapering sidewall 722. The end of the first shaft end 702 opposite of the first coupling face 706 comprises a through hole 726. The corresponding end of the second shaft end 704 comprises a threaded hole 730. A threaded fastener 732 can pull the second shaft end 704 into the first shaft end 702 such that the pins 716 are secured in position. The pins 716 provide alignment while the interaction between the tapering sidewall 722 and the outer surface 724 secure the first shaft end 702 and the second shaft end 704 together to reduce or eliminate rotation between the two components. Other configurations also are possible.

Figure 88:
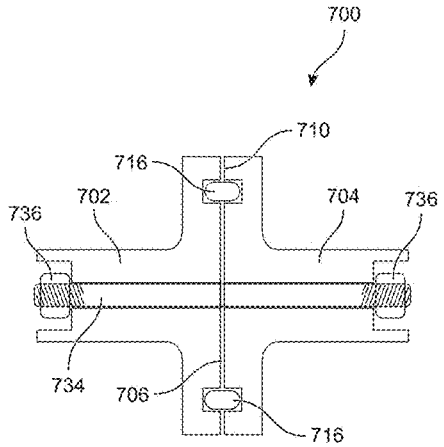
Figure 89:
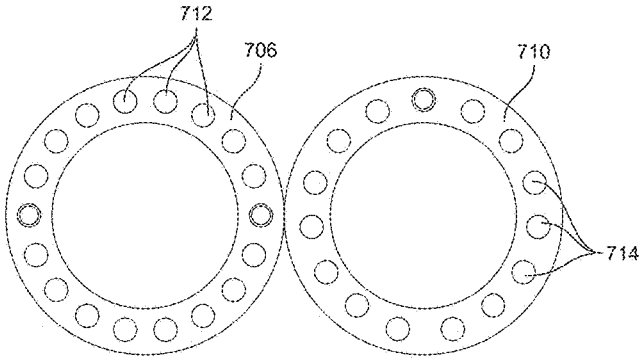

With reference to FIGS. 88 and 89, the indexing arrangement 700 is illustrated in which the first shaft end 702 and the second shaft end 704 are secured together to form a butt joint. In the illustrated configuration, the pins 716 are captured between the first coupling face 706 and the second coupling face 710. As discussed above, each pin 716 has a first portion within one of the plurality of first openings 712 and a second portion within one of the plurality of second openings 714. A shaft 734 with threading at each end, together with two nuts 736, can be used to secure together the first coupling face 704 and the second coupling face 710. Other arrangements can be used to secure the first shaft end 702 to the second shaft end 704.

Figure 90:
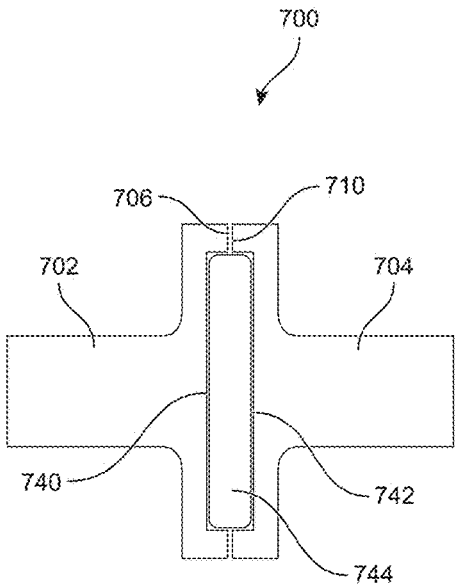
Figure 91:
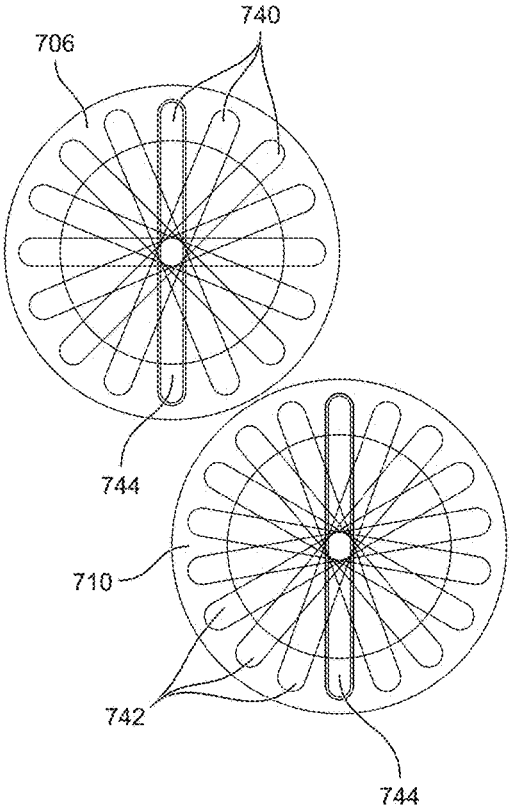

With reference now to FIGS. 90 and 91, the indexing arrangement 700 comprises a plurality of first radial recesses 740 (instead of the plurality of first openings 712) and a plurality of second radial recesses 742 (instead of the plurality of second openings 714). In this configuration, with the first coupling face 706 and the second coupling face 710 facing each other, one of the plurality of first radial recesses 740 can align with one of the plurality of second radial recesses 742 and a cylindrical key 744 can be used to align the first shaft end 702 and the second shaft end 704. Any suitable configuration can be used to force the first coupling face 706 into registry with the second coupling face 710. For example, a through bolt similar to the arrangement of FIG. 88 can be used.

While the indexing arrangements 700 can be used to adjust the timing of a cam lobe, other arrangements also are possible. For example, the first shaft end 702 can be a portion of any of the shafts discussed herein and the second shaft end 704 can be a portion of any of the shafts discussed herein. For example but without limitation, the indexing arrangements 700 can be used with crankshafts 112, camshafts 450, auxiliary shafts 470. The indexing arrangement can find utility with two axial load-bearing rods.

In addition to indexing with dowels or pins, the number of teeth of a spur gear that drives a shaft also can be used to index a shaft. For instance, there could be a shaft within another shaft and the end of one of the shafts could be attached to a spur gear. The shaft within the shaft can be secured against rotation relative to the other shaft using one or more key. The key, for example, could be positioned in a recess that extends radially inwardly from an outer periphery of the shafts or a coupling member that is connected to each of the shafts.

With each of the configurations, the number of key mounting locations can be even or odd. It is preferred, however, to use odd numbers of key mounting locations associated with each shaft. It is more preferred to use odd prime numbers of key mounting locations associated with each shaft.

Conditional language used herein, such as, among others, "can," "could," "might," "may," "e.g.," and the like, unless specifically stated otherwise, or otherwise understood within the context as used, is generally intended to convey that certain configurations include, while other configurations do not include, certain features, elements and/or states. Thus, such conditional language is not generally intended to imply that features, elements and/or states are in any way required for one or more configurations or that one or more configurations necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain configurations require the presence of at least one of X, at least one of Y, and at least one of Z.

While the above detailed description may have shown, described, and pointed out novel features as applied to various configurations, it may be understood that various omissions, substitutions, and/or changes in the form and details of any particular configuration may be made without departing from the spirit of the disclosure. As may be recognized, certain configurations may be embodied within a form that does not provide all of the features and benefits set forth herein, as some features may be used or practiced separately from others.

Additionally, features described in connection with one configuration can be incorporated into another of the disclosed configurations, even if not expressly discussed herein, and configurations having the combination of features still fall within the scope of the disclosure. For example, features described above in connection with one configuration can be used with a different configuration described herein and the combination still fall within the scope of the disclosure.

It should be understood that various features and aspects of the disclosed configurations can be combined with, or substituted for, one another in order to form varying modes of the configurations of the disclosure. Thus, it is intended that the scope of the disclosure herein should not be limited by the particular configurations described above. Accordingly, unless otherwise stated, or unless clearly incompatible, each configuration of this disclosure may comprise, additional to its essential features described herein, one or more features as described herein from each other configuration disclosed herein.

Features, materials, characteristics, or groups described in conjunction with a particular aspect, configuration, or example are to be understood to be applicable to any other aspect, configuration or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing configurations. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some configurations, the actual steps taken in the processes illustrated and/or disclosed may differ from those shown in the figures. Depending on the configuration, certain of the steps described above may be removed, others may be added.

Furthermore, the features and attributes of the specific configurations disclosed above may be combined in different ways to form additional configurations, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular configuration. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain configurations, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred configurations in this section or elsewhere in this specification and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

[Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred configurations described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims.

What is claimed is:

1. An internal combustion engine comprising a cylinder block, the cylinder block defining a cylinder bore, a piston capable of reciprocating within the cylinder bore between top dead center and bottom dead center, a combustion chamber defined above the piston within the cylinder bore, an intake passage extending into the combustion chamber, an intake port defined at a junction of the intake passage and the combustion chamber, an exhaust passage extending from the combustion chamber, an exhaust port defined at a junction of the exhaust passage and the combustion chamber, an intake valve that opens and closes the intake port, an exhaust valve that opens and closes the exhaust port, the piston driving a crankshaft, the crankshaft driving a cam assembly, the cam assembly controlling movement of the intake valve and the exhaust valve and having a worm gear such that the cam assembly is configured to control at least one of valve timing or valve duration.

2. The internal combustion engine of claim 1, wherein the worm gear is coupled to a stepper motor or a servo motor.

3. The internal combustion engine of claim 2, wherein the cam assembly comprises a differential assembly controlled by the worm gear, the differential assembly configured to adjust an angular position of one or more shafts relative to the crankshaft such that timing of at least one of opening or closing of one or more of the intake valve or the exhaust valve can be adjusted.

4. The internal combustion engine of claim 2, wherein the cam assembly comprises a first camshaft, the first camshaft comprising a first cam lobe, the cam assembly comprising a second camshaft, the second camshaft comprising a second cam lob, the first camshaft and the second camshaft being coupled for rotation, a first differential assembly controlling an angular orientation of the first camshaft relative to a crankshaft and a second differential assembly controlling an angular orientation of the second camshaft relative to the crankshaft such that at least one of valve timing or valve duration can be controlled by the first differential assembly and the second differential assembly.

5. The internal combustion engine of claim 1, wherein the worm gear is connected to at least two additional worm gears.

6. The internal combustion engine of claim 5, wherein the cam assembly comprises an auxiliary shaft and a camshaft, the auxiliary shaft being driven by the camshaft and the auxiliary shaft driving at least one cam lobe that is freely rotatable relative to the camshaft.

7. The internal combustion engine of claim 1, further comprising a planetary gear set, the planetary gear set comprising a ring gear, the worm gear being connected to the ring gear of the planetary gear set, the planetary gear set being connected to the cam assembly such that rotation of the worm gear is transferred to at least a portion of the cam assembly through the planetary gear set to adjust timing of at least one of opening or closing of at least one of the intake valve or the exhaust valve.

8. The internal combustion engine of claim 1, wherein an upper portion of the combustion chamber includes at least one opening that receives a fuel injector.

9. The internal combustion engine of claim 8, wherein more than one fuel injector are positioned in the at least one opening to inject fuel into the combustion chamber, a first fuel injector connected to a first fuel source and a second fuel injector connected to a second fuel source.

10. The internal combustion engine of claim 1, wherein at least one of the intake valve or the exhaust valve is moved by a valve actuation system that comprises a mechanical linkage.

11. The internal combustion engine of claim 10, wherein the crankshaft comprises at least one cam lobe, the at least one cam lobe moving a corresponding pushrod, and the corresponding pushrod acting against one or more rocker arms to cause movement of at least one of the intake valve or the exhaust valve.

12. The internal combustion engine of claim 11, wherein the one or more rocker arms is connected to a valve actuating arm, the valve actuating arm comprising a paw, the paw positioned within a paw slot, the paw and the paw slot cooperating to restrain movement of the valve actuating arm.

13. The internal combustion engine of claim 1, wherein the cam assembly comprises a cam shaft, the cam shaft comprising at least one cam lobe that rotates with the cam shaft, the at least one cam lobe configured to contact a cam follower, the cam follower being mounted to a first rocker arm, wherein positioning of the first rocker arm is controlled by a lash adjuster.

14. The internal combustion engine of claim 13, wherein the lash adjuster comprises a body, the body receiving a first pivot point of the first rocker arm such that the first pivot point of the first rocker arm extends through the body.

15. The internal combustion engine of claim 14, wherein the body of the lash adjuster receives a second pivot point that is parallel to the first pivot point.

16. The internal combustion engine of claim 14, wherein the body of the lash adjuster comprises a central member that is positioned between the first rocker arm and a second rocker arm, wherein the first pivot point extends through the first rocker arm, the second rocker arm, and the central member such that the lash adjuster can adjust the first rocker arm and the second rocker arm simultaneously.

17. The internal combustion engine of claim 16, wherein the body of the lash adjuster receives a force generator that can be used to adjust lash.

18. The internal combustion engine of claim 17, wherein the force generator comprises a threaded fastener or a hydraulic cylinder.

19. The internal combustion engine of claim 17, wherein the force generator comprises a hydraulic cylinder, wherein the hydraulic cylinder exerts a force on at least one wedge.

20. The internal combustion engine of claim 13, wherein the cam shaft rotates about an axis and the axis is positioned above the lash adjuster.

* * * * *